US008985352B2

(12) United States Patent
Bergdoll et al.

(10) Patent No.: US 8,985,352 B2
(45) Date of Patent: Mar. 24, 2015

(54) MODULAR MERCHANDISE DISPLAY SYSTEM

(71) Applicant: Summit Plastics, Inc., Bayshore, NY (US)

(72) Inventors: James Bergdoll, East Setauket, NY (US); Michael Mongelluzzo, East Quogue, NY (US); Gary Rein, New York, NY (US)

(73) Assignee: Summit Plastics, Inc., Bayshore, NY (US)

( * ) Notice: Subject to any disclaimer, the term of this patent is extended or adjusted under 35 U.S.C. 154(b) by 76 days.

(21) Appl. No.: 13/835,481

(22) Filed: Mar. 15, 2013

(65) Prior Publication Data

US 2014/0104826 A1 Apr. 17, 2014

Related U.S. Application Data

(63) Continuation-in-part of application No. 13/268,203, filed on Oct. 7, 2011, now Pat. No. 8,602,230, which is a continuation-in-part of application No. 12/932,162, filed on Feb. 18, 2011, now Pat. No. 8,607,997.

(60) Provisional application No. 61/338,408, filed on Feb. 18, 2010.

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47F 1/04*** | (2006.01) |
| ***A47F 7/00*** | (2006.01) |
| ***A47F 5/10*** | (2006.01) |
| ***F21V 21/00*** | (2006.01) |

(Continued)

(52) U.S. Cl.

CPC ..... *A47F 5/103* (2013.01); *F21V 21/00* (2013.01); *F21V 21/096* (2013.01); *A47B 57/16* (2013.01); *A47B 57/408* (2013.01); *A47B 96/00* (2013.01)

USPC ..... 211/187; 211/59.3

(58) Field of Classification Search

USPC ..... 211/189, 87.01, 175, 207, 103, 187; 248/250, 220.21, 220.31

See application file for complete search history.

(56) References Cited

U.S. PATENT DOCUMENTS

| | | | | |
|---|---|---|---|---|
| 3,794,183 | A | 2/1974 | Colbridge | 211/176 |
| 4,934,645 | A | 6/1990 | Breslow | 248/242 |

(Continued)

*Primary Examiner* — Joshua Rodden
*Assistant Examiner* — Kimberley S Wright
(74) *Attorney, Agent, or Firm* — Gerald T. Bodner

(57) ABSTRACT

A modular merchandise display system includes a frame and a plurality of merchandise supporting units. The frame has a pair of spaced apart, parallelly disposed first and second indexing members. Each indexing member has a plurality of openings formed therein. Each merchandise supporting unit has a front side and an opposite rear side, and spaced apart first and second locator protrusions extending outwardly from the rear side. The first and second locator protrusions are respectively receivable in corresponding openings in the first and second indexing members. Each of the first and second locator protrusions includes an open side, and a latch barb received thereby and movable within the locator protrusion. The latch barb is positionable in a first position, wherein it is engageable with one of the first and second indexing members to secure a respective merchandise supporting unit thereto, and a second position, wherein it is disengageable from one of the first and second indexing members to allow a respective merchandise supporting unit to be removed from the first or second indexing member.

20 Claims, 129 Drawing Sheets

(51) Int. Cl.

| | |
|---|---|
| ***F21V 21/096*** | (2006.01) |
| ***A47B 57/16*** | (2006.01) |
| *A47B 57/40* | (2006.01) |
| *A47B 96/00* | (2006.01) |

(56) References Cited

U.S. PATENT DOCUMENTS

| | | | | |
|---|---|---|---|---|
| 5,660,287 | A | 8/1997 | Tryon | 211/186 |
| 6,105,791 | A | 8/2000 | Chalson et al. | 211/59.3 |
| 6,427,855 | B2 * | 8/2002 | LaBruna, Jr. et al. | 211/87.01 |
| 7,270,242 | B2 * | 9/2007 | Liu | 211/189 |
| 7,824,055 | B2 * | 11/2010 | Sherman | 362/125 |
| 7,946,066 | B2 * | 5/2011 | Wamsley | 40/657 |
| 7,950,538 | B2 | 5/2011 | Zang et al. | 211/187 |
| 8,061,539 | B2 * | 11/2011 | Punzel et al. | 211/103 |
| 8,210,368 | B2 * | 7/2012 | Schwartzkopf et al. | 211/103 |
| 8,602,230 | B2 * | 12/2013 | Bergdoll et al. | 211/187 |
| 8,607,997 | B2 * | 12/2013 | Bergdoll et al. | 211/187 |
| 2006/0096939 | A1 * | 5/2006 | Liu | 211/189 |
| 2008/0087621 | A1 | 4/2008 | Zang et al. | 211/187 |
| 2008/0121146 | A1 * | 5/2008 | Burns et al. | 108/23 |
| 2010/0300999 | A1 * | 12/2010 | Schwartzkopf et al. | 211/104 |
| 2013/0220947 | A1 * | 8/2013 | Pintur | 211/1 |
| 2013/0327733 | A1 * | 12/2013 | Csak | 211/59.3 |
| 2014/0043797 | A1 * | 2/2014 | Sun | 362/133 |
| 2014/0055987 | A1 * | 2/2014 | Lindblom et al. | 362/125 |

* cited by examiner

MODULAR MERCHANDISE DISPLAY SYSTEM

CROSS-REFERENCE TO RELATED APPLICATIONS

This application is a continuation-in-part of U.S. application Ser. No. 13/268,203 filed on Oct. 7, 2011, and entitled "Modular Merchandise Display System", the disclosure of which is incorporated herein by reference and on which priority is hereby claimed, which prior application is a continuation-in-part of U.S. application Ser. No. 12/932,162 filed on Feb. 18, 2011, and entitled "Modular Merchandise Display System", the disclosure of which is incorporated herein by reference and on which priority is hereby claimed, which prior application is based on U.S. Provisional Application Ser. No. 61/338,408, which was filed on Feb. 18, 2010, and is entitled "Modular Merchandise Display System", the disclosure of which is hereby incorporated by reference and on which priority is hereby claimed.

BACKGROUND OF THE INVENTION

1. Field of the Invention

The present invention relates to merchandise display systems, and more specifically relates to merchandise display systems which are modular in function and which are free-standing or mountable to a wall.

2. Description of the Prior Art

Many conventional merchandise display systems include one or more parallel, vertically arranged, elongated support members which are spaced apart from one another. Each elongated support member may include a plurality of slots formed through its thickness and spaced apart axially along the length of the support member. The slots receive hooked ends of mounting brackets, which mounting brackets, when secured to the support members, extend perpendicularly to and outwardly from the front face of each support member. A tray or shelf extends between adjacent pairs of mounting brackets, and merchandise is displayed on, and supported by, the trays or shelves. The trays and shelves, with their associated mounting brackets, may be removed from their current location on adjacent support members and repositioned into different slots in the support members in accordance with the requirements of the merchandiser.

In order to reposition a shelf on such conventional merchandise display system, as described above, the shelf may have to be manipulated vertically (or horizontally) to disengage the mounting brackets on which the shelf rests from the elongated support members, and again manipulated vertically (or horizontally) to re-engage the mounting brackets to the support members when the shelf is repositioned. Such action, required to disengage the shelf and mounting brackets from the support members, may interfere with other shelves in close proximity to the shelf being repositioned and may necessitate the removal of other shelves adjacent to the one being repositioned. This problem is exacerbated if, rather than planar shelves or trays, rectangular parallelepiped or cuboidal modules situated one on top of another or situated side-by-side, with no space between modules, are used in the merchandise display system. Then, most probably all of the modules situated in a row or column may have to be removed in order to reposition a single module.

Additionally, the provision, and distribution of lighting throughout the retail environment, more specifically, on wall merchandising systems, often involves a massive amount of initial, and secondary, electrical work required on an ongoing basis. The advent of LED lighting in conjunction with low-voltage power options significantly reduces the amount of maintenance in such systems.

OBJECTS AND SUMMARY OF THE INVENTION

It is an object of the present invention to provide a merchandise display system which includes a quick release, front-loading mechanism for mounting individual shelves or modules used in the system.

It is another object of the present invention to provide a wall mountable, modular merchandise display system, where one module or a shelf of the display system may be easily removed without necessitating the removal of adjacent modules or shelves.

It is yet another object of the present invention to provide a wall mountable, merchandise display system having modules, trays or shelves which may easily lockingly engage or disengage from vertical support members of the system.

It is another object of the present invention to have a header signage element removable from the front of the module, without disassembling any peripheral components, to allow an alternative visual differentiation.

It is a further object of the present invention to provide a modular low-voltage electrical "grid" that can provide a safe, low voltage, stepped down from a standard 110 volt AC electrical power, to the merchandising system to allow for illumination in part, or the entirety, of the presentation unit, as well as for signage elements, RFID, sensing, scanning, Wi-Fi enabled, or dispensing, devices.

It is also an object of the present invention to provide an illuminated header mechanism that provides the ability to engage a secondary signage element that depends from the underside of the sign, and allows for expandable signage to be easily attached, and span any number of modules.

It is yet a further object of the present invention to provide an illuminated header sign on the modular merchandise system which utilizes an aluminum heat-sink, which supports an LED lighting element or elements, in conjunction with a U-shaped molded plastic header, to create a channel on the underside of the header to support a slide-in, removable, edge-lit signage panel.

It is yet a further object of the present invention to provide a merchandise display system which overcomes the inherent disadvantages of conventional merchandise display systems.

A merchandise display system constructed in accordance with one form of the present invention includes a frame which is free-standing or which may be fixed to an existing wall in an establishment, and a plurality of modules which are mountable on the frame directly from the front of the frame without requiring any manipulation of the modules either vertically or horizontally. The modular merchandise display system incorporates a unique method of attaching the modules to the frame, and incorporates a quick disconnect mechanism that allows the merchandiser or store planners to easily re-planogram the items of merchandise in an efficient, cost-effective manner.

The merchandise display system includes a plurality of metal or plastic modular "cubes" that snap onto a steel back wall of the supporting frame. The frame further supports an indexing system having vertical members, preferably made from injection molded plastic, to allow the modules to locate into a specific position from the front of the support frame. Each of the individual modules has insertable, retractable product trays, which may be extended from and retracted into the modules, to accommodate varying types of merchandise. The trays may be removed from the module by the store owner.

One of the advantages of the merchandising display system of the present invention is that an individual module (or tray) may be easily detached from the front of the support frame utilizing a spring-activated "trigger" mechanism located beneath the tray front, or may be the actual tray front, and a molded header sign. The molded header sign works in concert with the tray front.

In order to disengage an individual module from the frame, the spring-loaded header, which is mounted on the module, is depressed in a backward direction toward the frame, which allows the store owner to pull the tray front forward. When the tray is in such an extended position, locking wings, which had engaged the indexing members mounted on the frame, are opened to disengage the indexing members so that the complete module may be repositioned on the frame in another location or replaced by another module containing different items of merchandise.

In accordance with another form of the present invention, a merchandise display system includes a support frame on which are mounted two or more vertically disposed, spaced apart indexing members. The merchandise display system also includes a plurality of modules. The modules are mountable on the frame and selectively engage the vertical indexing members. Each module includes one or more trays which are slidably mounted within the module and which may be extended outwardly from the module so that a customer may select an item of merchandise resting on the tray.

Extending outwardly from the rear of each module is a pair of spaced apart pins. The pins are closely received in arcuate open recesses, or bores, formed in adjacent vertical indexing members when the module is mounted on the frame. The module further includes a pair of mutually inwardly biased, pivotable locking wings. The locking wings selectively engage the vertical indexing members when the module is mounted thereon. A release member, forming part of a release mechanism, situated within each module may be pulled (or pushed) to disengage the locking wings from the vertical indexing members of the frame in order to remove a module from the front of the merchandise display system without the need to remove adjacent modules from the system.

In yet another form of the present invention, a modular merchandise display system includes a frame and a plurality of merchandise supporting units. The frame has a pair of spaced apart, parallelly disposed indexing members. Each indexing member has an axial length, a thickness, a plurality of spaced apart openings formed through the thickness thereof and situated at least partially along the axial length thereof, and a plurality of spaced apart resilient locking clips situated at least partially along the axial length thereof. A respective locking clip is disposed in at least partial alignment with a corresponding opening formed in the indexing members.

Each merchandise supporting unit has a front side, a rear side situated opposite the front side, and at least a pair of spaced apart locator protrusions extending outwardly from the rear side thereof. The locator protrusions of each merchandise supporting unit include a recessed portion defining a recess. The locator protrusions are at least partially receivable in corresponding openings formed in each indexing member of the pair of indexing members and are engageable with corresponding resilient locking clips. The locking clips are receivable in the recesses of the locator protrusions when the merchandise supporting units are mounted on the frame to help secure the merchandise supporting units to the frame. Each merchandise supporting unit has a release mechanism to effect the disengagement of the merchandise supporting unit from the frame, the release mechanism including a release bar reciprocatingly slidably mounted on the merchandise supporting unit. The release bar has at least one free end, the free end being selectively engageable with a corresponding resilient locking clip to disengage the locking clip from a corresponding locator protrusion to effect removal of the merchandise supporting unit from the frame.

In yet another form of the present invention, the merchandise display system includes a plurality of metal or plastic modular "cubes" that snap onto rails of a steel back wall of the supporting frame. The "rail" frame's penetrations create an indexing system to allow the modules to locate into a specific position from the front of the support frame. Each of the individual modules has insertable, retractable product trays, which may be extended from and retracted into the modules, to accommodate varying types of merchandise. The trays may be removed from the module by the store owner.

Additionally, the modules can accept alternative snap-in interior components, other than trays, which include, but are not limited to, interior backwalls which allow for steel peg-hooks to be adjustably inserted, to allow for complete planogram flexibility, alternative signage elements, or illuminated product glorifier compartments.

One of the advantages of the merchandising display system of the present invention is that an individual module (or tray) may be easily detached from the front of the rear support frame utilizing a spring-activated "trigger" mechanism concealed behind a molded header sign. The molded header sign works in concert with a pair of rare earth magnets, which hold the header sign in the closed position, and serve to override the force of the two compression springs located at the ends of the U-shaped header, described previously, and conveying the low voltage electrical system to power the illuminated sign.

In order to disengage an individual module from the frame, the protruding legs of the magnetically held U-shaped header slide out from a pair of rectangular channels in the top of the side walls of the modular housing, which allows the store owner to pull the header forward. When the header is in such an extended position, it reveals a contoured "push-button" locking mechanism. Once this button is depressed, it disengages the indexing members so that the complete module may be repositioned on the frame in another location or replaced by another module containing different items of merchandise.

In accordance with another form of the present invention, a merchandise display system includes a support rail frame on which are mounted two or more vertically disposed, spaced apart indexing members. The merchandise display system also includes a plurality of modules. The modules are mountable on the frame and selectively engage the vertical indexing members. Each module includes one or more trays which are slidably mounted within the module and which may be extended outwardly from the module so that a customer may select an item of merchandise resting on the tray.

These and other objects, features and advantages of the present invention will be apparent from the following detailed description of illustrative embodiments thereof, which is to be read in connection with the accompanying drawings.

BRIEF DESCRIPTION OF THE DRAWINGS

FIG. 118 is a partially cut away, front view of a portion of the merchandise module forming part of the merchandise display system of the present invention shown in FIG. 58.

FIG. 119 is a partially cut away, rear perspective view of a portion of the merchandise module forming part of the merchandise display system of the present invention shown in FIG. 58.

FIG. 120 is a partially cut away, side perspective view of a portion of the merchandise module forming part of the merchandise display system of the present invention shown in FIG. 58.

FIG. 121 is a partially cut away, side view of the merchandise module forming part of the merchandise display system of the present invention shown in FIG. 58.

FIG. 122 is a front perspective view of the release bar of the merchandise module forming part of the merchandise display system of the present invention shown in FIG. 58.

FIG. 123 is a rear perspective view of the release bar of the merchandise module forming part of the merchandise display system of the present invention shown in FIG. 58.

FIG. 124 is a partially cut away, side view of the latch bar and barbs of the merchandise module forming part of the merchandise display system of the present invention shown in FIG. 58.

FIG. 125 is a rear perspective view of the latch bar and barbs of the merchandise module forming part of the merchandise display system of the present invention shown in FIG. 58.

FIG. 126 is a front perspective view of the latch bar and barbs of the merchandise module forming part of the merchandise display system of the present invention shown in FIG. 58.

FIG. 127 is a side perspective view of the latch bar and barbs of the merchandise module forming part of the merchandise display system of the present invention shown in FIG. 58.

FIG. 128 is a partially cut away, rear perspective view of the latch bar and barbs of the merchandise module forming part of the merchandise display system of the present invention shown in FIG. 58.

DETAILED DESCRIPTION OF THE PREFERRED EMBODIMENTS

Figure 1:
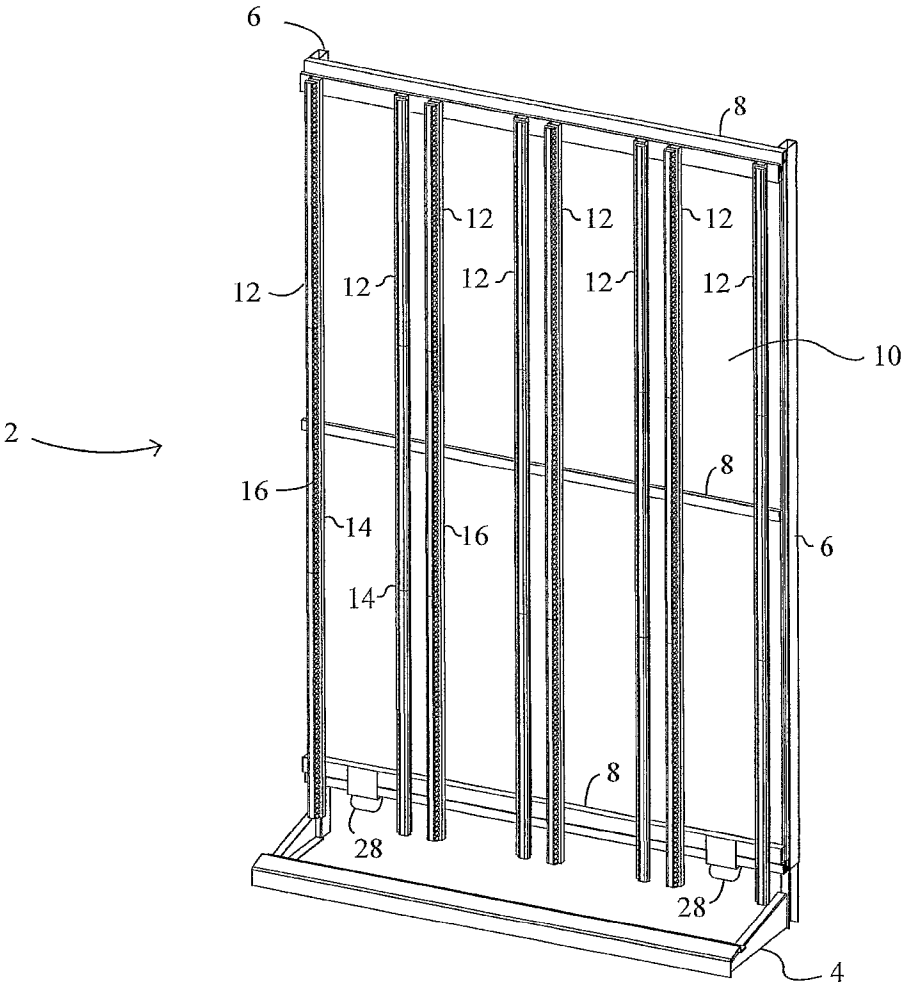
FIG. 1 is a front perspective view of a portion of a merchandise display system constructed in accordance with one form of the present invention.
Figure 2:
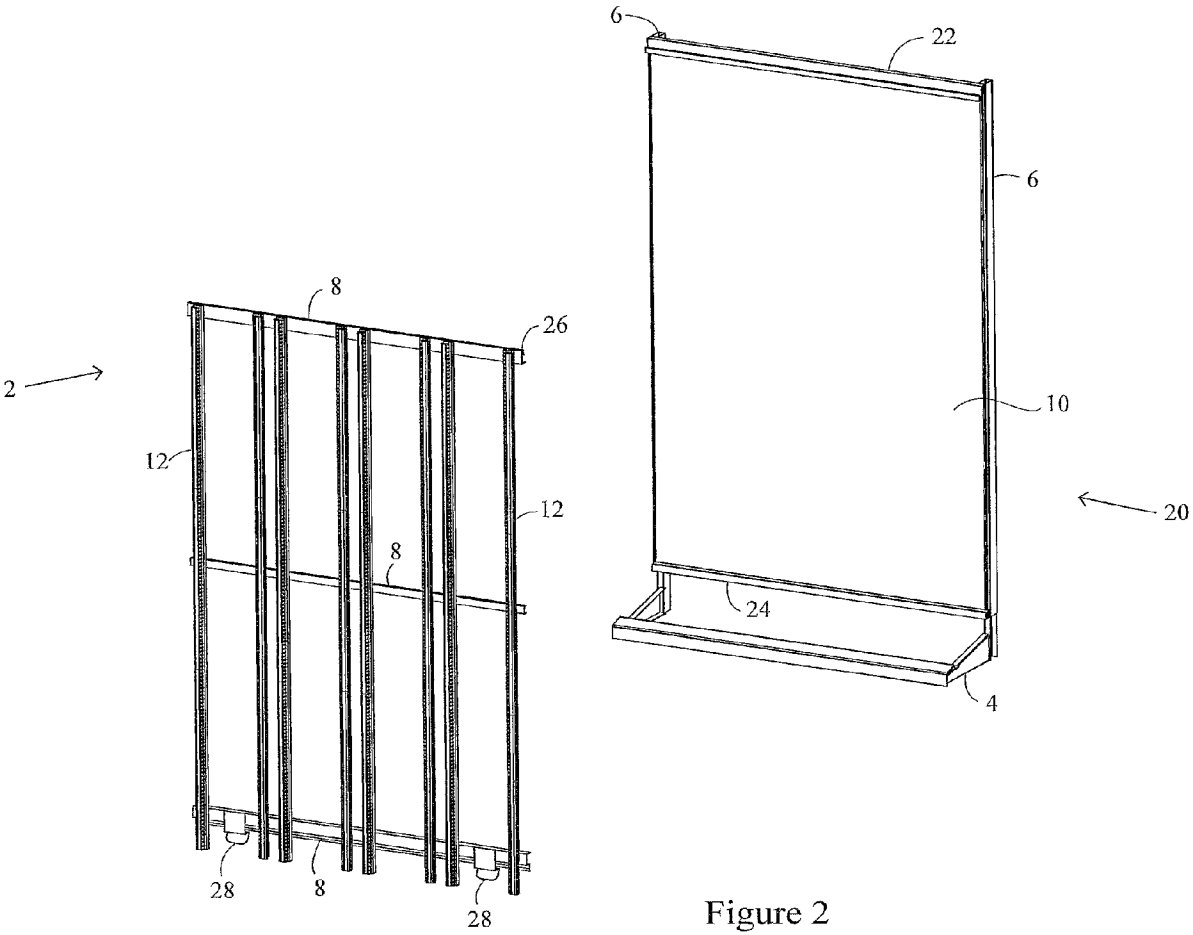
FIG. 2 is an exploded, front perspective view of the portion of the merchandise display system of the present invention shown in FIG. 1.
Figure 3:
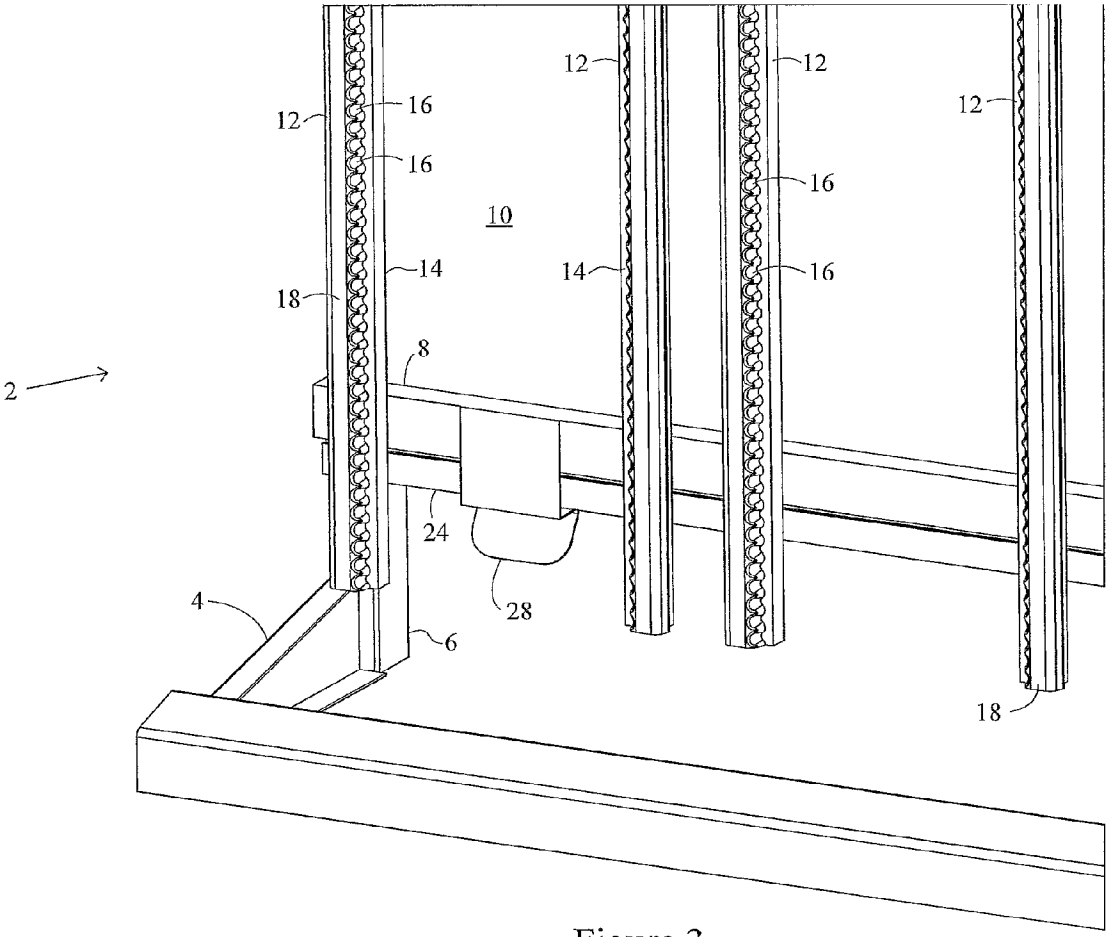
FIG. 3 is an enlarged front perspective view of a portion of the merchandise display system of the present invention shown in FIGS. 1 and 2.
Figure 4:
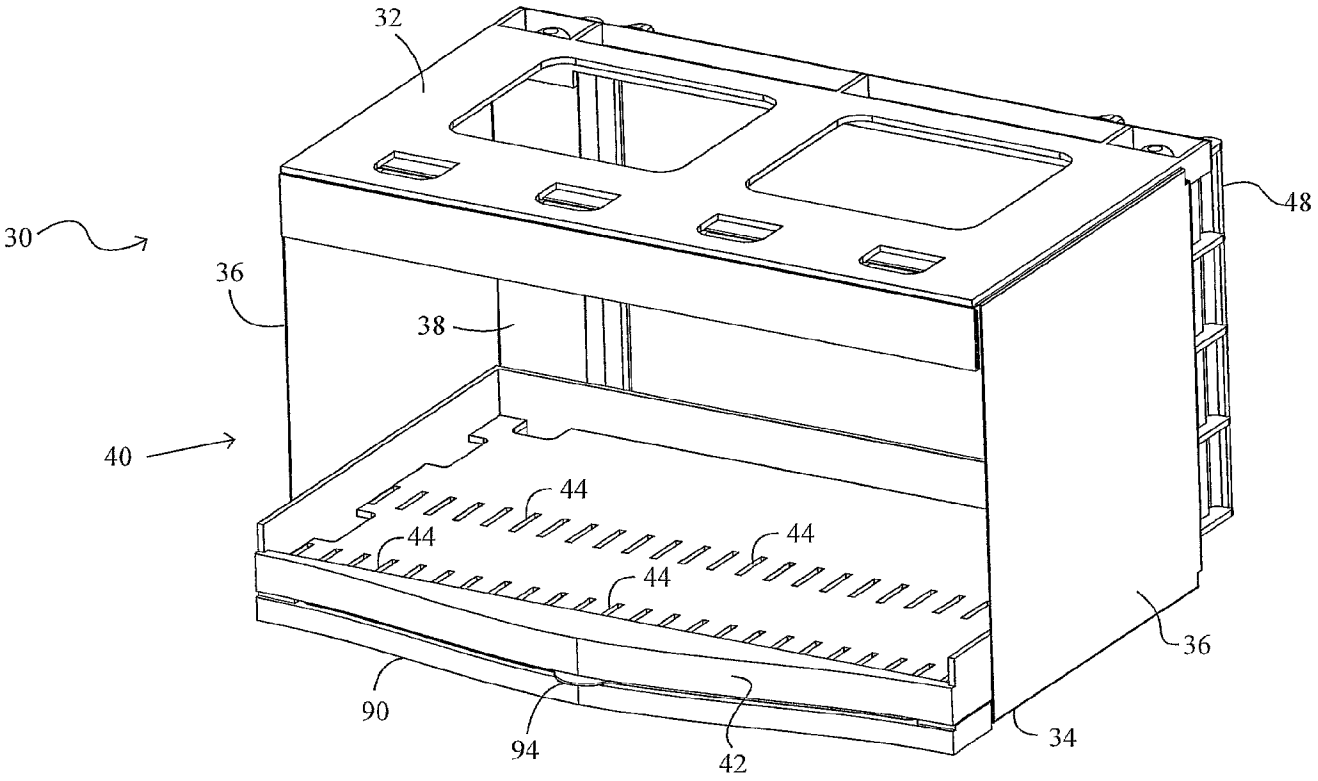
FIG. 4 is a front perspective view of a merchandise display module constructed in accordance with the present invention for use with the merchandise display system of the present invention.
Figure 5:
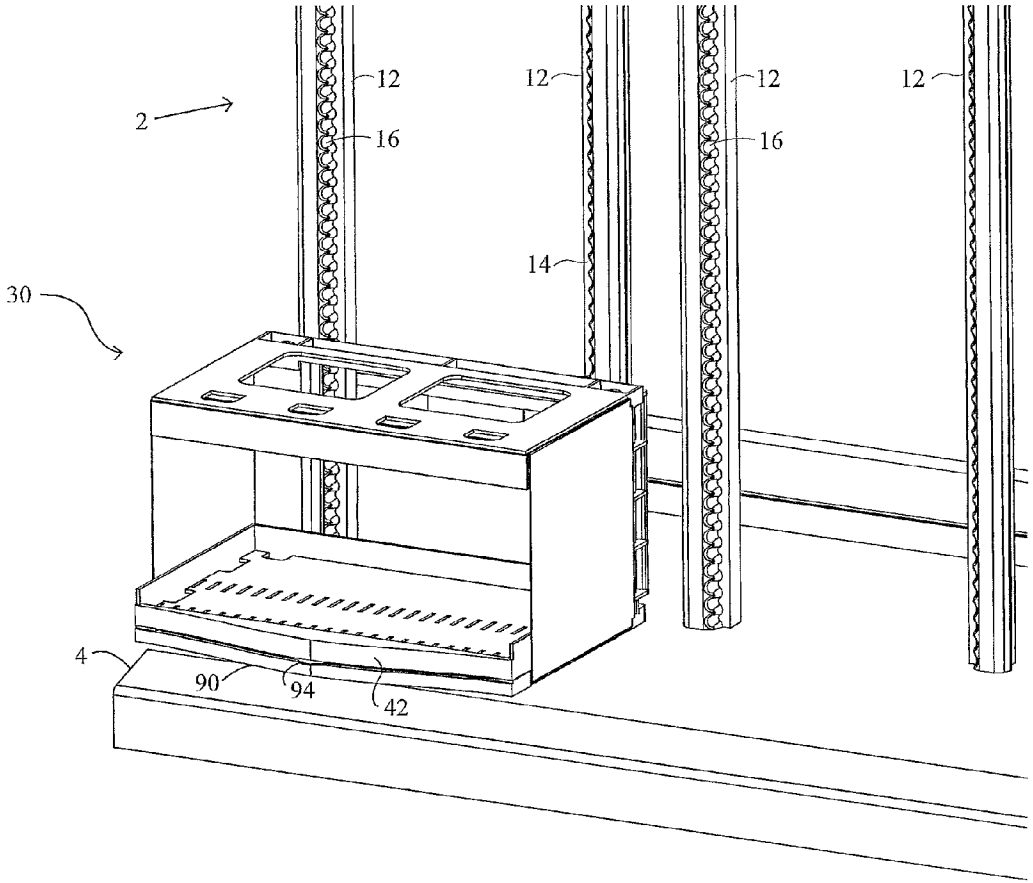
FIG. 5 is a front perspective view of the module shown in FIG. 4 mounted on vertical indexing members forming part of the merchandise display system of the present invention.
Figure 6:
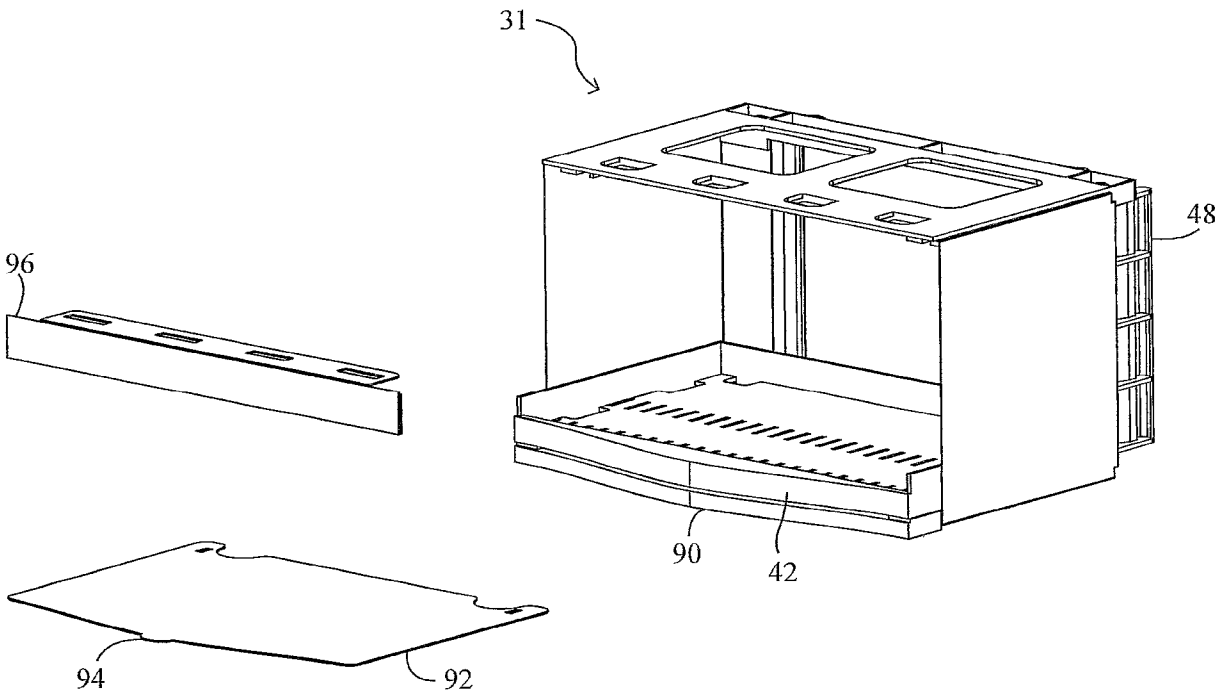
FIG. 6 is a partially exploded, front perspective view of the module of the present invention shown in FIGS. 4 and 5 for use with the merchandise display system of the present invention.

Referring initially to FIGS. 1-3 of the drawings, it will be seen that a modular merchandise display system, constructed in accordance with one form of the present invention, includes a frame 2 made of steel or other structural material. The frame 2 includes a base 4 which rests on the floor of an establishment, vertical side pieces 6 attached to the base 4 and horizontal cross braces 8 attached to the vertical side pieces 6. The frame 2 further includes a back wall 10, formed of steel or other material, which is joined to the vertical side pieces 6 and horizontal cross braces 8. The frame 2 may be free-standing on its base 4, or may be situated adjacent to a wall or other vertical supporting structure and attached thereto by fasteners or the like for added safety.

A plurality of pairs of vertically disposed indexing members 12 is mounted on the front face of the frame 2 to the horizontal cross braces 8. The pairs of indexing members 12 are spaced apart adjacent one another, and the indexing members 12 of each pair are also spaced apart from each other a predetermined distance.

Each vertical indexing member 12 is an elongated piece having opposite lateral sides 14. The lateral sides 14 of a pair of indexing members 12 which face each other have formed therein a plurality of partial cylindrical or arcuate cuts or open recesses 16 formed adjacent to one another along the longitudinal length thereof. Thus, a particular arcuate recess 16 formed in one indexing member 12 of a respective pair of indexing members is in alignment with and faces an arcuate recess 16 formed in an adjacent indexing member 12 of the same pair of indexing members. Alternatively, each indexing member 12 may include bores (not shown), instead of arcuate recesses 16, formed in the front face 18 thereof and extending at least partially through the thickness thereof. The indexing members 12 may be formed from an injection-molded plastic, metal or other material.

Although the frame 2 of the merchandise display system is described as including a base 4, back wall 10, vertical side pieces 6 and horizontal cross braces 8, the system may be designed to cooperate with a pre-existing display frame 20 comprising the base 4, back wall 10 (such as a peg board backing) and vertical side pieces 6, as well as upper and lower horizontal support members 22, 24, as shown in FIG. 2. The frame 2 of the present system, then, would include several horizontal cross braces 8 on which are mounted the vertical indexing members 12. The top horizontal cross brace 8 may include a hook 26 running along the axial length thereof which engages the upper horizontal support member 22 of the pre-existing display frame 20, and the bottom horizontal cross brace 8 would be affixed to the lower horizontal support member 24 using resilient clips 28, as shown in FIGS. 2 and 3.

In one form of the present invention, and as shown in FIGS. 4-13 of the drawings, the merchandise display system includes a plurality of modules 30. Each module 30 is preferably in the shape of a rectangular parallelepiped or cuboid, that is, being box-like in shape. More specifically, each module 30 has a box-like main portion 31 which includes a top wall 32, a bottom wall 34, opposite lateral side walls 36 and, optionally, a rear wall or partial rear wall 38, to define at least a four-sided enclosure having a front opening 40. The module 30 may include one or more retractable trays 42 mounted therein. The trays 42 within the module 30 are provided for supporting merchandise thereon. The trays 42 may include slots 44 formed therein to receive dividers (see FIG. 31) for partitioning items of merchandise. Each tray 44 is preferably slidably mounted to the lateral side walls 36 of the module 30 using conventional drawer slide mechanisms (not shown), and may be extended at least partially outwardly through the front opening 40 thereof so that a customer may easily select an item of merchandise displayed within the module 30 and supported on the tray 42. The tray 42 is retractable within the module 30 through the front opening 40 thereof. The tray 42 is preferably formed from an injection-molded plastic, but may be formed of sheet metal or other material.

Each module 30 of the plurality of modules may include one pair, or more than one pair, of locator pins 46 extending outwardly from the rear side of the module 30. Each pin is preferably situated near an opposite lateral side wall 36 of the module 30, and the pins 46 are spaced apart from one another a predetermined distance. Adjacent vertically disposed, indexing members 12 are also spaced apart from each other a predetermined distance so that the pins 46 may register with and be at least partially closely received by the arcuate recesses 16 facing one another formed in adjacent indexing members 12 of a respective pair of indexing members. Thus, the modules 30 of the merchandise display system of the present invention may be loaded into the display system perpendicularly directly from the front of the frame 2, where the rearwardly facing pins 46 of each module 30 engage corresponding arcuate recesses 16 formed in adjacent spaced apart indexing members 12 of the frame 2. No manipulation of the module 30 either horizontally or vertically is required to reposition the module in a different location on the frame 2 and, accordingly, the modules 30 of the merchandise display system may be spaced closely to one another both vertically and horizontally and yet may be easily removed from and repositioned on the support frame 2.

To ensure that each module 30 lockingly engages the indexing members 12 of the frame 2, each module 30 includes at least one pair of pivotable locking wings 48. Each locking wing 48 is pivotably mounted to the module 30 on the rear side thereof, and extends rearwardly on each module. Each locking wing 48 is structured to define a recess or pocket 50 on a lateral side thereof. More specifically, the recess 50 of one locking wing 48 of a respective module 30 is formed so that it faces the recess 50 of the other locking wing 48 of the same module 30 and so that one locking wing 48 is structured as the mirror image of the other locking wing 48.

The locking wings 48 of each module 30 are biased by springs 52 or other means towards each other so that they extend substantially parallel to one another rearwardly of the module 30 on which they are mounted, but are pivotable laterally outwardly, away from each other, when the module 30 is being mounted onto adjacent indexing members 12 of a respective pair of indexing members. Each locking wing 48 includes a free end 54 having a leading, laterally outwardly sloping camming surface 56 situated adjacent to and outwardly from the recess or pocket 50 formed in the locking wing 48.

When a module 30 is being mounted on the frame 2, the spaced apart pins 46 of the module 30 are aligned with corresponding arcuate recesses 16 (or bores) formed in the indexing members 12, and the module 30 is pushed toward the front face of the frame 2, with the pins 46 registering with certain arcuate recesses 16 of the indexing members 12. The non-facing, opposite lateral sides 14 of the indexing members 12 contact the camming surfaces 56 of the locking wings 48, spreading the locking wings apart from one another against the bias of the springs 52. As the module 30 is continued to be pushed into the frame 2, the indexing members 12 move past the camming surfaces 56 of the locking wings 48 and are securely received by the pockets or recesses 50 formed therein. The locking wings 48, which are biased in a direction towards one another, close about the pair of indexing members 12 so that the locking wings 48 partially surround portions of the non-facing lateral sides 14 of the indexing members 12. With the pins 46 registered with selected arcuate recesses 16 of the indexing members 12 and the locking wings 48 closely engaging the lateral sides 14 of the indexing members, the product module 30 is now securely mounted to the frame 2 of the merchandise display system.

Each module 30 includes a release mechanism to allow the store owner to remove a module from the frame 2 of the merchandise display system. As can be seen from FIG. 11 of the drawings, the release mechanism includes an elongated release bar 58 which is mounted above the bottom wall 34 of the module 30 and below a plate-like frame 60 which, in turn, is situated below the lowest merchandise tray 42 in the module. The module frame 60 defines a tunnel 62 with the bottom wall 34 of the module 30 in which the release bar 58 may reciprocatingly slide. As can be seen from FIG. 11, each spring 52 for biasing the locking wings 48 is secured at one end to the top surface of the module frame 60 and at its other end to an extended portion 64 of the locking wing 48 which is situated internally to the module 30 and on the opposite side of a pivot pin (not shown) by which each locking wing 48 is pivotally mounted on the module frame 60. Thus, the release bar 58 reciprocatingly slides in the tunnel 62 of the module frame 60, and has an exposed axial end 66 which extends beyond the front opening 40 of the module 30. The exposed axial end 66 of the release bar 58 includes a tab 68 or opening 70 formed through its thickness which may be easily grasped by the store owner to remove a module 30 from the frame 2.

The inner axial end 72 of the release bar 58, situated opposite the exposed end 66, includes a pair of spaced apart pins 74 extending upwardly from the upper surface of the release bar 58. Each pin 74 is received by an elongated slot 76 formed in one end 78 of each of a pair of angled lever arms 80. Each lever arm 80 includes a first segment 82 and a second segment 84 which is joined to the first segment 82 and disposed at an angle thereto. The opposite axial end 86 of each lever arm 80 is pivotally joined to the inwardly extending portion 64 of a respective locking wing 48. Each lever arm 80 is pivotally mounted to the module frame 60 by a pivot pin 88 situated near where the first segment 82 is joined to the second segment 84.

To remove a selected module 30 from the frame 2 of the merchandise display system, the store owner pulls outwardly, away from the front opening 40 of the module 30, on the exposed end 66 of the release bar 58. When the store owner pulls on the release bar 58, the lever arms 80 pivot to force the locking wings 48 to open and disengage from a respective indexing member 12 against the bias of the spring 52 of each locking wing. The store owner may remove a module 30 from the frame 2 perpendicularly and outwardly from the front face of the frame 2. The store owner pulls on the module 30 until the pins 46 disengage from the arcuate recesses 16 formed in the adjacent indexing members 12 of the respective pair of indexing members on which the module 30 is mounted. The module release mechanism, including the elongated release bar 58 and pivotable lever arms 80, is contained substantially entirely within the module 30 and does not interfere with the closely spaced, adjacent modules 30 mounted on the frame 2.

Figure 7:
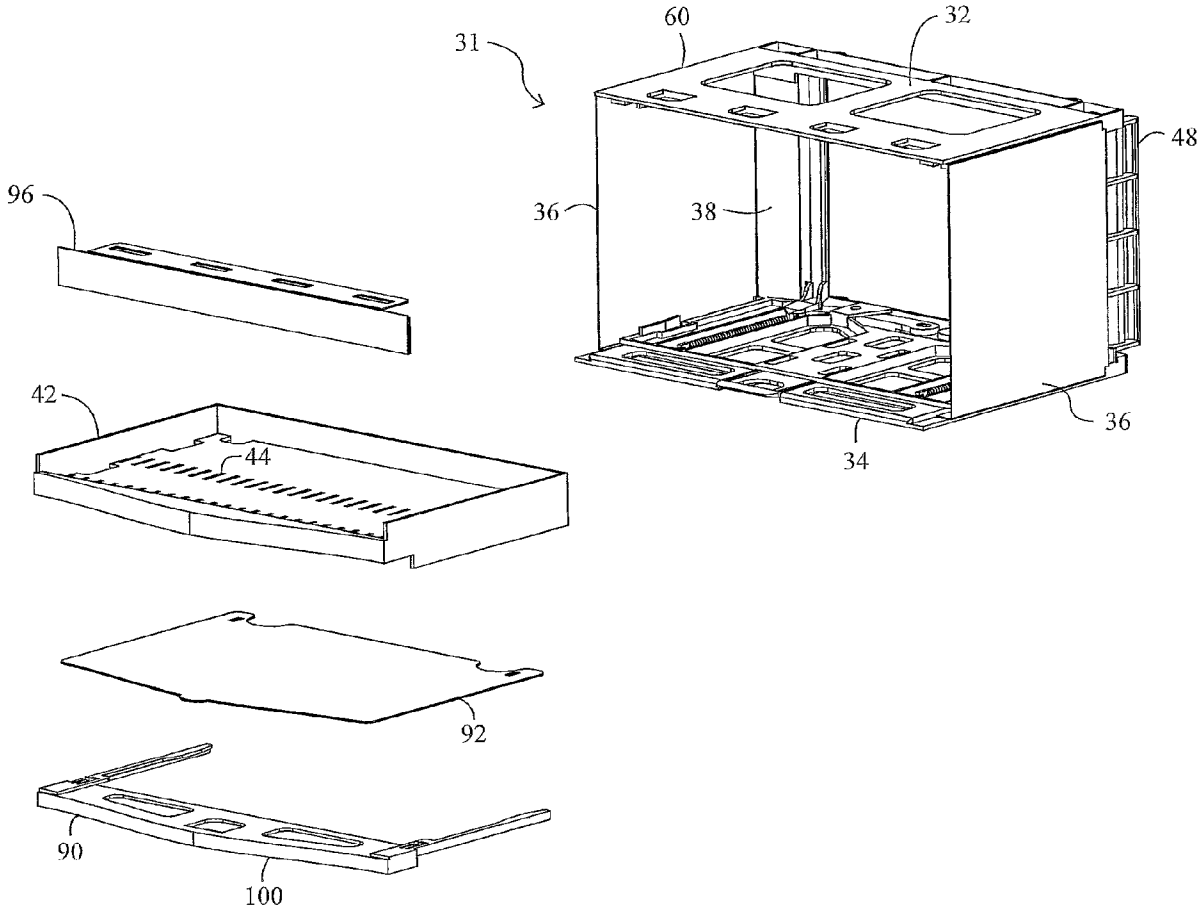
FIG. 7 is a partially exploded, front perspective view of a tray portion of the module of the present invention shown in FIG. 4.
Figure 8:
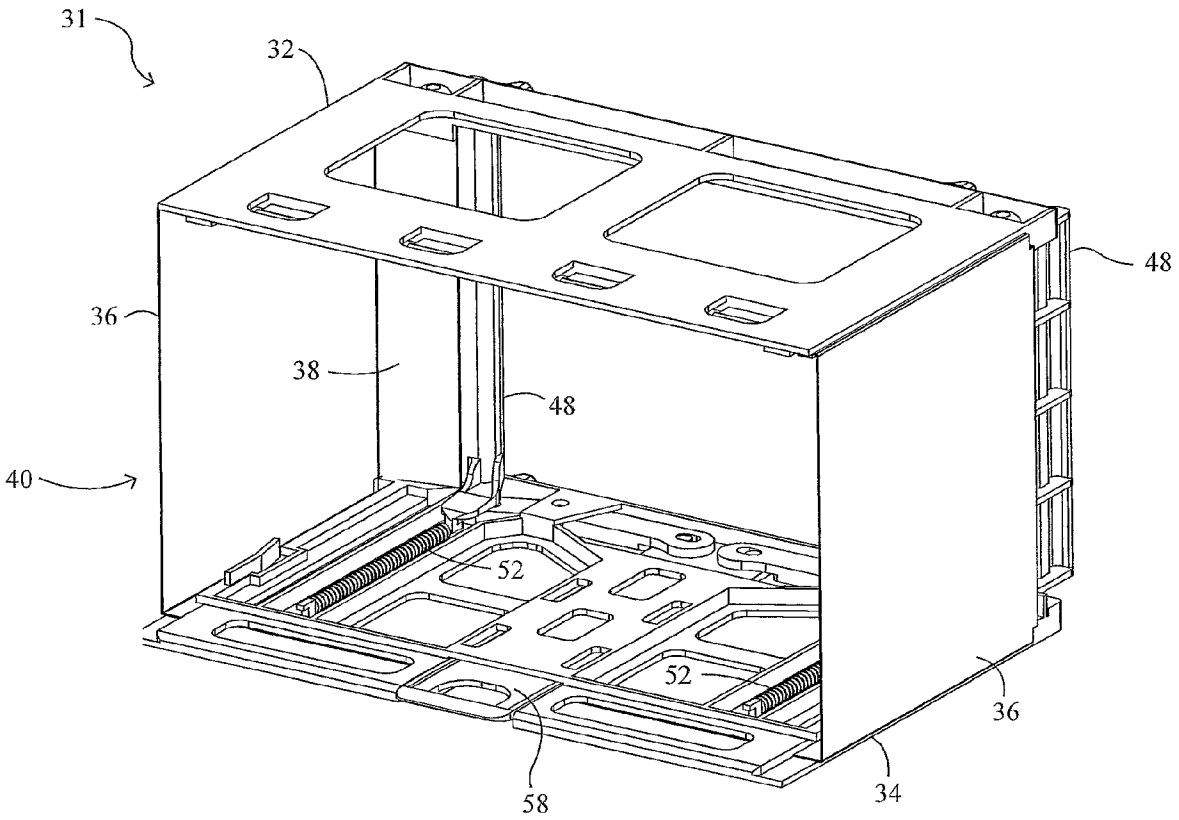
FIG. 8 is a front perspective view of a main portion of the module constructed in accordance with the present invention for use with the merchandise display system of the present invention.
Figure 9:
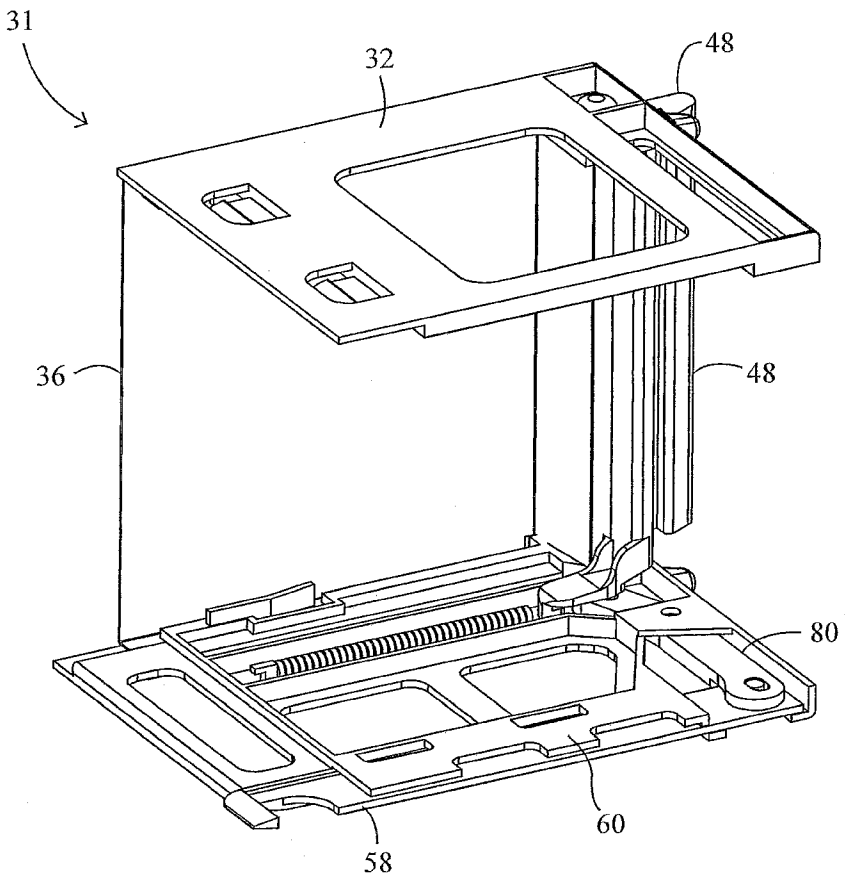
FIG. 9 is a cut away, front perspective view of the main portion of the module of the present invention shown in FIG. 8.
Figure 10:
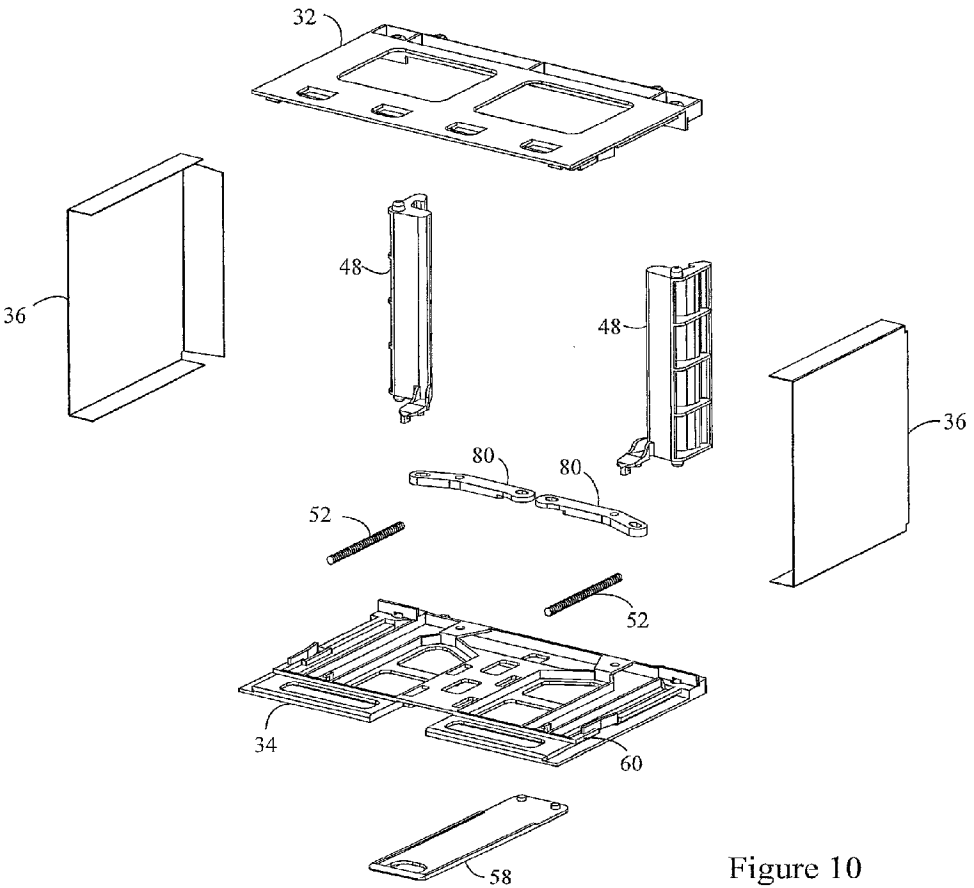
FIG. 10 is an exploded, front perspective view of the main portion of the module of the present invention shown in FIG. 8.
Figure 11:
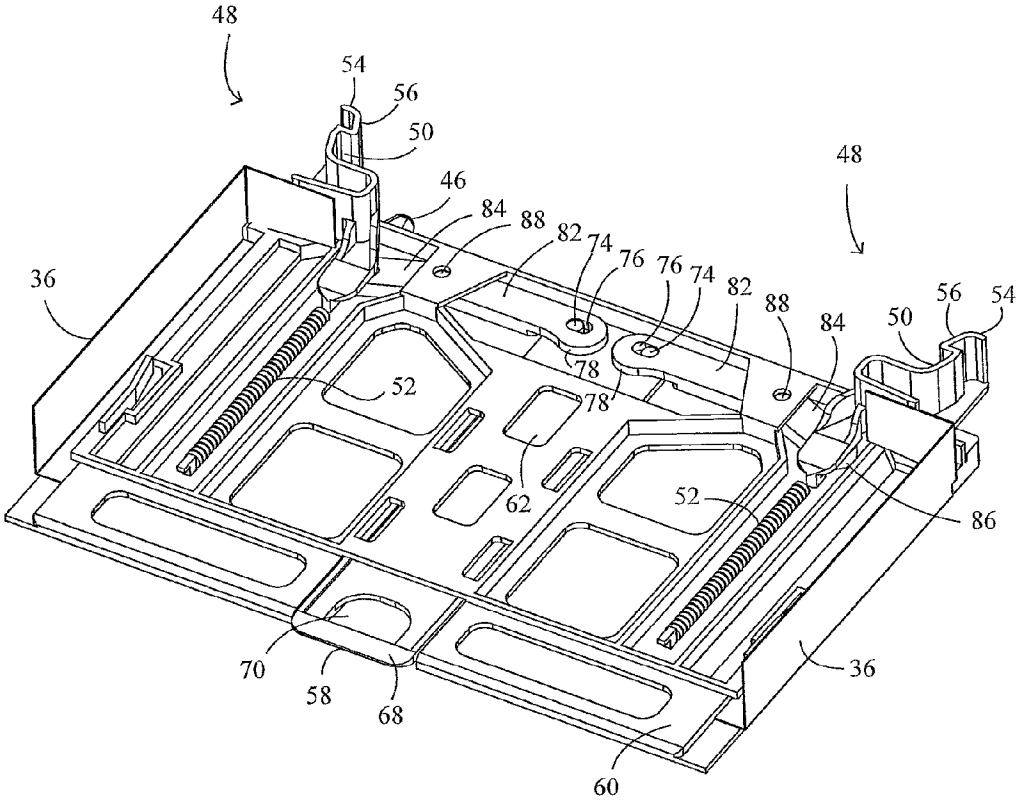
FIG. 11 is a top perspective view of the lower portion of the module of the present invention and illustrating the release and latching mechanisms thereof.
Figure 12:
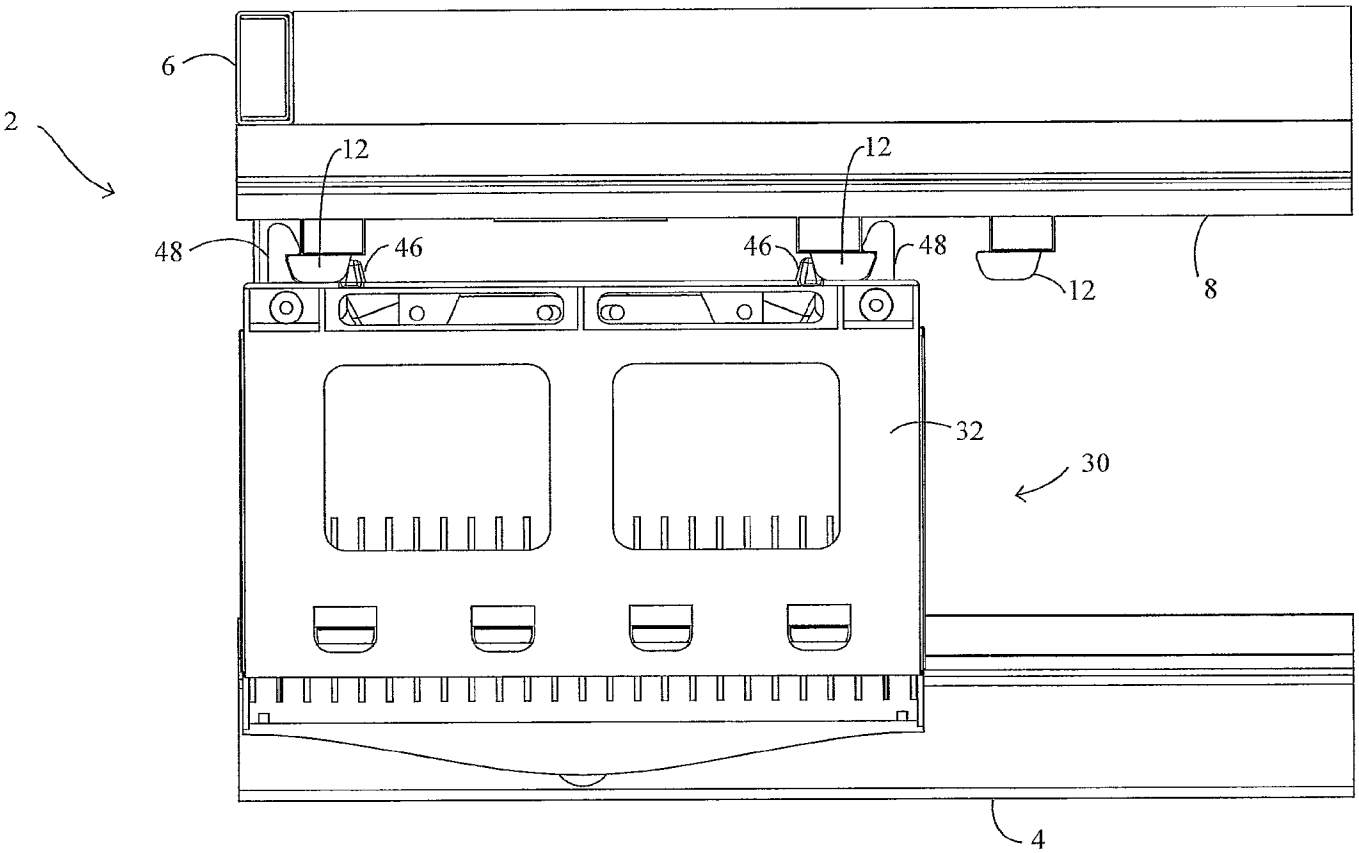
FIG. 12 is a top plan view of the module of the present invention shown in FIG. 4, and illustrating its attachment to a support frame forming part of the merchandise display system of the present invention.
Figure 13:
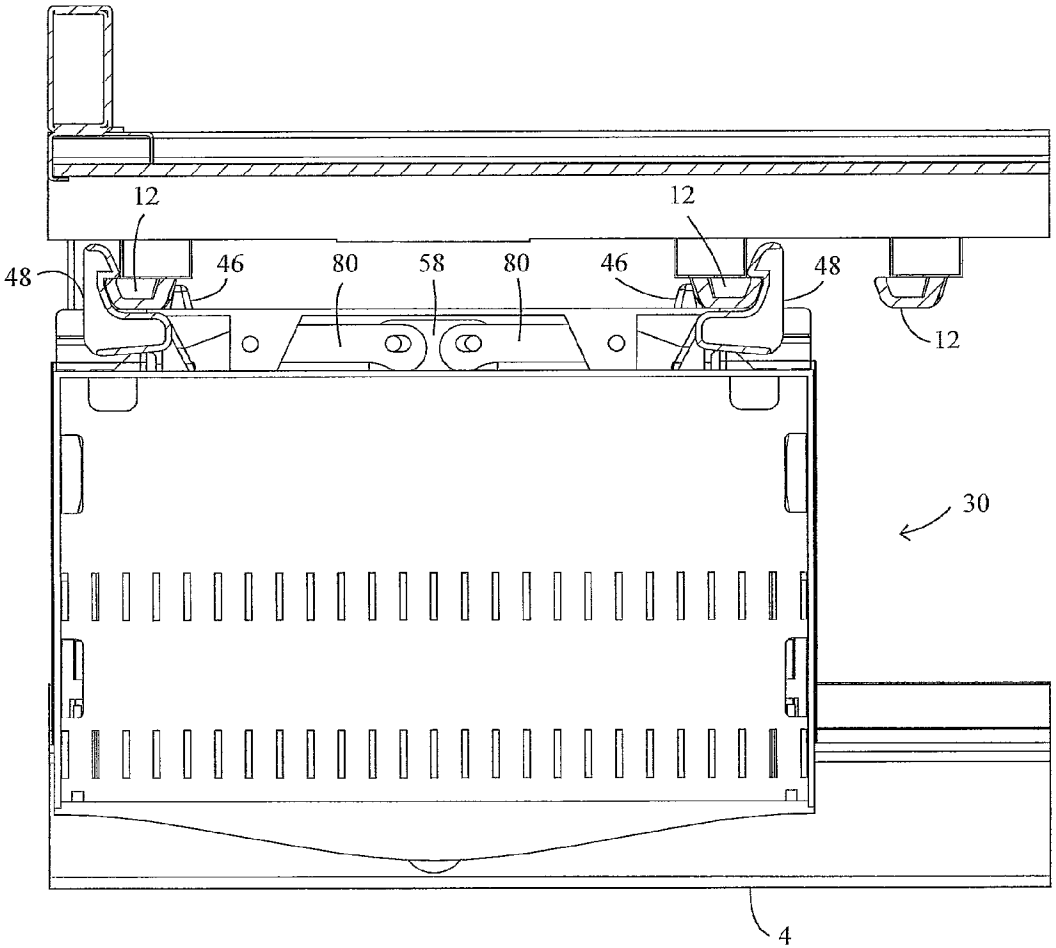
FIG. 13 is a top plan view of a portion of the module of the present invention shown in FIG. 12, with the top portion thereof cut away to facilitate an understanding of the invention.

In an alternative version of the module 30, as shown in FIG. 7, the module includes a UPC panel 90 and panel cover 92 situated underneath the merchandise tray 42. The UPC panel 90 and panel cover 92 are operatively joined to the release bar 58. The store owner may pull on a tab 94 of the panel cover 92 extending outwardly from the front of the UPC panel 90 and tray 42, which causes the UPC panel 90 and the release bar 58 affixed thereto to move outwardly of the module 30, thereby releasing the locking wings 48 from their engagement with respective indexing members 12 of the frame 2, in order to remove a particular module 30 from the frame 2.

Figure 14:
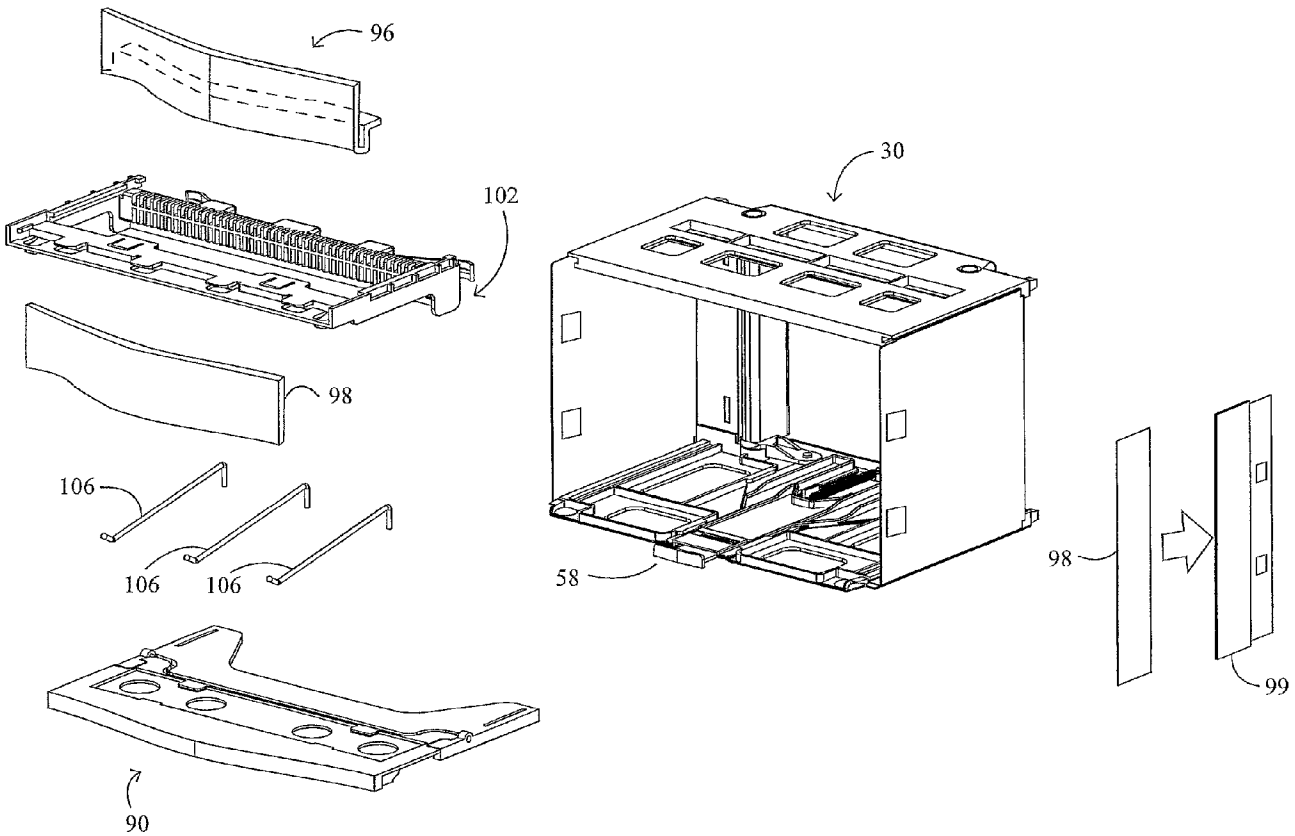
FIG. 14 is an exploded, front perspective view of another form of a module for use with the merchandise display system of the present invention.
Figure 15:
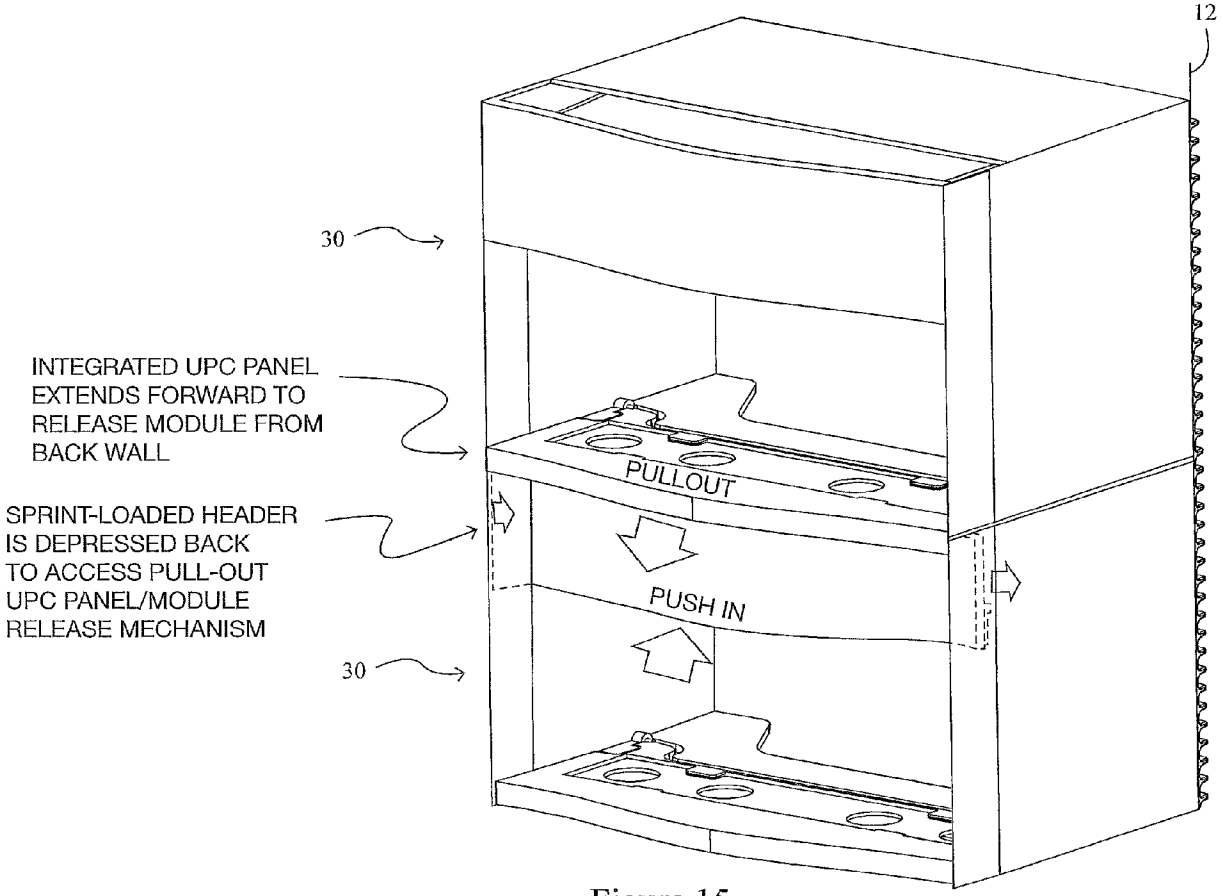
FIG. 15 is a front perspective view showing a pair of modules and the operation of the release mechanism to remove a module from the merchandise display system of the present invention.

A further modification of the module 30 is shown in FIGS. 14 and 15. A resilient header piece 96 is mounted to the module 30 at the upper front portion thereof. At least a portion of the header piece 96 is made of a transparent material so that the store owner may display product information or other graphics on a sheet of material 98 situated behind the header piece 96 and viewable through it from the front of the module 30. A graphics panel 98 may also be received behind and held in place by a clear or transparent side graphics holder piece 99 removably affixed to opposite side walls 36 of the module. The header piece 96, because of its resiliency, may be deflected inwardly of the module 30 by the store owner to expose the underside of the UPC panel 90 of the module 30 situated directly above it. In this way, the store owner may insert his fingers behind the underside and downwardly protruding front lip 100 of the UPC panel 90 of the module 30 situated directly above the module having the header piece 96 he is deflecting so that he may pull outwardly on the UPC panel 90 in order to move the release bar 58 and disengage the module 30 from the support frame 2.

It should be further noted from FIGS. 14 and 15 that the module 30 includes a hook bar 102 situated near the top wall 32 thereof. The hook bar 102 includes a plurality of recesses 104 formed across the width thereof. One or more product hooks 106, having downwardly bent rear end portions 108 which are receivable in corresponding hook bar recesses 104 selected by the store owner, may be positioned within the module 30, with the opposite upwardly bent free ends 110 of the product hooks 106 extending toward the front opening 40 of the module. Merchandise may be displayed within the module 30 by being inserted over the free ends 110 of the hooks 106 and hung thereon for selection and removal therefrom by consumers.

Figure 16:
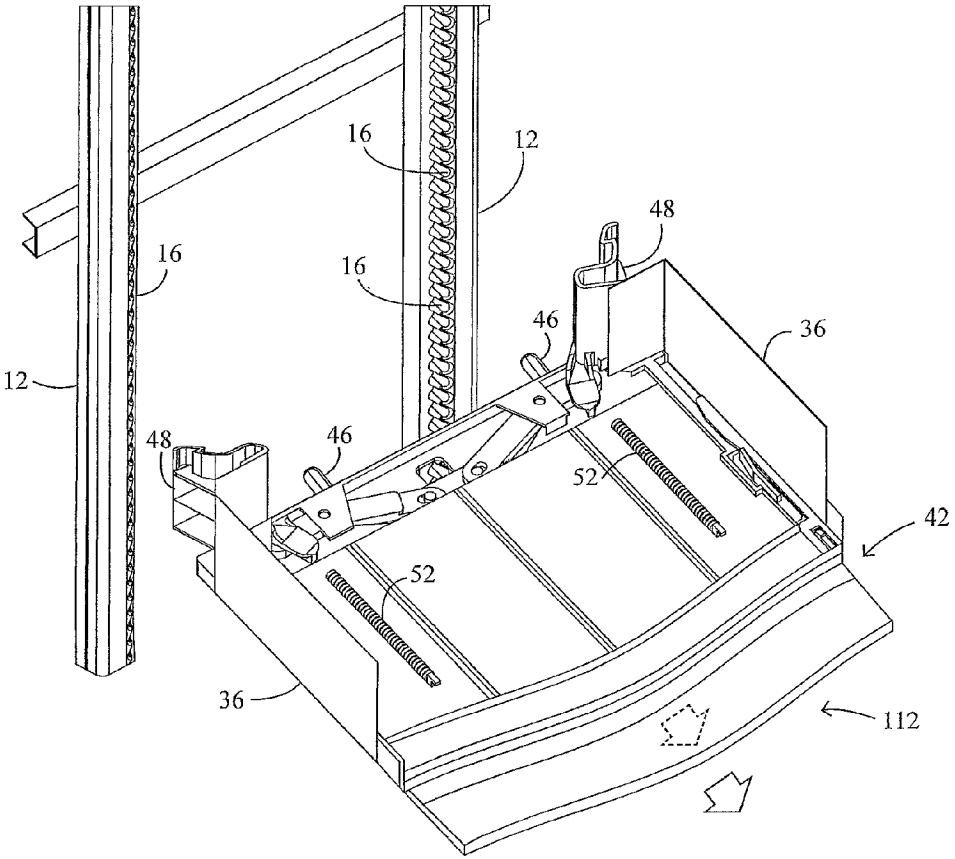
FIG. 16 is a front perspective view of a merchandise display system constructed in accordance with another form of the present invention, and illustrating a module and vertical indexing members of the merchandise display system and how the module is mountable to the vertical indexing members.
Figure 17:
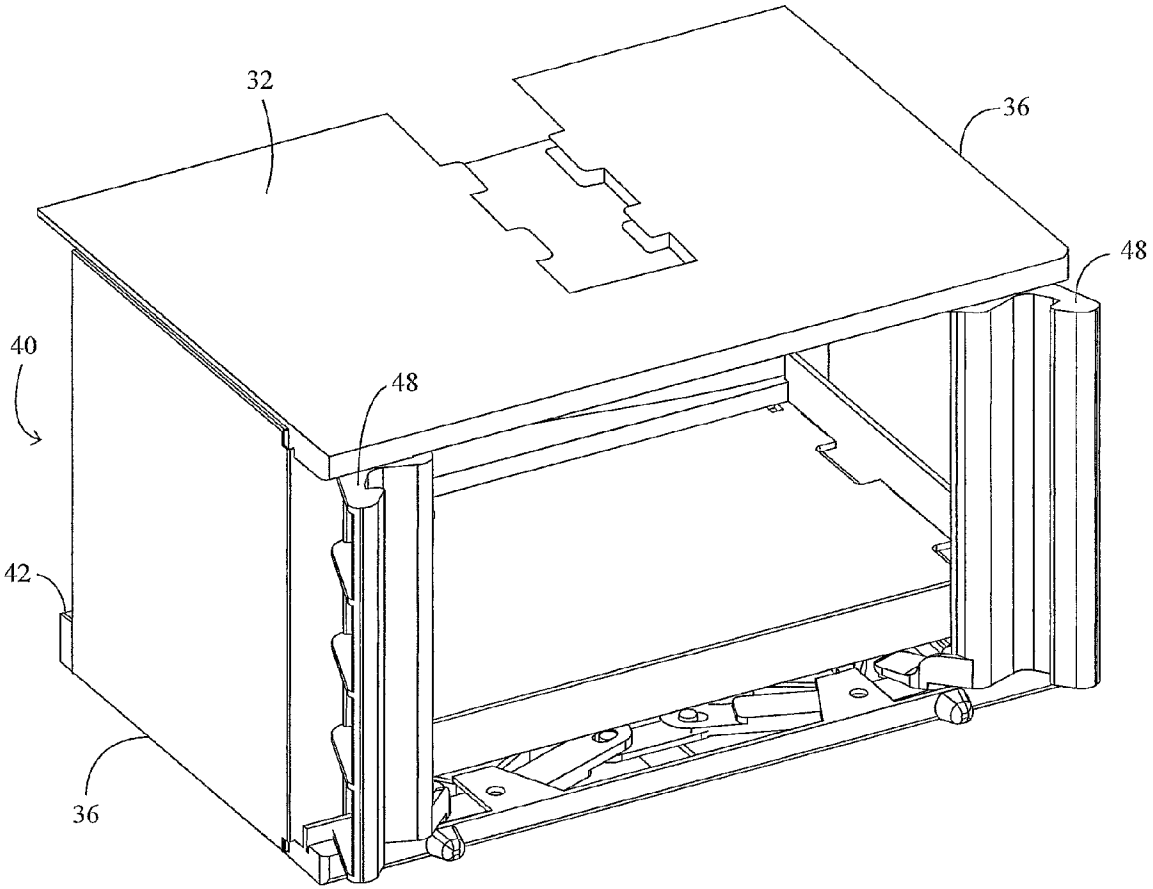
FIG. 17 is a rear perspective view of the module of the present invention shown in FIG. 16.

FIGS. 16 and 17 illustrate another version of the modular merchandise display system of the present invention. In the cutaway view of the module 30 shown in FIG. 16, the tray 42 situated within the module 30 is designed to accept pusher modules (see FIG. 29) which are spring loaded and exert pressure on a row of merchandise items standing upright in each pusher module, pushing the merchandise items towards the front of the pusher module and the tray 42. An example of such pusher modules is shown in U.S. Pat. No. 6,105,791 (Chalson, et al.), the disclosure of which is incorporated herein by reference. A spring-loaded extendible and retractable front UPC panel 112, similar to the UPC panel 90, situated below the tray 42, is operatively linked to the locking wings 48, such as by being coupled to the release bar 58, to disengage the locking wings 48 from the indexing members 12 by pulling outwardly thereon in much the same way as the release bar 58 and release mechanism of the prior embodiments shown in FIGS. 1-15 operate.

FIGS. 18-42 illustrate a preferred form of a modular merchandise display system constructed in accordance with the present invention. The preferred form of the display system shown in these figures is similar in structure and function to the embodiments described previously and shown in FIGS. 1-17.

Figure 18:
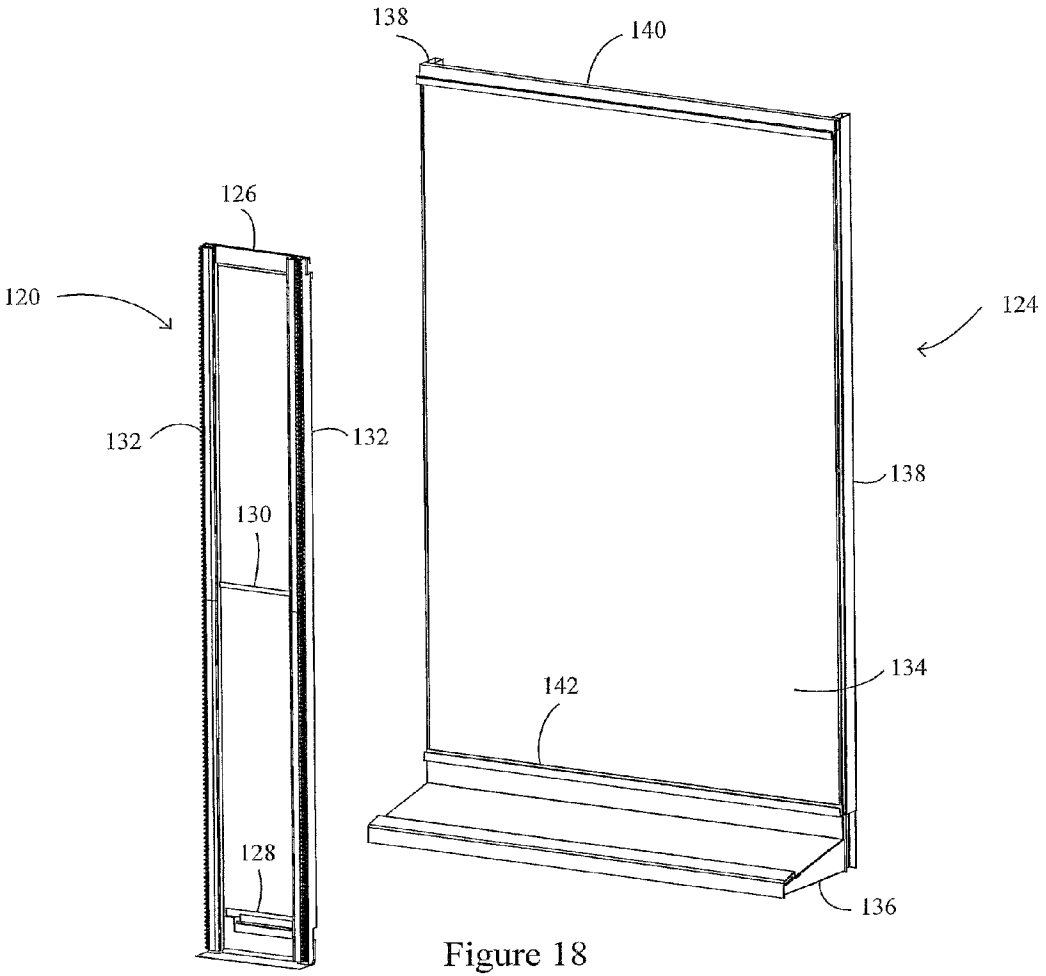
FIG. 18 is an exploded, front perspective view of a portion of a merchandise display system constructed in accordance with another form of the present invention.
Figure 19:
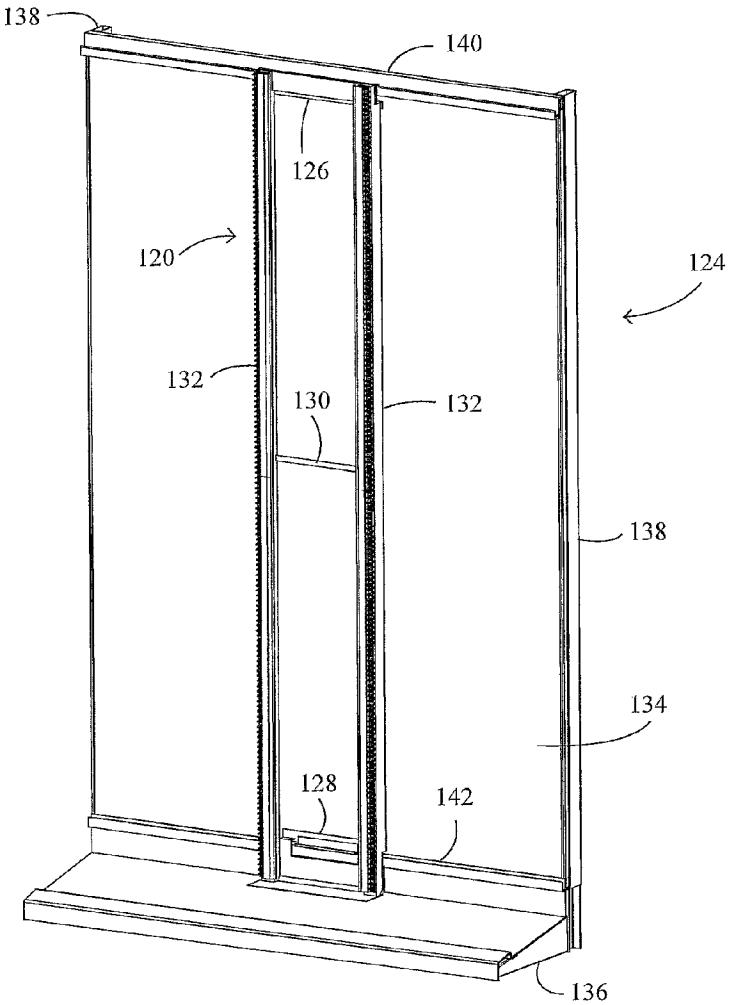
FIG. 19 is a front perspective view of the portion of the merchandise display system of the present invention shown in FIG. 18.
Figure 20:
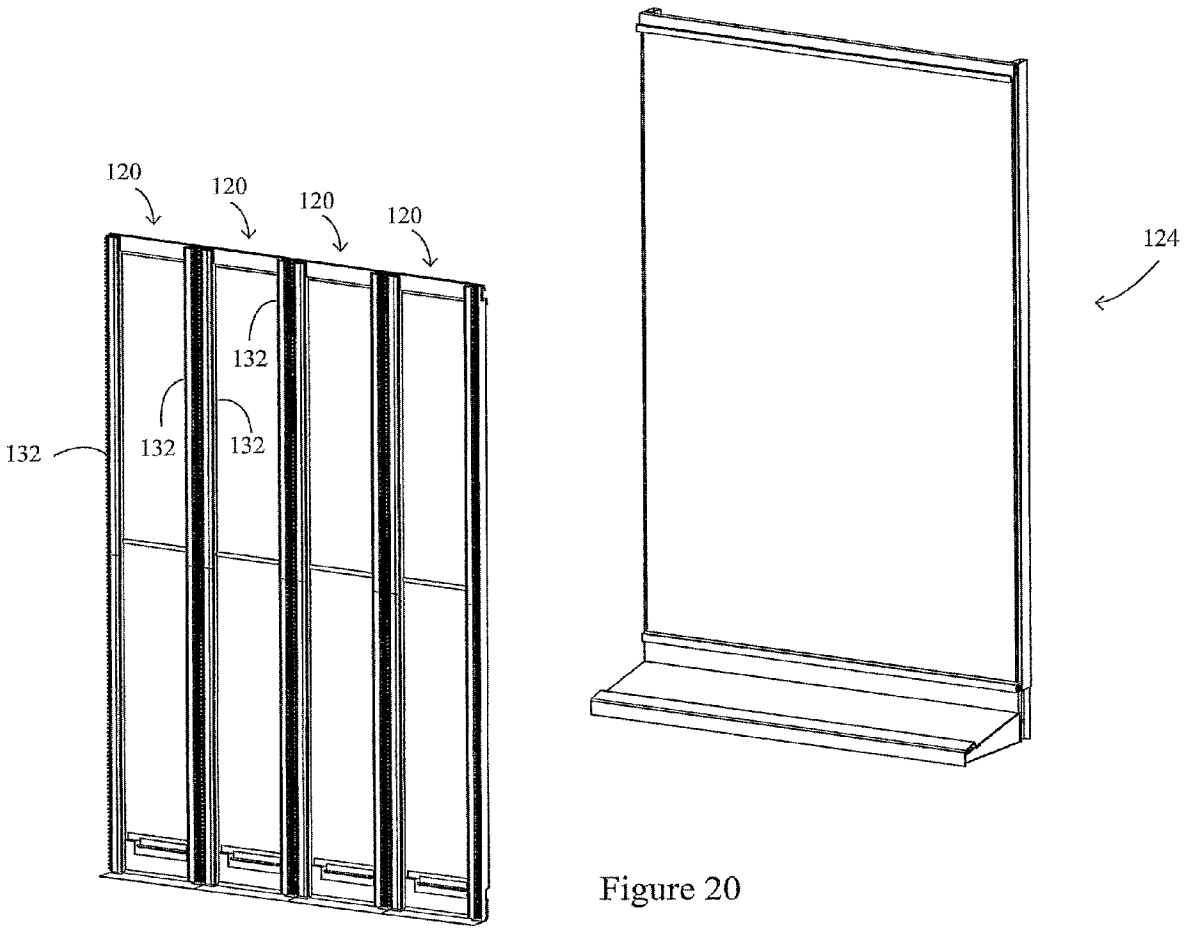
FIG. 20 is an exploded, front perspective view of a portion of a merchandise display system constructed in accordance with yet another form of the present invention.
Figure 21:
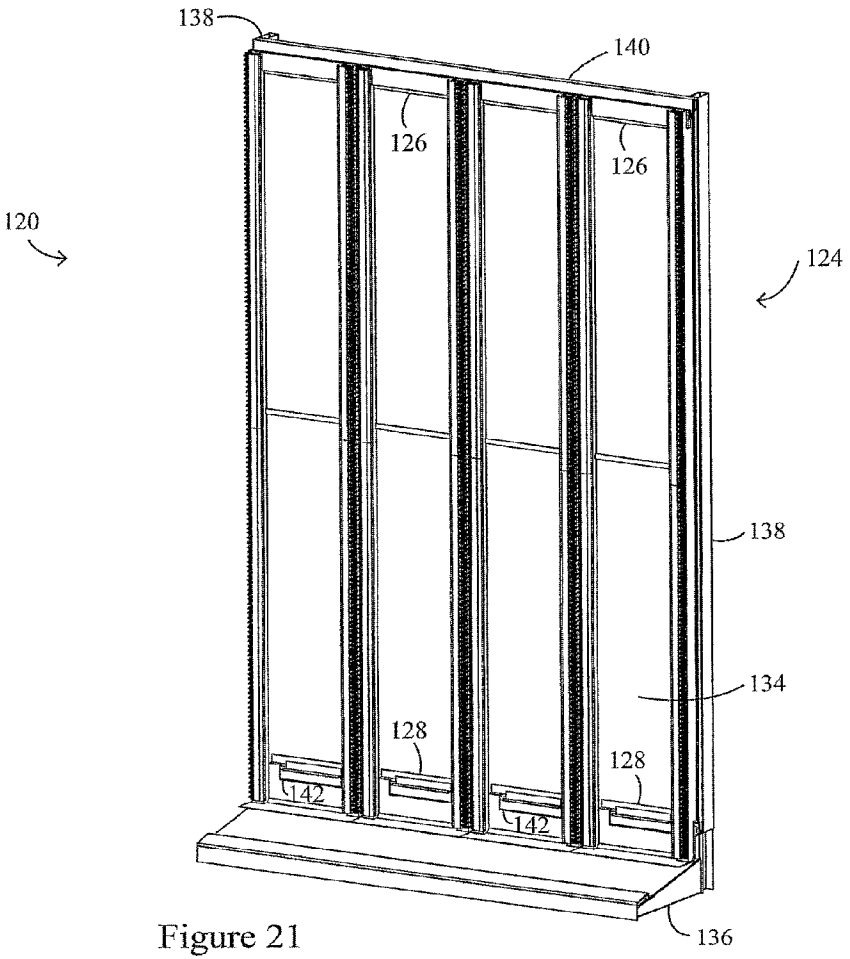
FIG. 21 is a front perspective view of the portion of the merchandise display system of the present invention shown in FIG. 20.

Referring initially to FIGS. 18-28, it will be seen that a modular merchandise display system constructed in accordance with the present invention includes a frame assembly 120, a plurality of merchandise display modules 122 (shown in FIGS. 29-43) mounted on the frame assembly 120, and a back wall support assembly 124. The frame assembly 120 may come in relatively narrow sections, such as about one foot in width, which may be mounted alone on the back wall support assembly 124, as shown in FIGS. 18 and 19, or mounted on the back wall support assembly with other similarly structured frame assemblies 120 in a side-by-side arrangement, as shown in FIGS. 20 and 21. Each frame assembly 120 includes an upper horizontal cross member 126, a lower horizontal cross member 128 and, optionally, one or more middle horizontal cross members 130 situated between the upper and lower horizontal cross members 126, 128. Each frame assembly 120 further includes a pair of spaced apart, vertical, parallelly disposed indexing members 132 having formed therein a plurality of arcuate or U-shaped recesses or openings 133 extending along their lengths. The vertical indexing members 132 are joined to the upper horizontal cross member 126, the lower horizontal cross member 128 and the one or more middle horizontal cross members 130.

The back wall support assembly 124 preferably includes a planar, vertical back wall 134, which may be formed of a solid sheet of material (e.g., plastic, metal, wood, pressed composition board or the like), or in the form of a pegboard having a multiplicity of holes and formed of a material such as described previously. The back wall support assembly 124 may also include a base 136 which rests on the floor of an establishment, vertical side pieces 138 attached to the base 136, an upper horizontal cross member 140 and a lower horizontal cross member 142. The back wall 134 is affixed to and supported by the vertical side pieces 138 and the upper and lower horizontal cross members 140, 142 of the back wall support assembly 124.

The upper and lower horizontal cross members 126, 128 of the frame assembly 120 include a provision for removably mounting the frame assembly to the back wall support assembly 124. As can be more clearly seen in FIGS. 22-24, the upper horizontal cross member 126 of the frame assembly 120 includes a horizontal rear wall 144, a top wall 146 perpendicularly joined to the rear wall 144 and a cantilevered hook plate 148 extending downwardly from the top wall 146 and spaced from the rear wall 144. Together, the rear wall 144, top wall 146 and hook plate 148 define a U-shaped channel 150 running along the length of the upper horizontal cross member 126 of the frame assembly 120. A preferably resilient pad 152, having an exposed concave lower surface portion 154, is affixed to the underside of the top wall 146 within the U-shaped channel 150.

The upper horizontal cross member 140 of the back wall support assembly 124 includes a front wall 156, a bottom wall 158 perpendicularly joined to the front wall 156, and a frame support hook wall 160 extending perpendicularly upwardly from the bottom wall 158 and spaced from the front wall 156. Together, the front wall 156, bottom wall 158 and frame support hook wall 160 of the upper horizontal cross member 140 of the back wall support assembly 124 define a U-shaped channel 162.

The upper free end of the frame support hook wall 160 preferably includes a bulbous bead 164 extending along the length the horizontal upper cross member 140 of the back wall support assembly 124. The frame assembly 120 is removably attached to the back wall support assembly 124 by lifting the frame assembly so that the cantilevered hook plate 148 of the upper horizontal support member 126 of the frame assembly 120 passes over the frame support hook wall 160 of the upper horizontal cross member 140 of the back wall support assembly 124 and is received by the U-shaped channel 162 of the back wall support assembly's upper horizontal member 140. The upper horizontal cross member 126 of the frame assembly 120 thus rests on the frame support hook wall 160 of the back wall support assembly's upper horizontal member 140, with the frame support hook wall 160 being received by the U-shaped channel 150 of the frame assembly's upper horizontal member 126, and the concave portion 154 of the resilient pad 152 resting atop the bulbous bead 164 of the frame support hook wall 160.

To further ensure the attachment of the frame assembly 120 to the back wall support assembly 124, the lower horizontal cross member 128 of the frame assembly 120 includes a locking clip 166 on its rear wall and extending along its length, the locking clip 166 defining an outwardly and downwardly extending surface that terminates in a lip 168. The locking clip 166 has a depth (front to back) so that it is closely received by an upwardly extending front U-shaped channel 170 partially defined by an upwardly extending wall 172 of the lower horizontal cross member 142 of the back wall support assembly 124 which is spaced from the front surface of this cross member, the lip 168 bearing against the inner surface of this upwardly extending wall 172.

Figure 23:
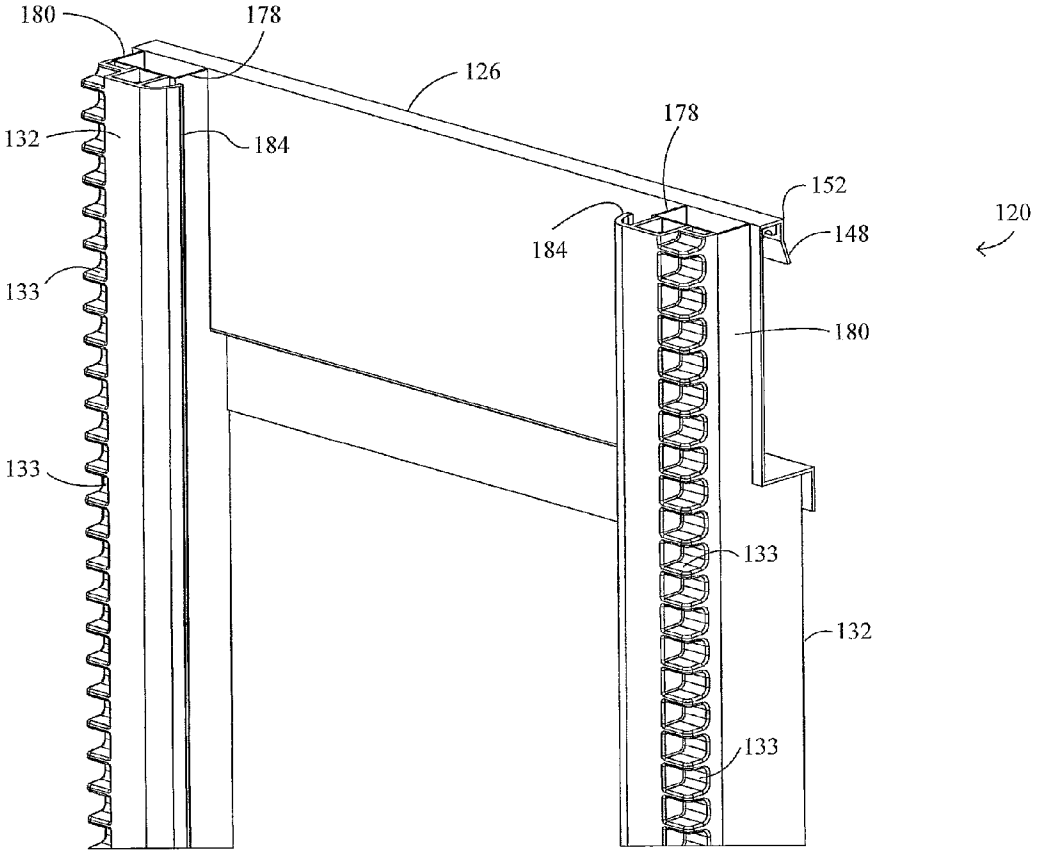
FIG. 23 is an enlarged front perspective view of a top portion of the merchandise display system of the present invention shown in FIG. 19.
Figure 24:
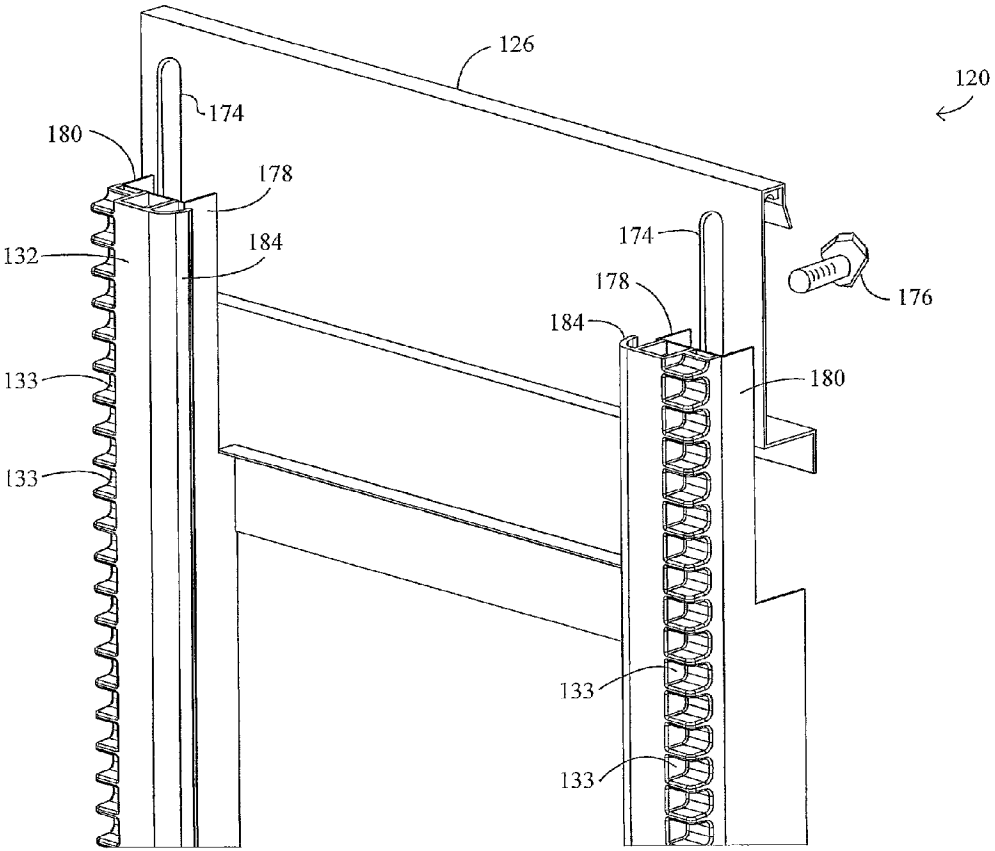
FIG. 24 is an enlarged front perspective view of the top portion of the merchandise display system of the present invention shown in FIG. 23, and illustrating the adjustability of the merchandise display system.
Figure 25:
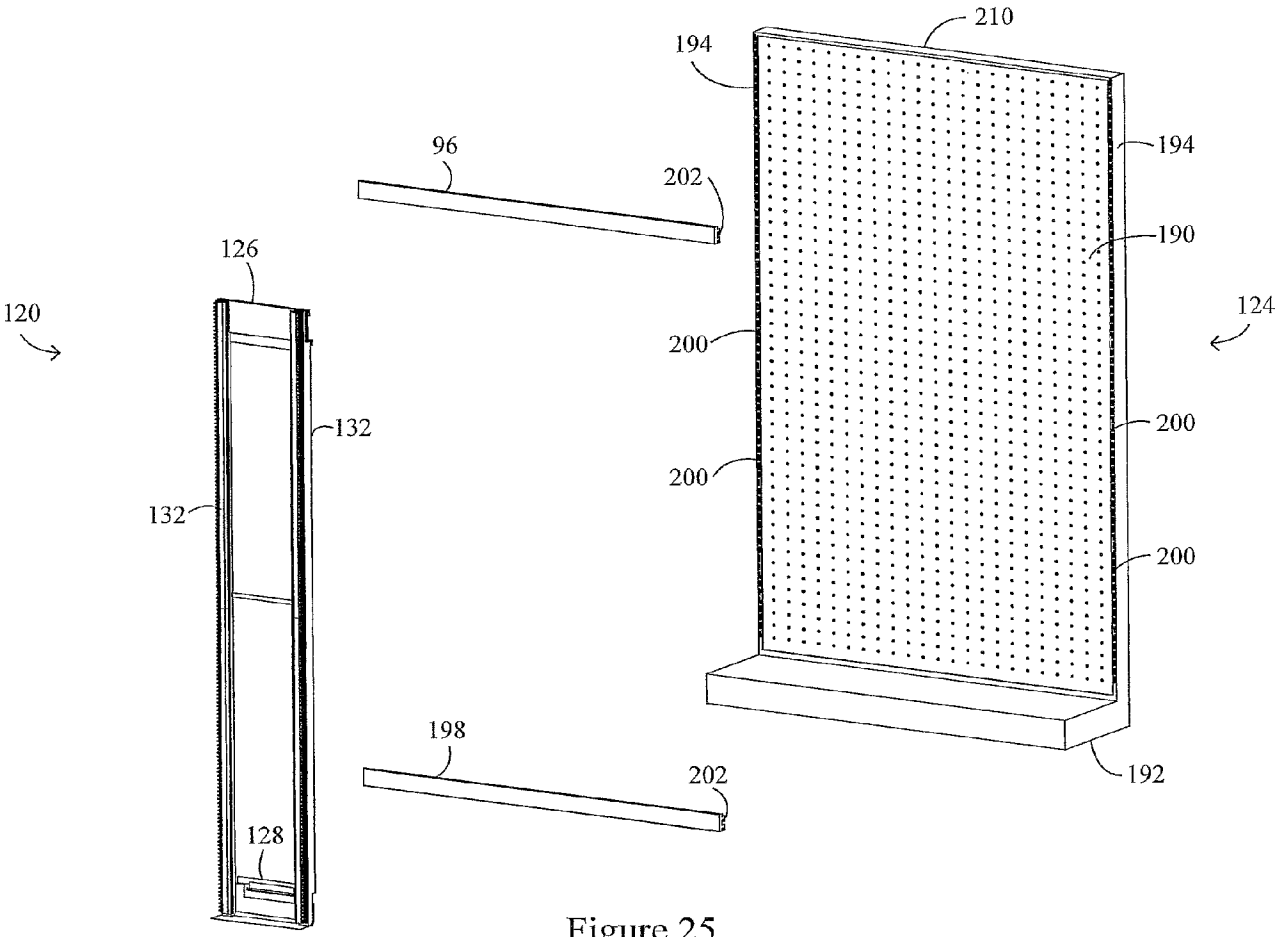
FIG. 25 is an exploded, front perspective view of a portion of a merchandise display system constructed in accordance with an alternative form of the present invention.
Figure 26:
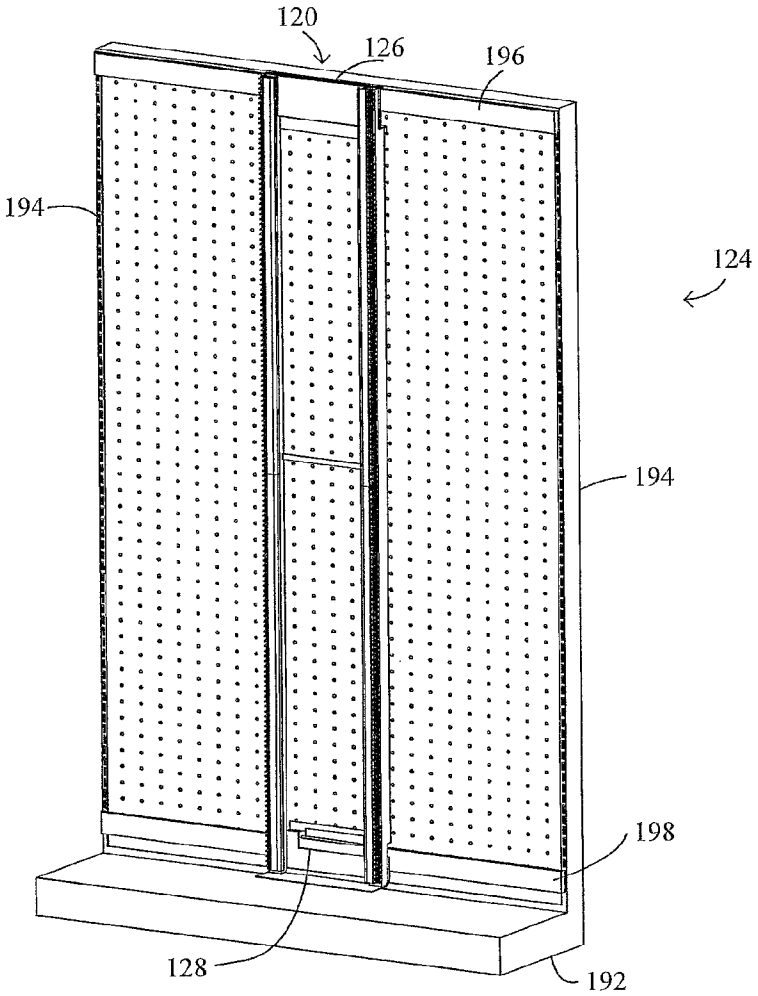
FIG. 26 is a front perspective view of the portion of the merchandise display system of the present invention shown in FIG. 25.
Figure 27:
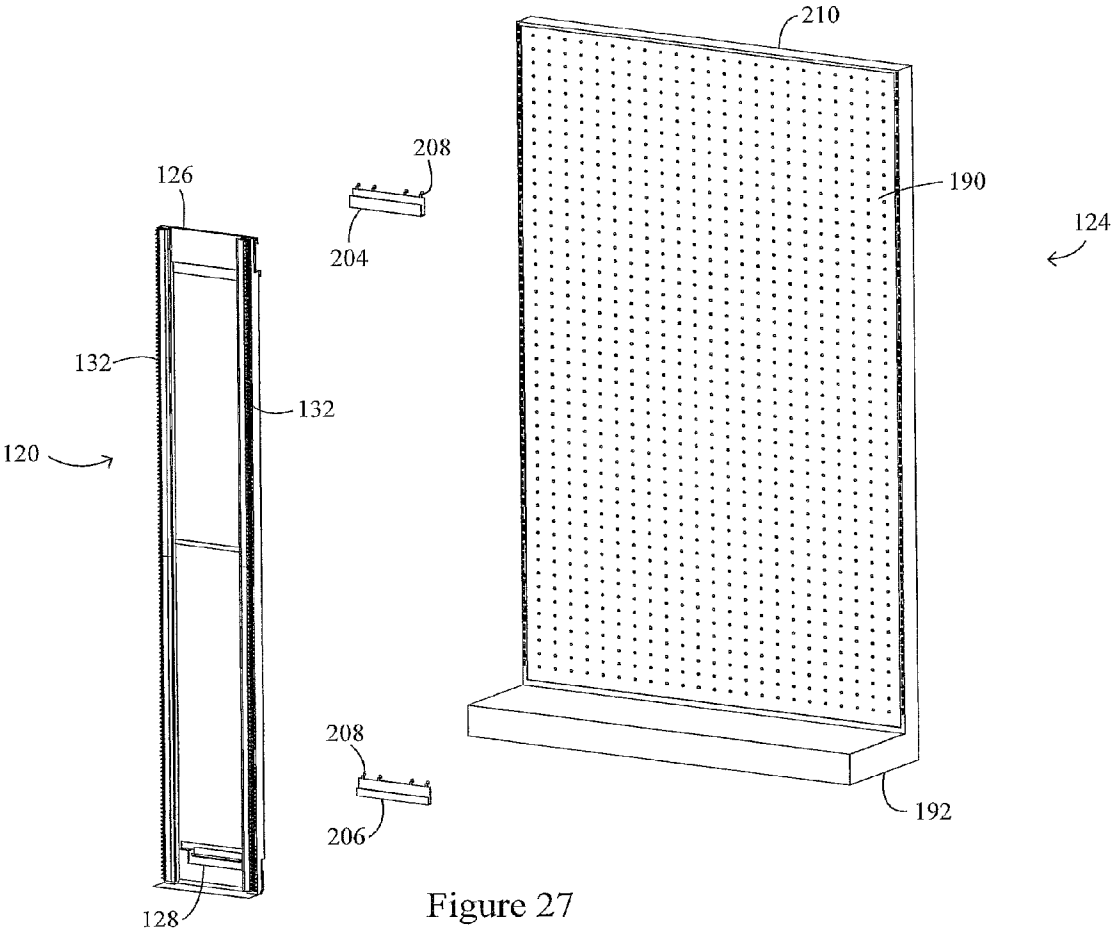
FIG. 27 is an exploded, front perspective view of a portion of a merchandise display system constructed in yet a further form of the present invention.

As shown in FIGS. 23 and 24, the upper horizontal cross member 126 of the frame assembly 120 may be adjustably attached to the vertical indexing members 132 so that the spacing between the upper and lower horizontal cross members 126, 128 of the frame assembly 120 is adjustable to make sure the locking clip 166 is fully engageable with the lower horizontal cross member 142 of the back wall support assembly 124 and to ensure that the frame assembly 120 is properly mounted on the back wall support assembly 124. To provide for such an adjustment, the upper horizontal cross member 126 of the frame assembly 120 may include vertically extending elongated slots 174 formed through its thickness which receive machine bolts or other fasteners 176 therethrough that are attached to the indexing members 132, as shown in FIG. 24.

As also can be seen in FIGS. 23 and 24, each indexing member 132 of the spaced apart pair of indexing members of each frame assembly 120 includes inner and outer lateral sides 178, 180, the inner lateral side 178 of one indexing member of the pair facing the inner lateral side 178 of the other indexing member of the pair, and with the outer lateral sides 180 facing away from one another. It should further be noted from FIGS. 23 and 24 that the plurality of arcuate or U-shaped recesses 133 are formed on the outer, non-facing lateral sides 180 of the indexing members 132 of each frame assembly 120, and that the inner, facing lateral sides 178 of the indexing members 132 include curved locking rails 184 extending outwardly from the inner lateral sides along the length of the indexing members 132. As will be explained, the arcuate recesses 133 are provided for at least partially receiving locator pins or protrusions 186 formed on the modules 122 of the merchandise display system, and the locking rails 184 are provided for engagement with locking wings 188 also forming part of the modules 122.

FIGS. 25-28 illustrate an alternative form of the display system of the present invention that is depicted in FIGS. 18-21. As mentioned previously, the back wall 134 could be a pegboard panel 190. The back wall support assembly 124 could include the pegboard panel 190, a base 192, vertical side pieces 194 affixed to the base 190, an upper horizontal back wall mounting member 196 and a lower horizontal back wall mounting member 198. The pegboard panel 190 is affixed to the vertical side pieces 194 and to the upper and lower horizontal back wall mounting members 196, 198. The vertical side pieces 194 include a plurality of slots 200 periodically spaced along their lengths. Each of the upper and lower horizontal back wall mounting members 196, 198 includes tabs 202 situated near their opposite axial ends and extending outwardly from the rear surfaces thereof. The tabs 202 hook into selected slots 200 on the vertical side pieces 194 to help hold the upper and lower horizontal back wall mounting members 196, 198, and the pegboard panel 190, in place on the vertical side pieces 194.

Figure 22:
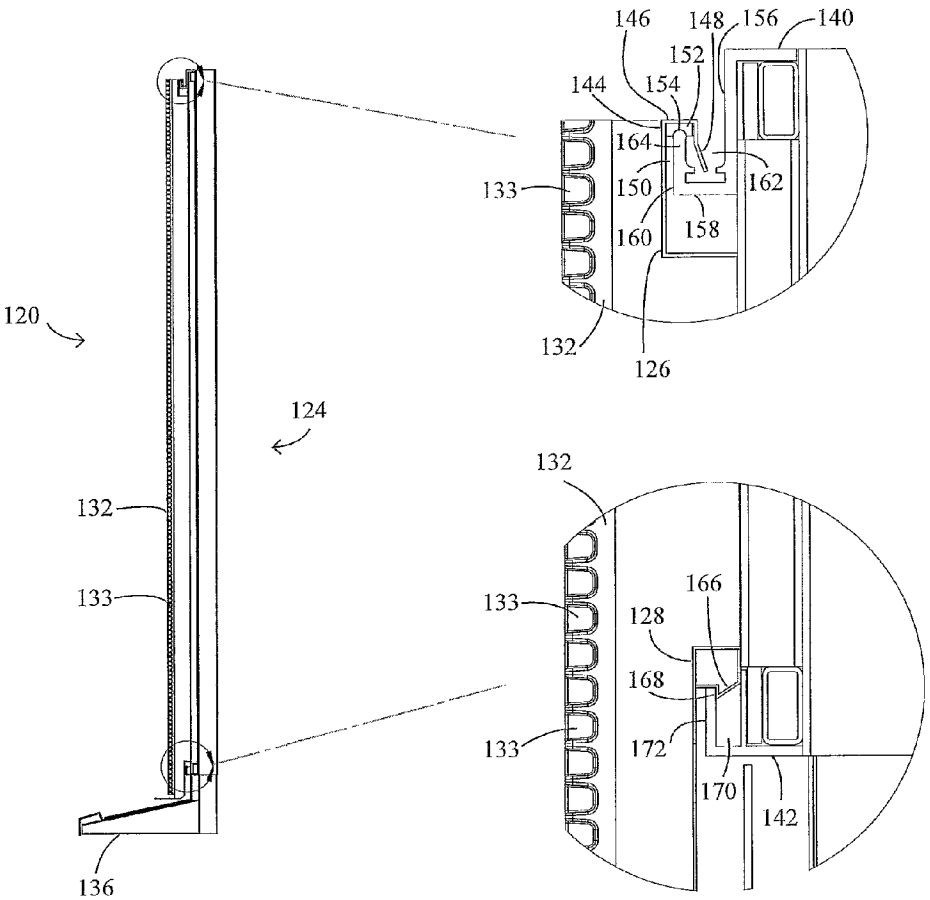
FIG. 22 is a side view and related detailed views of portions of the merchandise display system of the present invention shown in FIG. 21.

Each of the upper and lower horizontal back wall mounting members 196, 198 defines a U-shaped channel 150, 162, like those defined by the upper and lower horizontal cross members 140, 142 of the back wall support assembly 124 shown in FIGS. 22-24 so as to receive the cantilevered hook plate 148 and locking clip 166 respectively of the upper and lower horizontal cross members 126, 128 of the frame assembly 120 described previously. However, in the pegboard panel embodiment shown in FIGS. 24 and 28, the upper and lower horizontal back wall mounting members 196, 198 shown in FIGS. 25 and 26 may be respectively replaced with a pegboard upper back wall mounting member 204 and a pegboard lower back wall mounting member 206. Each of the pegboard mounting members 204, 206 defines a U-shaped channel 150, 162 as described previously with respect to the mounting members 196, 198 shown in FIGS. 25 and 26, but further include a plurality of spaced apart pegs 208 extending outwardly from the rear surface thereof which are receivable in corresponding holes of the pegboard panel 190 selected by the user in order to mount the frame assembly 120 on the pegboard panel 190 of the back wall support assembly 124. For this embodiment, the pegboard panel 190 is affixed to the vertical side pieces 194 secured to the base 192, and to a horizontal top rail 210 extending between the vertical side pieces 194.

Figure 28:
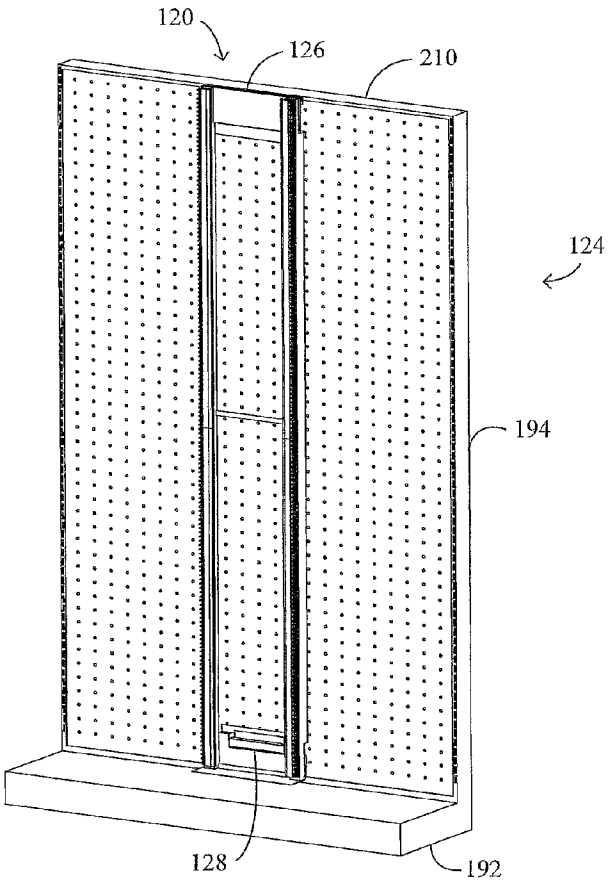
FIG. 28 is a front perspective view of the portion of the merchandise display system of the present invention shown in FIG. 27.

Although in FIG. 28 only one frame assembly 120 is depicted as being mounted on the back wall support assembly 124, it should be realized that several frame assemblies 120 may be mounted on the back wall support assembly 124 next to one another, such as with the embodiment of the display system shown in FIGS. 20 and 21.

As described previously, the merchandise display system of the present invention includes a plurality of modules 122. A preferred form of such modules 122 is shown in FIGS. 29-42.

Figure 29:
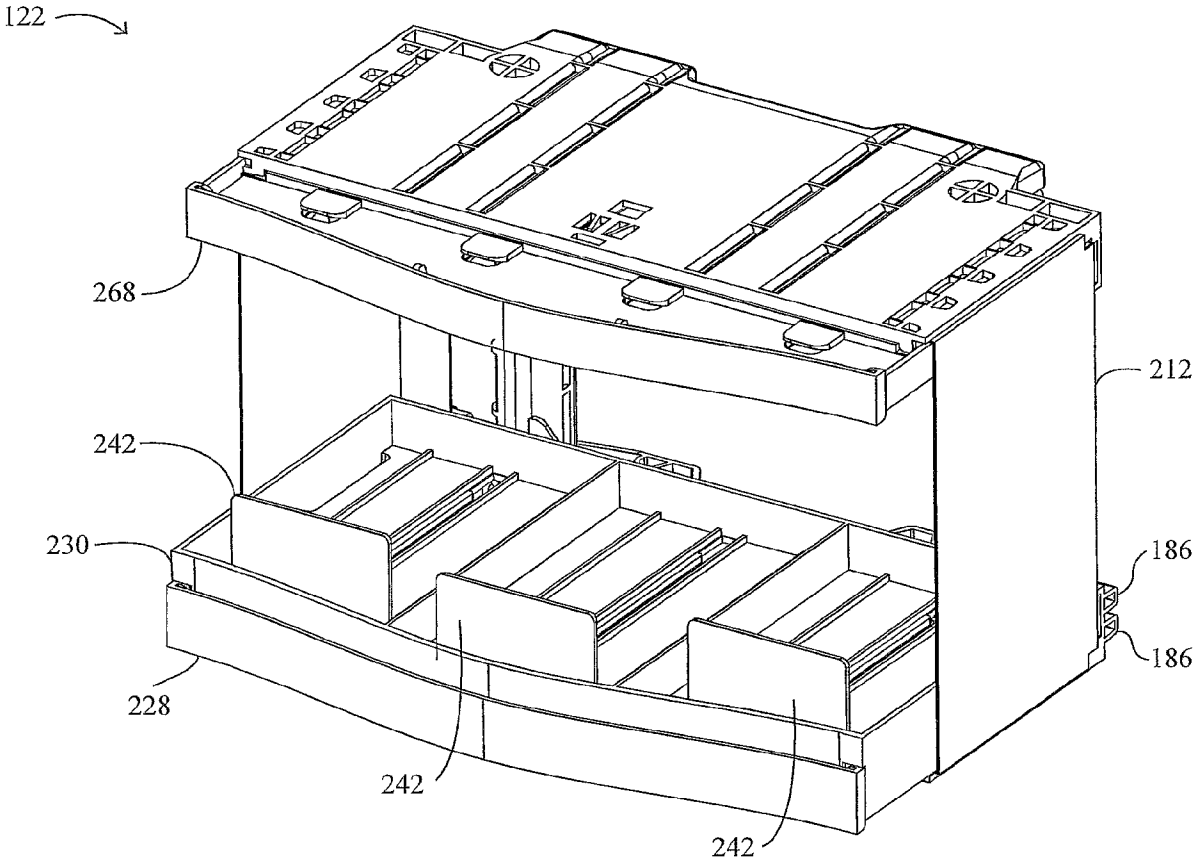
FIG. 29 is a front perspective view of a module constructed in accordance with the present invention and forming part of the merchandise display system of the present invention.
Figure 30:
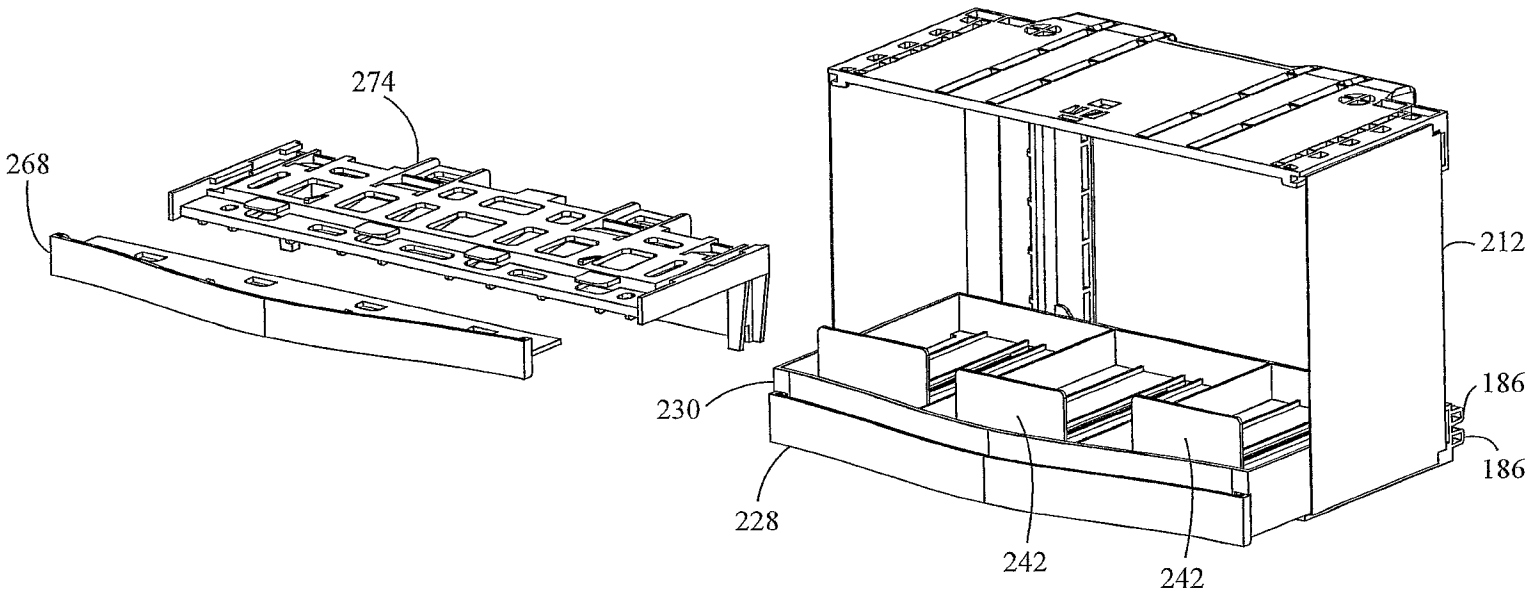
FIG. 30 is a partially exploded, front perspective view of the module of the present invention shown in FIG. 29.
Figure 31:
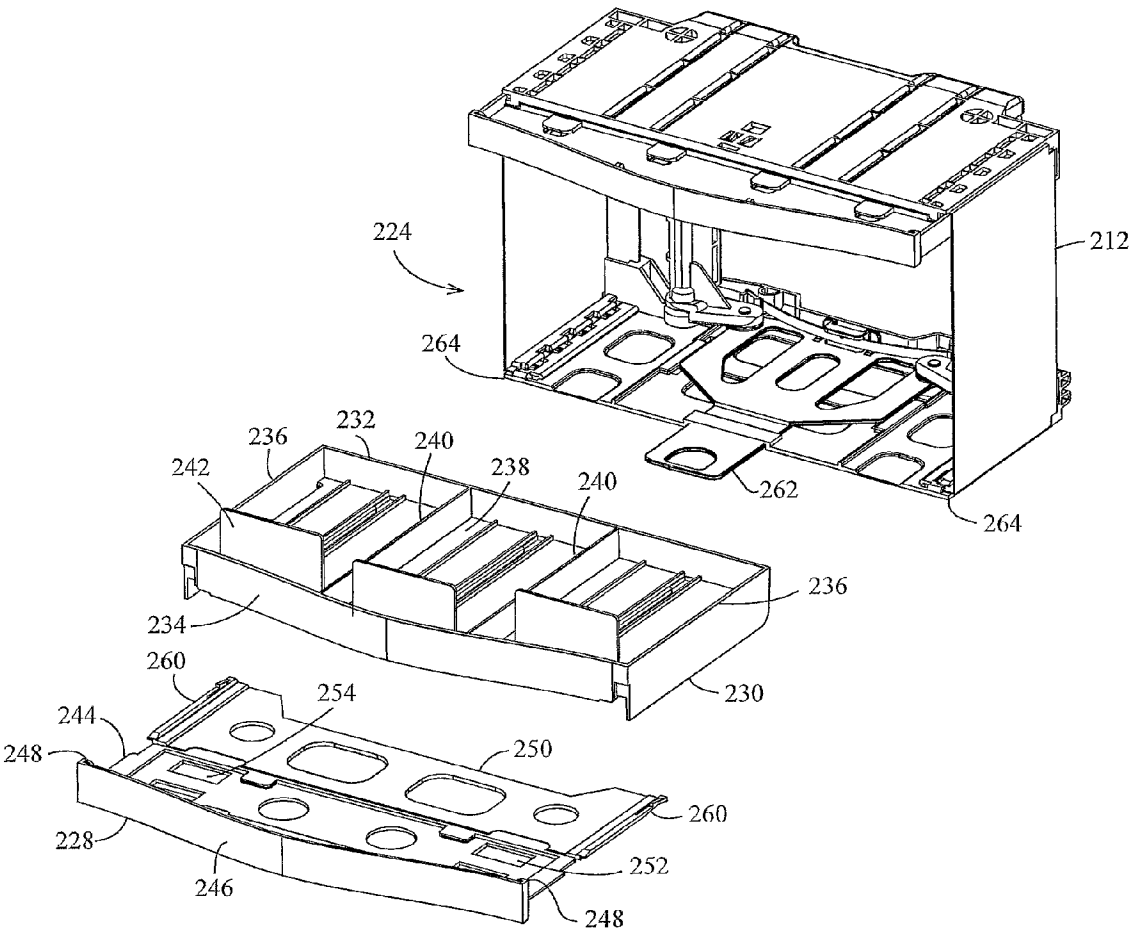
FIG. 31 is another partially exploded, front perspective view of the module of the present invention shown in FIG. 29.
Figure 32:
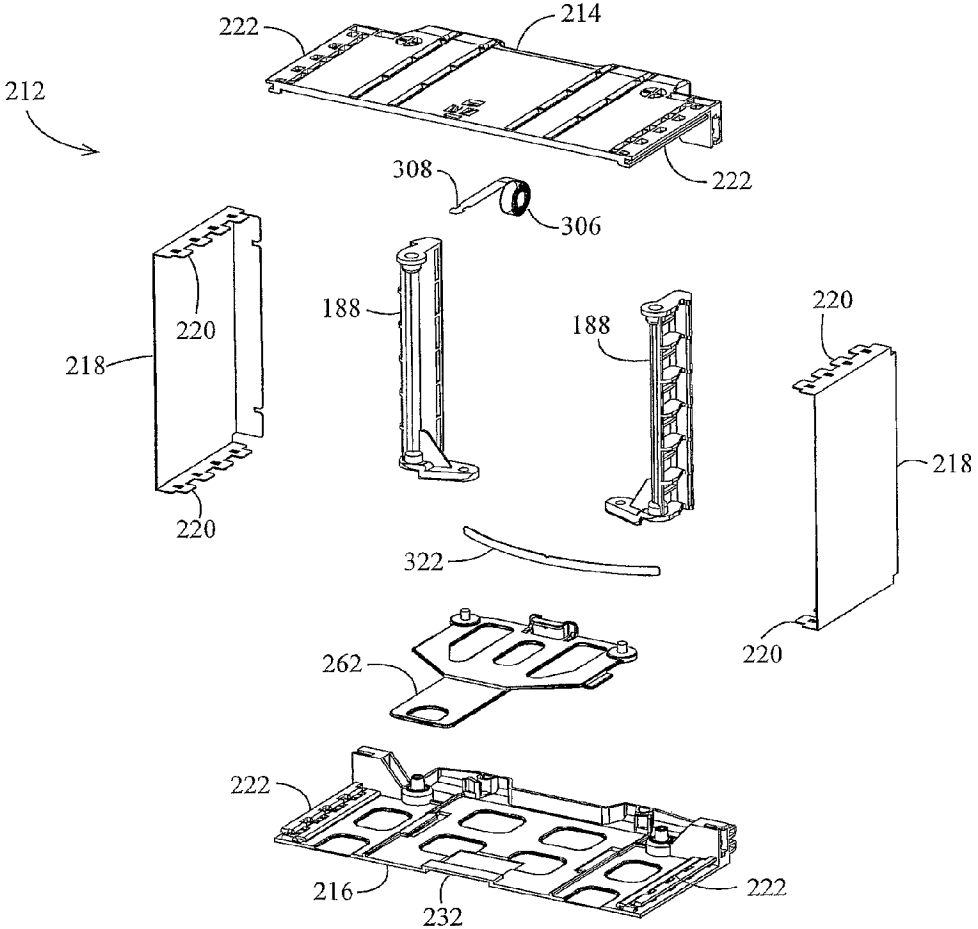
FIG. 32 is yet another partially exploded, front perspective view of the module of the present invention shown in FIG. 29.
Figure 33:
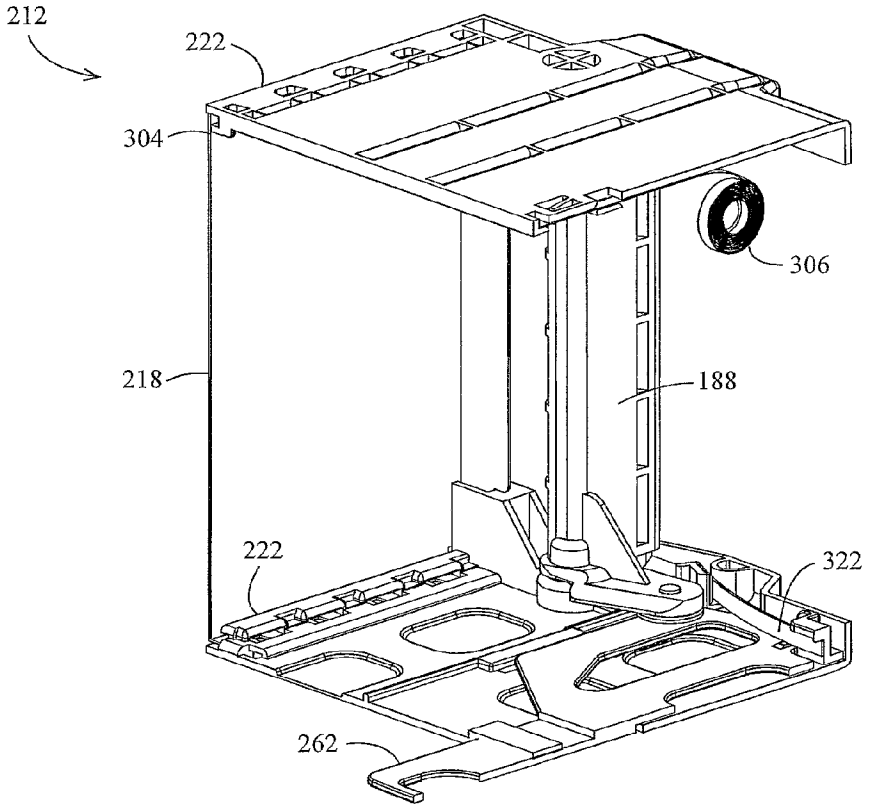
FIG. 33 is a partially cut away, front perspective view of a portion of the module of the present invention shown in FIG. 29.
Figure 34:
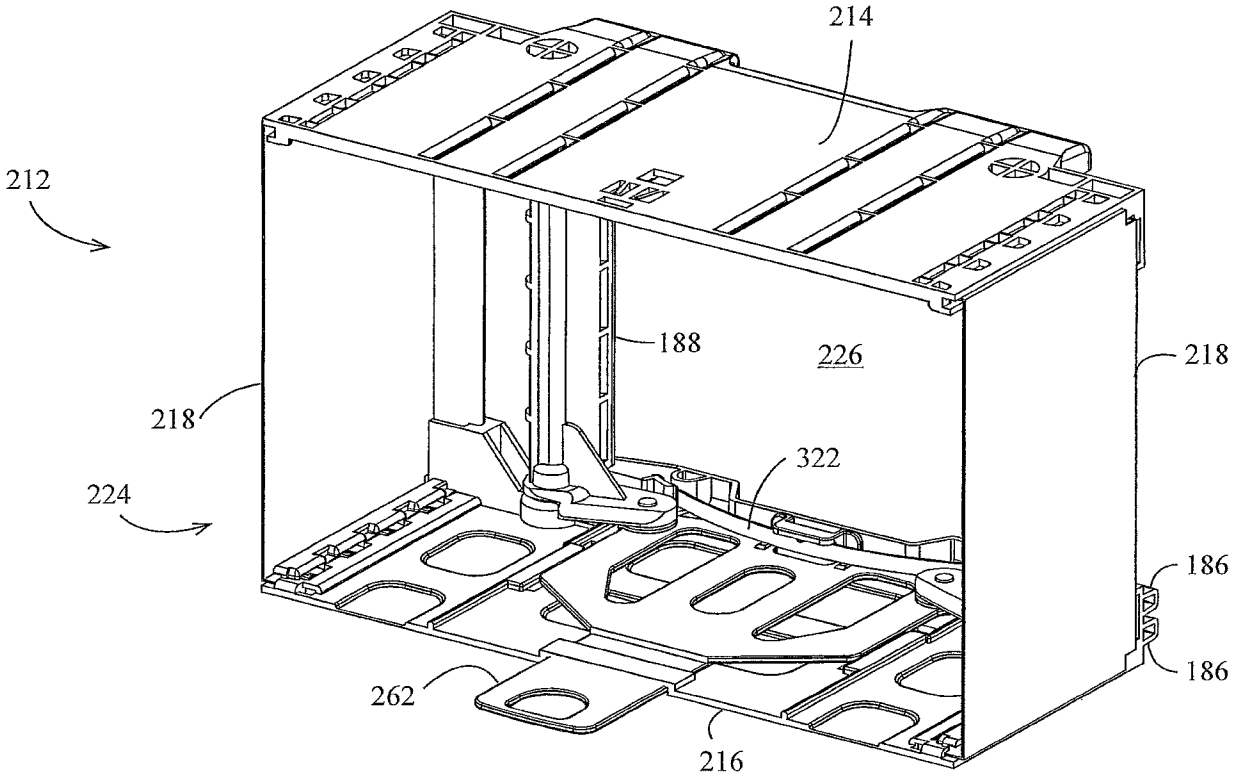
FIG. 34 is a front perspective view of a portion of the module of the present invention shown in FIG. 29.
Figure 35:
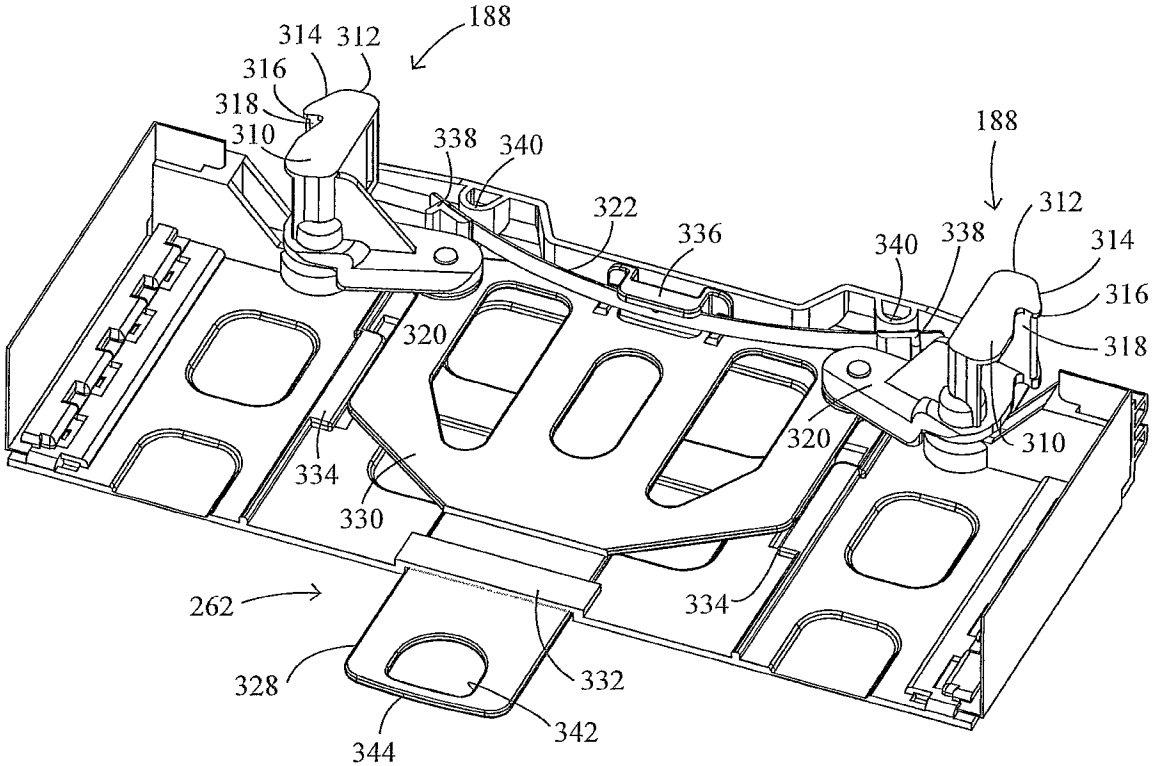
FIG. 35 is another front perspective view of a portion of the module of the present invention shown in FIG. 29.

As shown in FIGS. 29-31, the module 122 preferably includes a box-like module frame 212 which defines an interior area for displaying merchandise. The module frame 212, as can be seen in FIG. 32, includes a top wall 214, an opposite bottom wall 216, and two opposite side walls 218 which are joined to the top and bottom walls 214, 216. More specifically, the side walls 218 have a plurality of locking tabs 220 extending perpendicularly from the inner surface of each, which locking tabs 220 are received in corresponding slots formed in opposite lateral edge pieces 222 of the top and bottom walls 214, 216 to hold the module frame 212 together in a box-like shape. The module frame 212 includes a front opening 224 and an open or partially open rear side 226.

Slidably mounted on the bottom wall 216 of the module frame 212 is a UPC panel 228, and slidably mounted above the UPC panel 228 on the bottom wall 216 is an extendible and retractable tray 230. Both the UPC panel 228 and the tray 230 extend partially from the module frame 212 through the front opening 224.

The tray 230 includes a rear wall 232, an opposite front wall 234, two opposite side walls 236 and a floor 238. The tray 230 also has one or more vertically disposed divider panels 240 extending from the tray floor 238.

The divider panels 240 define compartments with the rear and front walls 232, 234, and the side walls 236, in which compartments are preferably housed product pusher trays 242, such as those disclosed in the aforementioned U.S. Pat. No. 6,105,791. The tray 230 is extendible from the front opening 224 of the module frame 212 by the user so that new merchandise may be loaded into the pusher trays 242 carried on the tray 230.

Figure 39:
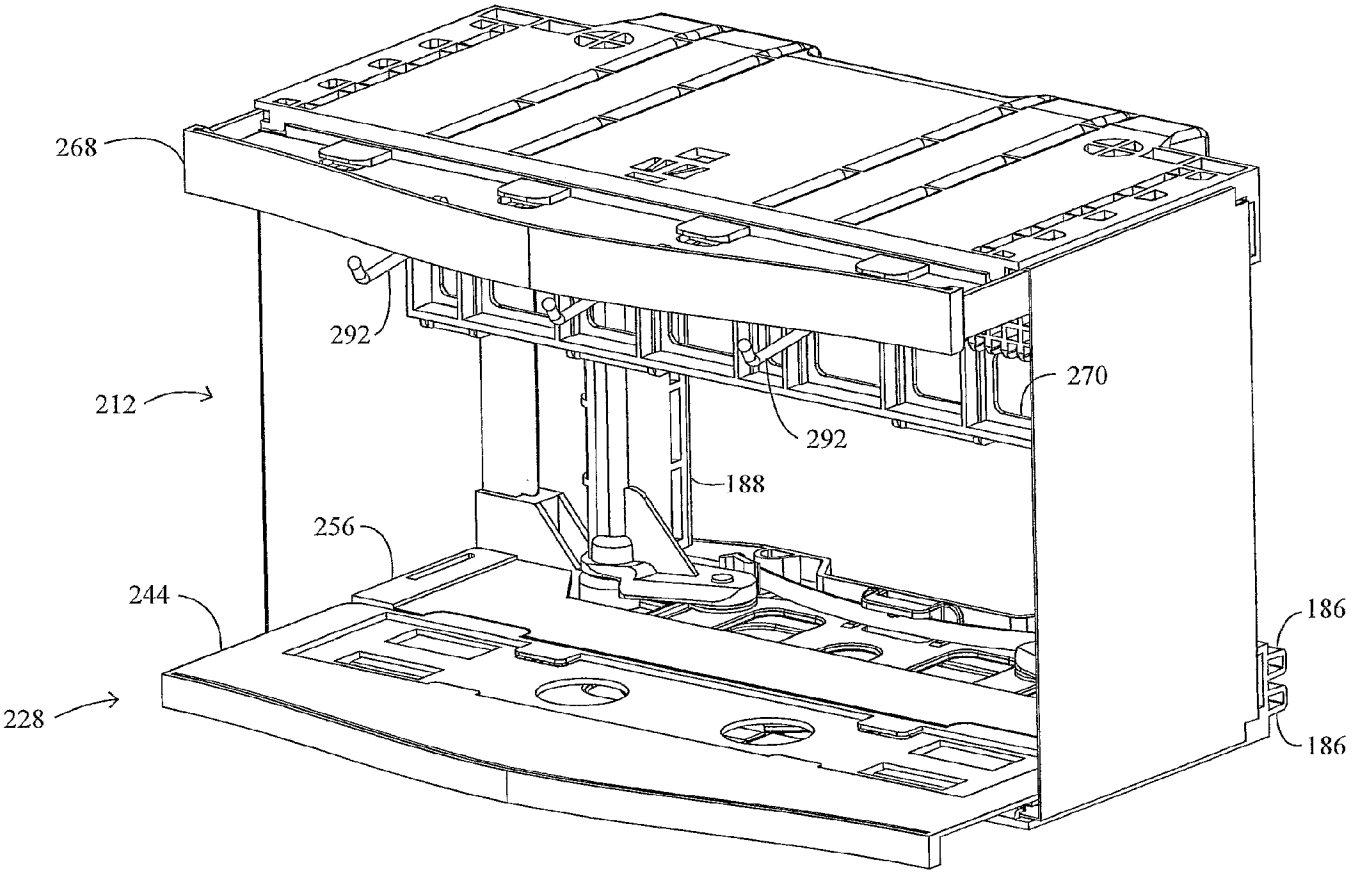
FIG. 39 is a front perspective view of a portion of the module of the present invention shown in FIG. 29.
Figure 40:
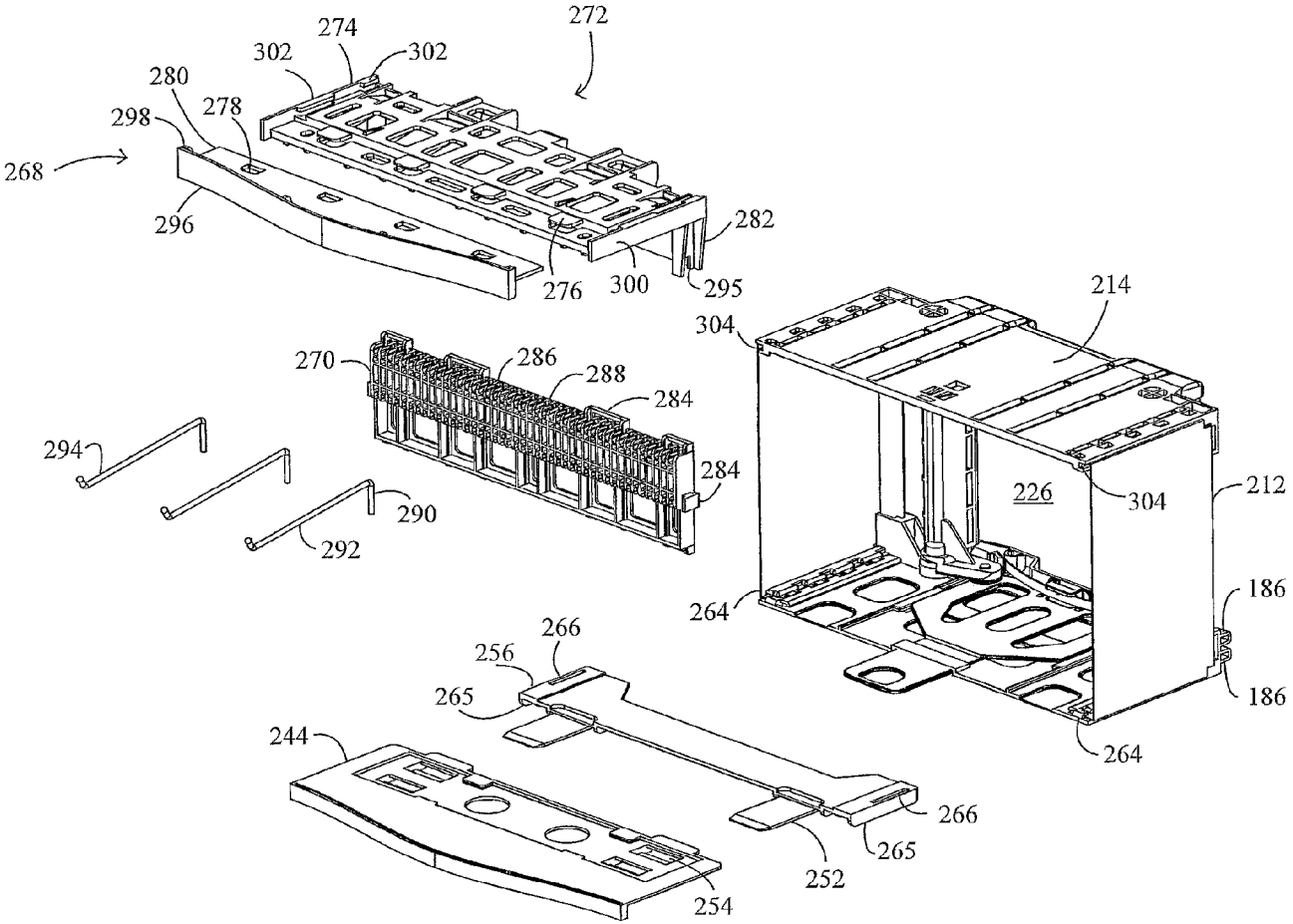
FIG. 40 is a partially exploded, front perspective view of the portion of the module of the present invention shown in FIG. 39.
Figure 41:
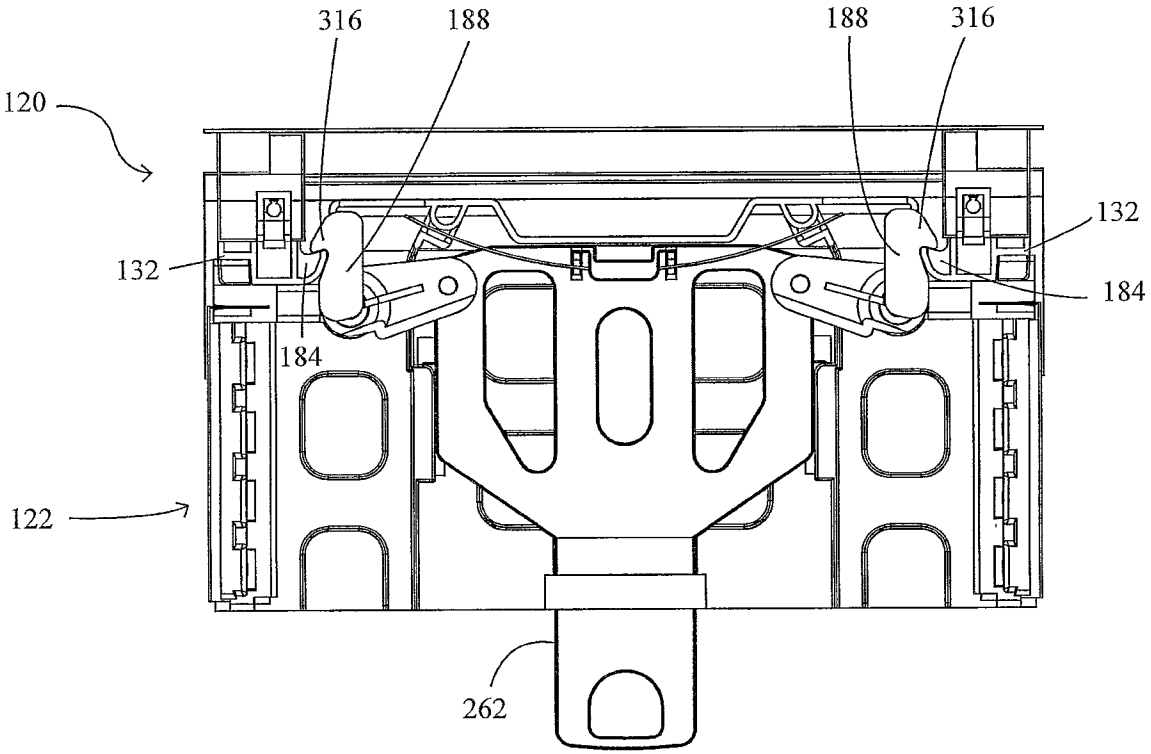
FIG. 41 is a top plan view of a portion of the module of the present invention shown in FIG. 29.
Figure 42:
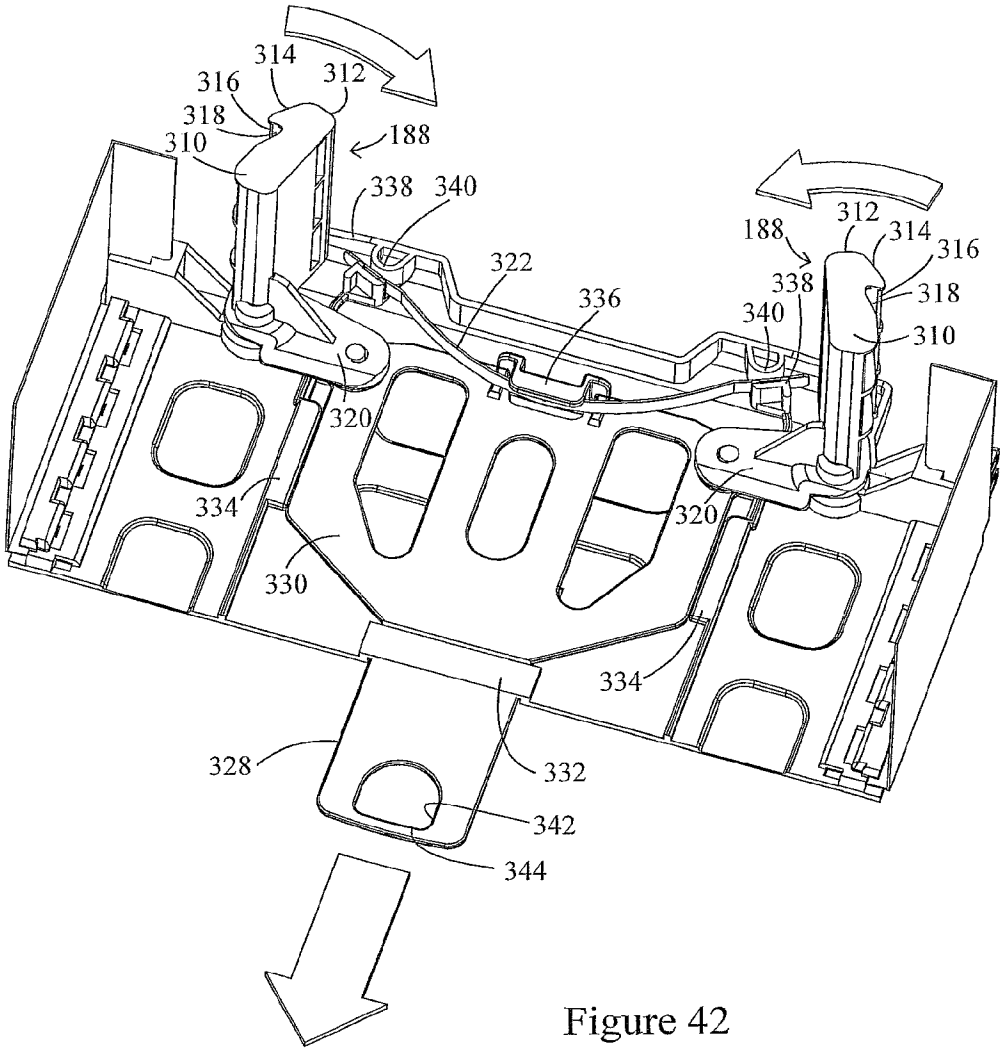
FIG. 42 is a top perspective view of the portion of the module of the present invention shown in FIG. 41, and illustrating the operation of the module.

As can be seen in FIGS. 31, 39 and 40, the UPC panel 228 preferably is formed from two interlocking pieces, a front piece 244 having a clear plastic or transparent vertical front wall 246 having turned-in lateral edges 248 which define channels for holding a graphic display behind the transparent front cover or wall 246, and a rear piece 250 substantially co-planarly joined to the front piece 244 via interlocking tongues 252 on the rear piece 250 being received by aligned slots 254 formed in the front piece 244.

The rear piece 250 of the UPC panel 228 includes two upstanding resilient tabs 260 situated on the top surface of the panel, which tabs are received by, and can move reciprocatingly within, corresponding channels (not shown) formed on the underside of the tray 230. The tabs 260 and tray channels allow the UPC panel 228 to be extended from the front opening 224 of the module 122 only a predetermined distance, in order to enable the user of the display system to more easily change the graphics of the UPC panel front cover 246, but also to more easily allow the user to gain access to a release bar 262 situated underneath the UPC panel 228 when it is desired to remove the module 122 from the frame assembly 120 of the display system, as will be explained in greater detail.

The bottom edges of the side walls 236 of the tray 230 ride in channels 264 defined by the lateral side walls 218 of the module frame 212 and the lateral edge pieces 222 of the bottom wall 216 of the module frame. This structure allows the tray 230 to be extended from, and retracted into, the interior area of the module frame 212, but it should be noted that the UPC panel 228 can be extended and retracted independently of the tray 230.

If the tray 230 is not used in the module 122, which is the situation shown in FIG. 39, when hooks are used on which products are hung rather than being placed on the tray, a UPC slide cover 256 is used in its place. The UPC slide cover 256 takes the place of the rear piece 250 of the UPC panel 228. The slide cover 256 also has tongues 252 which are received by the slots 254 of the front piece 244 to interlock the slide cover 256 with the front piece 244 of the UPC panel 228. The slide cover 256 rides on its lateral edges 265 in the same channels 264 in which the tray 230 would have ridden, and includes downwardly extending projections on its bottom side formed by elongated cutouts 266 through its thickness to maintain the UPC panel 228 coupled to the module frame 212 as the panel is moved in and out of the module front opening 224.

Also, as can be seen in FIGS. 29, 30 and 40, the module 122 may further include a header assembly. The header assembly is formed of a front header piece 268, a header hook bar 270 and a header hook bar slide 272. The header piece 268 is co-planarly joined to a main body portion 274 of the header hook bar slide 272 by spaced apart tabs 276 formed on the hook bar slide 272 which lockingly engage with cooperating openings 278 formed in the rear plate 280 of the header piece 268. A bottom piece 282 of the hook bar slide 272, which extends perpendicularly from the rear of the main body portion 274, is similarly joined co-planarly to the hook bar 270 with interlocking tabs 284 extending upwardly from the top edge and/or sides of the hook bar 270 and slots 285 formed in the lower edge of the bottom piece 282 of the hook bar slide 272.

The hook bar 270 has a plurality of bores 286 formed therein and situated between adjacent divider walls 288 of a plurality of divider walls. The bores 286 are provided to receive the bent ends 290 of product holding hooks 292. Adjacent divider walls 288 prevent lateral movement of a product holding hook 292 when it is received by a bore 286 situated between the divider walls. The product hooks 292 have bulbous free ends 294 situated opposite the bent ends 290 on which products may be hung. The hooks 292 are used to display merchandise in the module 122 in lieu of the tray 230.

The header piece 268 preferably includes a transparent vertical front wall 296 joined to the front edge of the rear plate 280. Like the UPC panel 228, the front wall 296 has turned-in side edges 298 which define a channel for receiving graphics or printed material behind the front wall which can be seen through the transparent front wall 296.

The hook bar slide 272 includes opposite lateral side walls 300 on which are situated slide tabs 302 turned inwardly of the hook bar slide to face each other. The slide tabs 302 are received in cooperating slots 304 formed in the opposite lateral edges of the top wall 214 of the module frame 212 so that the header assembly, including the front header piece 268, the hook slide bar 272, the hook bar 270 and hooks 292 mounted thereon, is suspended from the top wall 214 of the module frame 212 within the interior space or area thereof, and is extendible from the front opening 224 and retractable within the module interior space, so that a user may more easily add products to the exposed hooks 292.

A coiled spring 306 affixed to the top wall 214 has its free end 308 attached to the header assembly so that the header assembly may more easily retract into the module frame 212 from an extended position under the bias of the spring 306.

The mechanisms for locking the module to the frame assembly 120 of the merchandise display system, and for releasing the locking mechanism to remove the module 122 therefrom, will now be explained, and reference should be had to FIGS. 32-42 of the drawings. The locking mechanism in this embodiment to be described is very similar in operation to the mechanism described previously and shown in FIGS. 1-17 of the drawings. However, it should be noted that in the embodiment shown in FIGS. 32-42, the arcuate recesses 133 of the indexing members 132 are formed on the outside, non-facing lateral sides 180 of the indexing members 132, and the locking wings 188 engage the indexing members 132 of a pair of indexing members on their inner, facing lateral sides 178.

More specifically, the module 122 includes a pair of locking wings 188 pivotally mounted on the bottom wall 216 of the module frame 212 and extending upwardly therefrom and outwardly from the open rear side 226 of the module. The locking wings 188 are spaced apart from each other a predetermined distance so that they may engage the inner lateral sides 178 of corresponding indexing members 132 of a pair of indexing members.

Each locking wing 188 of the pair extends vertically from the bottom wall 216 of the module frame 212, and has a main portion 310 that is structured to include a free end 312 having a leading, laterally outwardly sloping camming surface 314 facing away from one another, the camming surfaces 314 leading toward a more inwardly located hooked edge 316 and a recess or pocket 318 adjacent the hooked edge 316.

Each locking wing 188 also includes an extended portion 320 situated at an angle to the main portion 310 thereof at the bottom of the locking wing 188 where it is pivotally joined to the bottom wall 216 of the module frame 212. The extended portion 320 of each locking wing 188 is pivotally joined to a release bar 262 which is biased in a direction into the module by a leaf spring 322, so that the release bar 262, in turn, biases the locking wings 188 to turn in opposite outward directions so that they will engage the inner facing lateral sides 178 of the indexing members 132.

Figure 36:
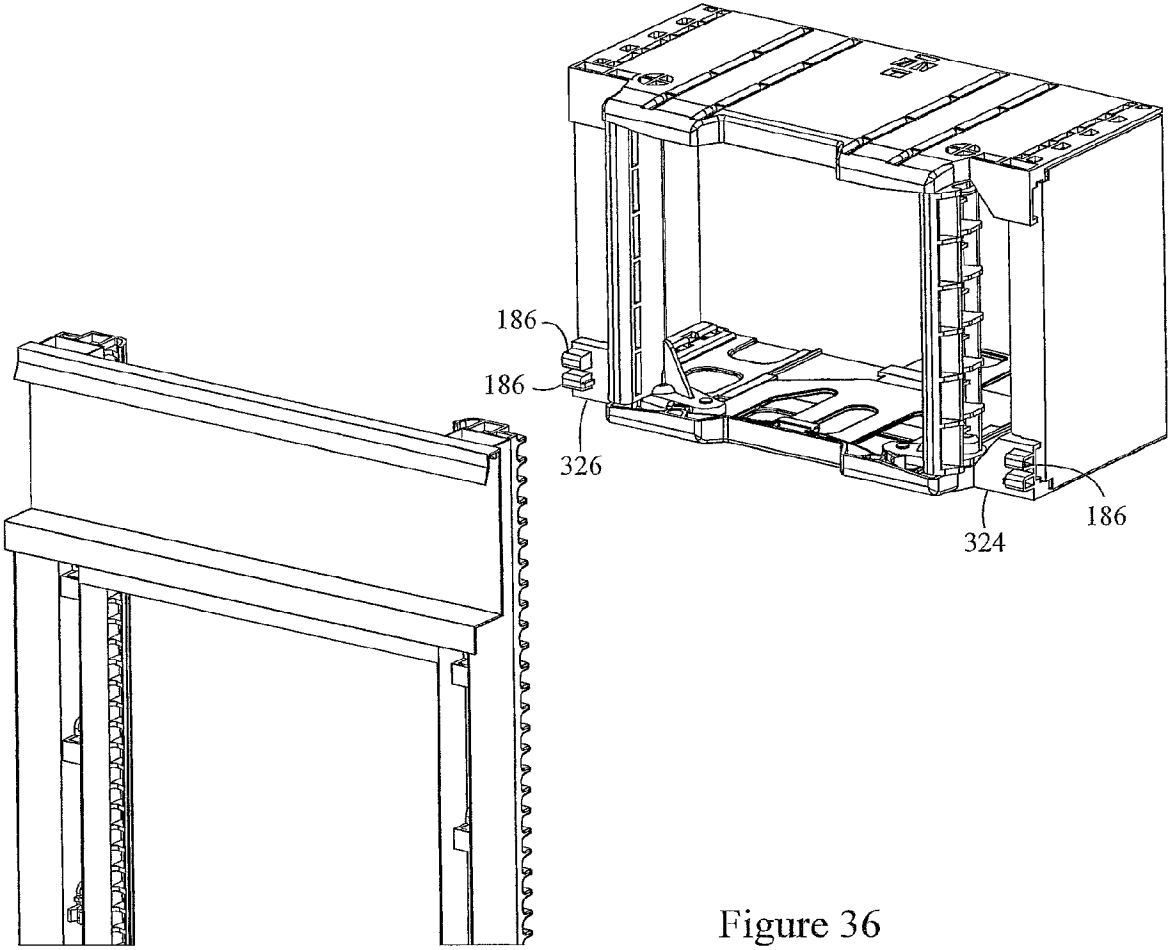
FIG. 36 is a partially exploded, front perspective view of portions of the merchandise display system of the present invention shown in FIGS. 18 and 29.
Figure 37:
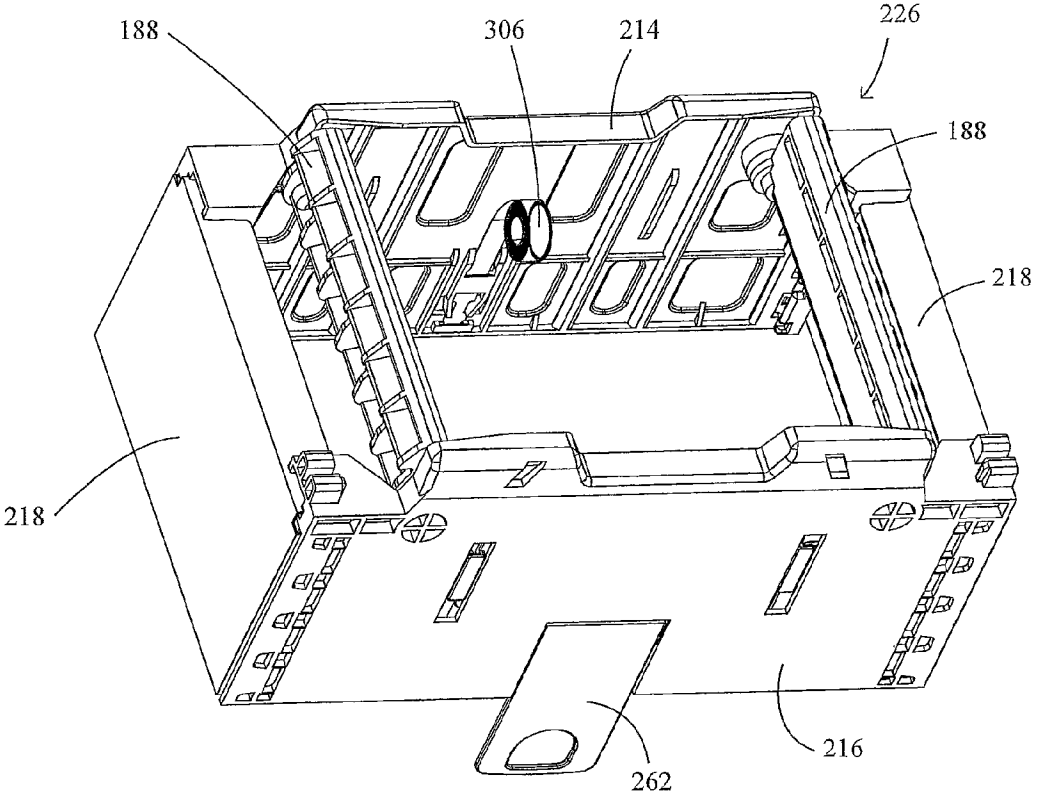
FIG. 37 is a rear perspective view of a portion of the module of the present invention shown in FIG. 29.
Figure 38:
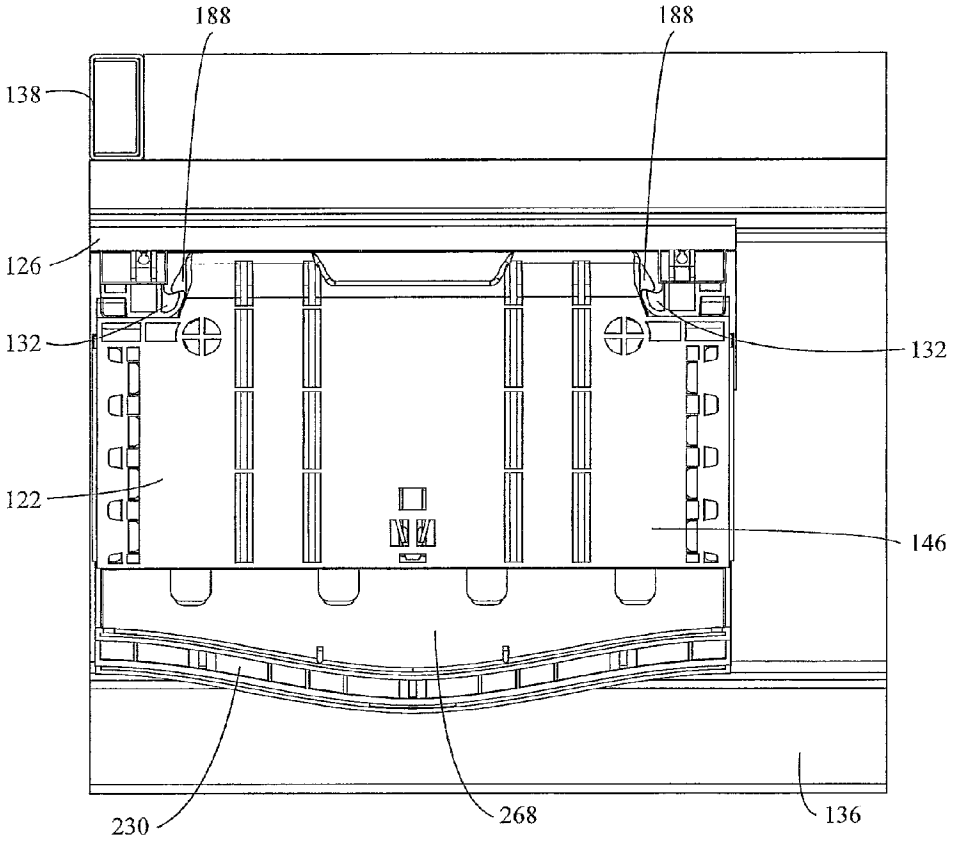
FIG. 38 is a top view of a portion of the module of the present invention shown in FIG. 29 mounted on the portion of the merchandise display system of the present invention shown in FIG. 18.

As shown in FIGS. 29, 36 and 37, each module 122 includes a first set of adjacent locator protrusions 186 (also referred to herein as pins) situated on a first vertical rear extension segment 324 of the bottom wall 216 near one lateral side wall 218 of the module frame 212, and a second set of adjacent locator protrusions 186 situated on a second vertical rear extension segment 326 of the bottom wall 216 near the other lateral side wall of the module frame. The locator protrusions 186 of the first and second sets have a shape which complements that of the arcuate recesses 133 of the indexing members 132 so that they may be closely received by two corresponding adjacent arcuate recesses 133 on the non-facing lateral sides 180 of each indexing member 132 of the pair of indexing members when the module 122 is mounted on the frame assembly 120 of the display system.

More specifically, when a module 122 is being mounted on the frame assembly 120, the locator protrusions 186 of the module are aligned with corresponding arcuate recesses 133 formed in the indexing members 132, and the module is pushed toward the front face of the frame assembly 120, with the locator protrusions 186 registering with certain arcuate recesses 133 of the indexing members 132. The locking rails 184 extending from the facing lateral sides 178 of the indexing members contact the camming surfaces 314 of the locking wings 188, spreading the locking wings apart from one another against the bias of the spring 322. As the module 122 is continued to be pushed into the frame assembly 120, the indexing members 132 move past the camming surfaces 314 of the locking wings 188 until the hooked edges 316 of the locking wings engage the locking rails 184 of the indexing members 132, the locking rails 184 further being received by the pockets or recesses 318 of the locking wings 188. The locking wings 188, which are biased in a direction away from each other, latch onto the indexing members 132 between the pair of indexing members. With the locator protrusions 186 registered with selected arcuate recesses 133 of the indexing members 132 and the locking wings 188 closely engaging the locking rails 184 of the indexing members 132, the product module 122 is now securely mounted to the frame assembly 120 of the merchandise display system.

Each module 122 includes a release mechanism to allow the store owner to remove a module from the frame assembly 120 of the merchandise display system. As can be seen from FIGS. 35 and 42 of the drawings, the release mechanism includes an elongated release bar 262 which is mounted above the bottom wall 216 of the module frame 212 and below the UPC panel 228. The release bar 262 includes a narrowed front section 328, and a widened rear section 330 joined to the narrowed front section 328. The bottom wall 216 of the module frame 212 defines a tunnel 332 through which the narrowed front section 328 of the release bar 262 may move reciprocatingly and by which the release bar is held captive. The widened rear section 330 of the release bar 262 has its opposite lateral edges situated under corresponding ledges 334 raised from the top surface of the bottom wall 216 and extending over the opposite lateral edges of the widened rear section 330 of the release bar in a direction facing each other. Thus, the widened rear section 330 of the release bar 262 is also held captive under these ledges 334, but is allowed to move reciprocatingly thereunder so that the release bar 262 may move on the bottom wall 216 of the module frame 212 reciprocatingly in a front-to-back direction.

The opposite rear corners of the widened rear section 330 of the release bar 262 are pivotally joined to the angled extended portions 320 of the locking wings 188. Thus, when a user of the merchandise display system pulls on the release bar 262 in an outward direction, the locking wings 188, because of their attachment to the release bar 262, rotate towards one another in the direction of the arrows shown adjacent to the locking wings in FIG. 42.

A leaf spring 322, as mentioned previously, is used to bias the release bar 262 in a direction into the module frame 212. An upstanding clamp 336, situated on the top surface of the release bar 262 at the middle rear portion of the widened rear section 330, securely holds the middle of the leaf spring 322. The opposite ends of the leaf spring 322 are loosely held in gaps defined by two vertical projections 338, 340 extending from the top surface of the bottom wall 216 of the module frame 212 at the leaf spring ends to hold the ends of the leaf spring 322 in place but allow the ends to move within the gaps defined thereby when the release bar 262 is pulled outwardly by the user of the display system.

The narrowed front section 328 of the release bar 262 includes a grasp opening 342 formed therein which defines a tab 344 between the opening 342 and the front edge of the release bar 262. The opening 342 and tab 344 of the release bar 262 may be easily grasped by the store owner to remove a module 122 from the frame assembly 120.

To remove a selected module 122 from the frame assembly 120 of the merchandise display system, the store owner pulls outwardly, away from the front opening 224 of the module, on the narrowed front end section 328 of the release bar 262, which is situated under the UPC panel 228. When the store owner pulls on the release bar 262, the extended portion 320 of the locking wings 188 pivot to force the locking wings to open and disengage from a respective indexing member 132 against the bias of the leaf spring 322. The store owner may remove a module 122 from the frame assembly 120 perpendicularly and outwardly from the front face of the frame assembly. The store owner pulls on the module 122 until the locator protrusions 186 disengage from the arcuate recesses 133 formed in the adjacent indexing members 132 of the respective pair of indexing members on which the module is mounted. The module release mechanism, including the elongated release bar 262, is contained substantially entirely within the module 122 and under the UPC panel 228, and does not interfere with the closely spaced, adjacent modules mounted on the frame assembly 120.

Figure 43:
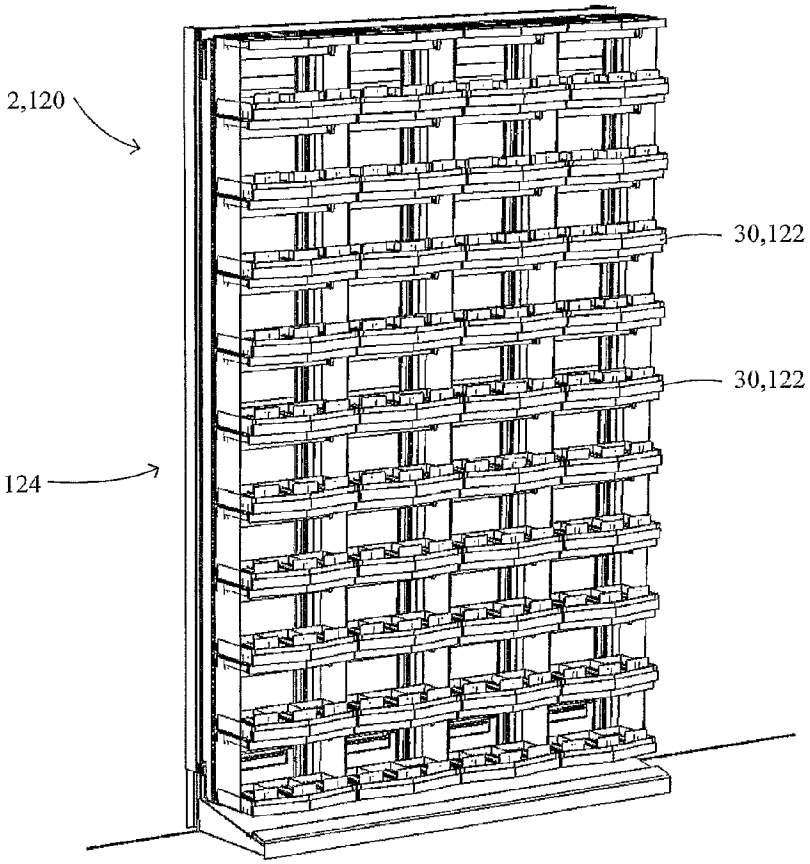
FIG. 43 is a front perspective view of the merchandise display system of the present invention shown mounted on a supporting wall in an establishment.

As can be seen from FIG. 43 of the drawings, a plurality of modules 30, 122 may be mounted on the frame 2, 120 in rows and columns and closely situated next to one another. Each module 30, 122 may be removed directly from the front of the frame 2, 120 without the need for tilting the module 30, 122 or disturbing adjacent modules. Thus, the display system of the present invention can provide a higher density of items of merchandise than conventional merchandise display systems.

Although the modules 30, 122 having one or more trays 42, 230 are described as being mountable on the frame 2, 120 of the modular merchandise display system of the present invention, it should be realized that the trays 42, 230 themselves may include the structure described previously for mounting the modules 30, 122 to the frame 2, 120, including the locking wings 48, 188, the locator protrusions (pins) 46, 186 and the components of the release mechanism, to releasably mount the trays 42, 230 directly to the frame 2, 120 of the display system, without the need to use the modules 30, 122 described herein, and such structure is envisioned to be within the scope of the present invention.

Figure 44:
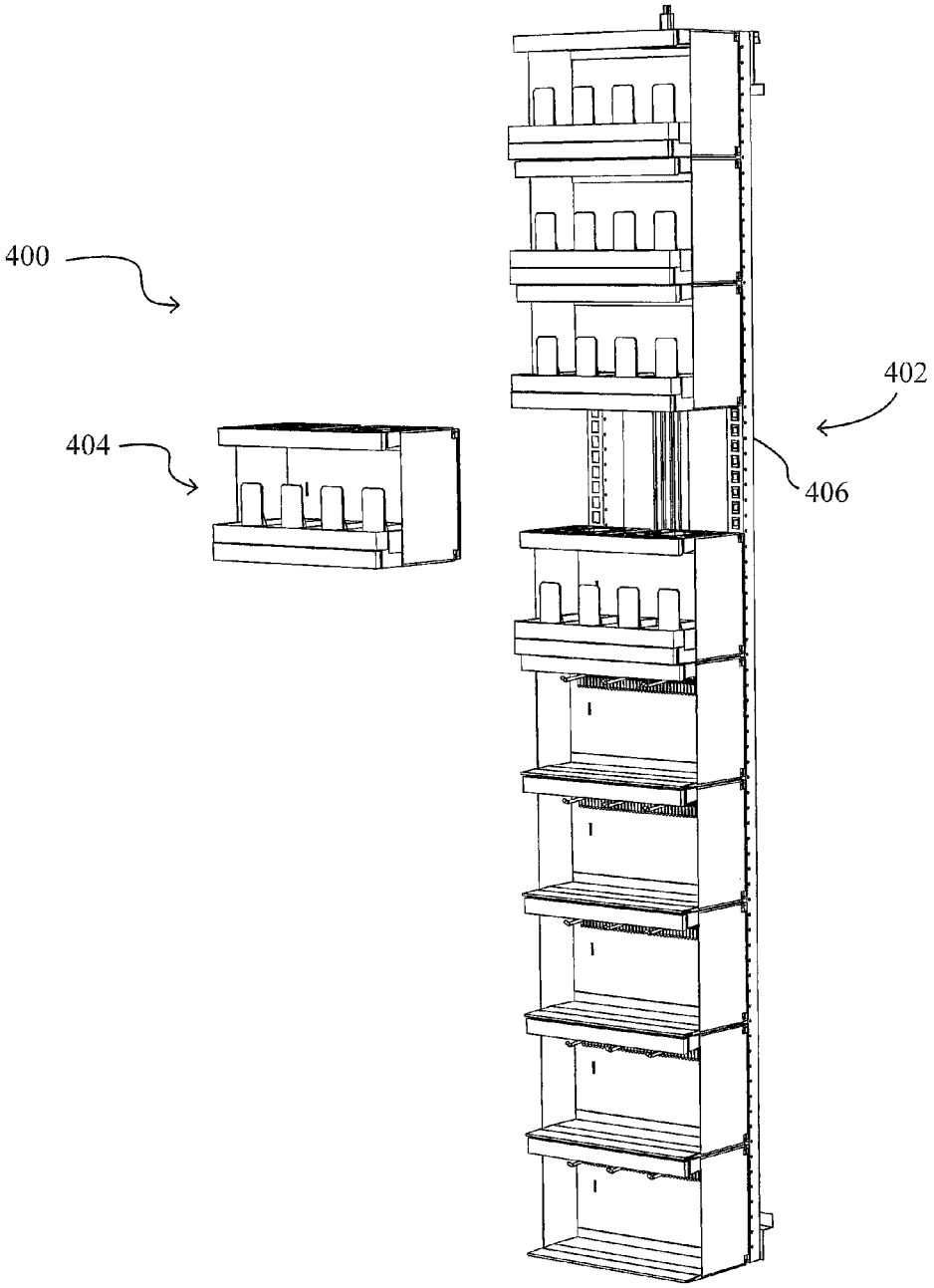
FIG. 44 is a front perspective view of yet another embodiment of the modular merchandise display system of the present invention, showing a module thereof disengaged from the supporting frame.
Figure 45:
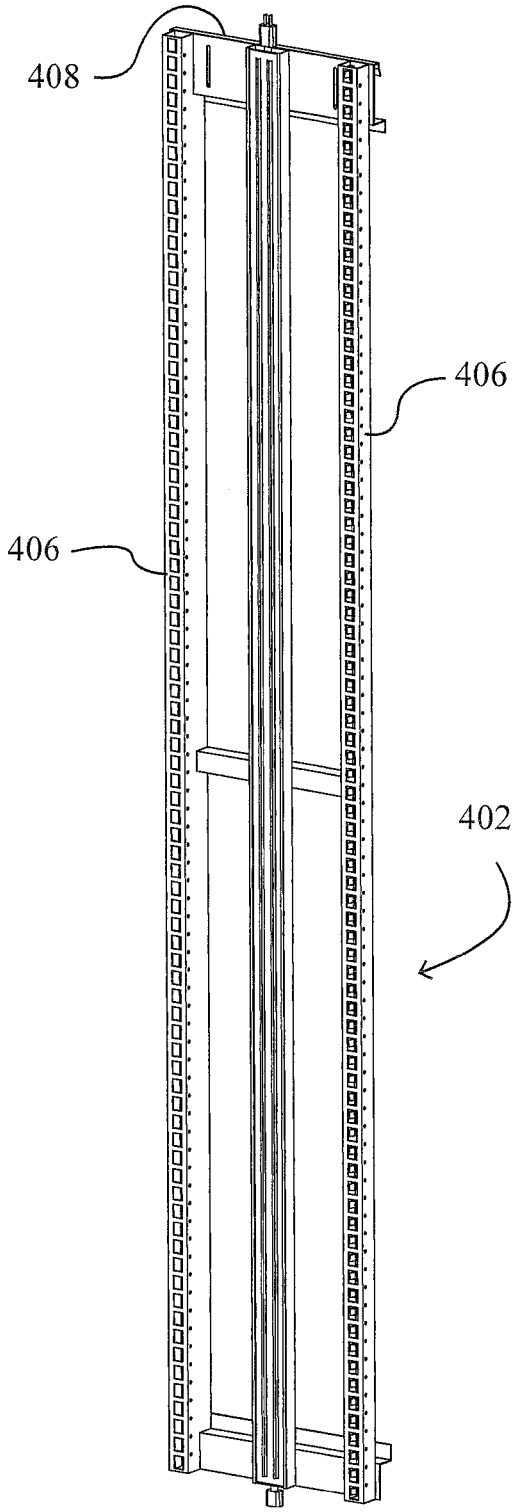
FIG. 45 is a front perspective view of the supporting frame of the modular merchandise display system of the present invention shown in FIG. 44.

FIGS. 44-57 illustrate yet another modular merchandise display system 400 constructed in accordance with the present invention. As with previous embodiments, this further display system 400 includes a frame 402 and one or more generally rectangular display modules 404 that are removably mountable on the frame 402 in a direction perpendicular to the frame, as shown in FIG. 44. No tilting of the display module 404 is necessary to add or remove the module to or from the frame, and adjacent display modules need not be removed.

Like the other embodiments of the display system described previously and shown in FIGS. 1-43, the frame 402 of the display system 400 shown in FIGS. 44-57 has at least two vertically disposed indexing members 406 affixed to the horizontal cross braces 408. Furthermore, as with the other embodiments, the horizontal cross braces 408 permit the frame 402 of the present invention to be affixed to a pre-existing frame 402. The hook 410 running along the axial length of the top horizontal cross brace 408 can engage similar or complementary structures of the pre-existing display system 400.

Adjacent indexing members 406 are parallelly disposed and spaced apart from each other a predetermined distance so that one or more display modules 404 may be fitted on the pair of indexing members 406 and extend between them in a vertically stacked arrangement, as shown in FIG. 44. As can be clearly seen in FIGS. 46 and 49, each indexing member 406 of a pair of indexing members includes a front wall 412, an inside lateral wall 414 affixed to and extending rearwardly perpendicularly from an inner edge of the front wall 412, and an outside lateral wall 418 affixed to and extending rearwardly perpendicularly from an outer edge of the front wall 412 and spaced apart from the inside lateral wall 414. Thus, for a pair of adjacent indexing members 406, the inside lateral walls 414 face each other, whereas the outside walls 418 face in opposite directions of each other.

Each indexing member 406 has formed through the thickness of the front wall 412 thereof a plurality of rectangular openings 422 spaced apart along the vertical length thereof.

As will be seen, these openings 422 are provided for receiving locator protrusions 424 and locking hooks 426 disposed on the display modules 404 for removably securing the display modules to pairs of adjacent indexing members 406.

Figure 46:
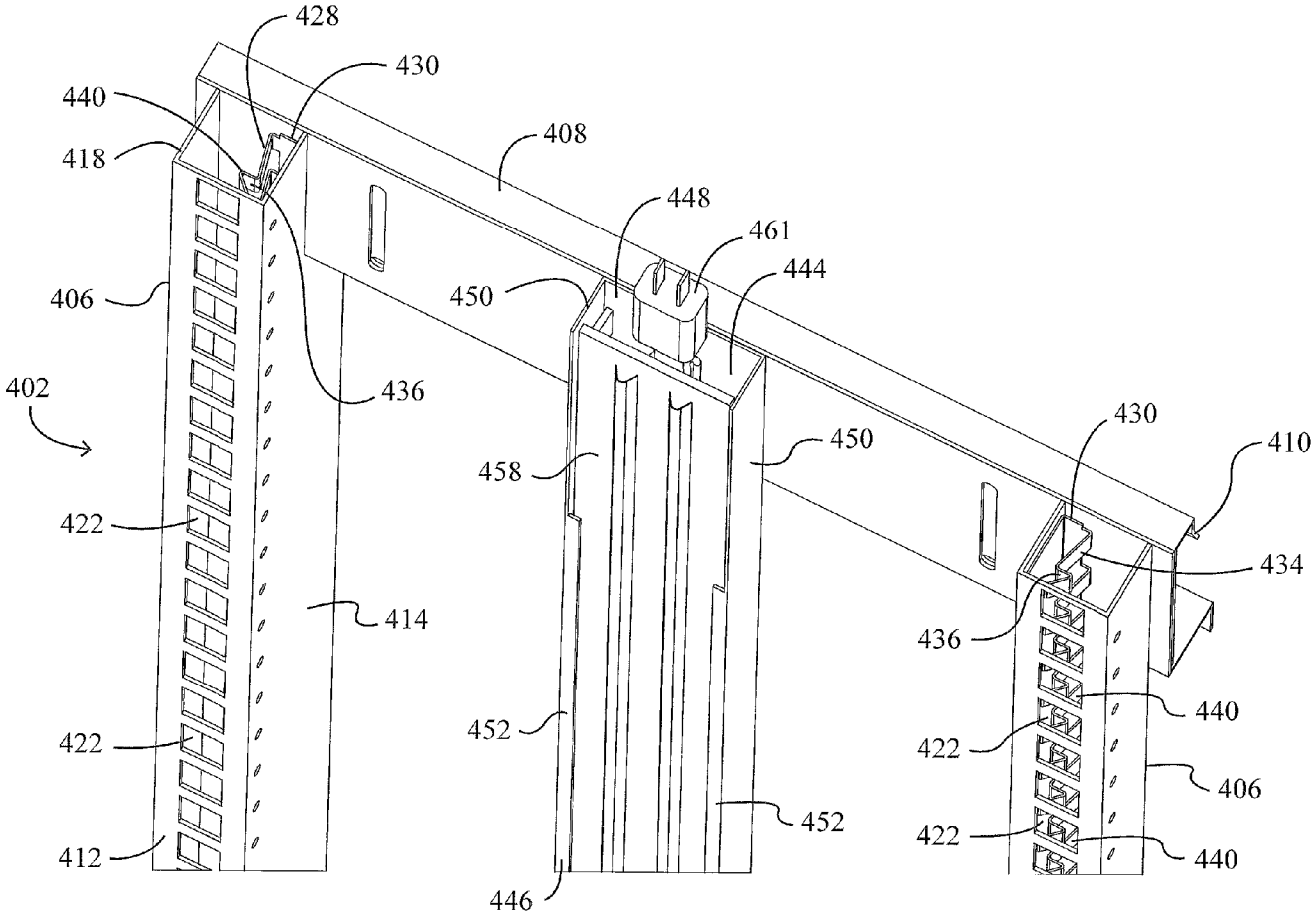
FIG. 46 is a front perspective view of a portion of the supporting frame of the modular merchandise display system of the present invention shown in FIGS. 44 and 45.
Figure 49:
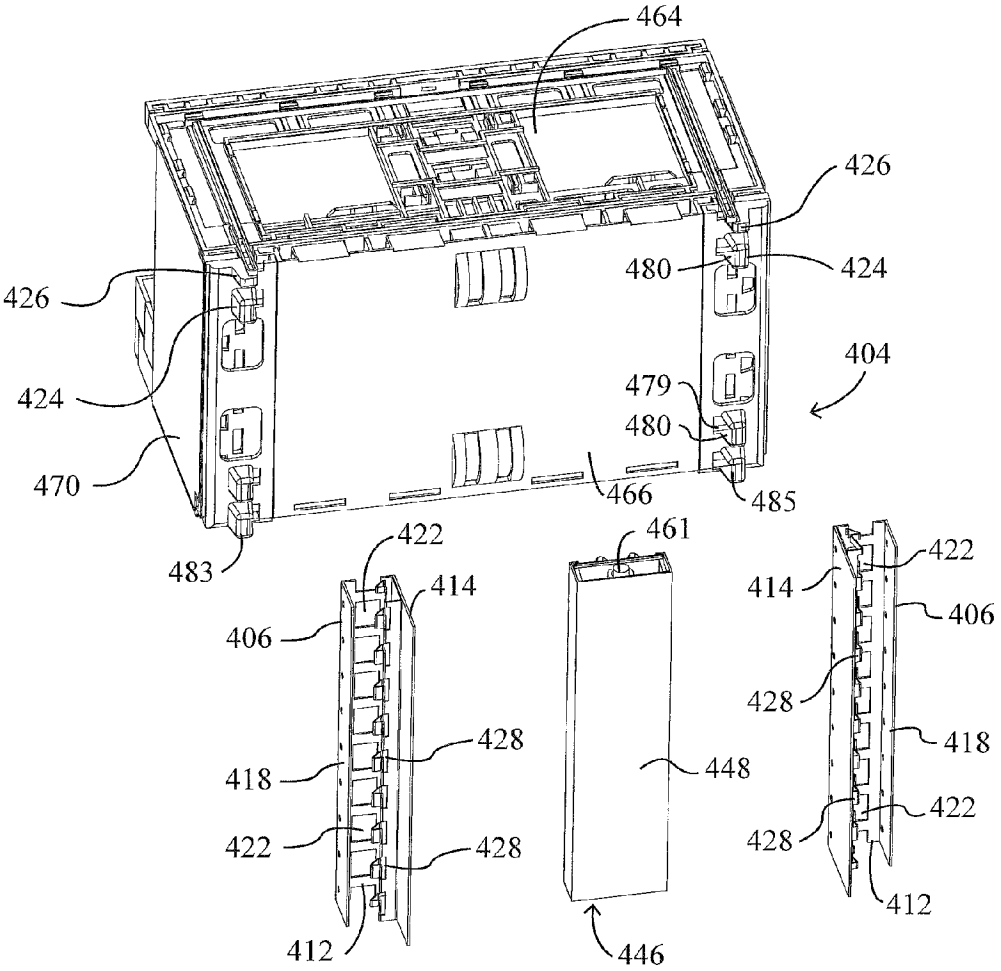
FIG. 49 is a partially exploded, perspective view of the embodiment of the modular merchandise display system of the present invention shown in FIG. 44, and illustrating how the module thereof may be mounted on the supporting frame.

As further can be seen from FIGS. 46 and 49 of the drawings, each indexing member 406 includes a plurality of resilient locking clips 428. A plurality of locking clips 428 may be integrally formed from one or more sections or blanks of sheet metal, plastic 429 or the like, which sections are affixed to the inside surface of one of the lateral walls of the indexing members.

The locking clips 428 are formed to be spaced apart from one another and situated along the vertical length of the indexing members 406 within the space defined by the inside and outside lateral walls 414, 418 and the front wall 412. The locking clips 428 are also particularly shaped, as will be explained, so that they extend outwardly from the lateral wall, either the inside wall or the outside wall, 414, 418 on which they are mounted and at least partially project into the space directly behind the openings 422 formed in the front wall 412 of the indexing members 406. In this way, the locking clips 428 may resiliently engage the locator protrusions 424 and locking hooks 426 of a display module 404 mounted on the indexing members 406 of the display frame 402.

Figure 57:
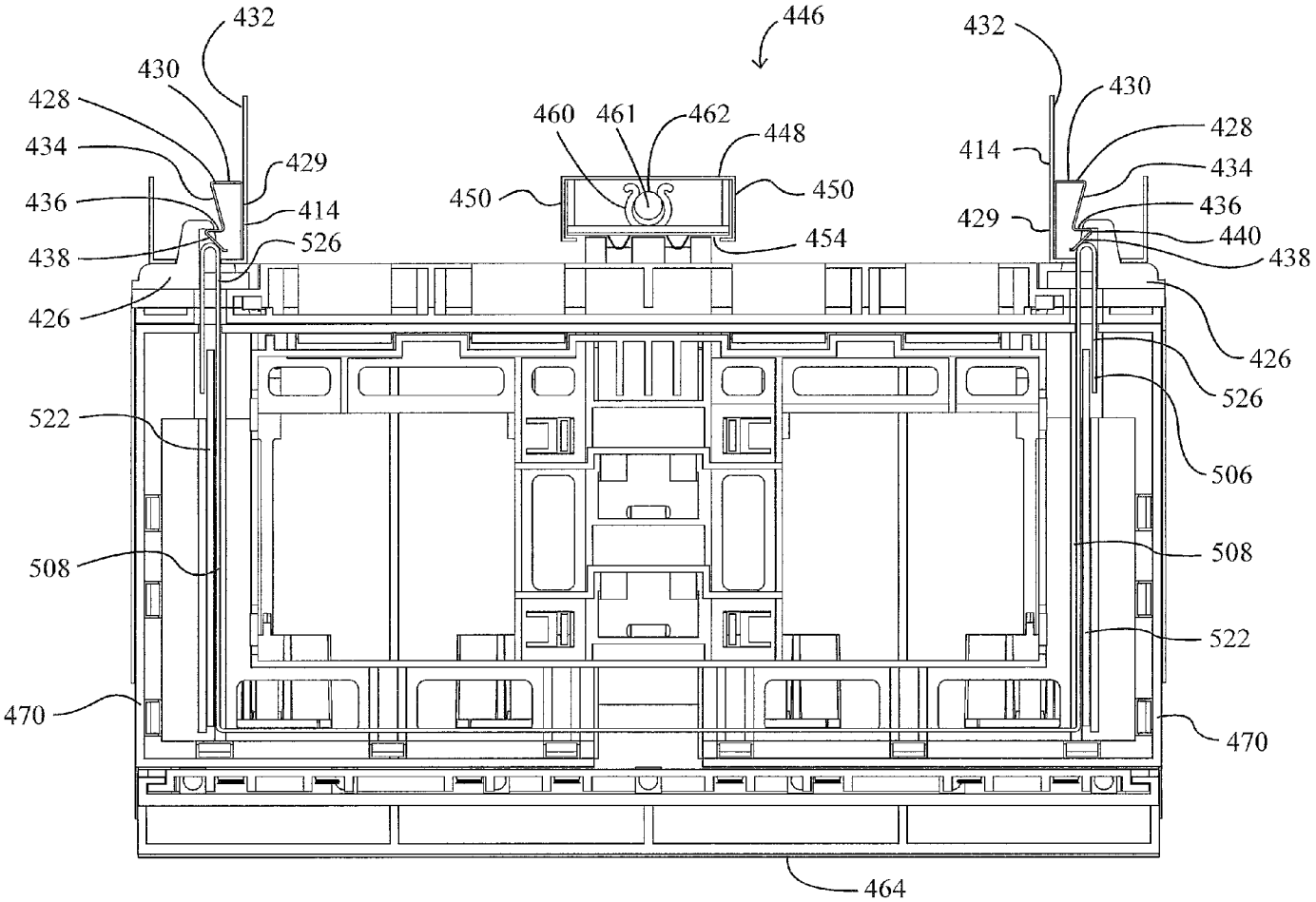
FIG. 57 is a top plan view of the modular merchandise display system of the present invention shown in FIG. 44, and illustrating the module thereof secured to the indexing members of the supporting frame.

As can be seen in FIGS. 46 and 57, each resilient locking clip 428 has a serpentine configuration and extends into the space defined by the inside and outside lateral walls 414, 418 and front wall 412 of each indexing member 406, as mentioned previously. More specifically, each locking clip 428 includes a first segment 430 extending perpendicularly from the blank or section 429 from which one or more locking clips are formed, which section 429 resides against the inner surface of 432 one of the inside and outside lateral walls 414, 418 of the indexing member. In the exemplary embodiment shown in FIG. 57, the blank or section 429 resides against the inner surface 432 of the inside lateral wall 414. The first segment 430 is bent toward the inside lateral wall 414 at an acute inside angle to define the second segment 434 of the locking clip 428. The angled second segment 434 is then bent toward the outside lateral wall 418 to define the third or "catch" segment 436 of the locking clip 428, and then the third, catch segment 436 is bent again in an opposite direction toward the inside lateral wall 414 at an acute inside angle to define a leading ramp-like, free end, fourth segment 438 situated at least partially behind and in alignment with a respective opening 422 formed in the front wall 412 of a corresponding indexing member 406. The third, catch segment 436 and the angled, ramp-like free end fourth segment 438 define between them at their juncture an abrupt edge, also referred to herein as an exposed barb 440, which, with the catch segment 436, is used to help lock the display module 404 to the indexing members 406 of the frame 402. With such structure, the locking clips 428 act as resilient leaf springs which may be biased inwardly, toward the inside lateral walls 414 of the indexing members 406, against the force of the locator protrusions 424 and locking hooks 426 of the display modules 404, as will be described in greater detail.

In the present embodiment shown in FIGS. 44-57 of the drawings, the display frame 402 of the modular merchandise display system 400 may include structure that defines a channel 444 for routing a power cord behind the display modules 404, if it is desired that the display modules 404 or portions of the display frame be illuminated. As may be seen from FIGS. 46, 49, 50 and 57 of the drawings, an intermediate, generally U-shaped (in transverse cross-section) bracket 446 is situated between a pair of adjacent indexing members 406 and affixed vertically to the horizontal cross braces 408. The bracket 446 includes a back wall 448 perpendicularly joined to opposite lateral walls 450, the lateral walls being slightly bent perpendicularly toward each other in front to define front tabs 452 and between them an open front face 454 in communication with an interior channel 444 running the axial length of the bracket 446. The channel 444 is provided for receiving axially therein an elongated, flexible substrate or board 458.

Figure 47:
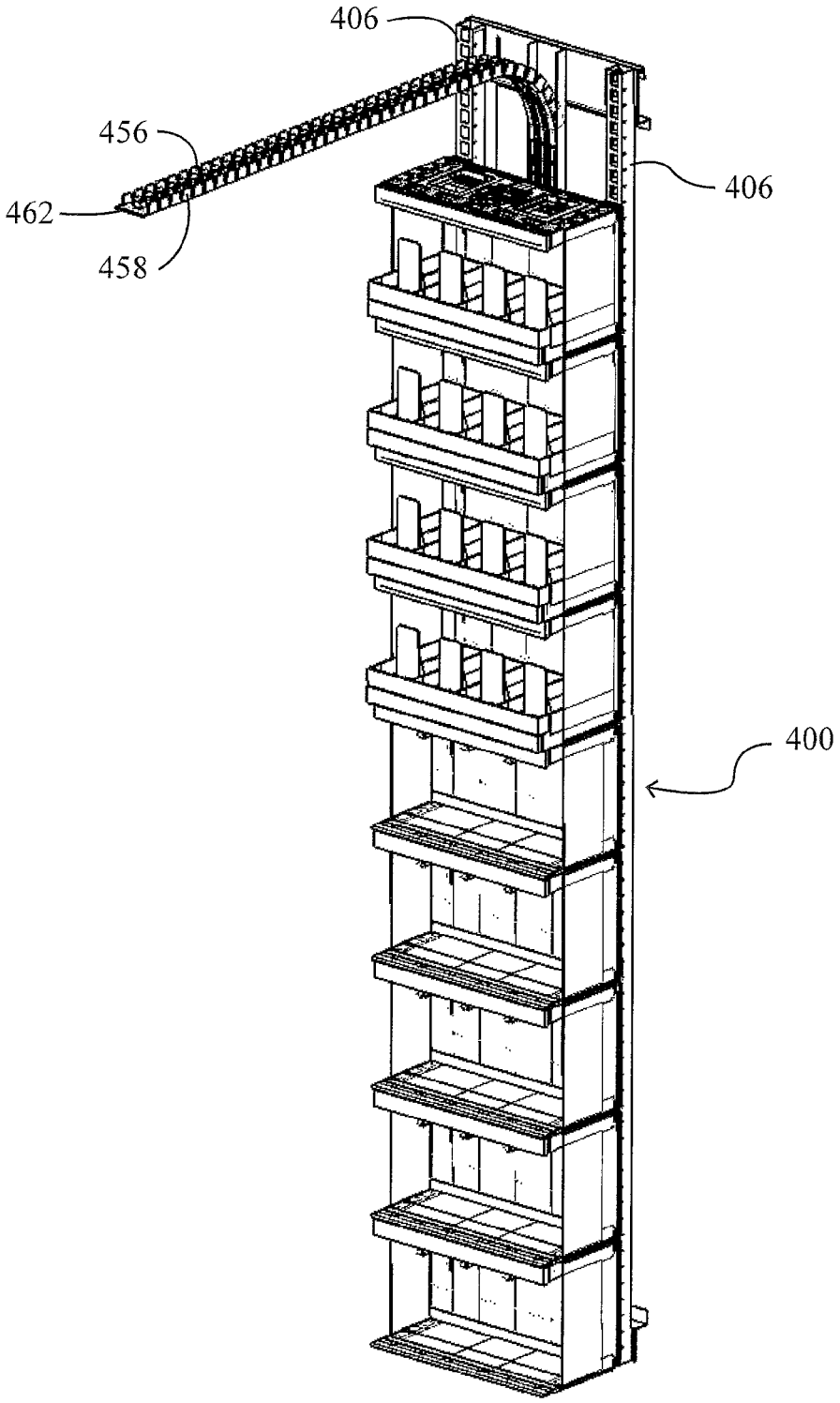
FIG. 47 is a front perspective view of the embodiment of the modular merchandise display system of the present invention shown in FIG. 44, and illustrating a flexible substrate or board for holding a power cord for lighting the display system.

Referring to FIGS. 46, 47 and 57, spaced apart along the axial length of the substrate 458 and periodically affixed to the substrate 458 is a plurality of resilient, arcuate wire guides 460 that face each other to define a gap 462 therebetween through which an electrical power cord 461 may be inserted and held in place, and routed along the length of the channel 444. As mentioned previously, this electrical power cord 461 is provided if it is desired to illuminate portions of the display system 400, such as the interior of the modules 404. The power cord 461 is neatly dressed on the frame and hidden from view within the channel 444 and behind the display modules 404 mounted on the frame 402.

Figure 50:
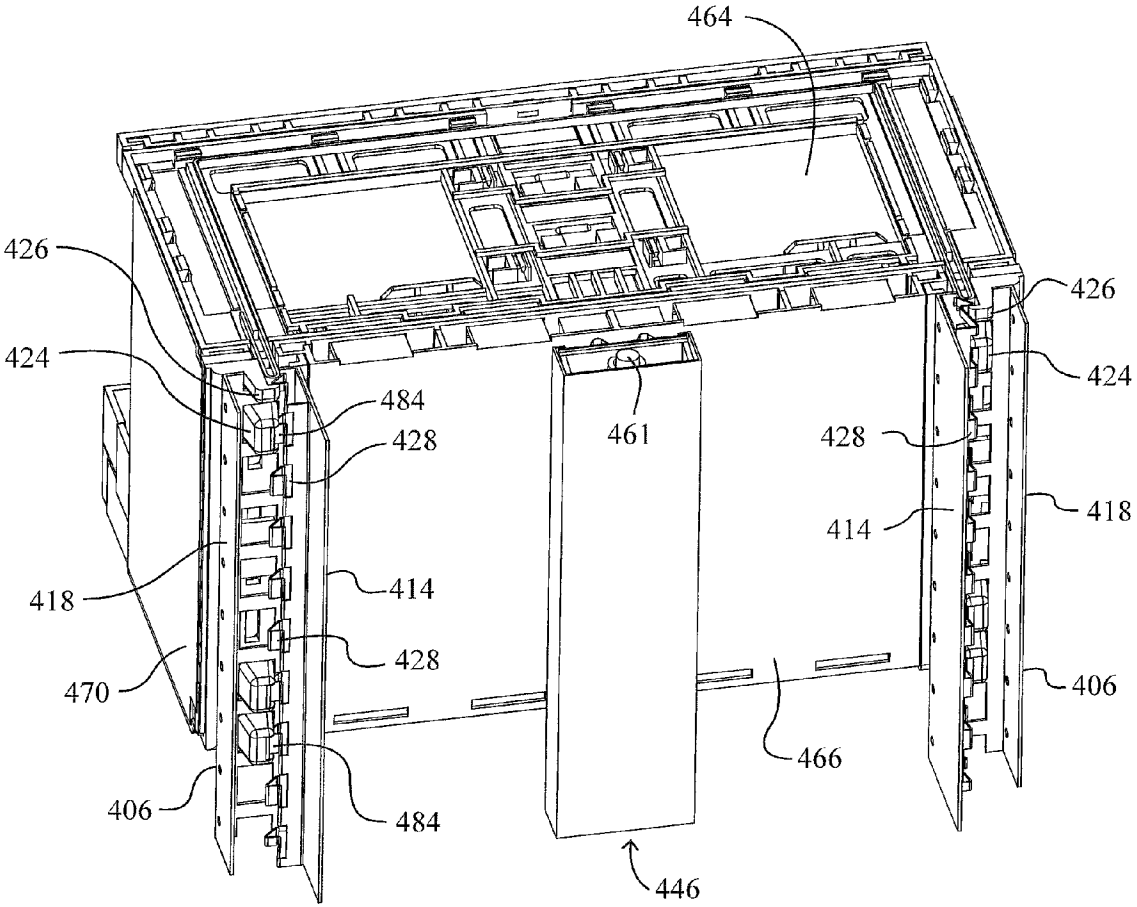
FIG. 50 is a rear perspective view of the embodiment of the modular merchandise display system of the present invention shown in FIG. 49, and illustrating the module mounted on the supporting frame.
Figure 51:
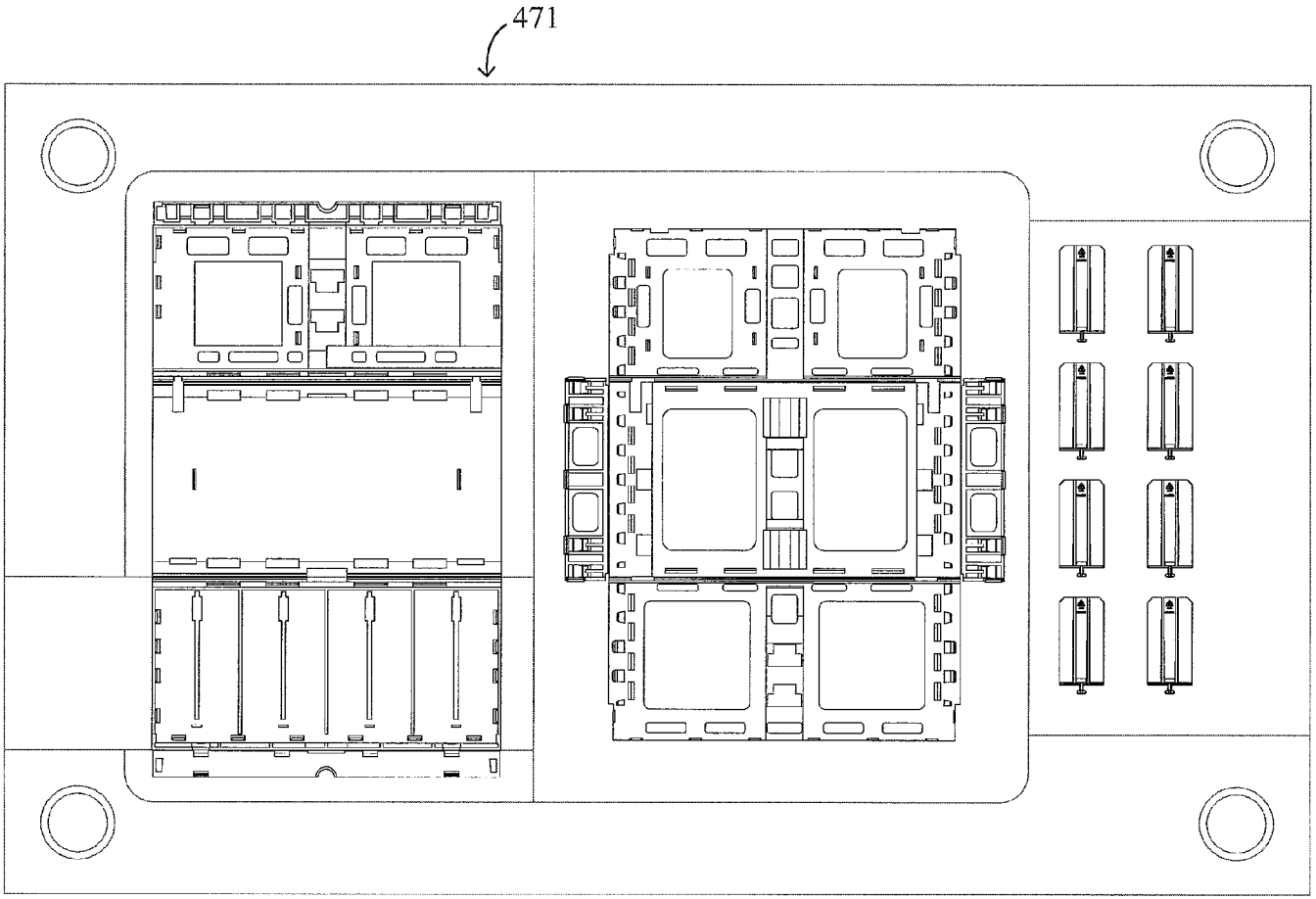
FIG. 51 is a plan view of a blank from which the module of the modular merchandise display system of the present invention shown in FIG. 48 may be formed.
Figure 52:
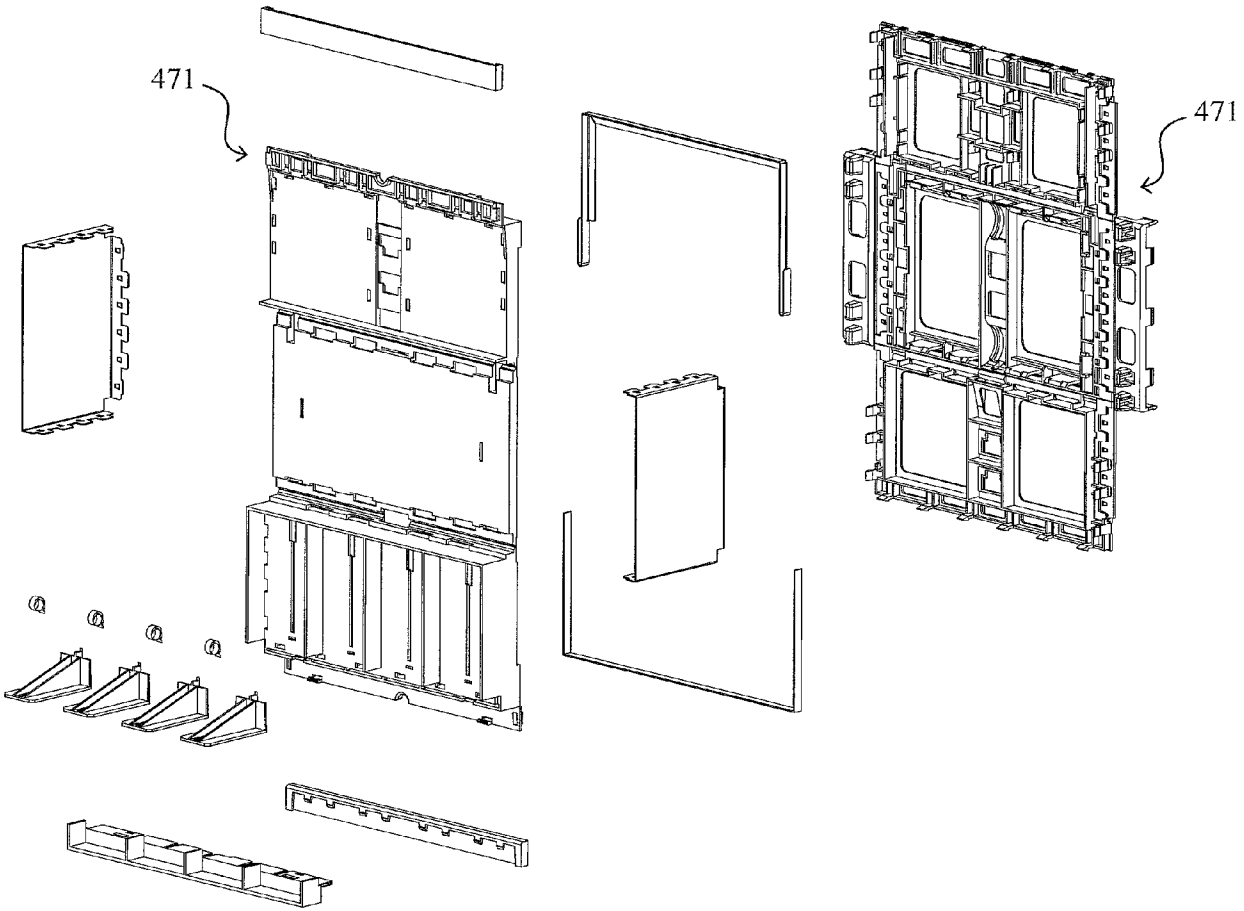
FIG. 52 is an exploded, front perspective view of the embodiment of the components forming the module of the modular merchandise display system of the present invention shown in FIG. 48.
Figure 54:
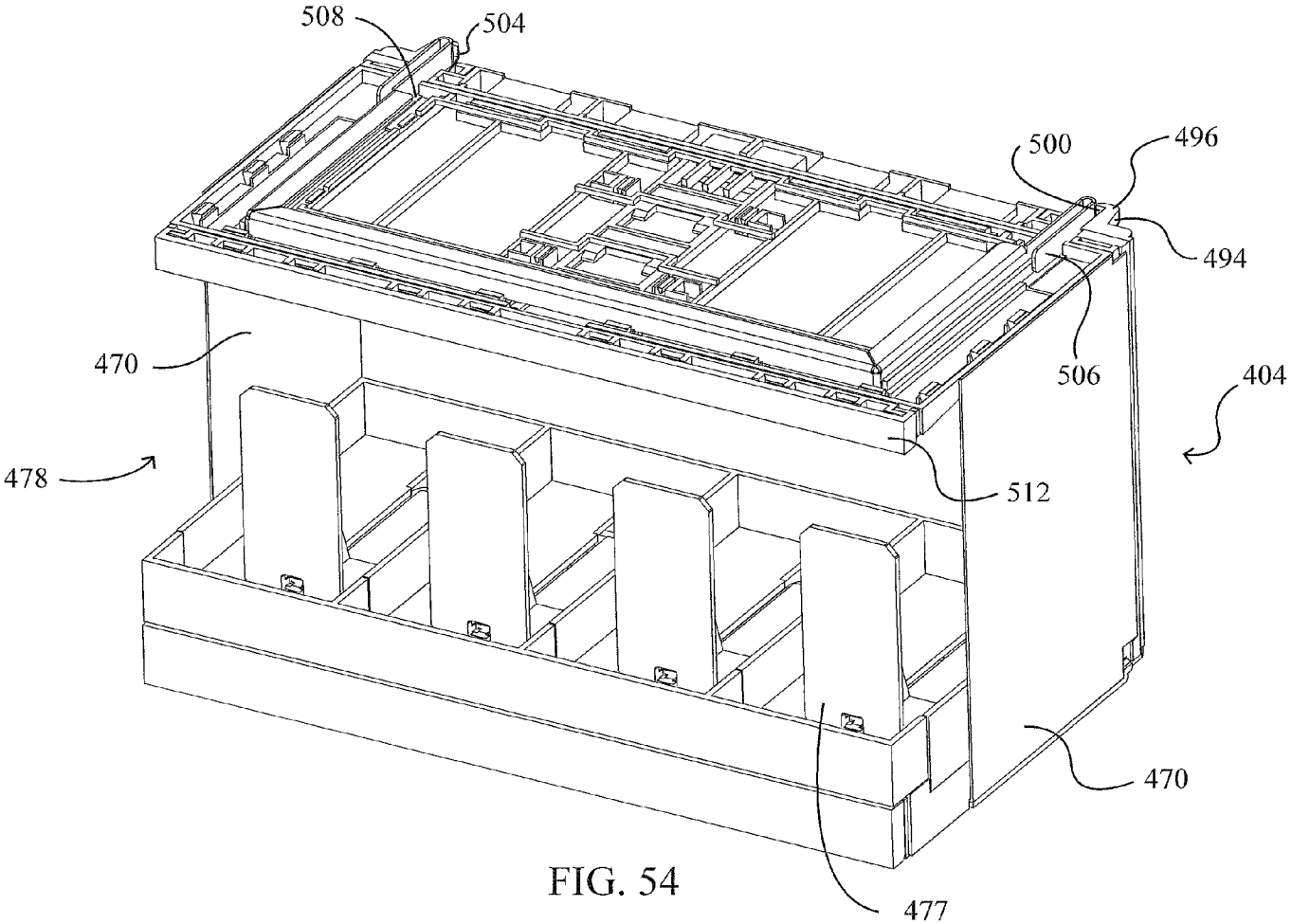
FIG. 54 is a front perspective view of the assembled module of the modular merchandise display system of the present invention shown in FIG. 48, and illustrating pusher trays received thereby.
Figure 55:
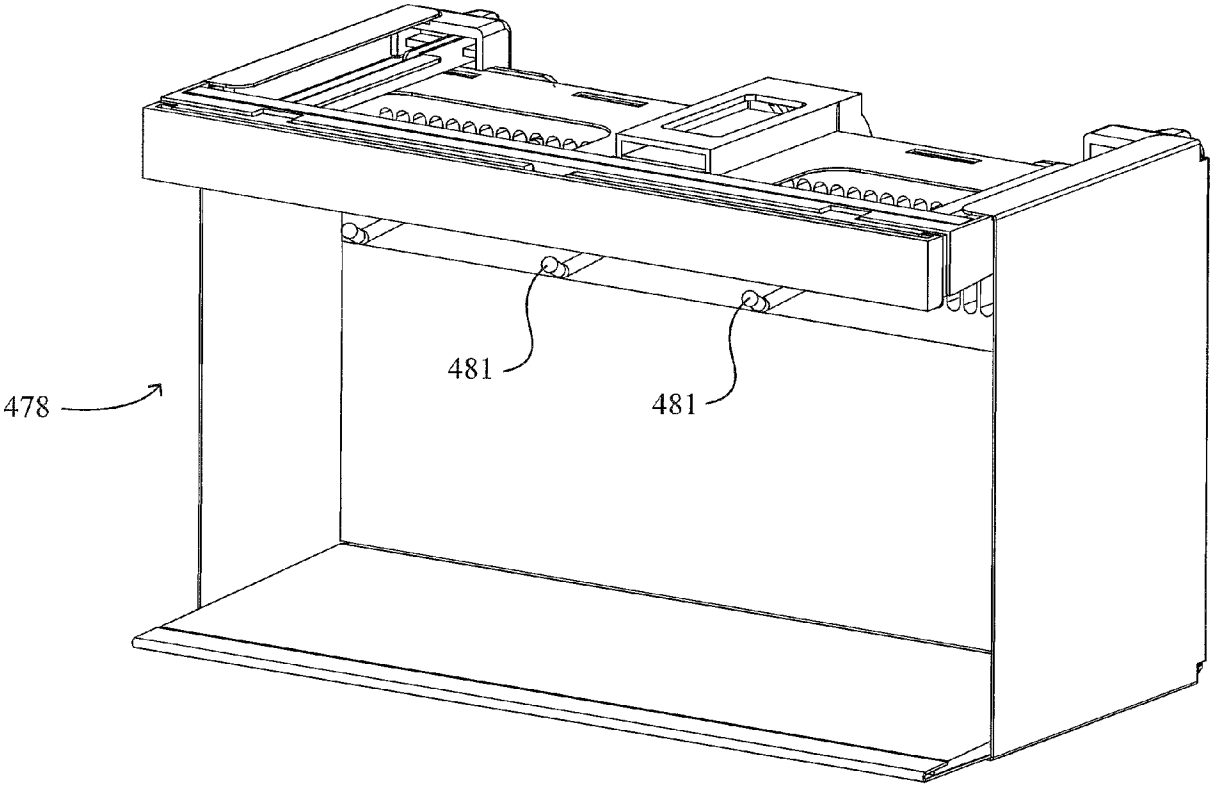
FIG. 55 is a front perspective view of yet another embodiment of the module of the modular merchandise display system of the present invention, and illustrating the module being outfitted with merchandise hanging hooks.
Figure 56:
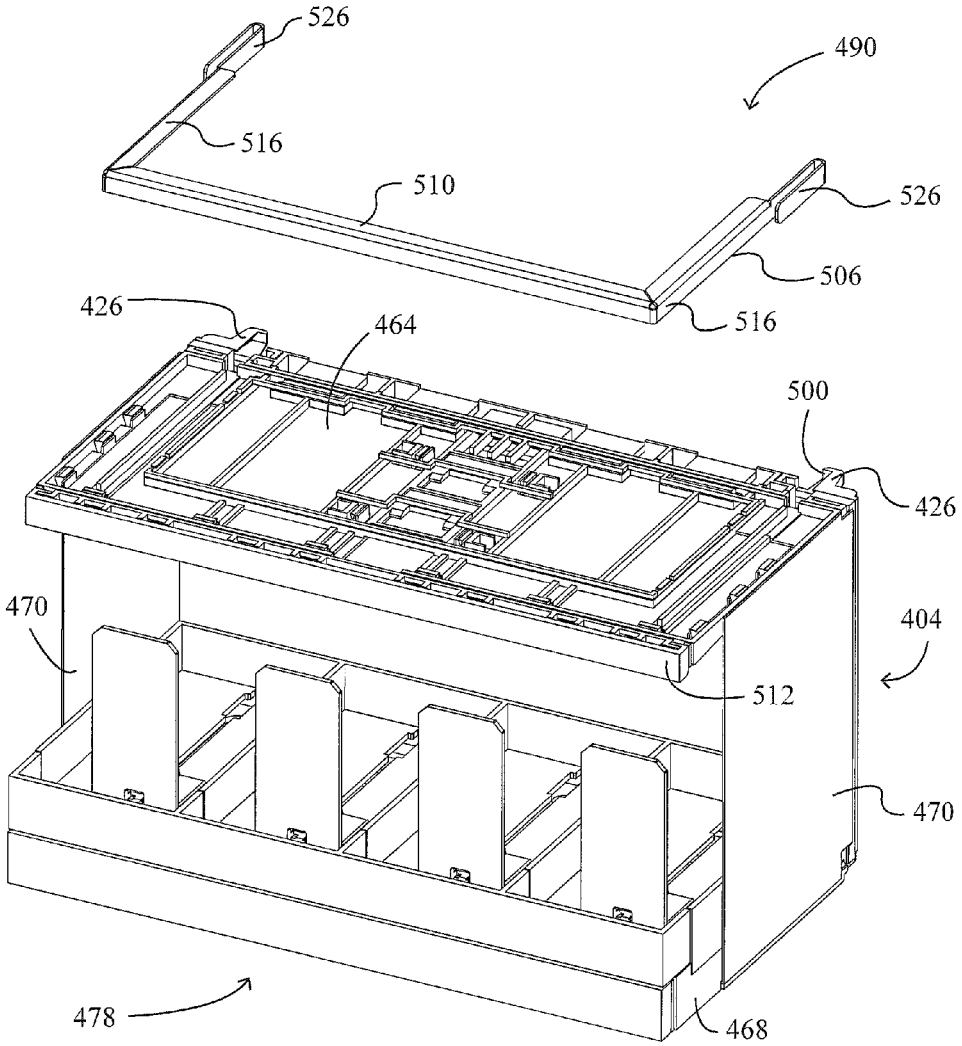
FIG. 56 is a partially exploded, front perspective view of the module of the modular merchandise display system of the present invention shown in FIG. 48, and particularly illustrating a release bar used to disengage the module from the supporting frame.

The preferred overall shape of the display module 404 for this embodiment of the system 400 shown in FIGS. 44-57 is rectangular, as in the case of the previously described embodiments shown in FIGS. 1-43, although merchandise trays 42 may be used instead of modules. The module 404 preferably includes a top wall 464, a back wall 466 and a bottom wall 468, and two opposite lateral (side) walls 470. In this embodiment, and as shown in FIGS. 51 and 52, the top wall 464, back wall 466 and bottom wall 468 (and preferably other components of the module) may be formed from a single, planar blank 471 of sheet metal or synthetic material, such as plastic, and then bent 90° at the adjoining edges of the walls to partially form the modules 404. Then, the opposite lateral side walls 470 are affixed to the opposite lateral edges of the top, back and bottom walls 464, 466, 468 by having tabs 472 on the lateral walls 470 interlock with slots 474 on the top, back and bottom walls 464, 466, 468, or vice versa, to hold all five walls 464, 466, 468 and 470 in place and to define the display module 404 with an open or partially open front face 478, as shown in FIGS. 54-56. Forming the top wall 464, back wall 466 and bottom wall 468 from a single sheet of plastic or metal simplifies the molding, manufacturing and assembly process for the modules 404 and display system 400 of the present invention. As with the other embodiments of the display system 400 described previously and shown in FIGS. 1-43, the display module of FIGS. 44-57 can receive pusher trays 477 or hooks 481 (see FIGS. 54 and 55) for holding and displaying merchandise within its interior space.

Figure 48:
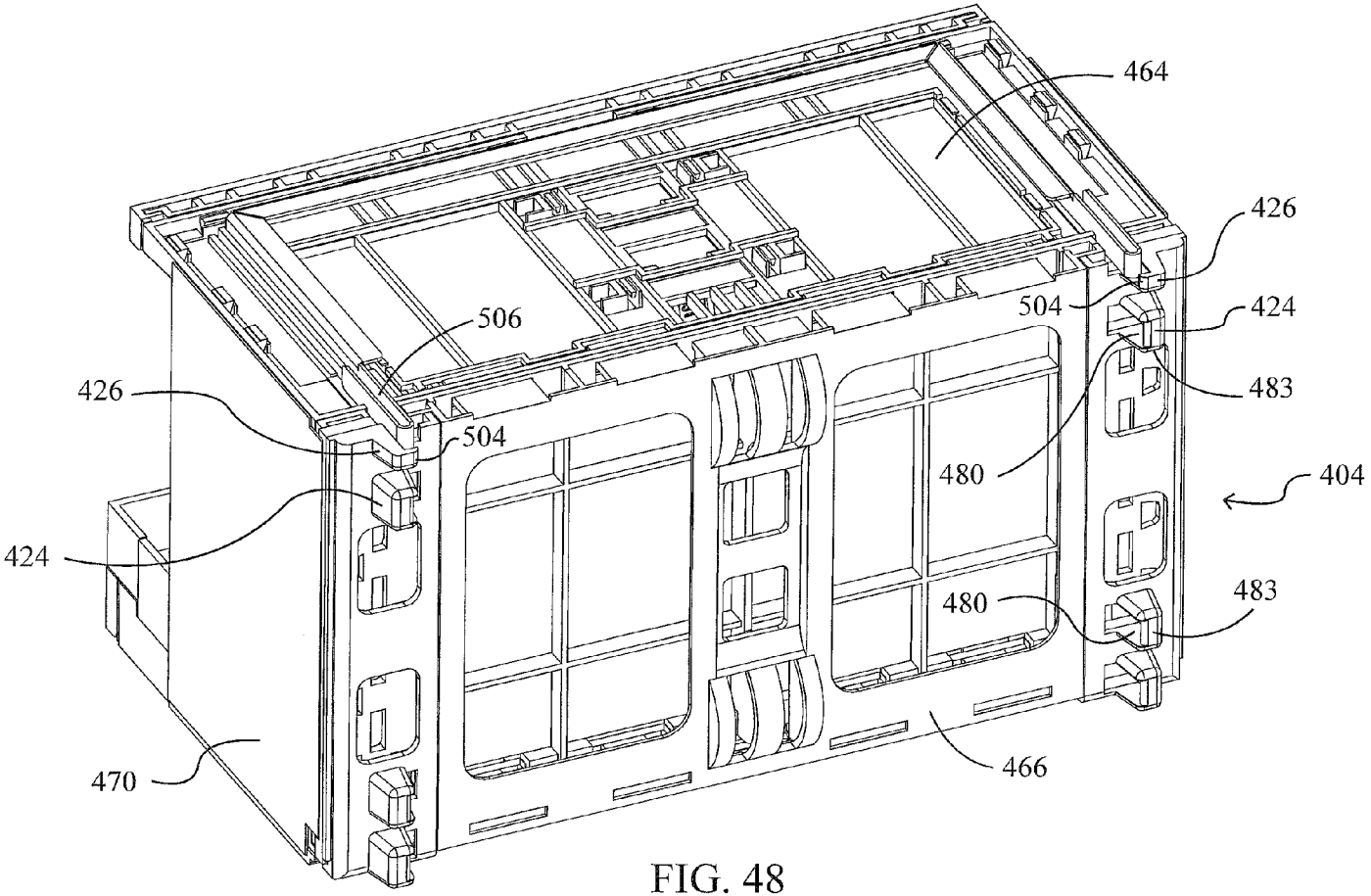
FIG. 48 is a top rear perspective view of the module of the modular merchandise display system of the present invention shown in FIG. 44.

A view of the outer surface of the back wall 466 of the display module 404 is shown in FIGS. 48 and 49. As can be seen, on opposite lateral portions of the back wall 466 of the module 404 are situated one or more locator protrusions 424, and at least one locking hook 426 (also situated on each lateral portion). As with previous embodiments of the display system 400, the locator protrusions 424 are used to help locate and position the display module 404 on a pair of adjacent indexing members 406 of the display frame 402. The locator protrusions 424 are particularly positioned on the back wall 466 of the display module 404 and protrude outwardly from the outer surface thereof so that each locator protrusion 424 is received by a corresponding opening 422 formed in the front wall 412 of an indexing member 406 in order to guide the display module 404 as it is being placed on the frame 402 of the system 400.

Referring to FIG. 49, each locator protrusion 424 preferably has a recessed portion 479 on one of its lateral sides that extends almost to the free end, or nose, 483 of the protrusion, and a lip 485 situated in front of the recessed portion 479 and on the same side thereof, near the free end or nose 483 of the protrusion 424, to define a recess or pocket 480 that is preferably relatively shallow. This recess 480 receives the angled abrupt edge, or catch barb 440, of the locking clip 428 situated inwardly of the protrusion lip 485, when the display module 404 is mounted on the indexing members 406 of the frame 402 and the module protrusions 424 are fully received by their corresponding indexing member openings 422. As the display module 404 is being mounted on the indexing members 406 of the frame 402, the nose 483 of each protrusion 424 engages the ramp-like, free end, fourth segment 438 of a corresponding resilient locking clip 428, displacing it slightly sideways, until the catch barb 440 passes over the lip 485 of the protrusion 424 and is received by the recess 480 of the protrusion 424, whereupon the clip 428 springs back into the recess 480 in the direction toward its unbiased state, as shown in FIG. 50.

The locator protrusions 424 of the display module 404 ensure that the module is properly mounted on the indexing members 406 of the frame 402, and help secure the module 404 to the frame. The shape of the protrusions 424 also provides some resistance to the removal of the display module 404 from the frame 402, which resistance may be overcome by a greater outward pulling force on the module 404 to disengage the locking clip 428 from the protrusion 424. However, the display module 404 of the display system 400 shown in FIGS. 44-57 further preferably includes locking hooks 426 and a cooperating release mechanism to securely but removably affix the display module 404 to the indexing members 406 of the frame 402, just as similar components are provided in the embodiments of the display system 400 described previously and shown in FIGS. 1-43 of the drawings.

More specifically, and as shown in FIGS. 49, 50, 56 and 57, and in particular FIG. 54, of the drawings, each display module 404 includes at least one, but preferably two or more, locking hooks 426 attached to and extending outwardly from the outer surface of the back wall 466 of the module 404. Each hook 426 is formed generally as an L-shaped member, with a first leg 494 extending perpendicularly from the outer surface 492 of the back wall 466 of the display module 404, and a second leg 496 situated on the remote, unconnected end of the first leg 494 at a 90° or other transverse angle to the first leg. This second leg 496 has an underside surface 500 which partially defines with the first leg 494 a space for receiving a portion of a corresponding locking clip 426 of an indexing member 406. The locking hooks 426 are situated near the lateral side portions of the back wall 466 of the display module 404 and in line with the locator protrusions 424 so that the locking hooks 426, like the locator protrusions 424, may also be received by corresponding openings 422 in the front wall 412 of the indexing members 406 to engage resilient locking clips 428 located at the openings 422.

When the display module 404 is being placed on the display frame 402, the locator protrusions 424 are received by the openings 422 in the indexing members 406, with the nose 483 of each protrusion 424 engaging the ramp-like, free end, fourth segment 438 to displace the locking clip 428 until the barb 440 is received over the lip 485 and into the shallow recess 480 of the protrusion 424. Also, the locking hooks 426 are received by openings 422 in the indexing members 406 that are in alignment with the hooks 426. The leading or front surface of each hook 426 may be curved, and engages the ramp-like, free end, fourth segment 438 of the corresponding locking clips 428 situated in alignment with the hooks 426. The hooks 426 bias the resilient locking clips 428 to the side until the ramp-like, free end, fourth segment 438 and barb 440 of corresponding locking clips 428 ride over the second leg 496, with the barb 440 of the locking clip 428 being received by the space defined by the locking hook 426, and with the catch segment 436 of the locking clip 428 resting against the underside surface of the second leg 496 of the locking hook 426, as shown in FIG. 57. In this manner, the display module is secured to the indexing members 406 of the frame 402 until intentionally released by the proprietor of the establishment in which the display system 400 of the present invention is situated.

Each display module 404 of this embodiment also includes a release mechanism 490, as shown in FIGS. 48, 49, 50, 53, 54, 56 and 57. The release mechanism 490 in this embodiment is in the form of a generally U-shaped bar 506 which is mounted at least partially within one or more interconnected channels 508 formed in the outer surface of the top wall 464 of the display module 404. The release bar 506 includes an intermediate section 510 which, as will be explained, is pressed inwardly of the module 404 by the store owner or employee to disengage the locking hooks 426 of the display module 404 from the locking clips 428 of the indexing members 406 of the display frame 402. The intermediate section 510 of the release bar 506 extends at least partially across the top wall 464 of the display module 404, preferably from lateral side to lateral side, 470 and is situated near the front open face of the display module 404 so as to be easily accessible by the store owner or employee.

Figure 53:
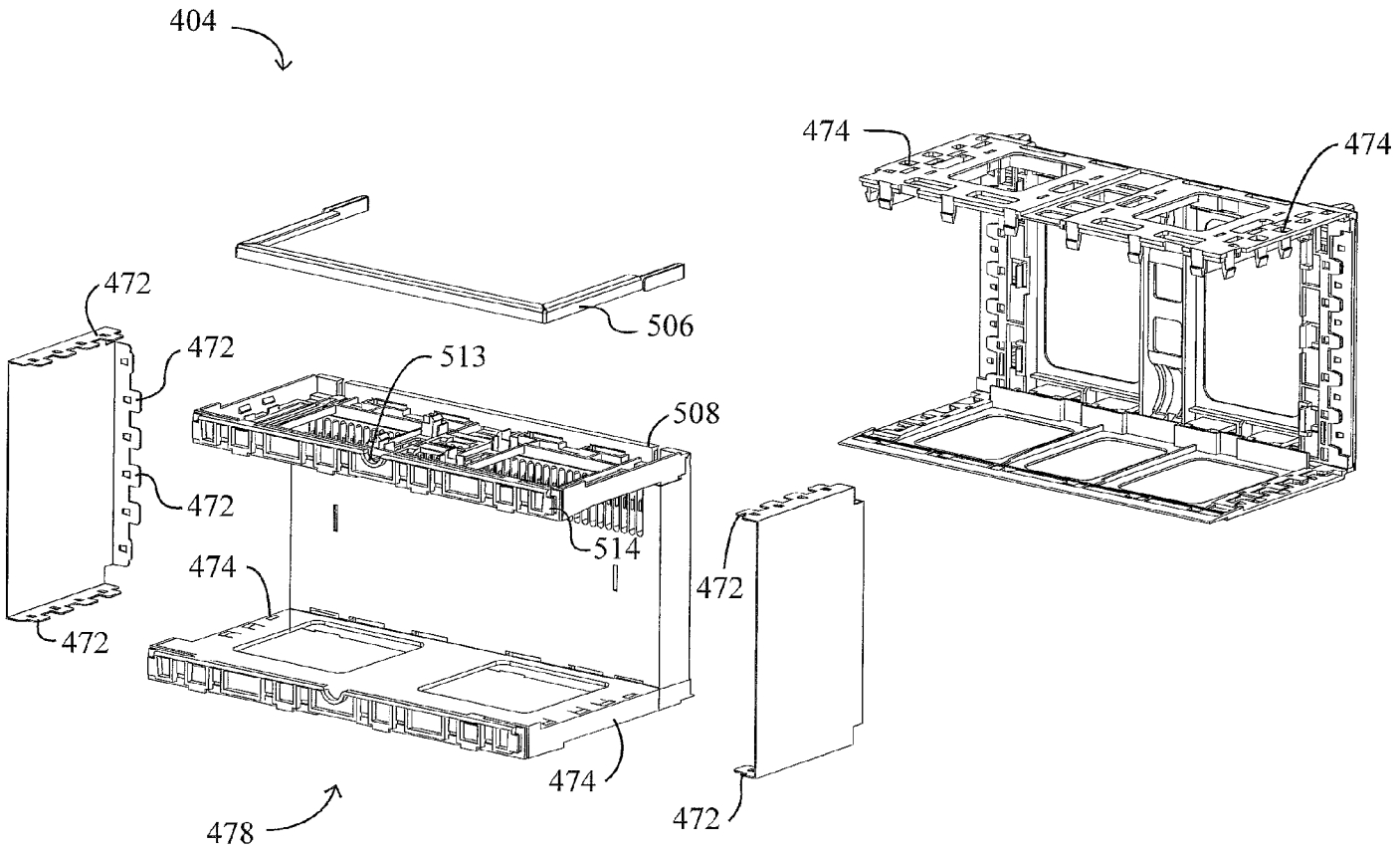
FIG. 53 is a partially exploded, front perspective view of the module of the modular merchandise display system of the present invention show in FIG. 48.

In one preferred form of the present invention, the intermediate section 510 of the release bar 506 may be hidden behind a top panel 512 pivotally mounted across and in front of the upper front portion 514 of the top wall 464 of the display module 404, which top panel 512 is used for carrying advertisements, price or product information or other information on a placard or paper sheet, as shown in FIG. 53. The store owner or employee would pivot downwardly (or upwardly, if so designed) the top panel 512 to expose and gain access to the intermediate section 510 of the release bar 506 through an opening 513 formed in the upper front portion 514.

The release bar 506 also preferably includes a pair of side sections 516, each of which is joined to and extends perpendicularly from a corresponding axial end of the intermediate section 510 and which extends in a direction from the open front face 478 of the display module 404 to the back wall 466 thereof. The free ends of the side sections 516 are preferably turned 180° back on itself partially along the length of the side sections 516 to form U-shaped end portions 526. An upstanding wall 522 is situated between the main portion of the side section 516 and the turned back section to help guide the side sections 516 in their reciprocating movement within their respective channels 508. Accordingly, the U-shaped end portions 526 of each side section 516 of the release bar 506 has a smoothly curved free end which engages the locking clip 528 to bias it away from contact with a locking hook 526 in order to release the display module 404 from the frame 402, as will be explained below. Tabs or lands (not shown) extending from the outer surface of the top wall 464 of the display module 404 and over the channels, and portions of the release bar maintain the release bar 506 and its sections within their respective channels 508, yet allow the release bar 506 to move reciprocatingly therein. Alternatively, a top plate (not shown) may be used to cover the top wall 464 of the display module 404 and the release bar 506 interposed therebetween.

To remove a display module 404 from the display frame 402, the user of the display system presses on an exposed portion of the intermediate section 510 of the release bar 506, causing the side sections 516 to move within their respective channels 508 outwardly of the back wall 466 of the module 404. The U-shaped end portions 526 of the side sections 516 are particularly positioned to engage the ramp-like, angled, free end segments 438 of the resilient locking clips 428. This action causes the catch segment 436 of the locking clip 428 to disengage from contact with the underside surface of the hook 488 such that the barb or angled edge 442 of the locking clip no longer projects into the space behind the underside surface 500 of the locking hook 526 and so that the second leg 496 of the hook is free of the locking clip 428.

This allows the user to pull the display module 404 outwardly from the frame 402 using a force sufficient to disengage the protrusions 424 from their corresponding locking clips 428. The release bar 506 is preferably biased by a spring (not shown) situated on the top wall 464 of the display module 404 so that the release bar 506 is biased to return to its initial position within the channels 508 when the user releases pressure on the intermediate section 510. Also, the resilient locking clips 528 return to their unbiased position behind the corresponding openings 422 in the indexing members 406 to insure their engagement with the locking hooks 426 and locator protrusions 424 when a display module 404 is again placed on the display frame 402.

Figure 58:
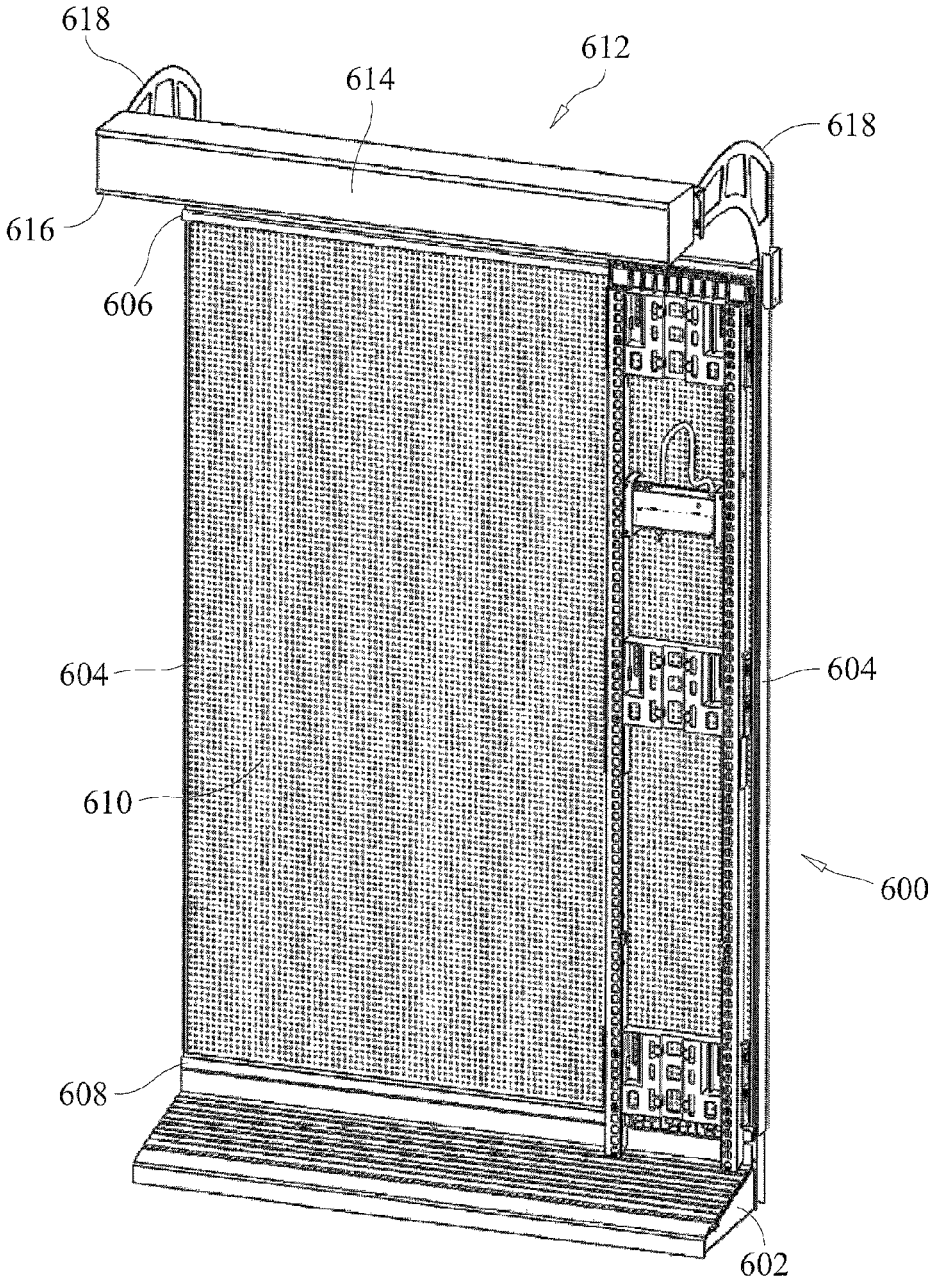
FIG. 58 is a front perspective view of a modular merchandise display system constructed in accordance with another form of the present invention.
Figure 59:
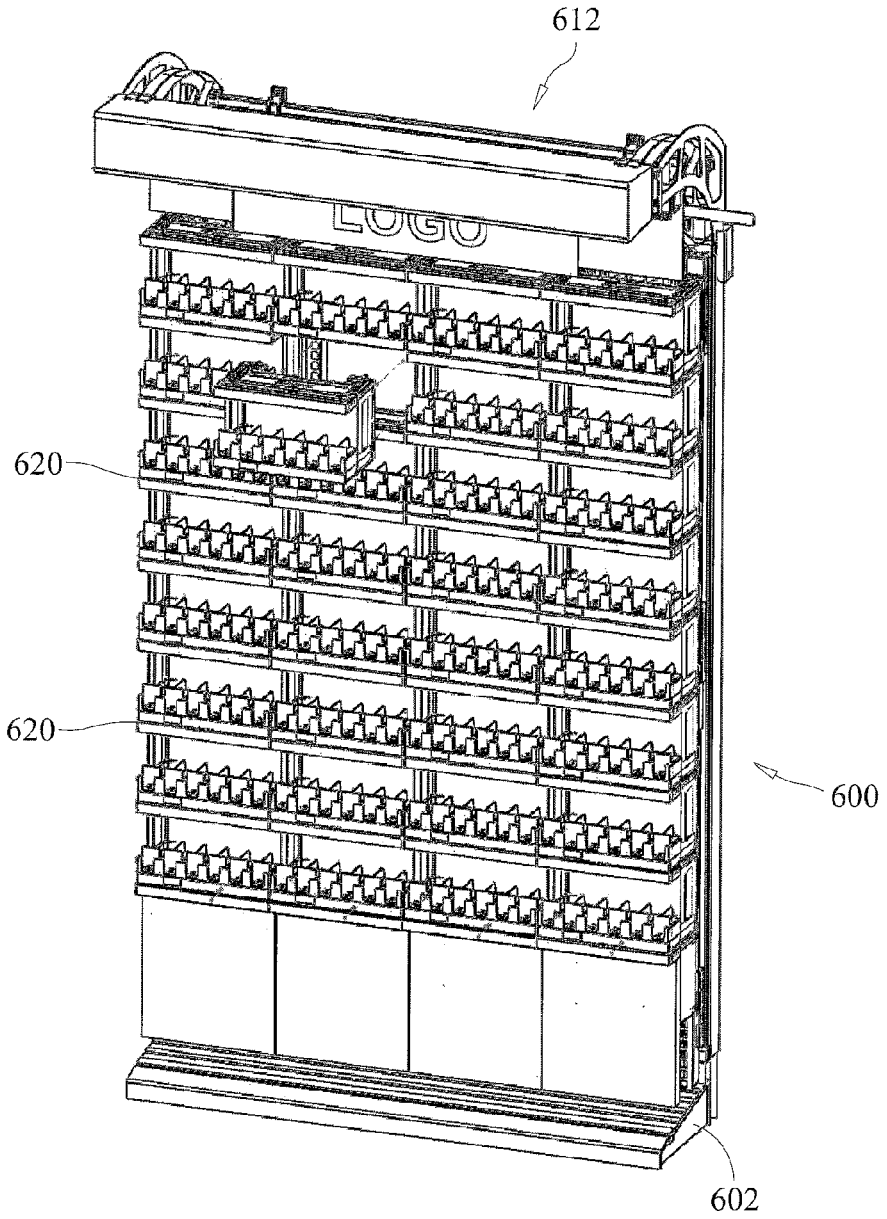
FIG. 59 is a front perspective view of the modular merchandise display system of the present invention shown in FIG. 58 having a plurality of merchandise modules mounted thereon.
Figure 60:
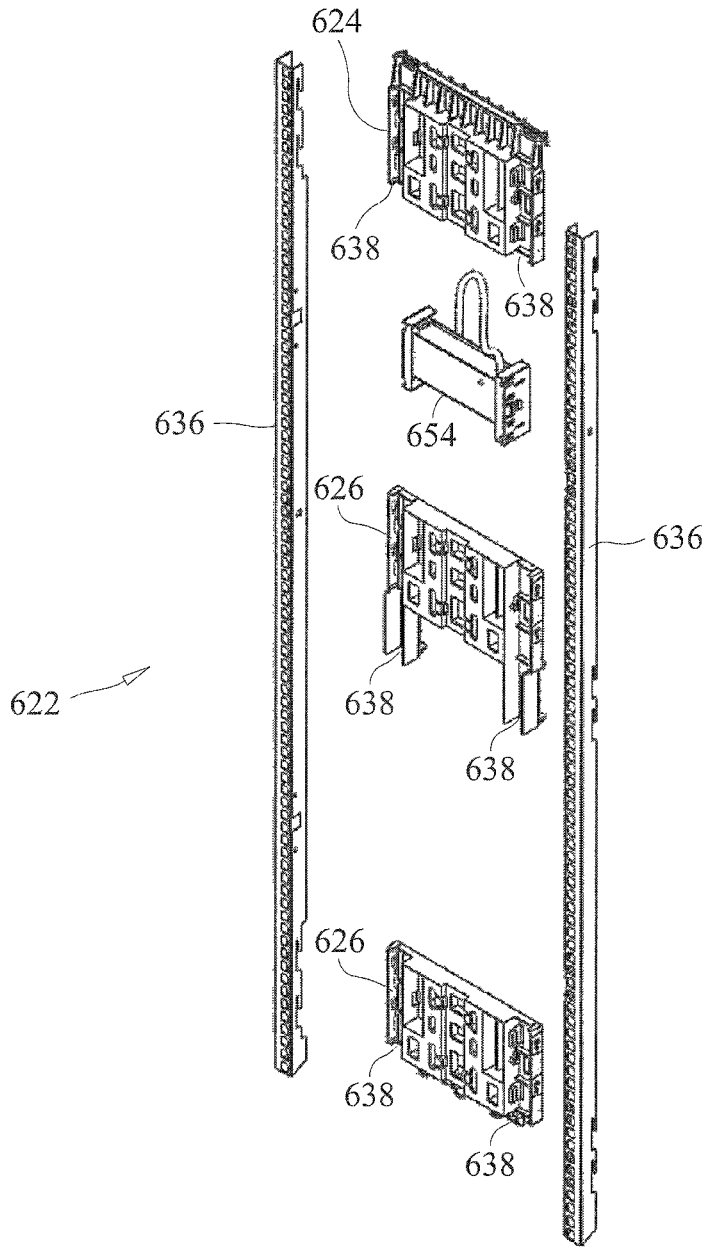
FIG. 60 is an exploded, front perspective view of an indexing rail assembly of the modular merchandise display system of the present invention shown in FIG. 58.
Figure 61:
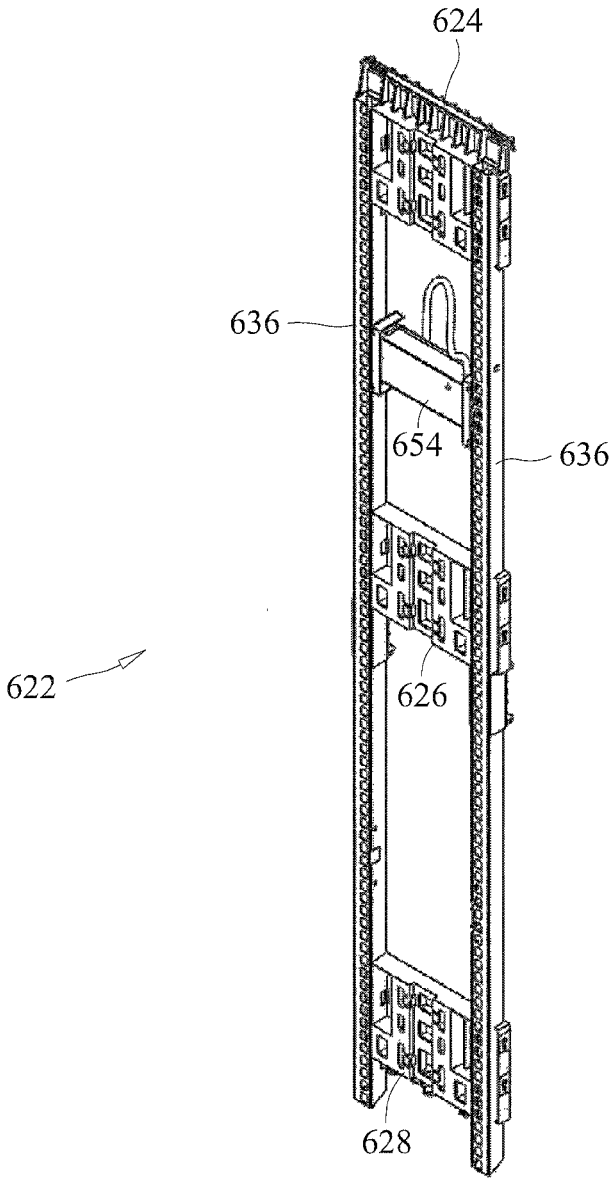
FIG. 61 is a front perspective view of the indexing rail assembly, shown assembled, forming part of the merchandise display system of the present invention shown in FIG. 58.
Figure 62:
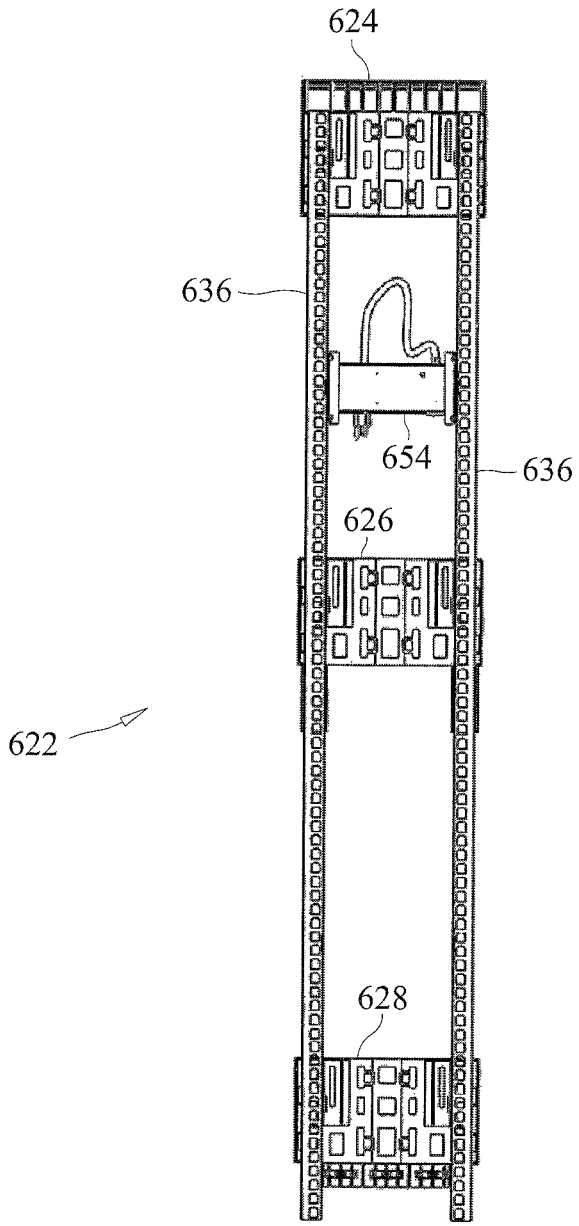
FIG. 62 is a front view of the indexing rail assembly forming part of the merchandise display system of the present invention shown in FIG. 58.
Figure 63:
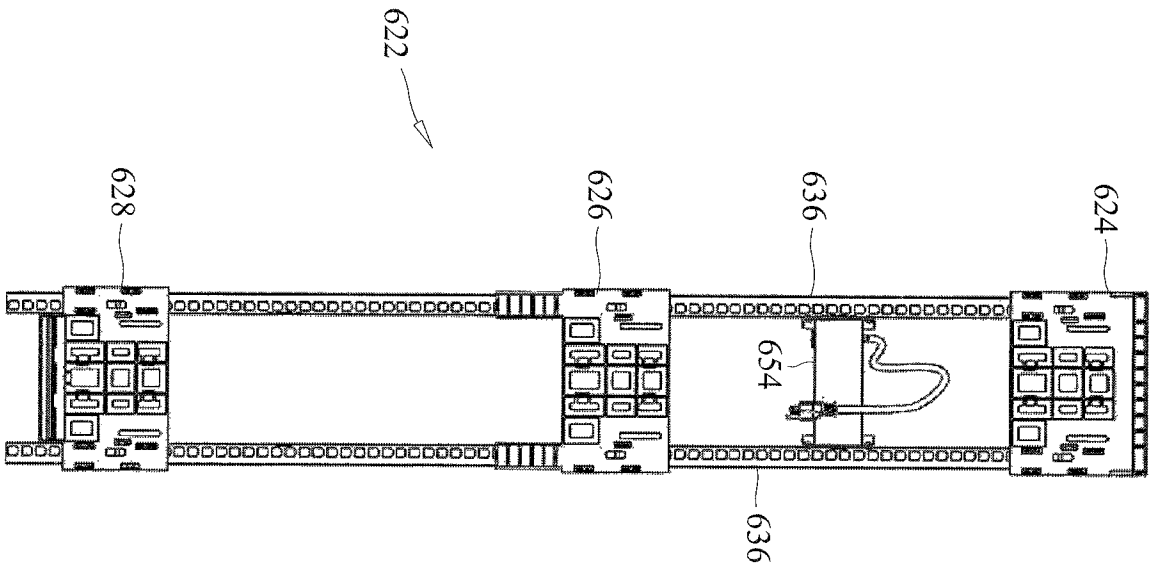
FIG. 63 is a rear view of the indexing rail assembly forming part of the merchandise display system of the present invention shown in FIG. 58.

FIGS. 58 and 59 illustrate another form of the modular merchandise display system constructed in accordance with the present invention. Referring initially to FIG. 58, it will be seen that the display system includes a frame 600 having a base 602 which rests on the floor of an establishment, vertical side pieces 604 attached to the base 602 and upper and lower horizontal cross braces 606, 608 attached to the vertical side pieces 604. The frame 600 further includes a back wall 610, formed of steel or other material, which is joined to the vertical side pieces 604 and the horizontal cross braces 606, 608. Like one or more of the previously-described embodiments of the present invention, the frame 600 may be free-standing on its base 602, or may be situated adjacent to a wall or other vertical supporting structure and attached thereto by fasteners or the like for added safety.

A light fixture 612 having a housing 614 which defines an internal cavity for receiving lighting elements, such as fluorescent tubes, and having an open bottom side 616, may be supported above and in front of the back wall 610 by a pair of generally horizontal support members 618 mounted on the vertical side pieces 604. The light fixture 612 is provided to direct light on the plurality of modules 620 supported by the frame and/or other components of the merchandise display system, as will be described in greater detail.

FIGS. 60-69 illustrate one rail assembly 622 of a plurality of rail assemblies of the modular merchandise display system of the present invention, which allows a plurality of trays or display modules 620 to be mounted on the system and removed easily therefrom. Each rail assembly 622 preferably includes an upper bridge member 624, a middle bridge member 626 and a lower bridge member 628 that are preferably provided. The upper bridge member 624, as can be seen from FIGS. 66-68, includes an upper hooked end 630 which rests on an upwardly protruding rail 632 of the upper horizontal cross brace 606, which is generally U-shaped in cross-section along its horizontal, axial length. The lower bridge member 628 has a downwardly extending portion 634 which is received by the lower horizontal cross brace 608, which is also generally U-shaped in cross-section along its horizontal, axial length to provide a track or slot in which the downwardly extending portion 634 resides. The middle bridge section 626 may be secured to the back wall using fasteners, such as screws or bolts, or the like. Each of the upper bridge member 624, middle bridge member 626 and lower bridge member 628 is formed from an electrically insulative material, such as a thermoplastic, to maintain the electrical separation of the rails of the rail assembly 622, as will be described in greater detail.

The hooked end 630 of the upper bridge member 624 may include an insert 635 of polypropylene or other anti-friction material where it engages the upwardly protruding rail 632 of the upper horizontal cross brace 606 to allow the rail assembly 622 to glide transversely on the upper horizontal cross brace 606 of the frame. Such structure facilitates the repositioning of the rail assemblies 622 on the frame 600 by an employee or owner of the retail establishment in which the display system of the present invention is used.

Each rail assembly 622 includes a pair of vertically disposed rails 636, which define indexing members. The pair of rails 636 is mounted to opposite lateral side portions 638 of the upper bridge member 624, the lower bridge member 628 and the middle bridge member 626. As can be seen from FIG. 66, each rail 636 is preferably U-shaped in transverse cross-section and includes a front wall 640 and a pair of opposite inner and outer lateral walls 642, 644 joined generally perpendicularly to the front wall 640. More specifically, the inner lateral walls 642 of a pair of indexing rails 636 face each other, while the outer lateral walls 644 of each pair of indexing rails 636 are non-facing. On one or both of the lateral walls 642, 644 of each rail 636 is formed several receiving slits 646 which are dimensioned to receive corresponding L-shaped brackets 648 formed in the opposite lateral side portions 638 of the upper bridge member 624, the middle bridge member 626 and the lower bridge member 628 to secure the pair of rails 636 to the bridge members and form a unitary support system for a plurality of merchandise display trays or modules 620 to be mounted thereon. As can be seen also from FIGS. 66-68, the front wall 640 of each rail 636 of the pair of rails, defining indexing members, includes a plurality of openings 650 formed through the thickness thereof along all or at least a portion of the axial length of each rail. The openings 650 are provided to receive locator pins or protrusions 652 mounted on the merchandise module 620, or tray, as will be described in greater detail.

One of the advantages of this particular embodiment of the modular merchandise display system of the present invention shown in FIGS. 58-69 is its ability to provide electricity to each of the merchandise display trays or modules 620 mounted thereon. Thus, as can be seen in FIGS. 60-65 of the drawings, the display system includes a power supply/converter unit 654 which is mounted between a pair of rails 636.

Figure 64:
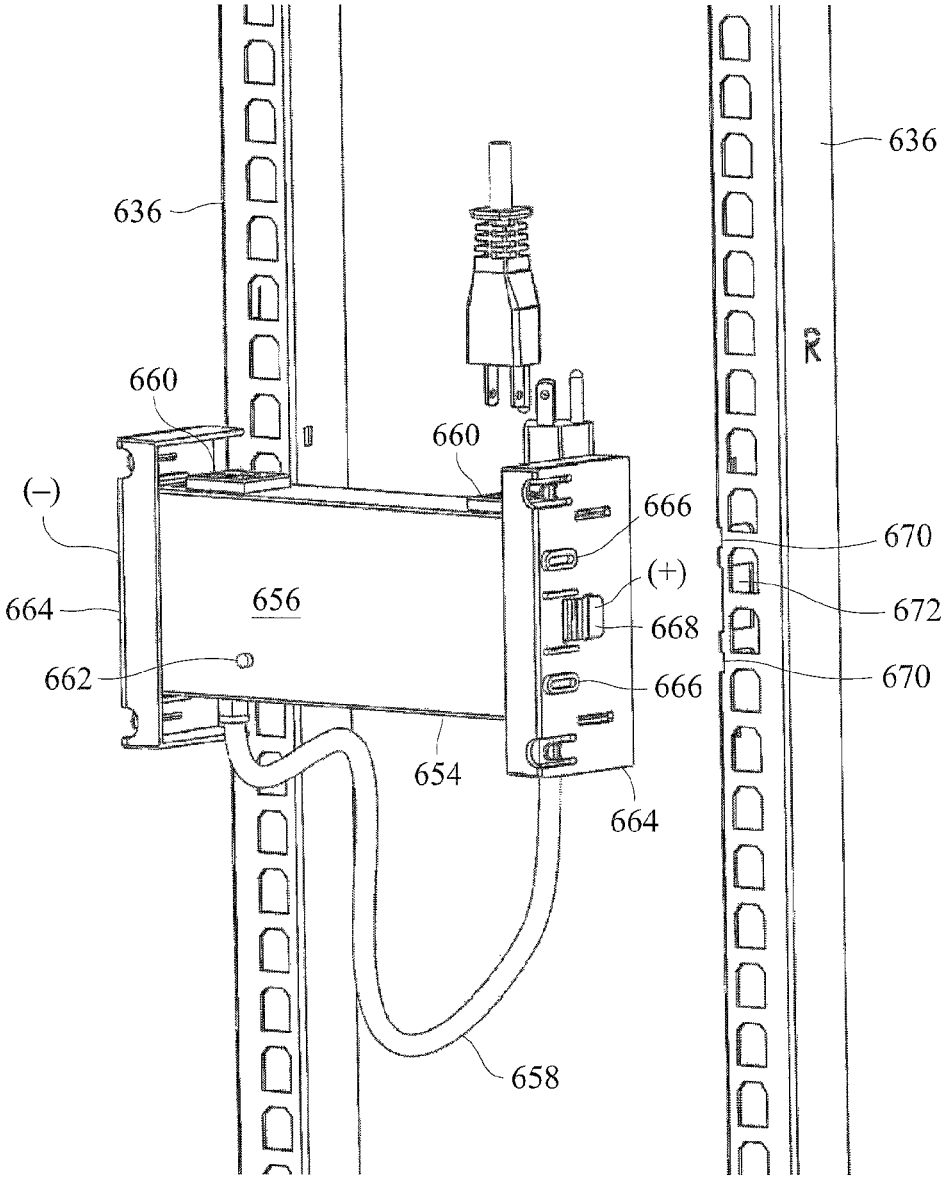
FIG. 64 is an exploded, front perspective view of a portion of the indexing rail assembly forming part of the merchandise display system of the present invention shown in FIG. 58.
Figure 65:
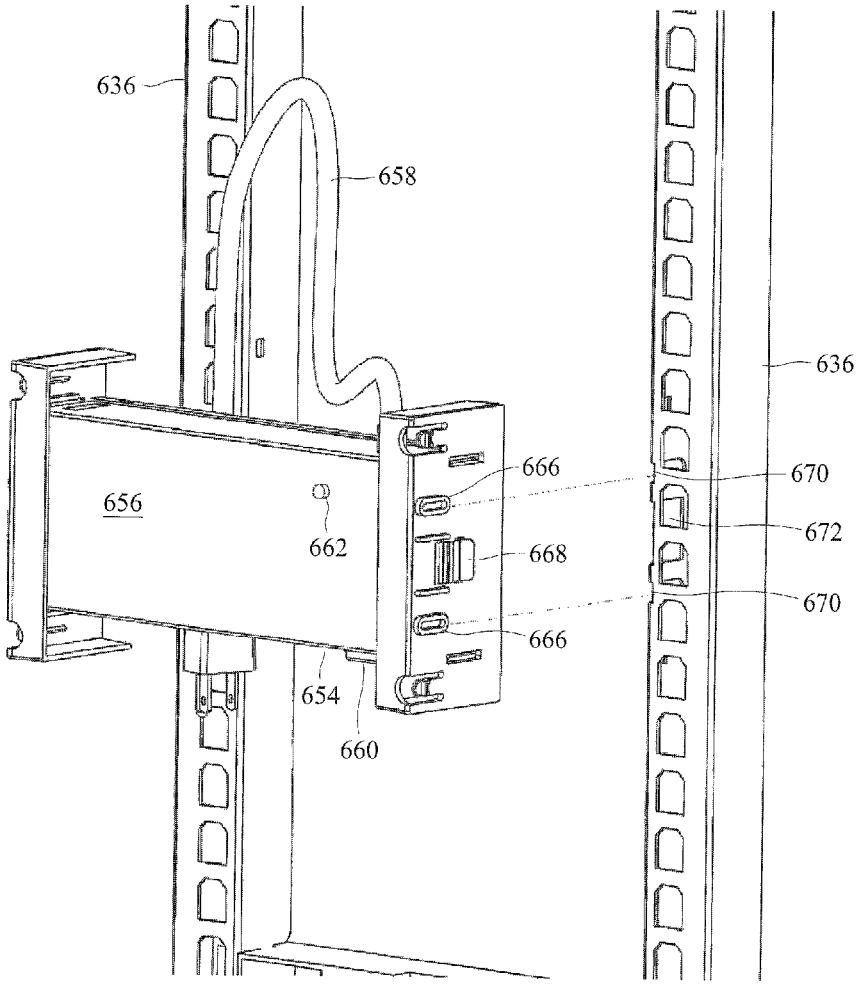
FIG. 65 is an exploded, front perspective view of a portion of the indexing rail assembly forming part of the merchandise display system of the present invention shown in FIG. 58.
Figure 66:
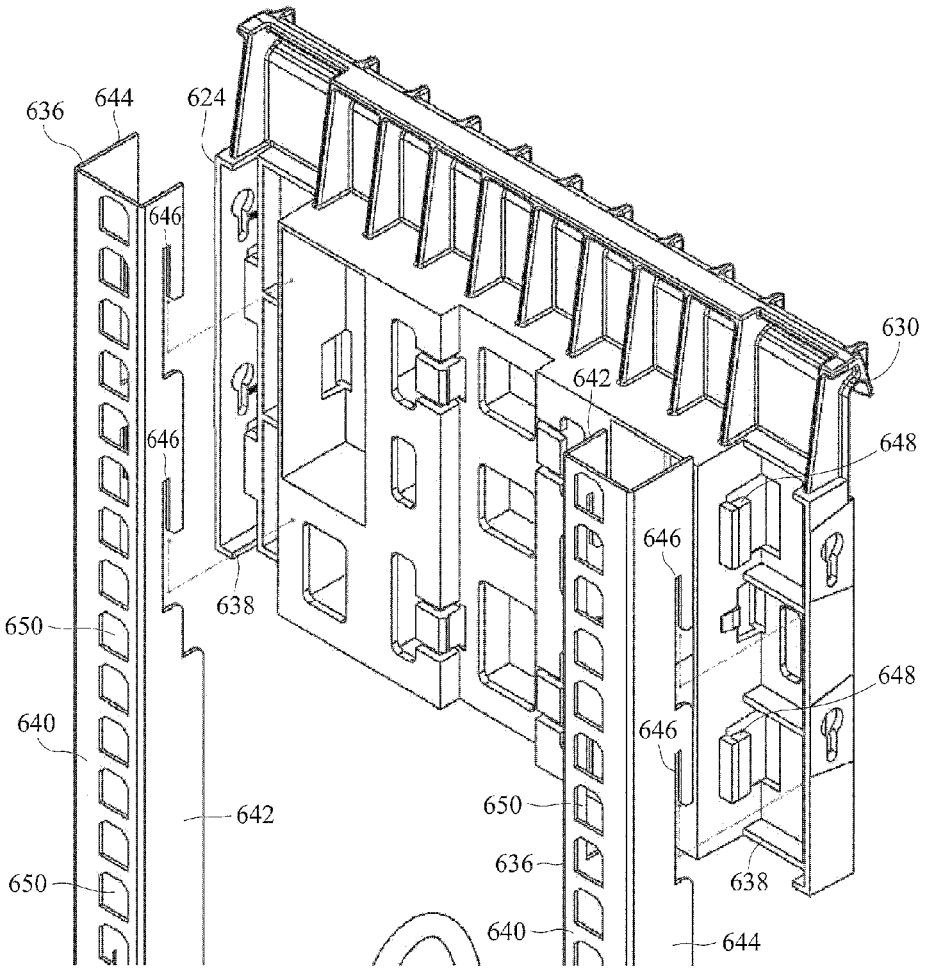
FIG. 66 is an exploded, front perspective view of a portion of the indexing rail assembly forming part of the merchandise display system of the present invention shown in FIG. 58.
Figure 67A:
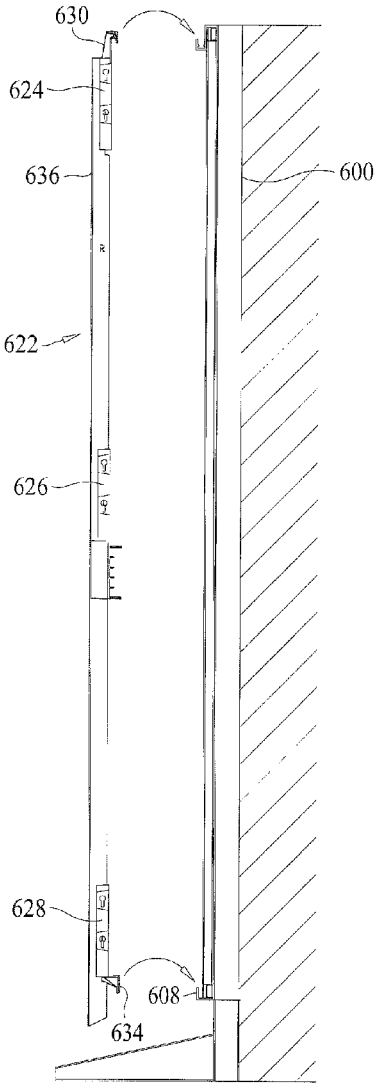
FIG. 67A is a partially exploded, side view of the merchandise display system of the present invention shown in FIG. 58.
Figure 67B:
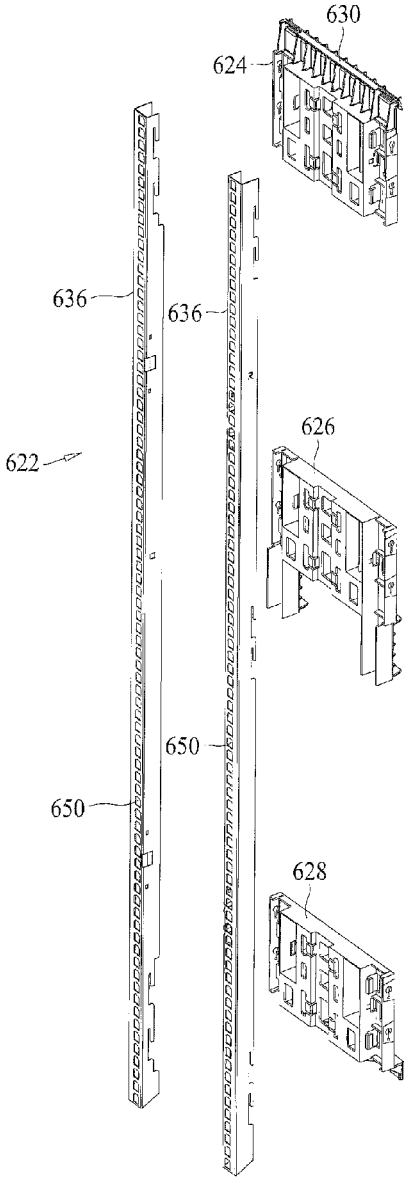
FIG. 67B is an exploded, front perspective view of the indexing rail assembly forming part of the merchandise display system of the present invention shown in FIG. 58.
Figure 67C:
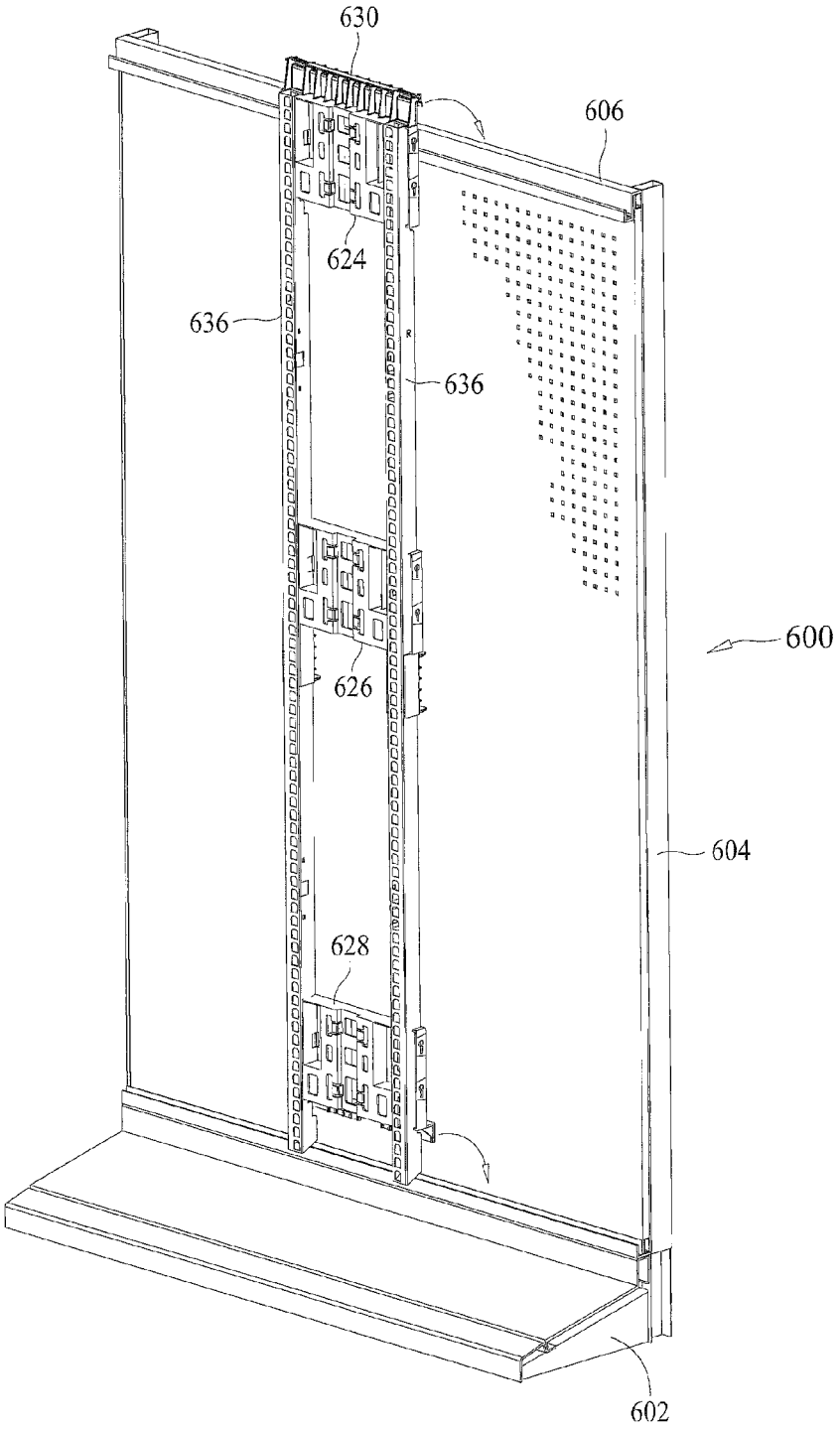
FIG. 67C is a partially exploded, front perspective view of the merchandise display system of the present invention shown in FIG. 58.
Figure 68:
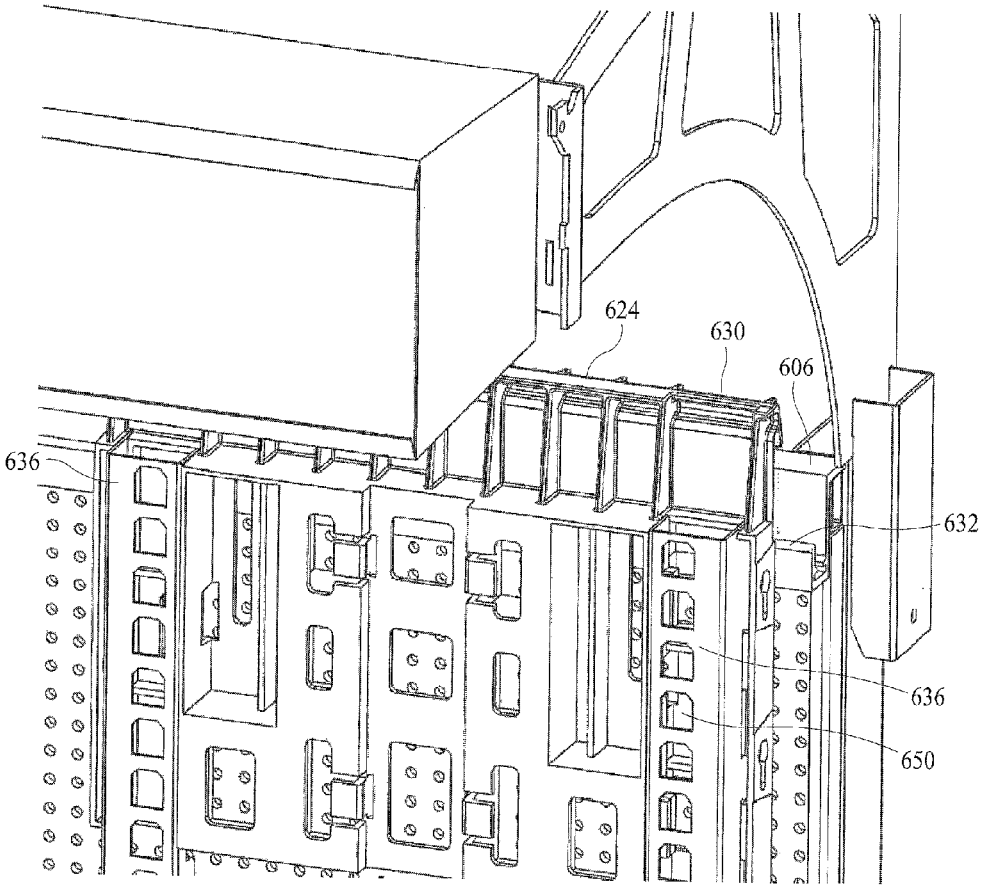
FIG. 68 is an exploded, front perspective view of a portion of the merchandise display system of the present invention shown in FIG. 58.
Figure 69:
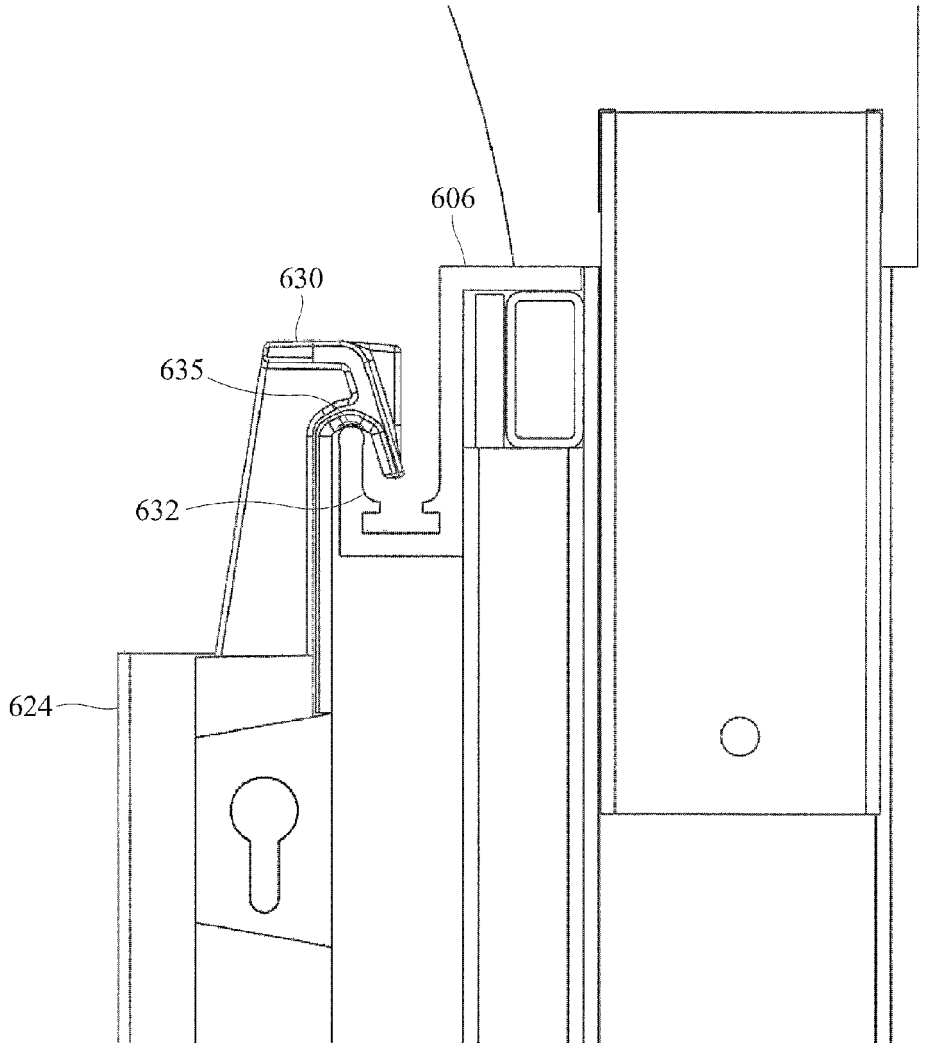
FIG. 69 is a side view of a portion of the merchandise display system of the present invention shown in FIG. 58.

More specifically, and as shown in FIGS. 64 and 65 thereof, the power supply/converter unit 654 of the present invention includes a housing 656 from which extends an AC power cord 658 for connection to a wall or floor 110 volt AC power outlet in the retail establishment where the display system is to be located. On one side of the housing 656 of the power supply/converter unit 654, one or more AC power outlets 660 are also provided to provide power to the power supply/converter units 654 of adjacent rail assemblies of the display system.

Each power supply/converter unit 654 includes a circuit, such as a transformer, to step down the 110 AC voltage provided to it to a lower voltage. The lower voltage is provided to a converter circuit within the unit 654, which may be, for example, a full wave rectifier circuit and a filter circuit, to convert the stepped-down AC voltage to a safe, DC voltage for powering light emitting devices or other illumination devices on the frame 600 or the merchandise display trays or modules 620 mounted on the rails 636 of the frame. The power supply/converter unit 654 may include a power indicator lamp 662 mounted on one of its sides and connected to the internal electrical circuitry to indicate whether power is being provided to the unit 654.

As can be seen from FIGS. 64 and 65 of the drawings, the power supply/converter unit 654 includes two lateral side plates 664, each having an exposed outer surface on which is situated a pair of spaced apart, elongated bosses 666 and a resilient, leaf spring electrical contact 668 situated between the pair of bosses 666. The pair of bosses 666 on each opposite lateral side plate 664 is received by a pair of corresponding slots 670 formed in the inner lateral walls 642 of the pair of indexing rails 636, and each resilient contact 668 is received by an opening 672 formed in the inner lateral wall 642 of a corresponding rail 636 and situated between the receiving slots 670.

When the power supply/converter unit 654 is inserted between the pair of indexing rails 636 so that corresponding bosses 666 are received by the slots 670 and the resilient electrical contacts 668 are received by corresponding openings 672 in the pair of rails 636, the unit 654 is securely mounted between the indexing rails 636, and each contact 668 will be in electrical communication with a corresponding rail 636 of a pair of rails.

More specifically, the resilient electrical contact 668 on one lateral side plate 664 of the power supply/converter unit 654 is provided with a positive (+) DC voltage, and the resilient electrical contact 668 on the opposite lateral side plate 664 of the unit 654 is provided with a negative (–) voltage, or ground, these voltages being provided to the contacts by the AC/DC converter circuit situated within the housing 656 of the unit 654. Accordingly, one rail 636 of the pair of rails is electrified with a safe, low positive voltage, and the other rail 636 of the pair of rails is electrified with a safe, low negative voltage, or ground. Therefore, the pair of rails, now electrified, will provide a DC voltage to a merchandise display tray or module 620 mounted thereon and in electrical contact therewith.

Figure 70:
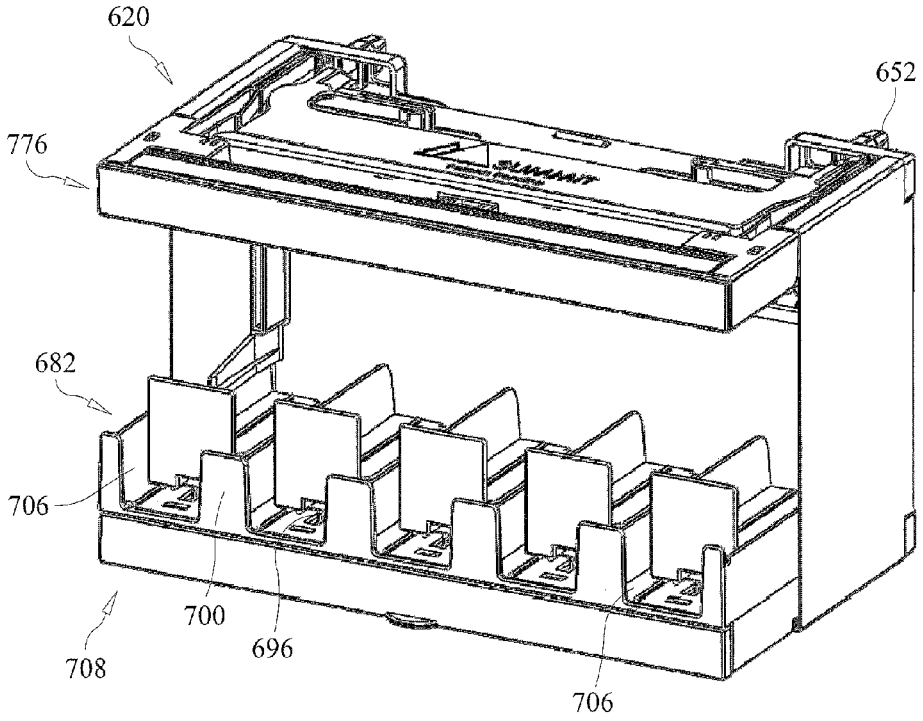
FIG. 70 is a front perspective view of a merchandise module forming part of the merchandise display system of the present invention shown in FIG. 58.
Figure 71:
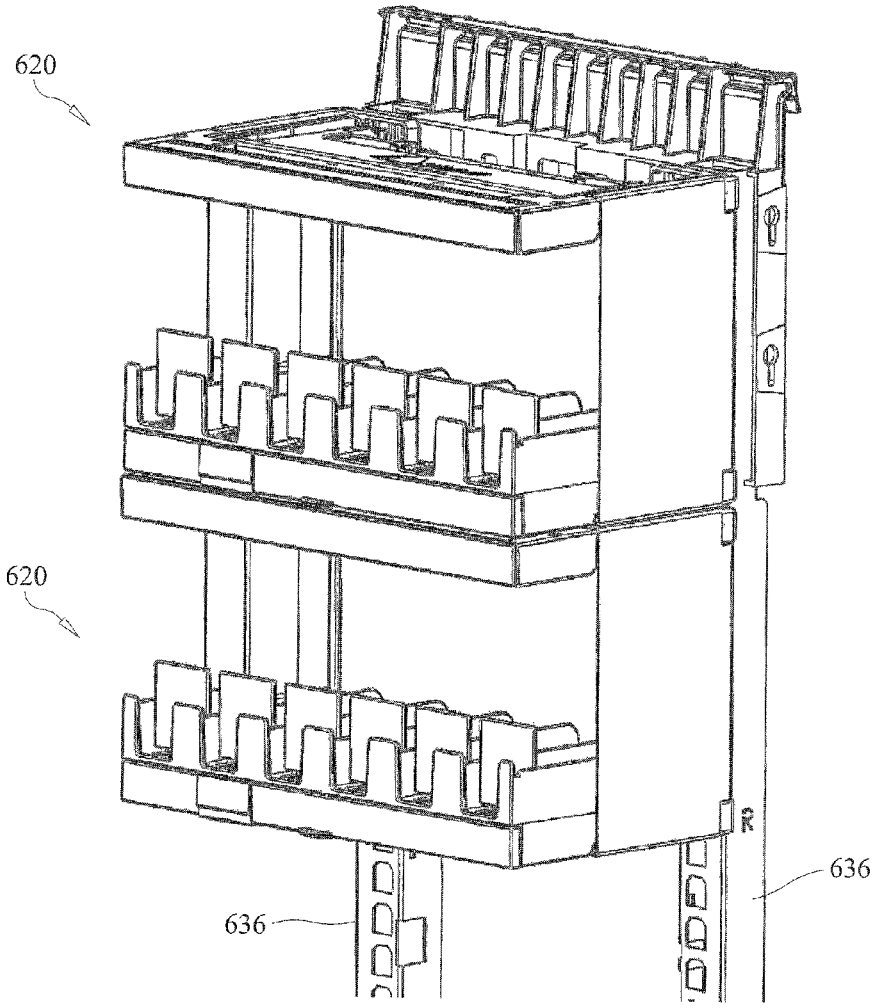
FIG. 71 is a front perspective view of a plurality of merchandise modules mounted to the indexing rail assembly forming part of the merchandise display system of the present invention shown in FIG. 58.
Figure 72:
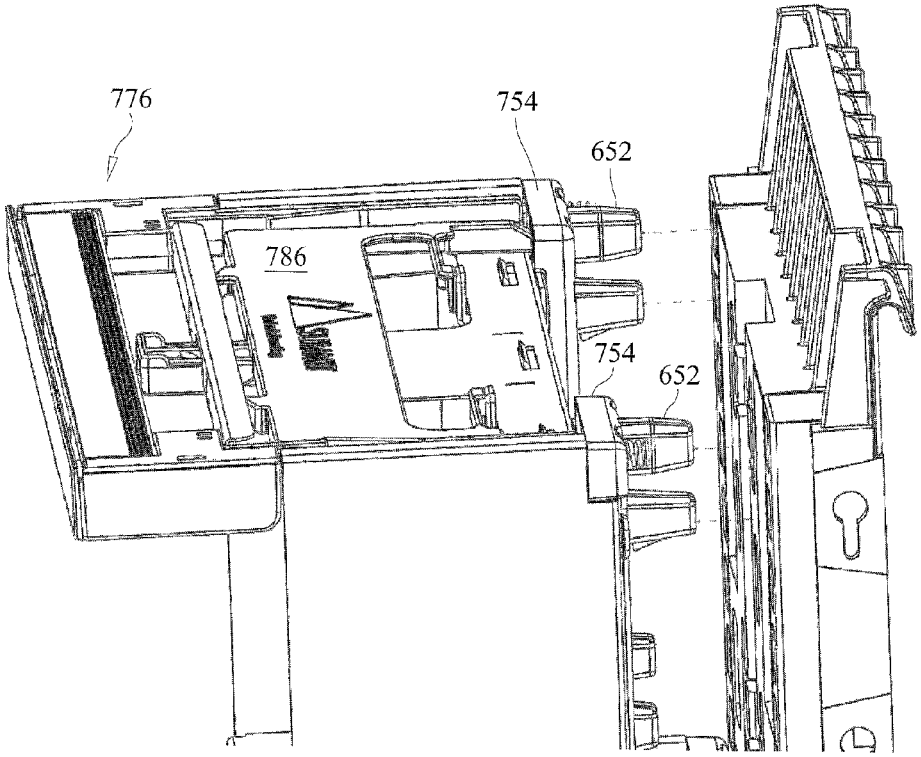
FIG. 72 is a partially exploded, side perspective view of the merchandise module and indexing rail assembly forming part of the merchandise display system of the present invention shown in FIG. 58.
Figure 73:
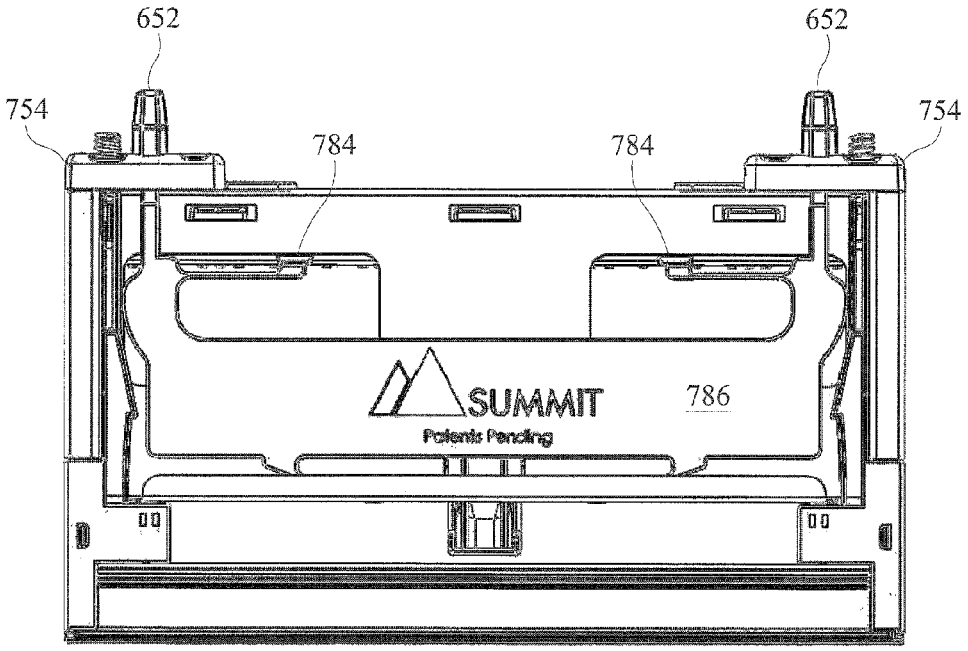
FIG. 73 is a top plan view of a merchandise module forming part of the merchandise display system of the present invention shown in FIG. 58.
Figure 74:
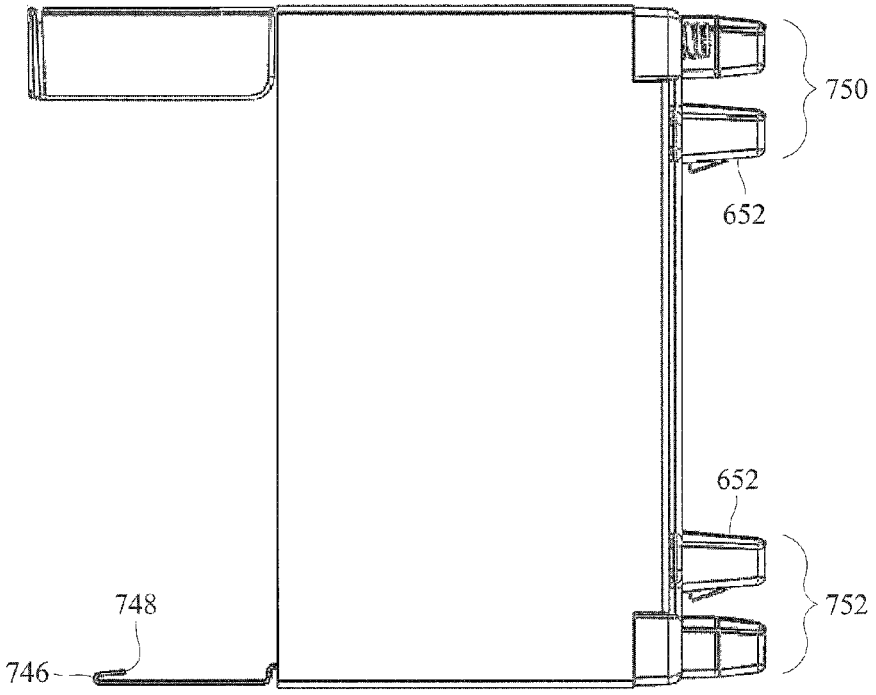
FIG. 74 is a side view of a portion of the merchandise module forming part of the merchandise display system of the present invention shown in FIG. 58.
Figure 75:
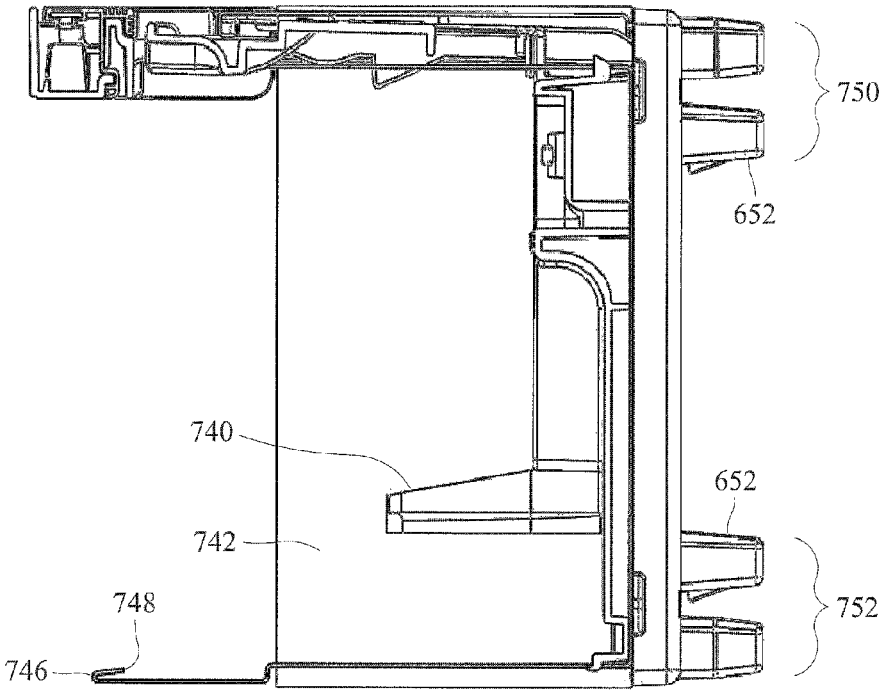
FIG. 75 is a partially cut away, side view of the merchandise module forming part of the merchandise display system of the present invention shown in FIG. 58.
Figure 76:
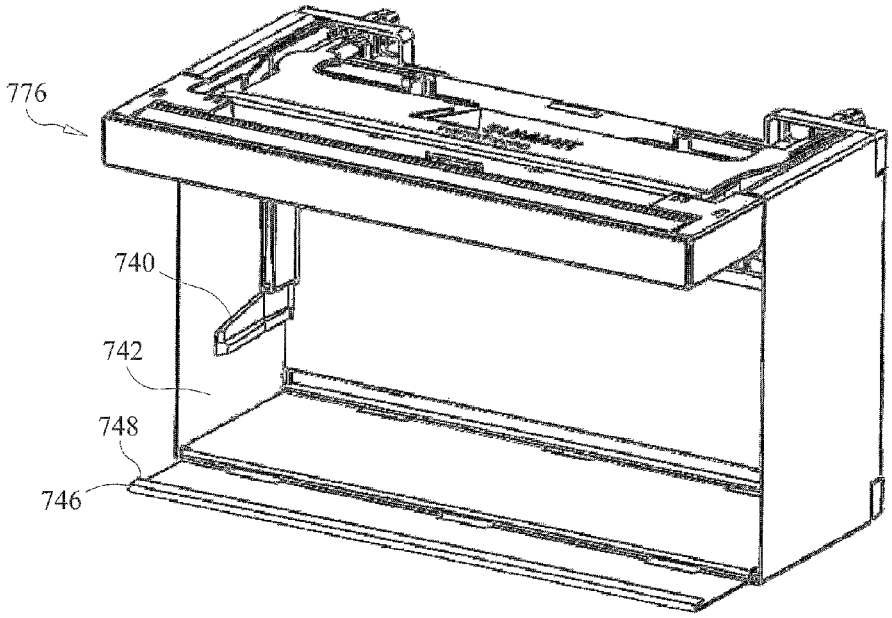
FIG. 76 is a front perspective view of a portion of the merchandise module forming part of the merchandise display system of the present invention shown in FIG. 58.
Figure 77:
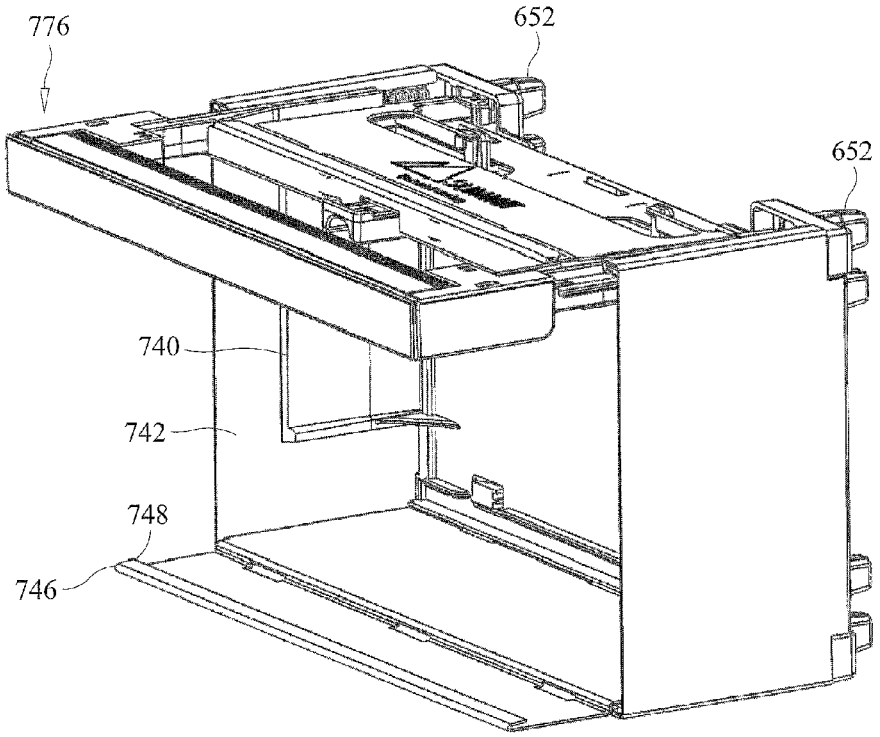
FIG. 77 is a front perspective view of a partially assembled merchandise module forming part of the merchandise display system of the present invention shown in FIG. 58.
Figure 78:
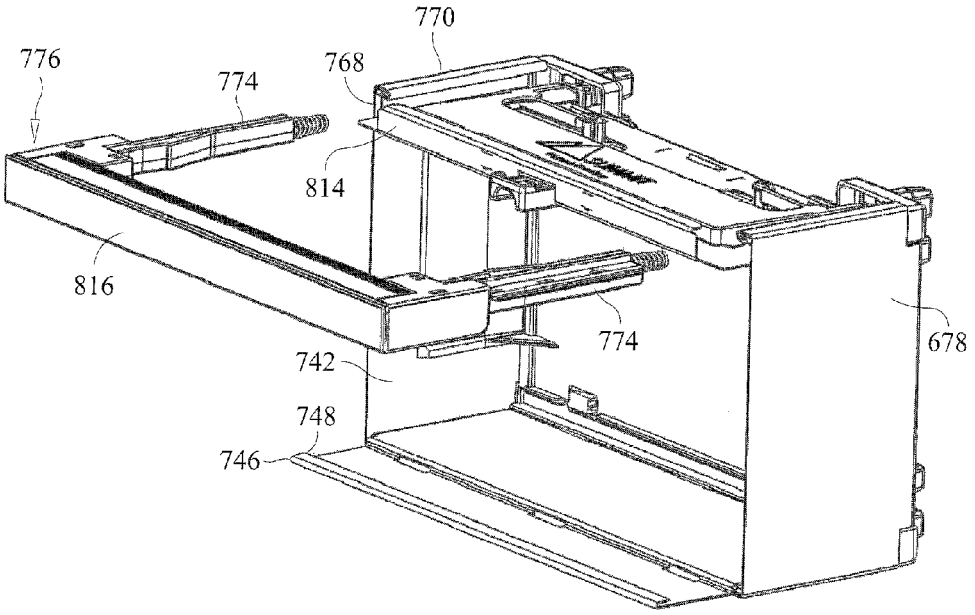
FIG. 78 is a partially exploded, front perspective view of a portion of the merchandise module forming part of the merchandise display system of the present invention shown in FIG. 58.
Figure 79:
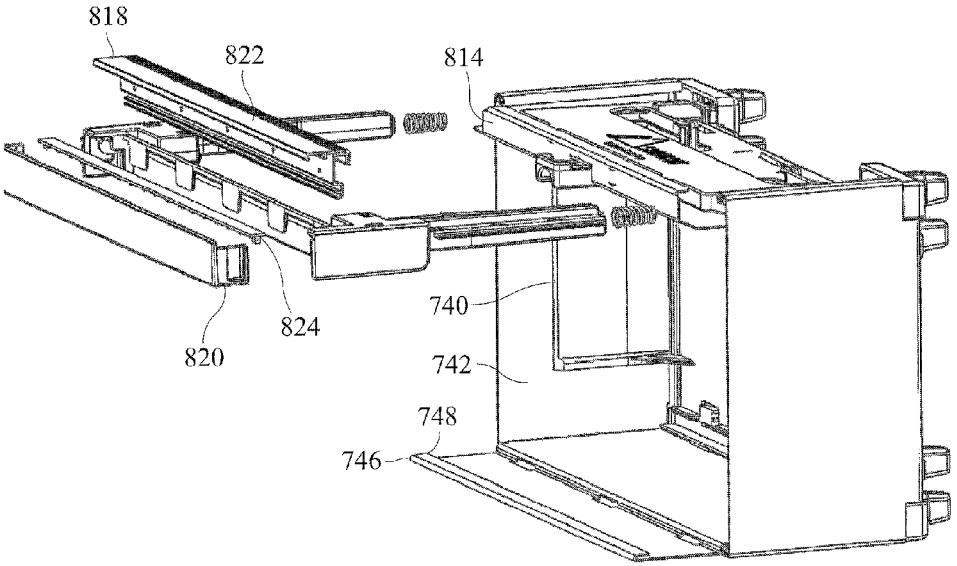
FIG. 79 is a partially exploded, front perspective view of the merchandise module forming part of the merchandise display system of the present invention shown in FIG. 58.
Figure 80:
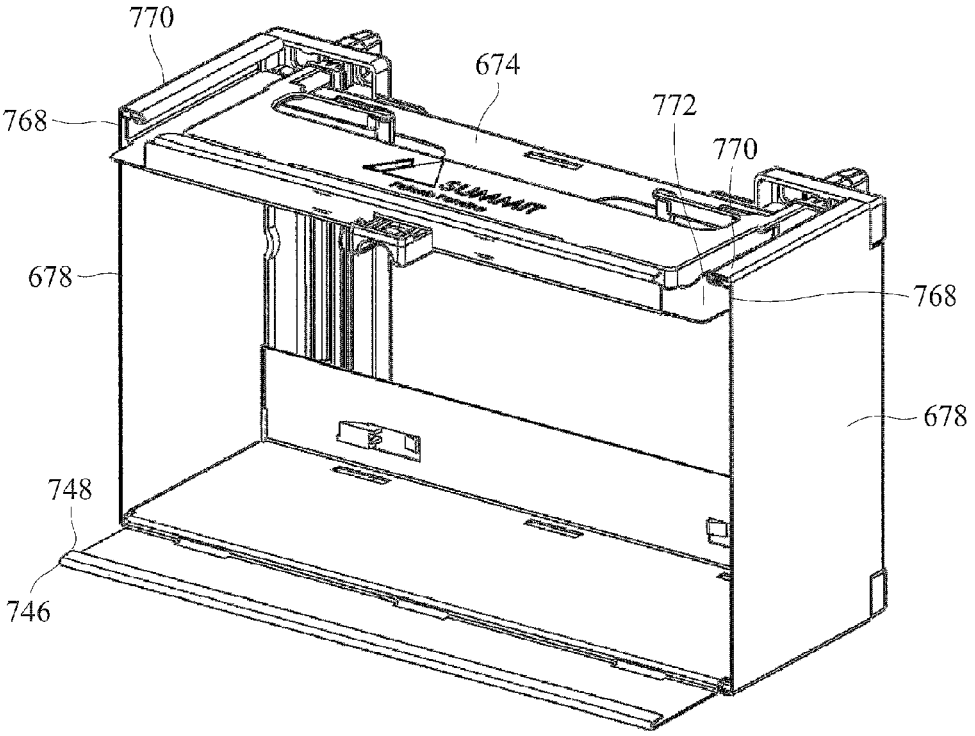
FIG. 80 is a front perspective view of a portion of the merchandise module forming part of the merchandise display system of the present invention shown in FIG. 58.
Figure 128:
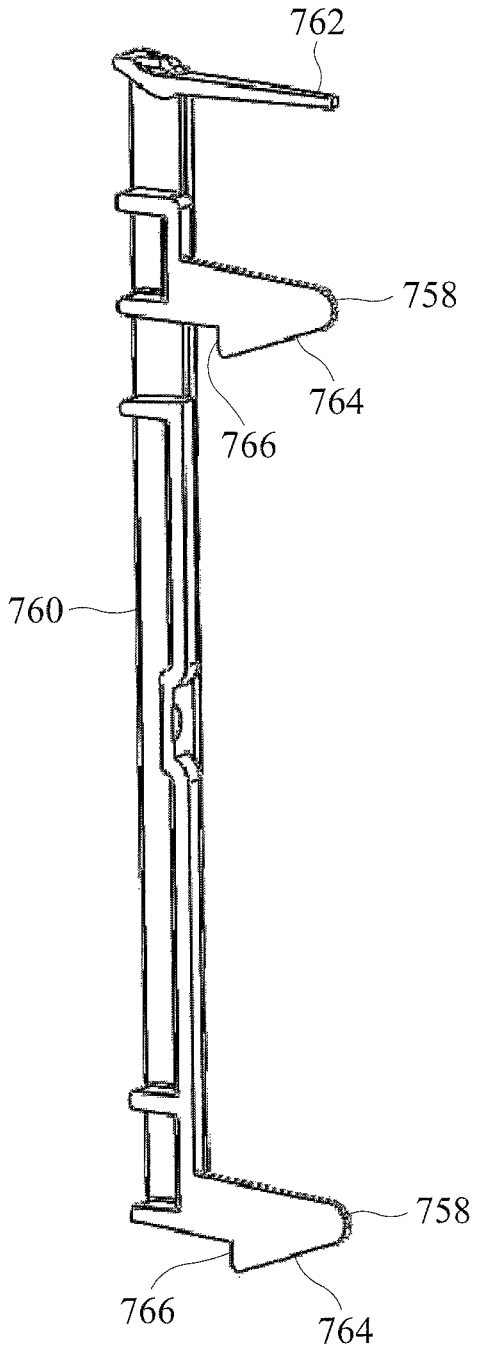

A lighted merchandise display module 620 forming part of the display system of the present invention is shown in FIGS. 70-128 of the drawings. As can be seen in FIGS. 59 and 71, a plurality of such modules 620 may be mounted on the indexing rails 636 and may be easily removed therefrom by activating the release mechanism on the modules and pulling on the module 620 in a direction normal to the frame 600 and indexing rails 636, without the need to remove any adjacent modules 620 mounted on the indexing rails 636 or adjacent pairs of indexing rails either above or below, or on either side, of the module being removed.

Figure 81:
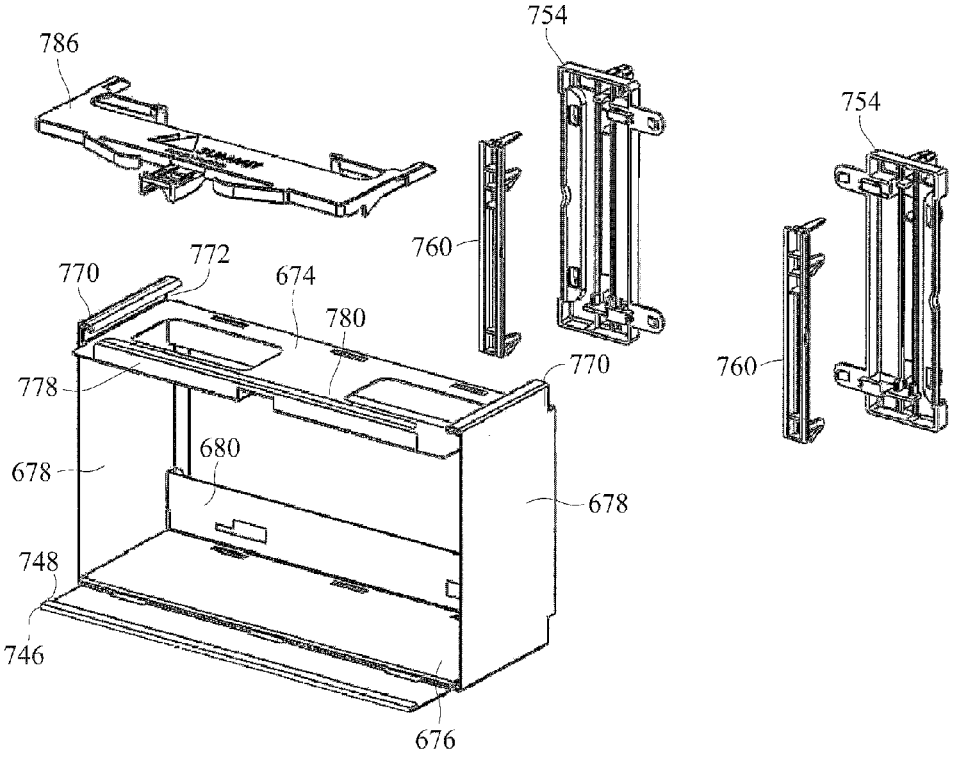
FIG. 81 is a partially exploded, front perspective view of the merchandise module forming part of the merchandise display system of the present invention shown in FIG. 58.
Figure 82:
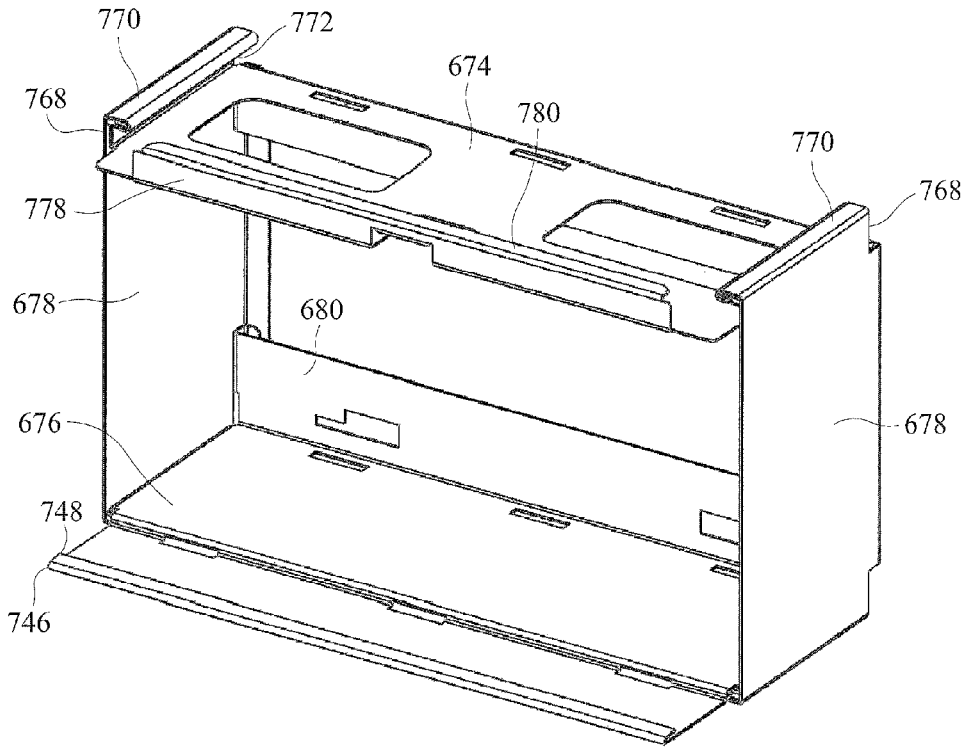
FIG. 82 is a front perspective view of a portion of the merchandise module forming part of the merchandise display system of the present invention shown in FIG. 58.

Each display module 620 includes a top wall 674, an opposite bottom wall 676, and two lateral side walls 678 which are opposite from each other. Each module 620 further includes at least partial back wall 680 joined to the top, bottom and lateral side walls 674, 676, 678 (see FIG. 81). Each of the walls 674-680 may be joined together by welding, fasteners or the like, or may be integrally formed from one sheet of metal or plastic and bent at fold lines at the junctures of adjacent walls.

As can be seen from FIGS. 70, 85, 86 and 114-121, the bottom wall 676 of the module 620 supports a removable merchandise pusher tray 682 for displaying merchandise thereon. Preferably, each merchandise pusher tray 682 includes pairs of upstanding divider walls 684, and merchandise pusher elements 686 situated between the divider walls 684 of each pair. The pusher elements 686 are generally L-shaped members, formed of an interconnected vertical leg 688 and a horizontal leg 690, having a coiled spring 692 mounted thereon. One end of each coiled spring 682 is affixed to the bottom wall 694 of the pusher tray 682, within the confines of the divider walls 684 of each pair, and the other end of the coiled spring 692 is affixed to a respective pusher element 686.

The horizontal leg 690 of the L-shaped pusher elements 686 includes a T-shaped rail 696 extending downwardly from the bottom surface thereof, which is received within a track, or elongated slot 698, extending from the back toward the front of the bottom wall 69 of the tray 682. The coiled spring 692 mounted on the pusher elements 686 biases the pusher elements towards the front of the tray 682 so that the pusher elements 686 exert pressure on any merchandise items situated in front thereof, that is, between the vertical leg 688 of the L-shaped pusher elements 686 and a partial, front wall 700 of the pusher tray 682.

In a preferred form, and as shown in FIGS. 115-121, each pusher element 686 includes a pair or more of laterally spaced apart protruding walls 702 extending outwardly from the front surface of the vertical leg 688 of the L-shaped pusher element (see FIGS. 103 and 107-109). Each protruding wall 702 preferably has an angled front edge which is sloped upwardly and inwardly of the front surface towards the top free end portion of the vertical leg 688 of the L-shaped pusher element 686 such that each wall 702 extends outwardly from the front surface of the pusher element 686 to a greater extent at the bottom portion of the vertical leg 688 than at the top free end portion thereof. This slope of walls 702 not only facilitates the removal of merchandise items from between the pusher elements 686 and the partial front wall 700 of the tray 682, but also tilts the merchandise items displayed in front of the pusher elements 686 backwardly so that light from the lighted header assembly 776, which will be described in greater detail, on the module 620 will illuminate and brighten the front faces of the merchandise items that are viewable to a consumer.

Figure 105:
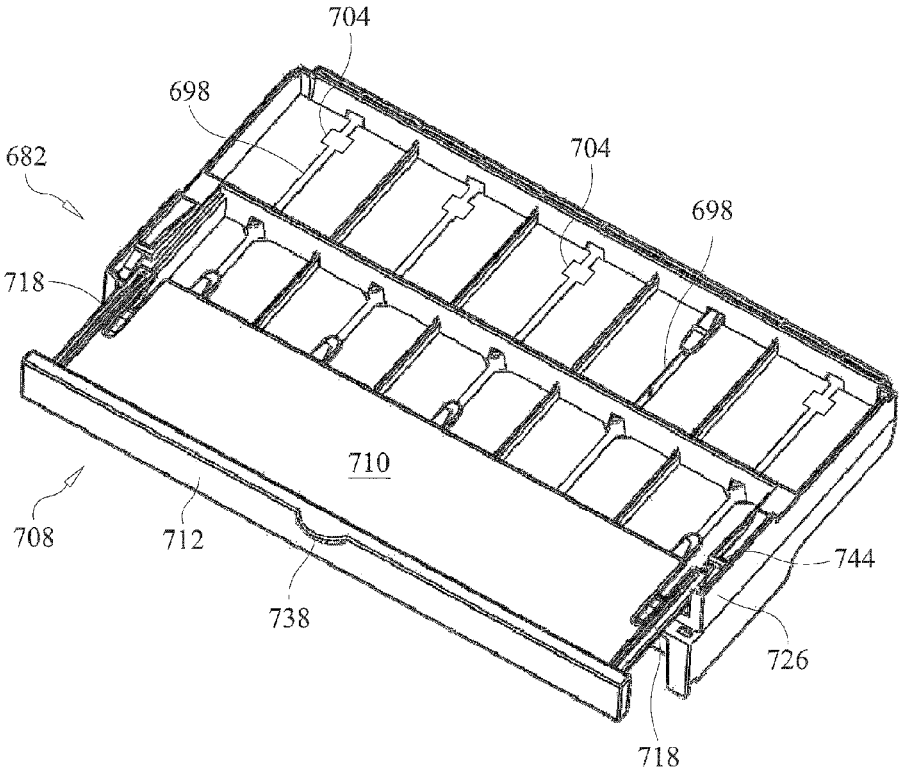
FIG. 105 is a top perspective view of a portion of the merchandise module forming part of the merchandise display system of the present invention shown in FIG. 58.
Figure 106:
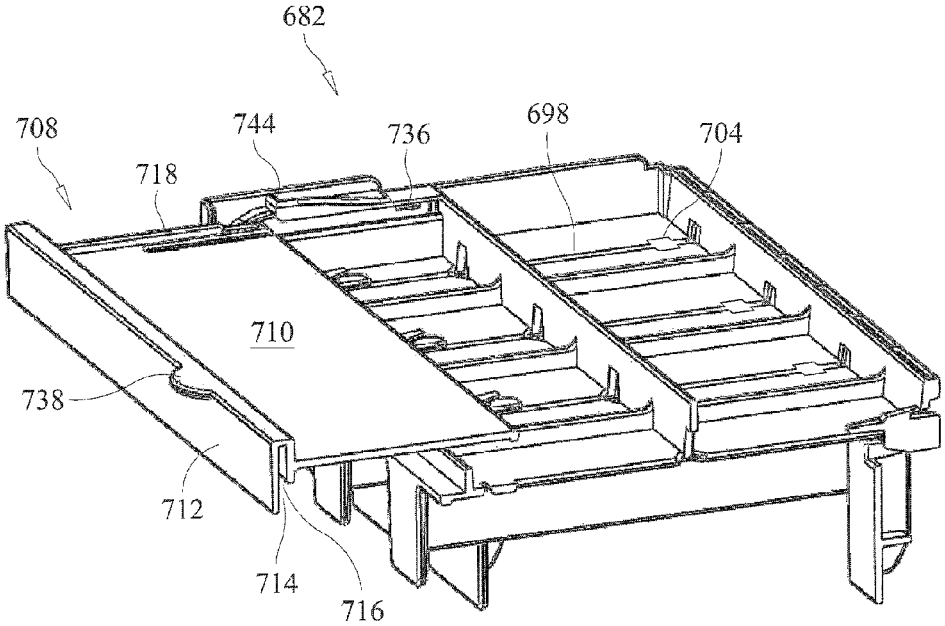
FIG. 106 is a partially cut away, bottom perspective view of a portion of the merchandise module forming part of the merchandise display system of the present invention shown in FIG. 58.
Figure 107:
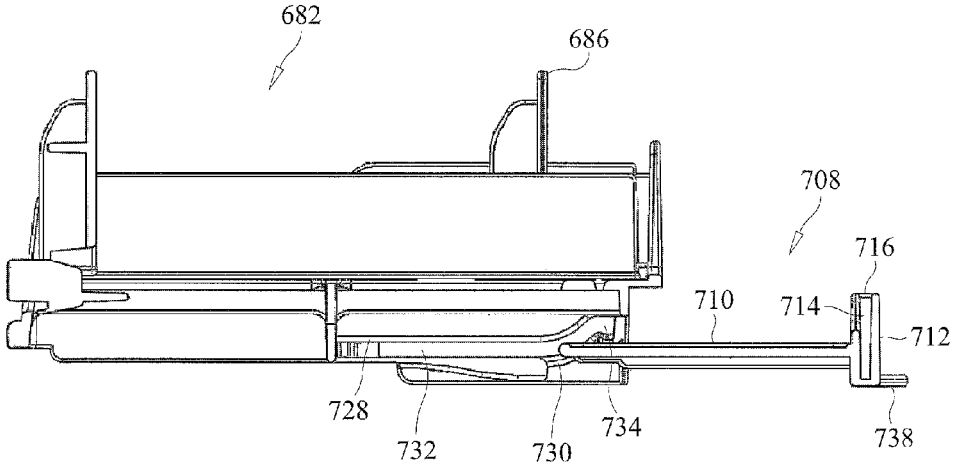
FIG. 107 is a partially cut away, side view of a portion of the merchandise module forming part of the merchandise display system of the present invention shown in FIG. 58.
Figure 108:
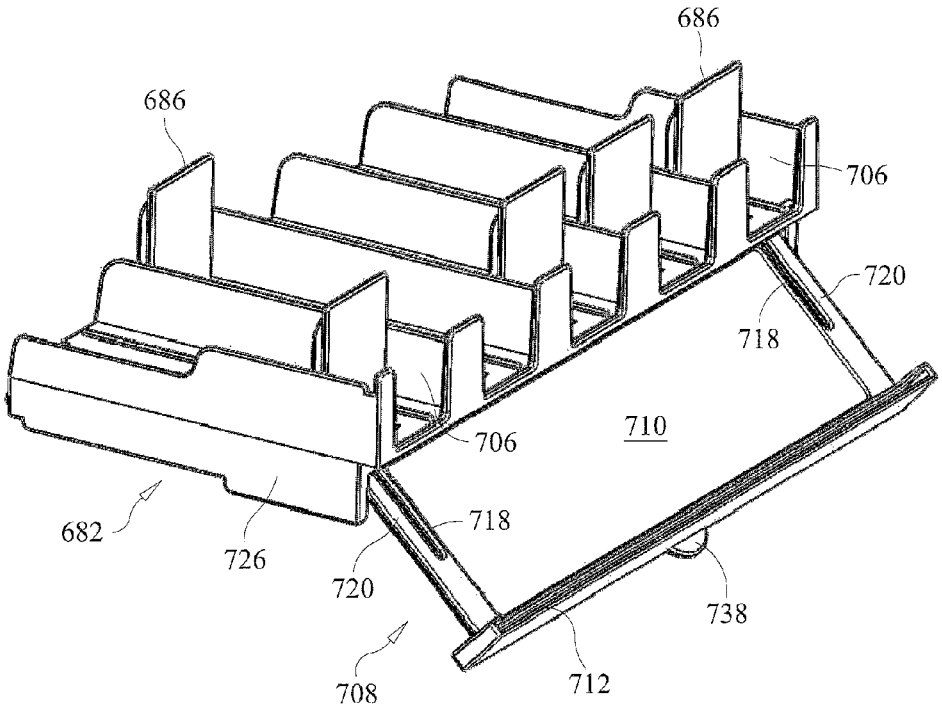
FIG. 108 is a front perspective view of a portion of the merchandise module forming part of the merchandise display system of the present invention shown in FIG. 58.
Figure 109:
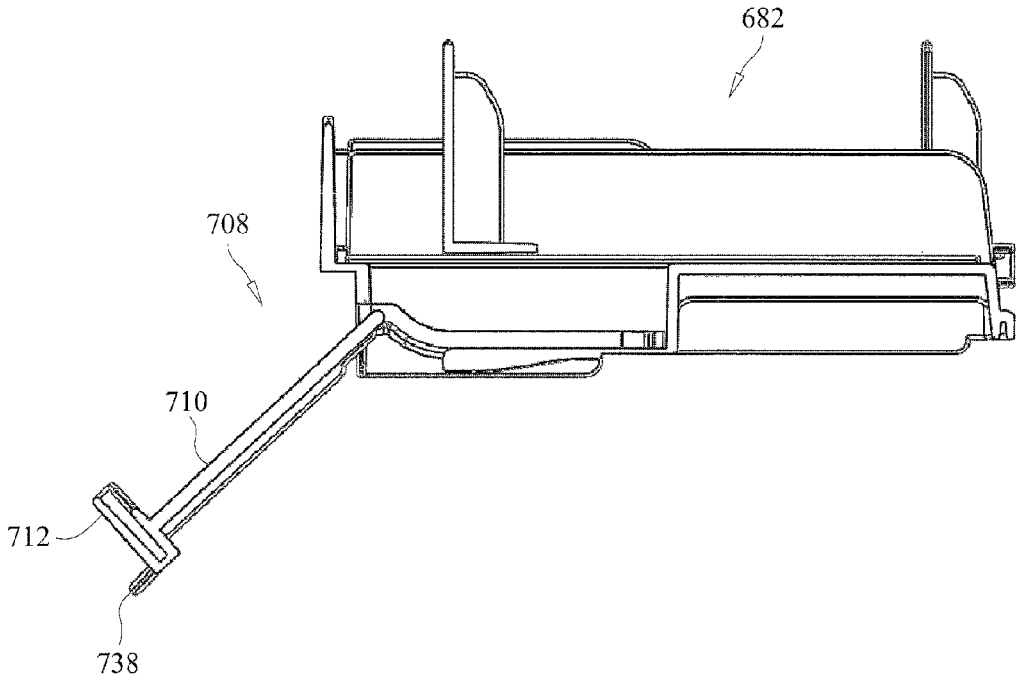
FIG. 109 is a partially cut away, side view of a portion of the merchandise module forming part of the merchandise display system of the present invention shown in FIG. 58.
Figure 110:
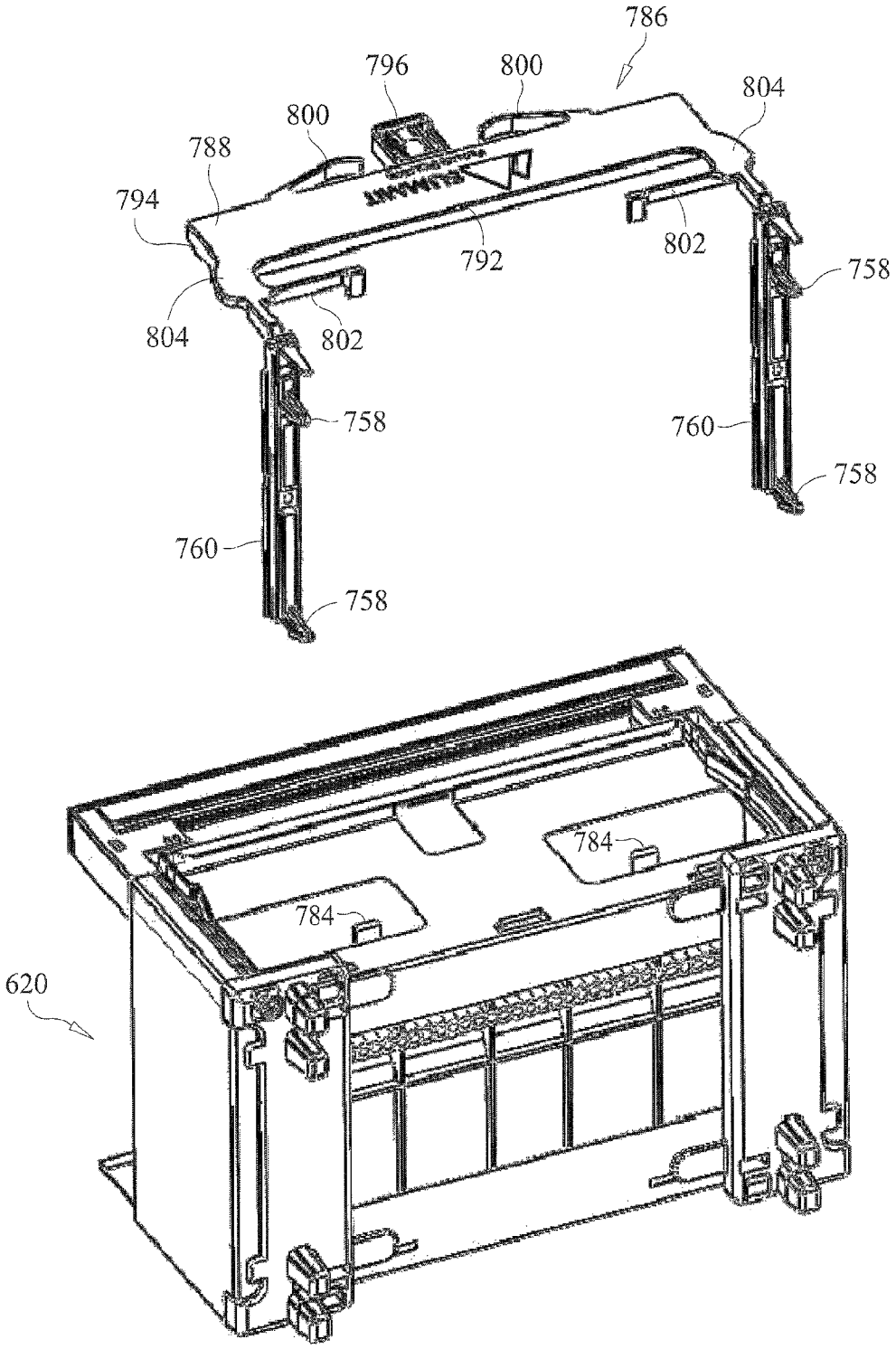
FIG. 110 is a partially exploded, rear perspective view of the merchandise module forming part of the merchandise display system of the present invention shown in FIG. 58.
Figure 111:
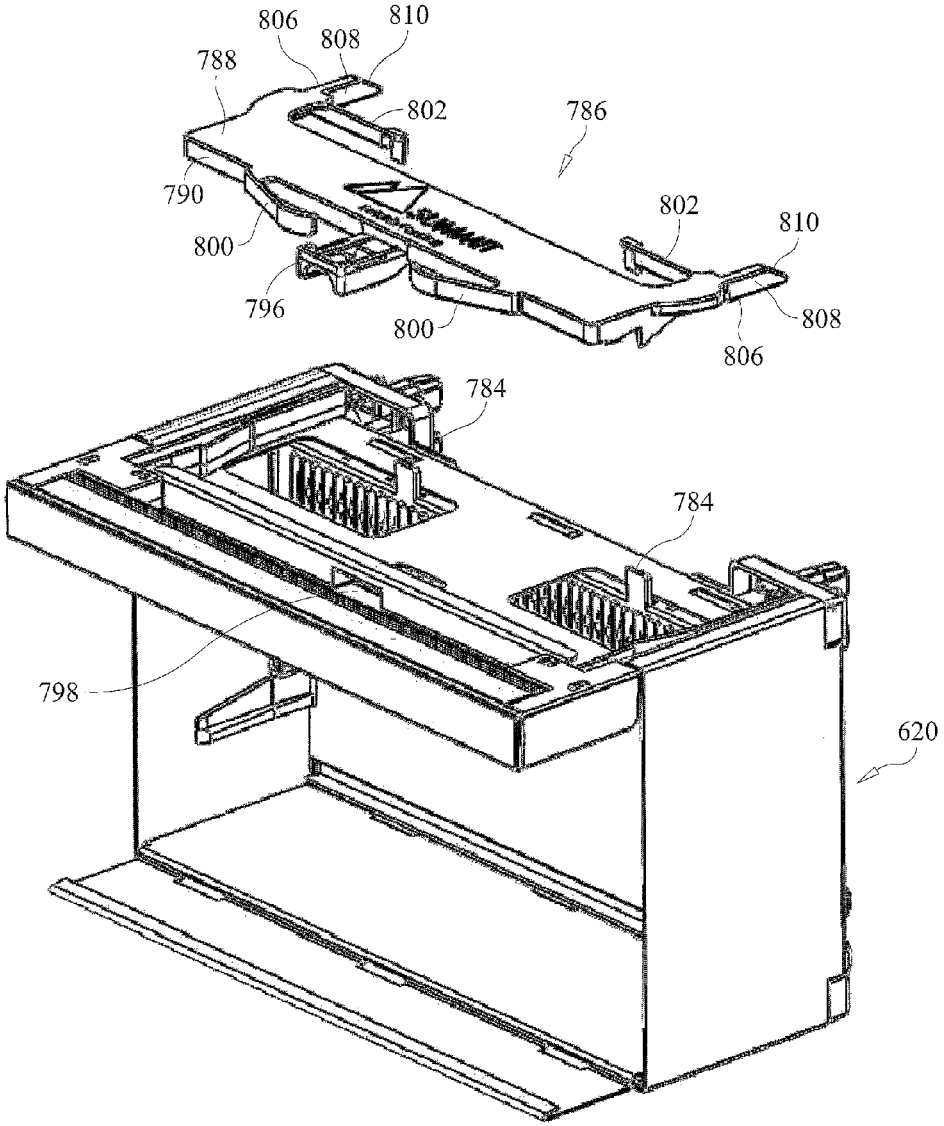
FIG. 111 is a partially exploded, front perspective of the merchandise module forming part of the merchandise display system of the present invention shown in FIG. 58.
Figure 112:
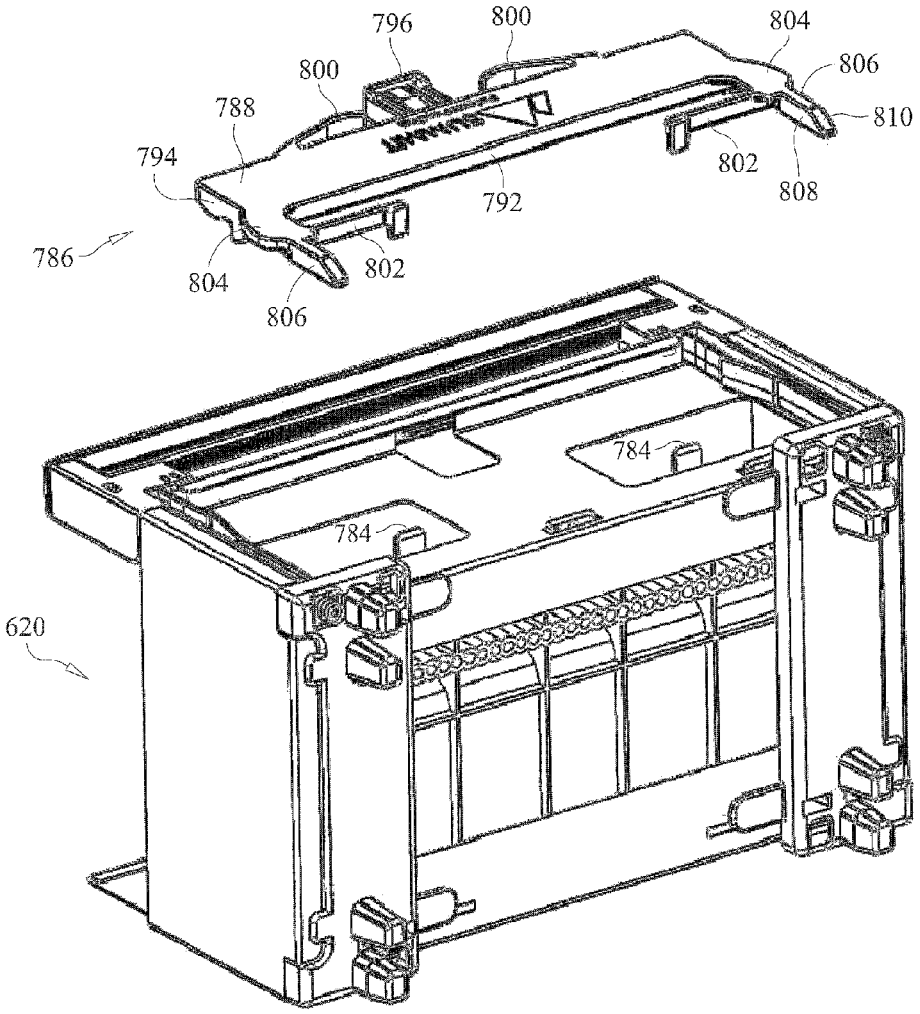
FIG. 112 is a partially exploded, rear perspective view of the merchandise module forming part of the merchandise display system of the present invention shown in FIG. 58.
Figure 113:
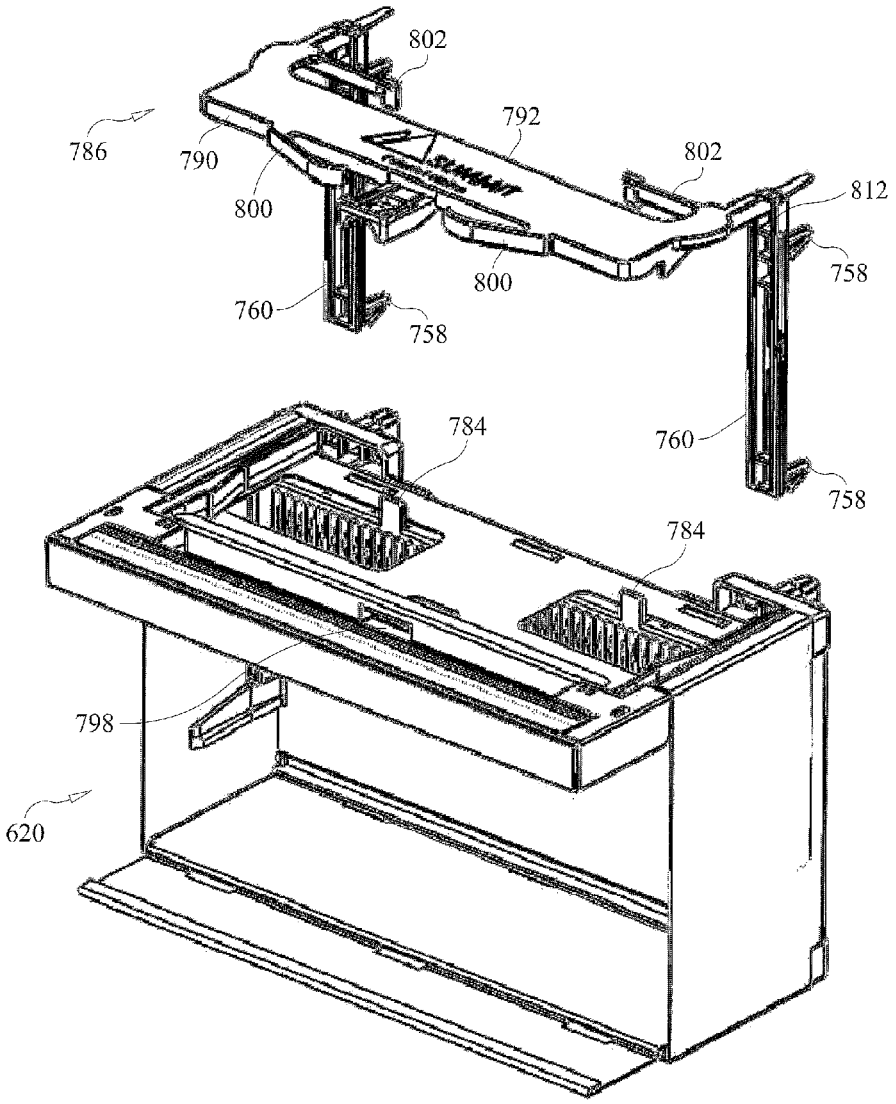
FIG. 113 is a partially exploded, front perspective view of the merchandise module forming part of the merchandise display system of the present invention shown in FIG. 58.
Figure 114:
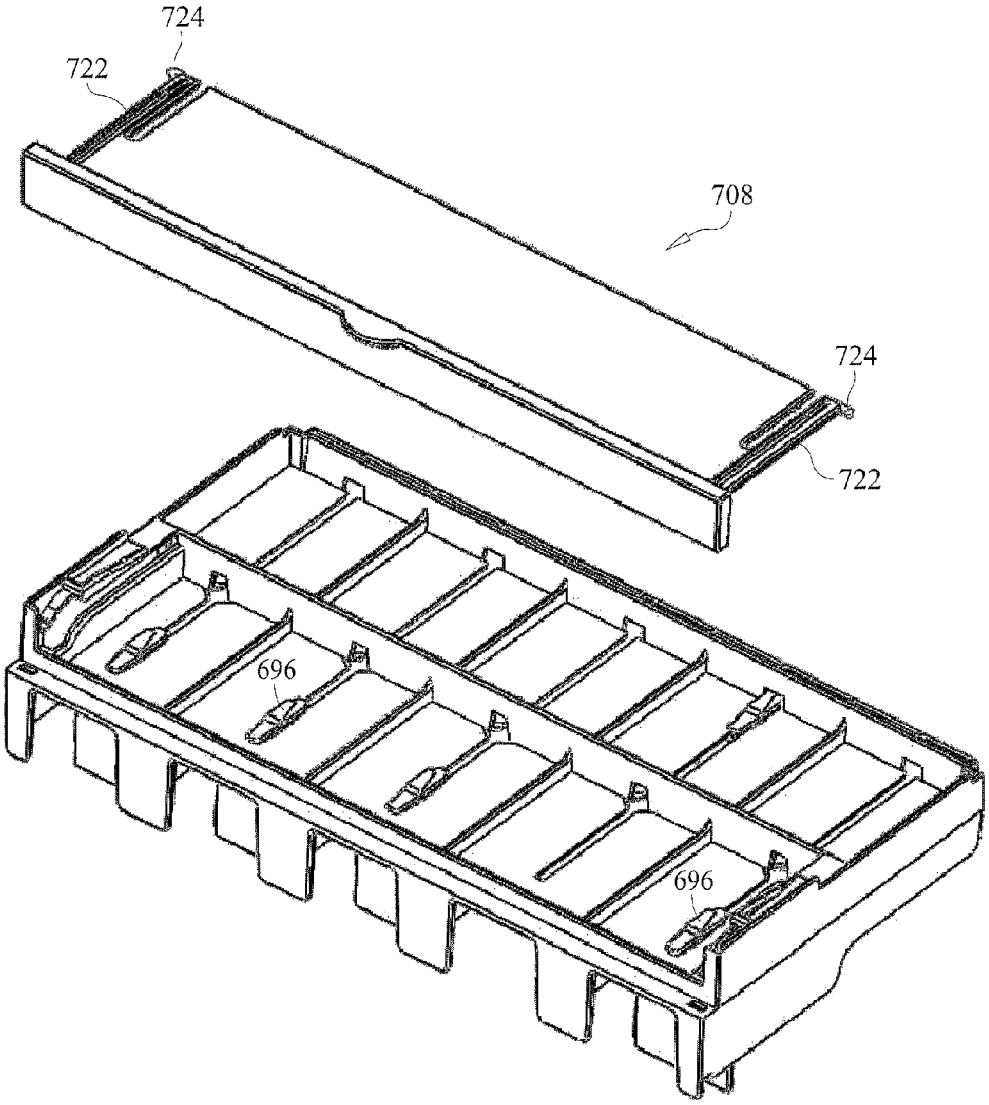
FIG. 114 is a partially exploded, bottom perspective view of a portion of the merchandise module forming part of the merchandise display system of the present invention shown in FIG. 58.
Figure 115:
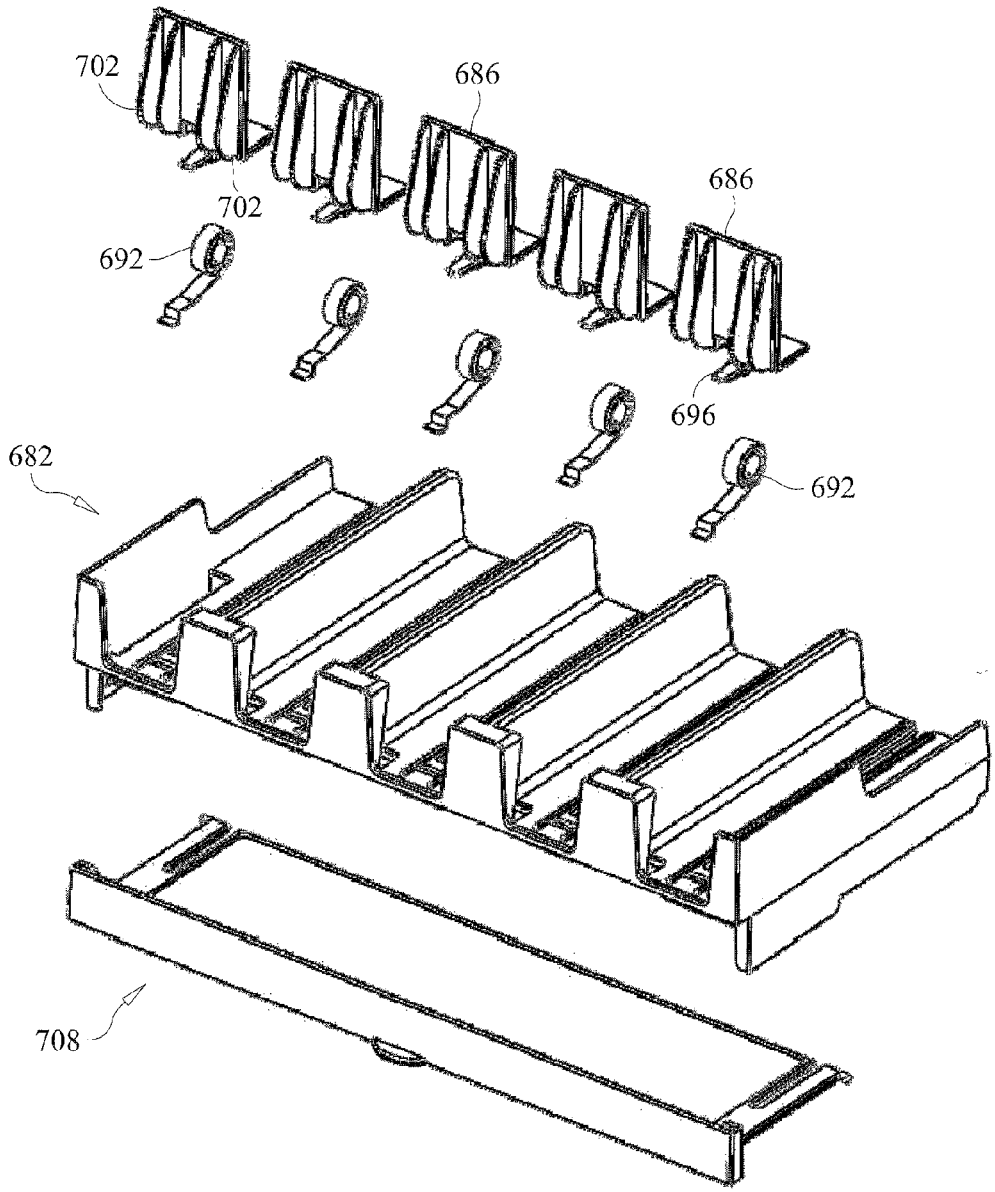
FIG. 115 is a partially exploded, front perspective view of a portion of the merchandise module forming part of the merchandise display system of the present invention shown in FIG. 58.
Figure 116:
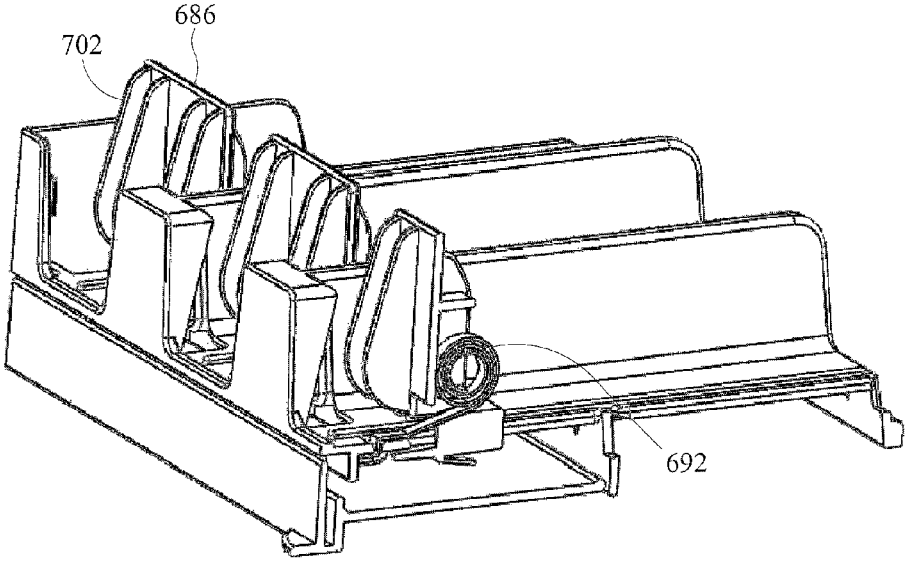
FIG. 116 is a partially cut away, front perspective view of a portion of the merchandise module forming part of the merchandise display system of the present invention shown in FIG. 58.
Figure 117:
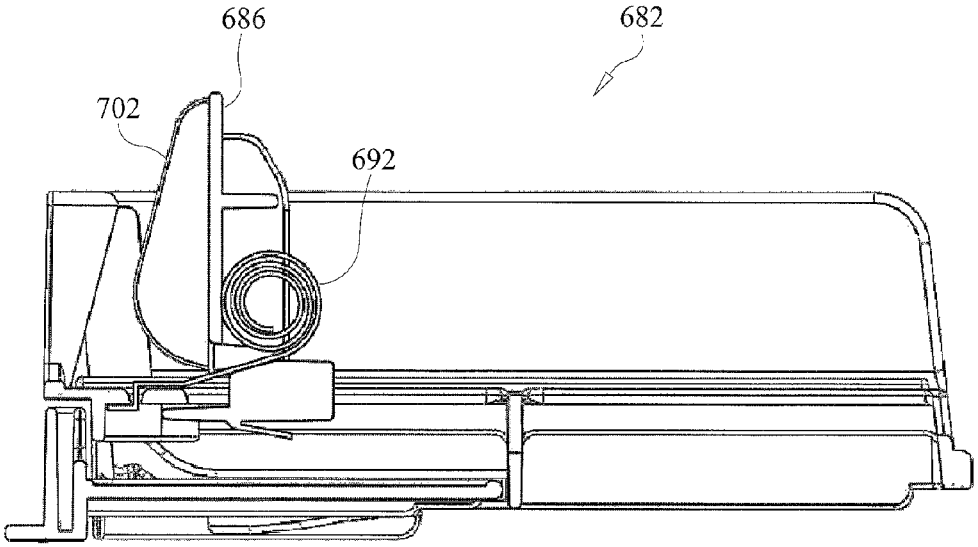
FIG. 117 is a partially cut away, side view of a portion of the merchandise module forming part of the merchandise display system of the present invention shown in FIG. 58.
Figure 118:
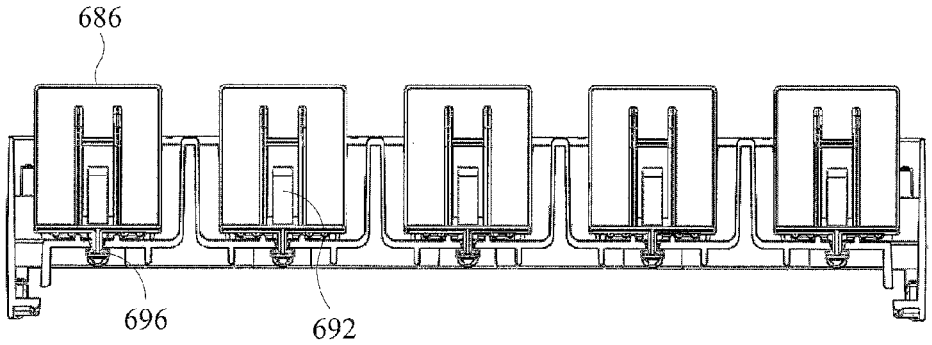
Figure 119:
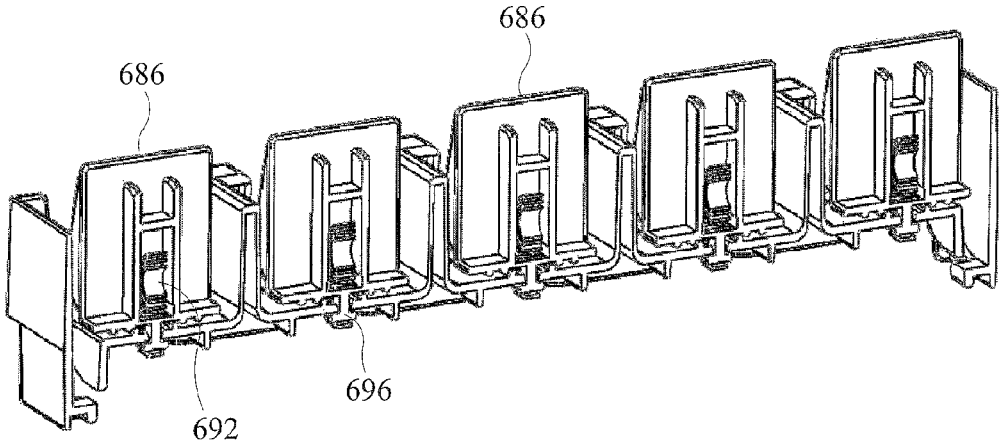
Figure 120:
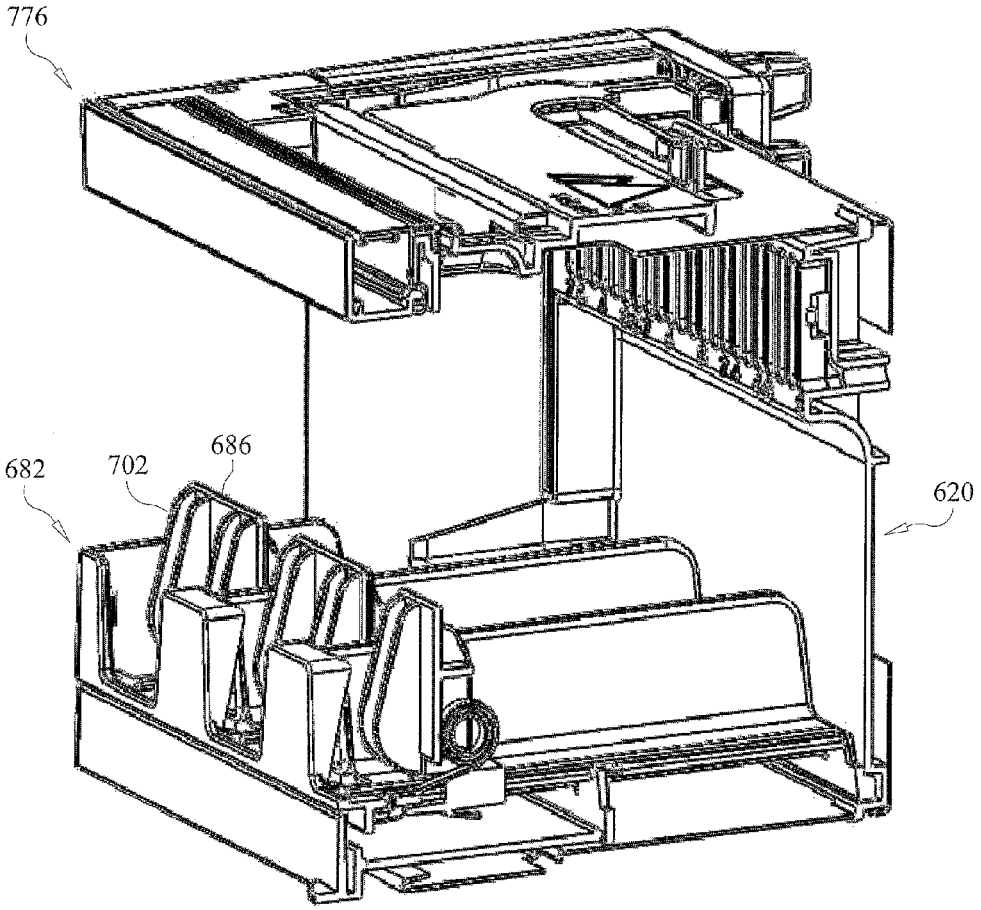
Figure 121:
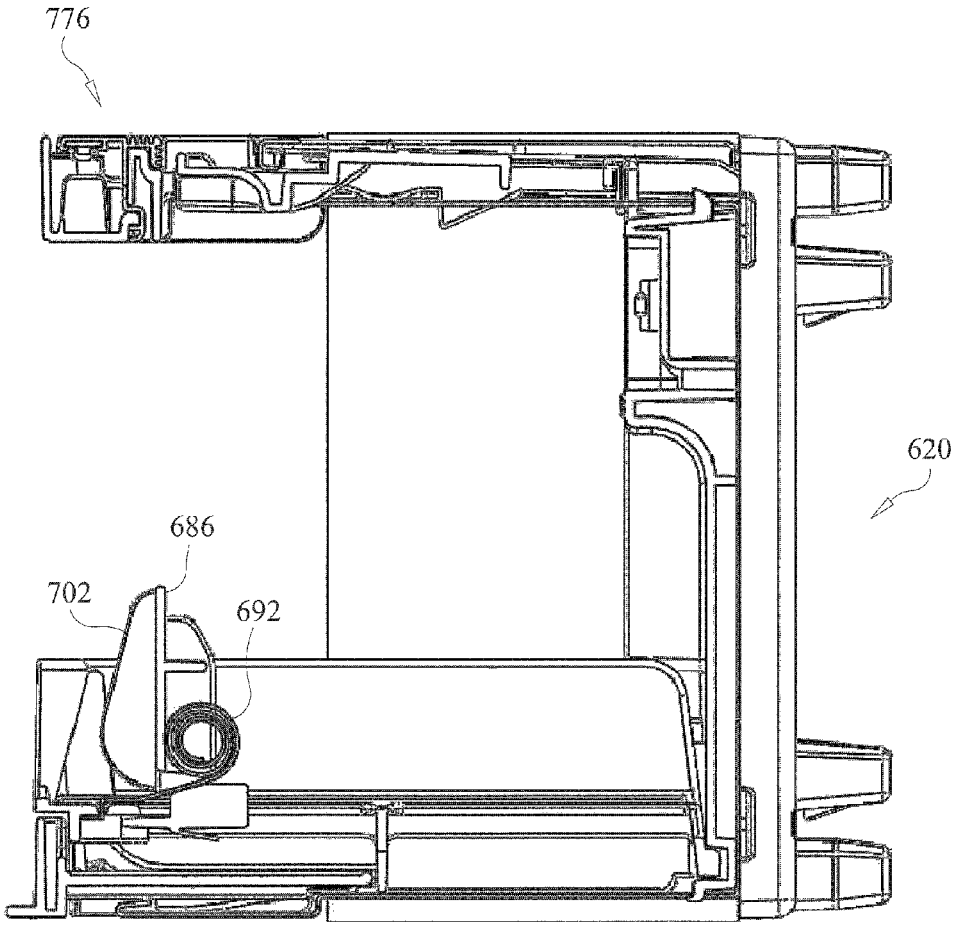
Figure 122:
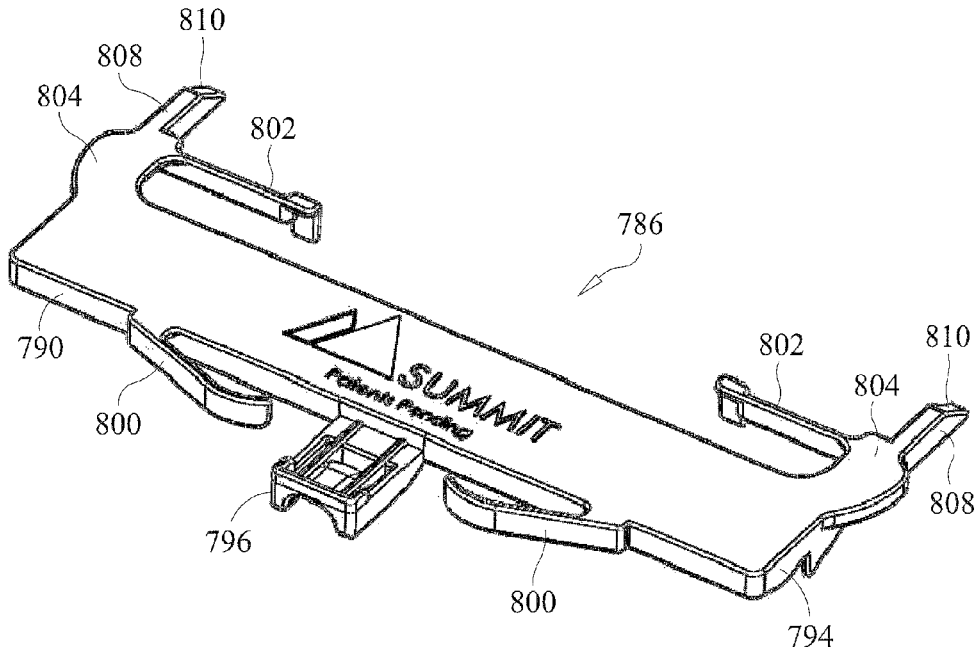
Figure 123:
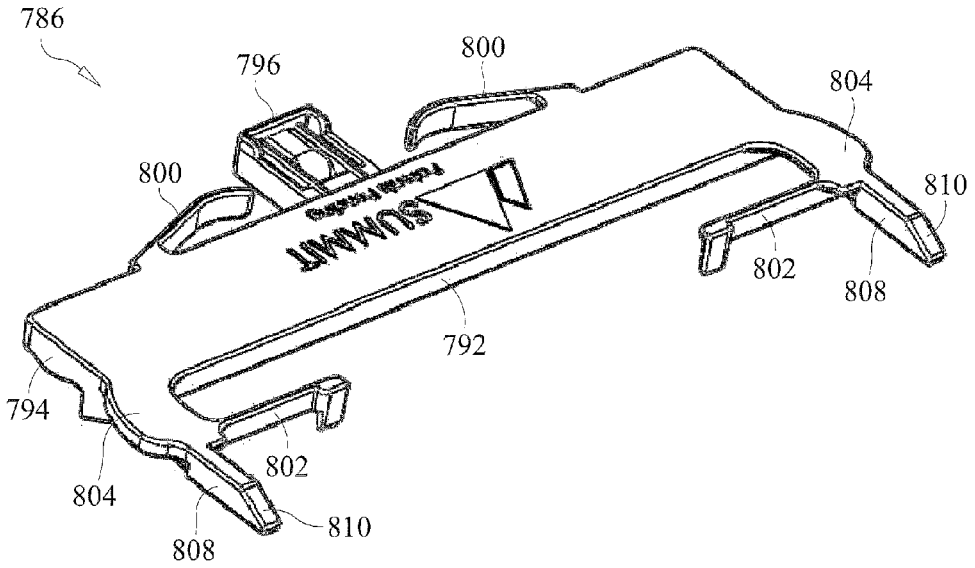
Figure 124:
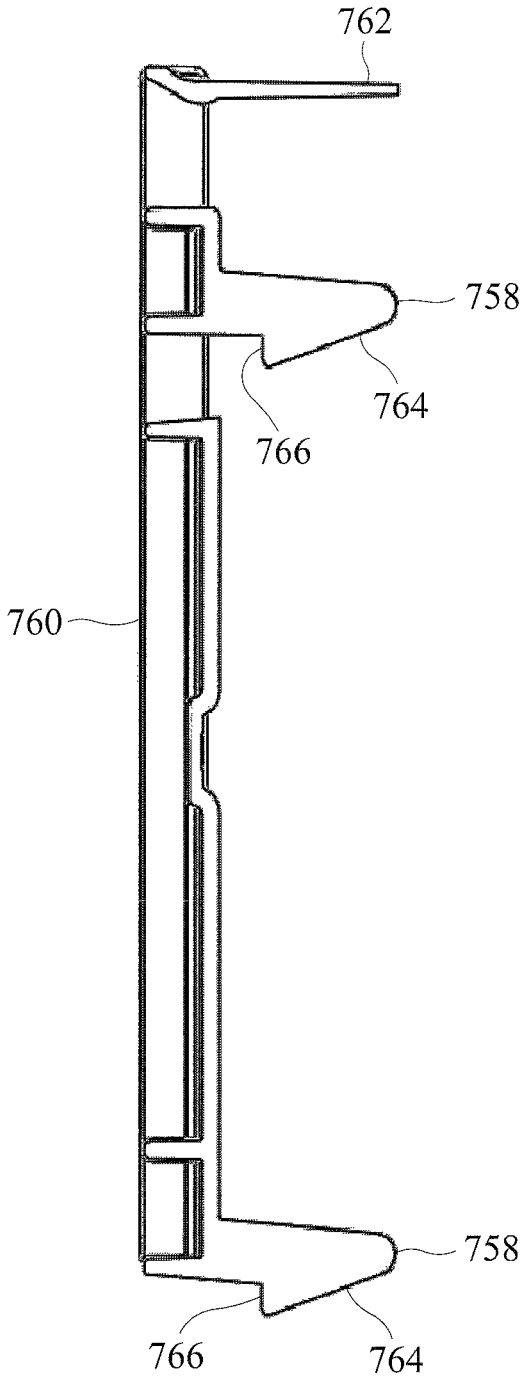
Figure 125:
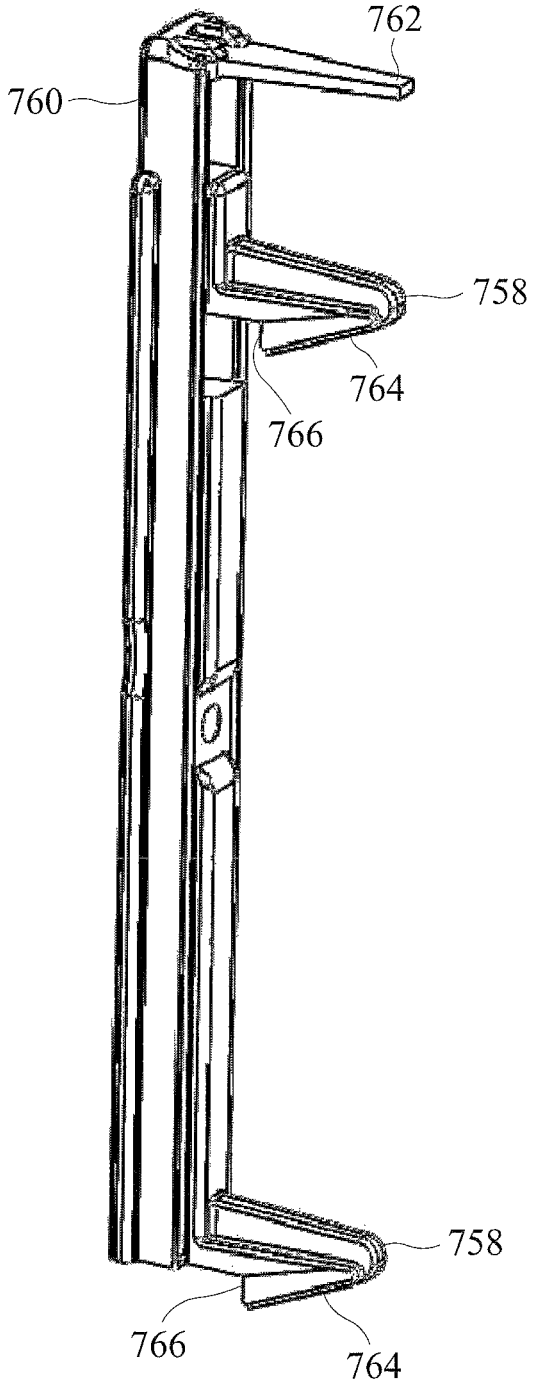
Figure 126:
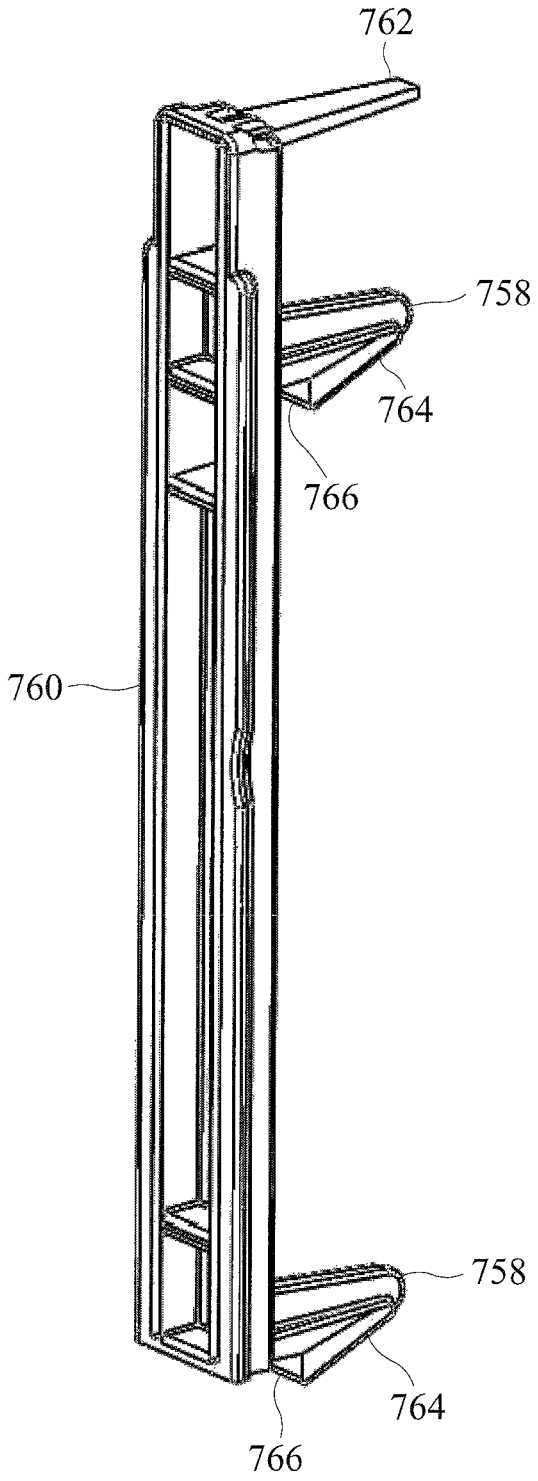
Figure 127:
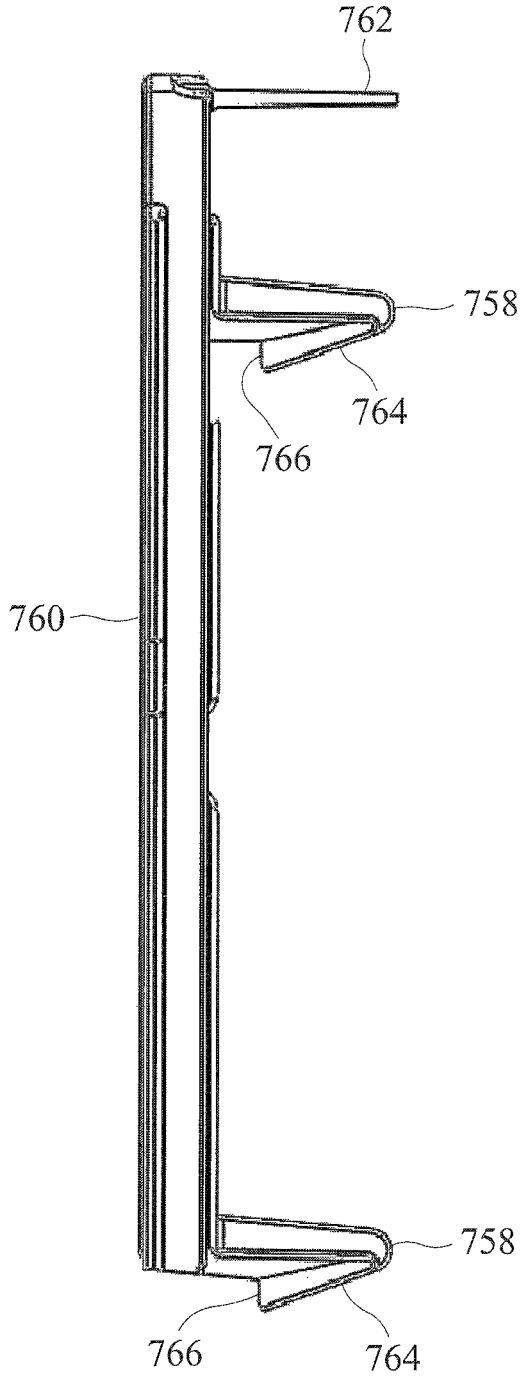

The tracks, or slots 698, in which the pusher elements 686 reciprocatingly slide include a portion 704 thereof with an enlarged width that is greater than the width of the T-shaped rail 696 of the pusher element 686 so that the pusher elements may be removed from between the divider walls 684 and replaced with a different pusher element, perhaps having a taller vertical leg 688 (see FIGS. 105 and 106).

Also, the partial front wall 700 of the tray 682 includes U-shaped cutouts 706 formed through the thickness thereof in alignment with the pusher elements 686 so that merchandise items situated in front of the pusher elements 686 may be easily grasped by a shopper in the retail establishment by using his or her fingers through the U-shaped cutouts 706.

The pusher tray 682 also preferably includes a slide out lower tray 708 mounted thereon, as more particularly shown in FIGS. 103-109. More specifically, the slide out lower tray 708 includes a bottom plate 710, and a short, double-walled front panel 712 mounted perpendicularly on a front edge of the bottom plate 710. The short front panel 712 defines a channel 714 running between the lateral sides of the slide out tray 708. This front channel 714 includes an open top side 716 so that a placard or strip of paper or plastic may be inserted therein, residing in front of each of the pusher elements 686, with indicia thereon to identify the merchandise held by the tray 682.

Each lateral side portion of the bottom plate 710 of the slide out lower tray 708 includes a slot 718 formed through the thickness thereof to define partially inwardly resilient edge legs 720, each leg 720 having a free end 722 and a pin 724 extending outwardly from each leg 720 in opposite directions. Opposite lateral side walls 726 of the pusher tray 682, which extend downwardly from the bottom wall 694 thereof, include a pair of generally parallel upper and lower flanges 728, 730, which define a slot or track 732 therebetween in which each pin 724 of the slide out lower tray 708 may reciprocatingly slide (see FIG. 107). The front portions of the upper and lower flanges 728, 730 are curved slightly upwardly, and each lower flange 730 has a concave surface defining a partial pocket 734 (see FIG. 107) in which the pin 724 can rest and pivot when the slide out lower tray 708 is pulled to its greatest extent outwardly from the front of the pusher tray 682.

When the slide out lower tray 708 is fully received within the slot or track 732, defined between the upper and lower flanges 728, 730 over the rear portion of the flanges, the lower edge of the upper flange 728 contacts the upper surface of the leg 720 on each lateral side of the slide out lower tray 708, and the upper edge of the lower flange 730 contacts the lower surface of the leg 720 on each lateral side of the slide out lower tray 708, so that the lower tray slides 708 out in front of the pusher tray 682 in a parallel direction with respect to the pusher tray. However, when the slide out lower tray 708 is extended from the front of the pusher tray 682 to where the upper and lower flanges 728, 730 are curved upwardly, and the pins 724 are received within the concave partial pockets 734 formed in the lower flanges 730, the upper flanges 728 do not contact the lateral edge legs 720 of the lower tray 708 to allow the lower tray to pivot downwardly at an angle with respect to bottom wall 694 of the pusher tray 682. This allows the owner or a worker of the retail establishment to easily replace the merchandise-identifying placard or paper strip received in the channel 714 of the front panel 712 of the slide out lower tray 708, even for modules 620 which are mounted high on the frame 600 or indexing rails 636 of the display.

Towards the rear portion of the slot or track 732 in which each pin 724 of the slide out lower tray 708 reciprocatingly slides, there is an inwardly extending ramp protrusion 736 having an inclined surface protruding from the inside surface of each side wall 726 of the pusher tray 682 (see FIG. 106). Because of the partial resiliency of the lateral edge legs 720 of the slide out lower tray 708, an employee or owner of the retail establishment may push on the slide out lower tray inwardly toward the pusher tray 682, so that the pins 724 ride over the inclined surface of the ramp protrusions 736 to rest in the rear end portion of the slot or track 732 situated past the inclined surface in order to retain the slide out lower tray 708 in a closed position on the pusher tray 682, with the front surface of the front panel 712 being flush with the front surface of the partial front wall 700 of the pusher tray 682. The owner or employee of the retail establishment need only exert a light pulling force on the slide out lower tray 708 to overcome the resistance provided by the ramp protrusions 736 on the pins 724 in order to extend the slide out lower tray 708 from the pusher tray 682.

Preferably, a tab 738 is mounted on the front surface of the front panel 712 of the slide out lower tray 708 and extends outwardly therefrom to allow the owner or employee of the retail establishment to grasp the tab 738 to extend the slide out lower tray 708 from the pusher tray 682.

The pusher tray 682, with its slide out lower tray 708, is removably mounted within the interior space defined by the merchandise module 620, and rests on the upper surface of the bottom wall 676 thereof. Preferably, each lateral side wall 678 of the module 620 includes an inner plate 740 mounted against the inside surface thereof. The bottom edge of each plate 740 is spaced from the top surface of the bottom wall 676 to define a slot 742 between the plate 740 and the bottom wall 676 for receiving therebetween a respective side wall 726 of the pusher tray 682.

A protrusion 744 extends outwardly from the inside surface of each lateral side wall 678 of the pusher tray 682, and is positioned thereon a predetermined distance from the front wall 700 of the pusher tray 682. The front edge portion 746 of the bottom wall 620 of the module is folded over itself to define a shoulder 748.

When the pusher tray 682 is inserted into the merchandise module 620, the lateral side walls 678 of the pusher tray are received within the slots 742 formed between the side wall plates 740 and the bottom wall 676 of the module, until the protrusions ride over the folded-over front edge portion 746 of the bottom wall 676 and rest thereon behind the shoulder 748 defined by the folded-over front edge portion 746 of the bottom wall 676, thus maintaining the pusher tray 682 in place within the interior space defined by the merchandise module 620. To remove the pusher tray 682 from the merchandise module 620, the owner or employee of the retail establishment lifts the pusher tray 682 slightly so that the protrusions 744 are raised above the shoulder 748 defined by the folded-over front edge portion 746 of the bottom wall 676. The pusher tray 682 may then be slid out of its receiving slots 742 on the side walls 678 of the module 620 and removed from the module.

The release mechanism for removing a module 620 from the indexing rails 636 of the display system will now be described. As in other embodiments, there are locator pins or protrusions 652 extending outwardly from the rear surface of the back wall 680 of each module 620. These locator protrusions 652 are received in the openings 650 formed in the front wall 640 of the indexing rails 636. Preferably, there are an upper pair 750 of locator protrusions 652 and a lower pair 752 of locator protrusions situated on each opposite lateral side portion of the back wall 680 of the module 620 and extending outwardly therefrom. Preferably, the protrusions 652 extend outwardly from rear plates 754 mounted on the outside surface of the back wall 680 of each module 620. The protrusions 652 of each pair of the upper and lower pairs 750, 752 of protrusions 652 are spaced apart from each other, and the upper pair 750 and lower pair 752 of protrusions 652 are also spaced apart from each other, a predetermined distance so as to be in alignment with and be receivable by corresponding openings 650 formed in the indexing rails 636 of a pair of indexing rails of the display system.

Figure 102:
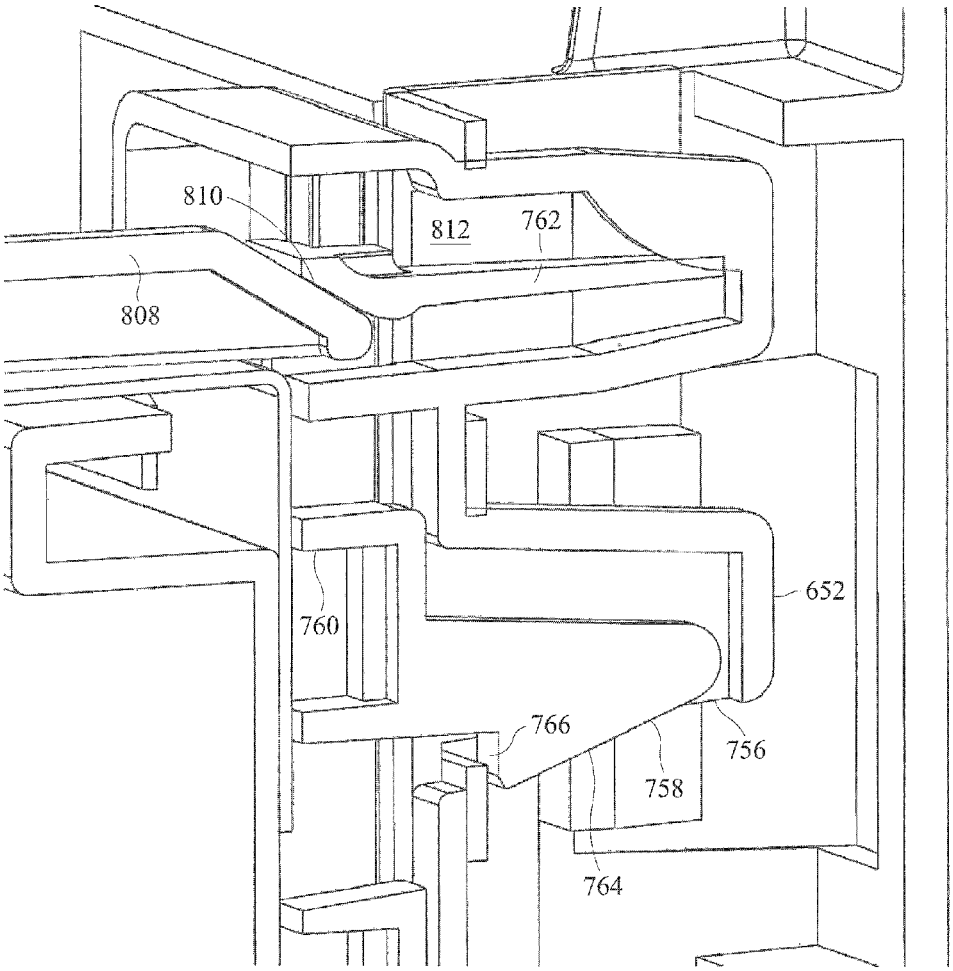
FIG. 102 is an enlarged, partially cut away, front perspective view of a portion of the merchandise module forming part of the merchandise display system of the present invention shown in FIG. 58.
Figure 103:
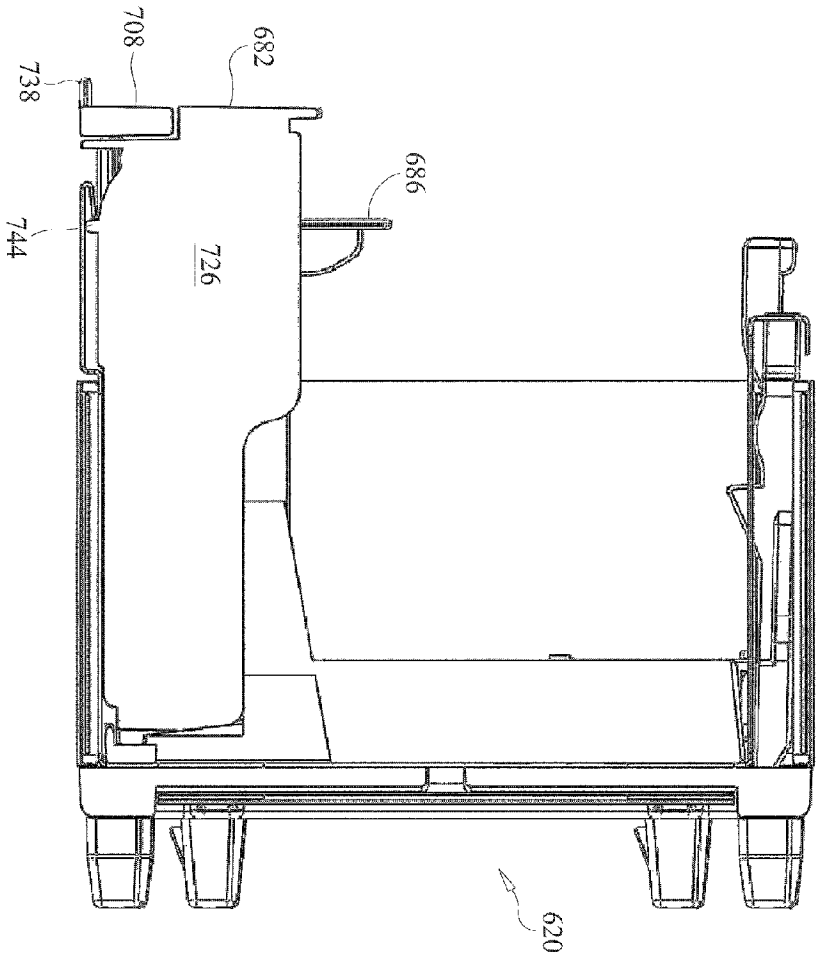
FIG. 103 is a partially cut away, side view of the merchandise module forming part of the merchandise display system of the present invention shown in FIG. 58.
Figure 104:
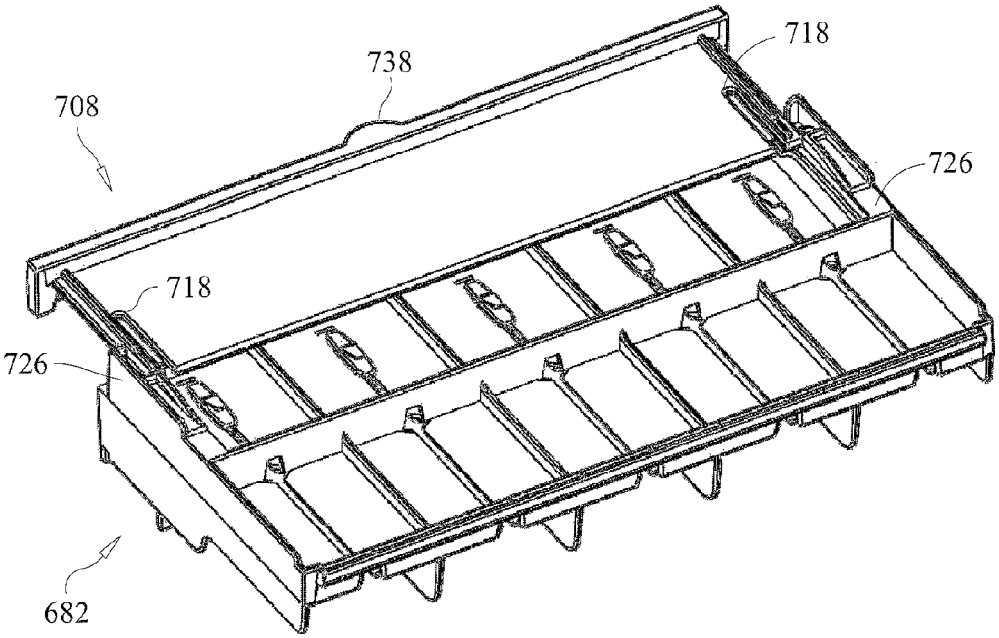
FIG. 104 is a bottom perspective view of a portion of the merchandise module forming part of the merchandise display system of the present invention shown in FIG. 58.

Preferably, at least one locator protrusion 652 of each upper and lower pair of protrusions 750, 752 on each lateral side portion of the back wall 680 of the module 620 has an opening 756 formed in the bottom surface thereof and defines a cavity therein in which is mounted a movable latch barb 758. The latch barbs 758 are affixed to and extend outwardly from a latch bar 760 which moves reciprocatingly and is held captive within a channel formed in each of the rear plates 754 affixed to the back wall 680 of the module 620. Each latch bar 760 includes a molded leaf spring 762 extending outwardly therefrom on a top surface thereof, which leaf spring 762 engages an inside top surface of a respective rear plate 754 in which it is mounted (see FIGS. 124-128). The leaf spring 762 biases each latch bar 760 downwardly so that the latch barbs 758 extend outwardly from the open side or opening 756 of the locator protrusions 652 in which they are mounted. The latch bar 760 may slide reciprocatingly, against the bias of the molded leaf spring 762, within the channel formed in each respective rear plate 754. Each barb 758 has an inclined surface 764 which is sloped outwardly from the free end of each of the particular locator protrusions 652 in which the barb 758 is mounted towards the back wall 680 of the module 620, and ends in a shoulder 766 at the rear edge of the inclined surface 764 (see FIG. 102).

When a module 620 is being mounted on the indexing rails 636 of the display system, the locator protrusions 652 are closely received by the openings 650 formed in the indexing rails 636, and the edge of the front wall 640 of the indexing rails 636 which define the openings 650 engage the movable latch barbs 758 to force them inwardly of the open-sided locator protrusions 652 against the bias of the molded leaf spring 762 formed on each latch bar 740. When the locator protrusions 652 of the module 620 are forced further into the openings 650 of the indexing rails 636, the edge of the inclined surface 764 of the latch barbs 758 passes the edge of the rail openings 650 such that the latch barbs 758 are biased outwardly on the open side 756 of the locator protrusions 652 in which they reside by the molded leaf springs 762 of the latch bars 760. The rear surface of the front wall 640 of the indexing rails 636 engages the shoulder 766 of each latch barb 758 so that the module 620 is secured in place on the indexing rails 636 of the display system until deliberately released.

Each lateral side wall 678 of the module 620 extends above the top wall 674 by a predetermined distance to define an extended portion 768 and a side flange 770 extending therefrom at a 90° angle inwardly of the module, which is raised above and overlies the outer surface of the main portion of the top wall 674 of the module 620, thereby defining a U-shaped channel 772 on each opposite lateral side above the top wall 674 of the module (see FIGS. 78-82). As will be described in greater detail, the channels 772 provided by the inwardly extending side flanges 770 receive corresponding legs of an illuminatable light bar assembly, also referred to herein as a header assembly 776.

Also, the front portion of the top wall 674 of the module 620 is bent into an L-shape so that it includes a vertical extended portion 778, and a front flange 780 attached to the vertical extended portion 778 and extending therefrom at a 90° angle so that it is raised above the outer surface of the main portion of the top wall 674 of the module, again to define a U-shaped channel 782.

The top wall 674 of the module 620 also includes two spaced apart, upwardly extending, vertically disposed tabs 784 extending normally from the outer surface of the main portion of the top wall 674 of the module. Situated between the tabs 784 and the front edge flange 780 is a movable, module release push bar 786, as will be described in detail below.

The release bar 786 is generally planar in shape and includes a main body 788 having a front wall 790, a rear wall 792 situated opposite the front wall 790, and two opposite lateral side walls 794. Mounted on and extending outwardly from the front wall 790 of the main body 788 of the release bar 786 is a push bar extension piece 796. The push bar extension piece 796 extends through an opening 798 formed through the thickness of the vertical extended front portion 778 of the top wall 674 of the module. The owner or employee of the retail establishment in which the display system is situated simply pushes inwardly on the push bar extension piece 796 to release the module 620 from the indexing rails 636 in order to remove the module.

A pair of leaf springs 800, spaced apart from each other, extends outwardly from the front wall 790 of the main body 788 of the release push bar 786. The front leaf springs 800 engage the inside surface of the vertical extended front portion 778 of the top wall 674 of the module. Similarly, a pair of spaced apart leaf springs 802 extends from facing inside surfaces of lateral side portions 804 of the main body 788 of the release push bar 786. These rear leaf springs 802 are spaced outwardly from the rear wall 792 of the main body 788 of the release push bar 786, and have free ends which engage the raised tabs 784 of the top wall 674 of the module. Thus, the module release push bar 786 is maintained in place between the spaced apart tabs 784 near the rear of the top wall 674 and the U-shaped channel 788 of the front edge portion of the top wall, and is reciprocatingly slidable on the outer surface of the top wall 674 therebetween. The front leaf springs 800 and the rear leaf springs 802 extending from the main body 788 of the release push bar 786 maintain the push bar in a particular position on the top wall 674 of the module, but allow reciprocating motion of the release push bar 786 on the top wall 674 of the module.

Figure 101:
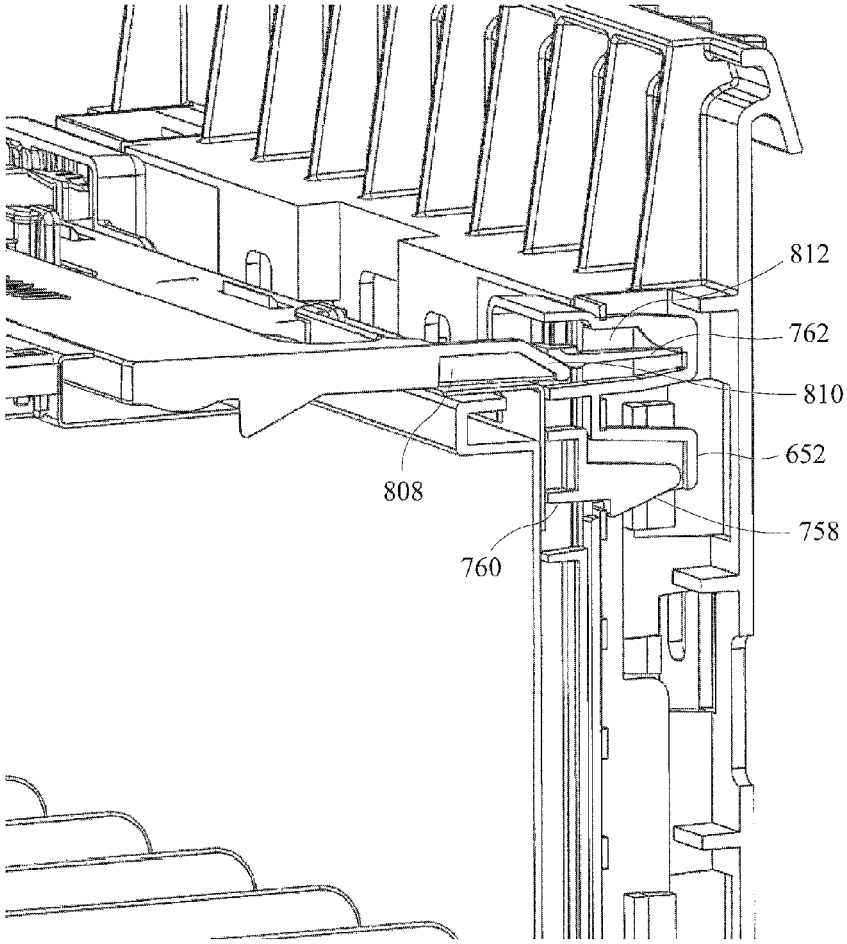
FIG. 101 is a partially cut away, front perspective view of a portion of the merchandise module forming part of the merchandise display system of the present invention shown in FIG. 58.

A leg 806 extends outwardly from each side wall 794 of the main body 788 of the release push bar 786 and rearwardly of the rear wall 792 thereof. Each side leg 806 includes an actuator ramp 808 having an inclined surface 810 which is received in a pocket 812 formed in the upper portion of each latch bar 760, with the inclined surface 810 of the actuator ramp 808 engaging the inner surface of an upper wall of the latch bar 760 within the pocket 812 (see FIGS. 101 and 102).

Figure 84:
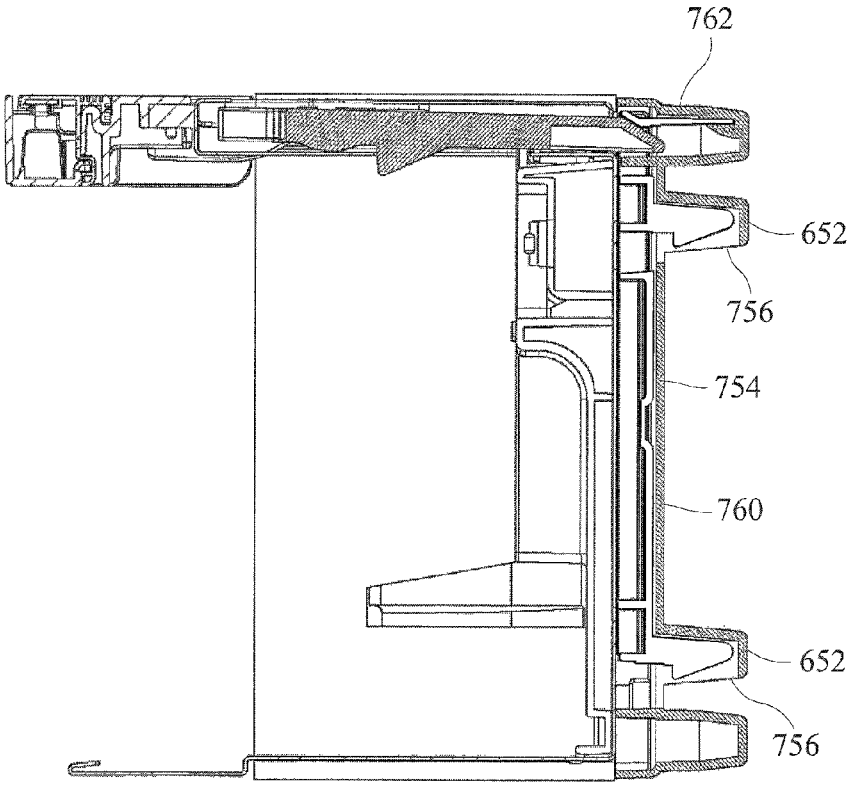
FIG. 84 is a transverse, cross-sectional view of a portion of the merchandise module forming part of the merchandise display system of the present invention shown in FIG. 58, showing the module in a release state.
Figure 85:
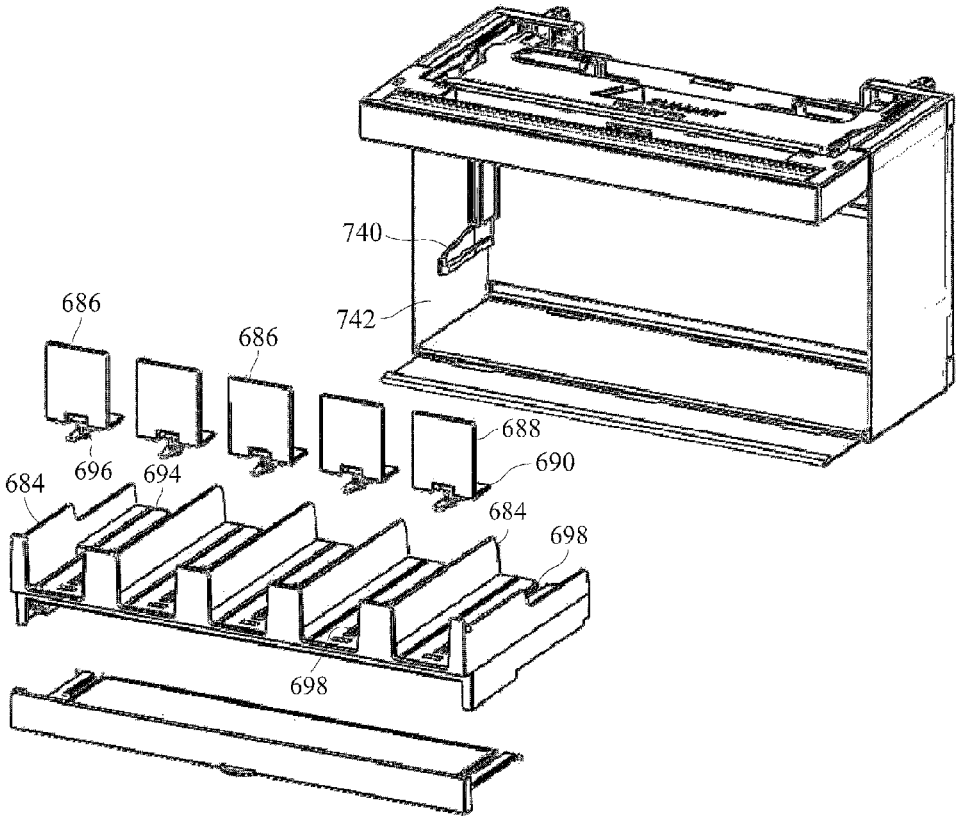
FIG. 85 is an exploded, front perspective view of a portion of the merchandise module of the merchandise display system of the present invention shown in FIG. 58.
Figure 86:
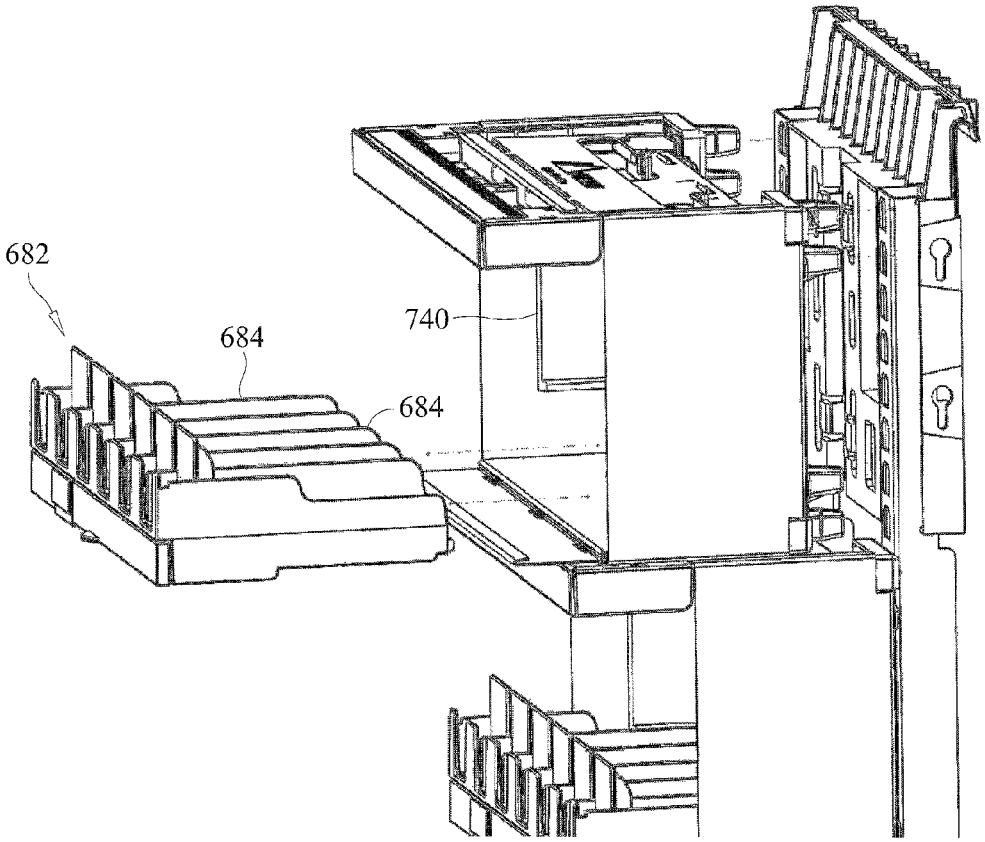
FIG. 86 is a partially exploded, front perspective view of the merchandise module forming part of the merchandise display system of the present invention shown in FIG. 58.
Figure 87:
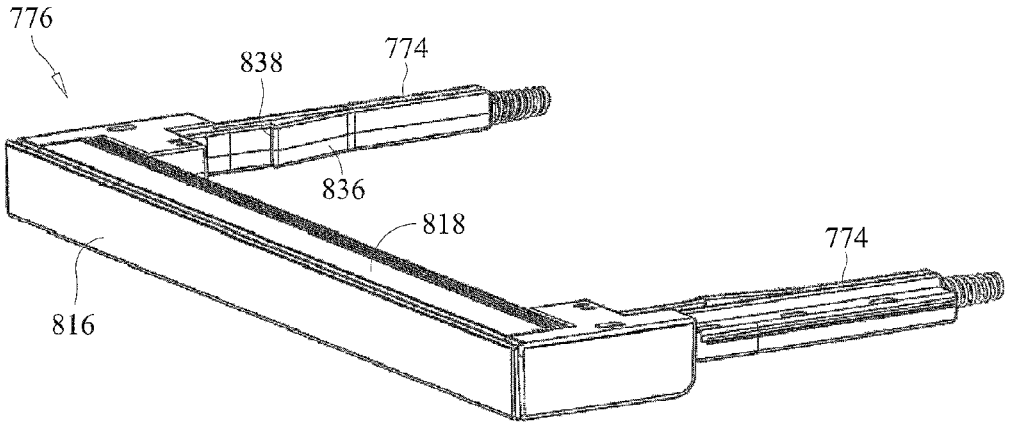
FIG. 87 is a front perspective view of a lighted header assembly of the merchandise module forming part of the merchandise display system of the present invention shown in FIG. 58.
Figure 88:
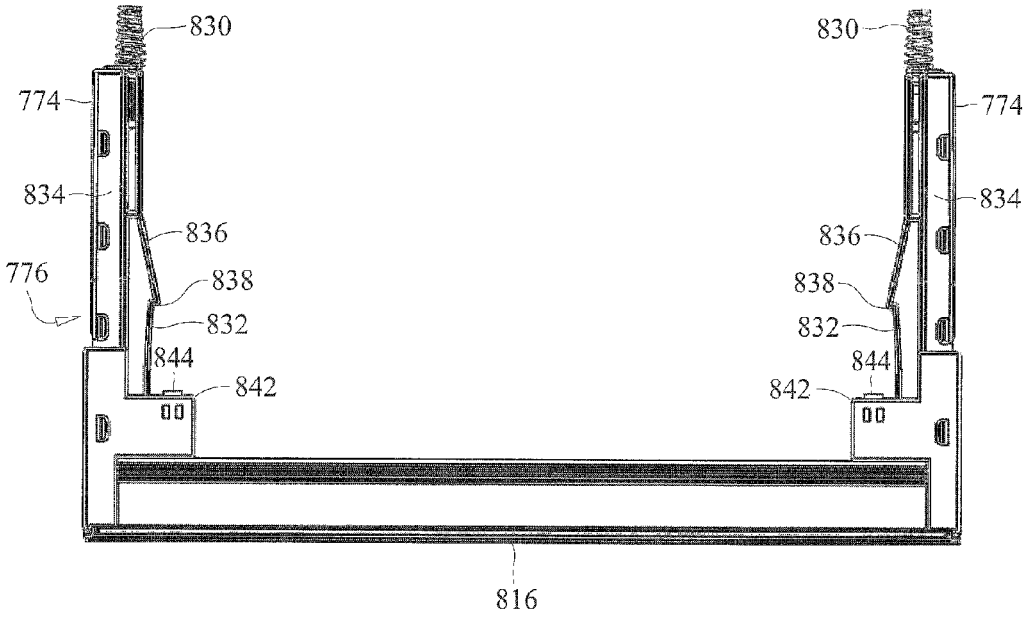
FIG. 88 is a top plan view of the header assembly of the merchandise module forming part of the merchandise display system of the present invention shown in FIG. 58.
Figure 89:
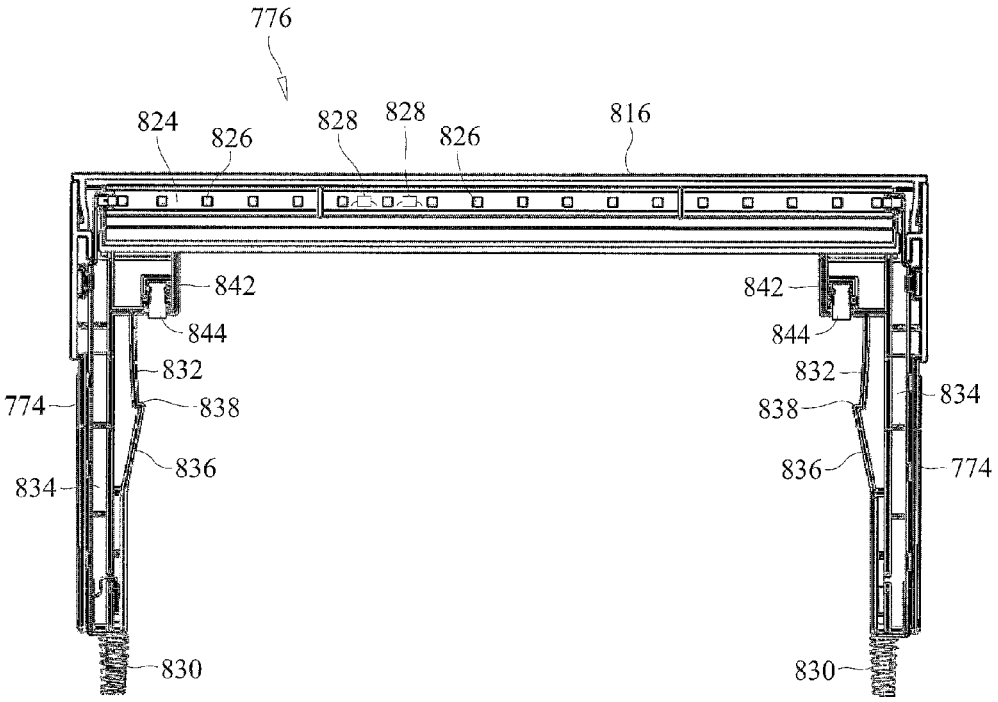
FIG. 89 is a bottom plan view of the header assembly of the merchandise module forming part of the merchandise display system of the present invention shown in FIG. 58.

When a force is exerted on the push bar extension piece 796 inwardly of the module 620, the main body 788 of the release push bar 786 moves rearwardly on the top wall 674 of the module, causing the actuator ramp's inclined surface 810 to engage the inside surface of the upper wall of each latch bar 760. This motion causes each latch bar 760 to rise in its respective channel formed in the rear plates 754 mounted on the back wall 680 of the module (see FIG. 84). In turn, the latch barbs 758, attached to respective latch bars 760, rise with the latch bar 760 and move inwardly within the cavity of the open-sided locator protrusions 652 in which they are mounted. As a result of such movement, the shoulders 766 on each latch barb 758 no longer engage portions of the indexing rails 636 surrounding the openings 650 in which the locator protrusions 652 are received, releasing the module 620 from the indexing rails 636 so that the module 620 may be pulled directly outwardly from the display system and removed therefrom.

Figure 83:
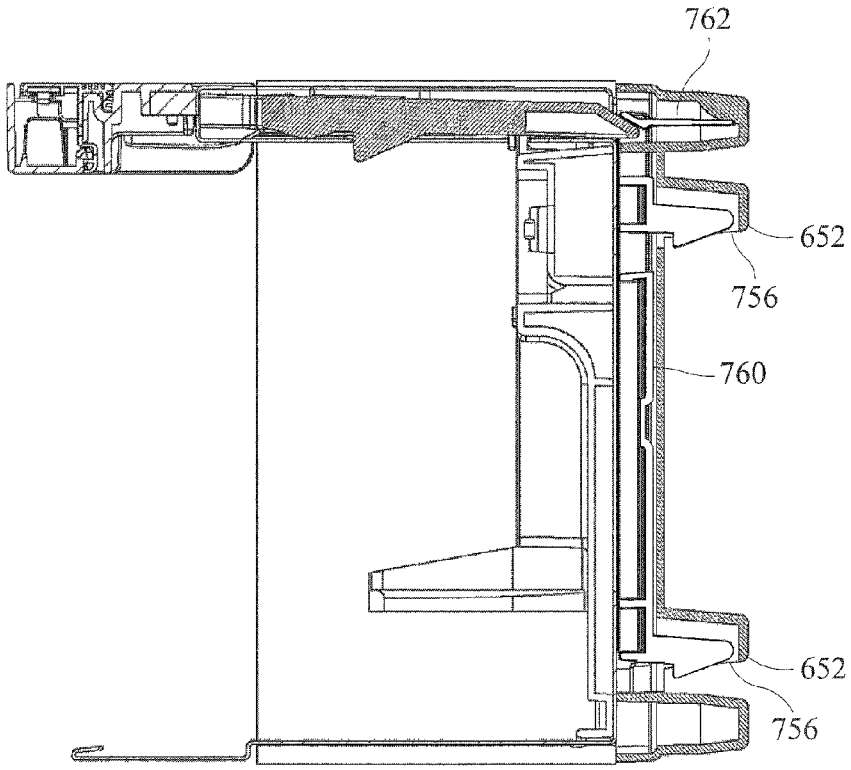
FIG. 83 is a transverse, cross-sectional view of a portion of the merchandise module forming part of the merchandise display system of the present invention shown in FIG. 58, showing the module in a latch state.

When the push bar extension piece 796 is released, the rear leaf springs 802 on the release push bar 786 cause the main body 788 of the release push bar to retract to its normal position on the outer surface of the top wall 674 of the module 620. The inclined surfaces 810 of the actuator ramps 808 are then withdrawn from the receiving pockets 812 of the latch bars 760, thereby releasing upward pressure on the latch bars. The molded leaf springs 762 of the latch bars 760 are now free to bias the latch bars downwardly within the respective channels of the rear plates 754, causing the latch barbs 758 to extend outwardly through the open sides 756 of their respective locator protrusions 652 (see FIG. 83).

A lighted header assembly 776, also referred to herein as a light bar assembly, is shown in FIGS. 77-79 and 87-100. The header assembly 776 is mounted on the upper portion of the module 620, and extends in front of the inwardly bent front edge portion 814 defined by the vertical extended portion 778 and the front flange 780 of the top wall 674 and the push bar extension piece 796.

The header assembly 776 includes a transverse section 816 and a pair of spaced apart legs 774 extending outwardly from the lateral end portions of the transverse section 816 at a 90° angle thereto. The transverse section 816 includes an upper wall 818 from which downwardly extends a transparent, L-shaped plastic or glass piece which defines an enclosure 820. Within the enclosure 820, and mounted on the lower surface of the upper wall 818, is first, an elongated heat sink 822, and second, adjacent to and in thermal communication with the heat sink 822 a printed circuit board 824 defining a light bar. The printed circuit board 824, i.e., the light bar, includes a plurality of spaced apart light emitting devices 826, such as light emitting diodes (LEDs), mounted thereto, as well as other electrical components, such as current limiting resistors 828. When a current is provided to the light emitting devices 826, they emit light through the transparent enclosure 820 to illuminate merchandise held within the module 620 on which the header assembly 776 is mounted.

At the free end of each leg 774 of the header assembly 776 is mounted a contact in the form of a coiled spring 830. Each coiled spring contact 830 is connected by a wire passing through each respective leg 774 to the printed circuit board 824 defining the light bar.

As mentioned previously, each rail 636 of a pair of rails of the display system is energized or electrified with either a positive voltage or a negative voltage (or ground). As will be seen, when the module 620 is mounted on the indexing rails 636 of the display system, the coil spring contacts 830 of the header assembly 776 are compressed against and make contact with respective indexing rails 636 of a pair of rails so that the voltage on the rails 636 may be provided to the printed circuit board 824 defining the light bar of the header assembly 776 to provide power to and energize the light emitting devices 826 thereof.

As also mentioned previously, the legs 774 of the header assembly 776 are received within corresponding U-shaped channels 772 defined by the flanges 770 of the side walls 678 of the module 620 which overhang the top wall 674. Each leg 774 is formed with a latch piece 832, which extends outwardly from an inner lateral wall of each leg 774, the latch piece 832 of one leg 774 facing the latch piece 832 of the other leg 774.

Each latch piece 832 is formed as a relatively thin section of the leg that is spaced apart from the main portion 834 of the leg so as to be resilient and slightly movable, and biased outwardly from the main portion 834 of the leg 774 and inwardly of the module. The resilient latch piece 832 includes an inclined ramp segment 836, followed by an abrupt shoulder 838 at the end of the inclined ramp segment 836. The inclined ramp segment 836 is sloped inwardly of the module 620 in a direction from the free end portion of the leg 774 toward the transverse section 816 of the header assembly 776.

When inserting the header assembly 776 into the U-shaped side channels 772 formed on the top wall 674 of the module, the opposite lateral edges 840 of the inwardly bent front edge portion 814 of top wall 674 engage the inclined ramp segments 836 of the legs 774. The user forces the header assembly 776 into the leg receiving side channels 772 against the bias of the resilient latch pieces 832 until the inclined ramp segments 836 of the legs 774 pass the lateral edges 840 of the front edge portion of the top wall 674 and beyond the shoulders 838. The resilient latch pieces 832 of the legs 774 are now free to extend outwardly from respective main portions 834 of the legs so that the header assembly 776 is captively retained on the upper portion of the module 620 until deliberately released. The shoulders 838 on each resilient latch piece 832 of the legs 774 act as stops to prevent the header assembly 776 from inadvertently being separated from the module 620 by the shoulder 838 abutting against the inside surface of the lateral edges 840 of the inwardly bent front edge portion 814 of the top wall 674.

To remove the header assembly 776 from the module 620, the user would grasp the legs 774 and squeeze the resilient latch pieces 832 thereof towards the main portion 834 of the legs 774 so that the shoulders 838 do not engage the lateral edges 840 of the inwardly bent front edge portion 814 of the module top wall 674. Then, the legs 774 of the header assembly 776 may be retracted from their respective channels 772 and the header assembly 776 may be removed from the module 620.

To insure that the header assembly 776 is properly mounted on the module 620 and so that the coil spring contacts 830 extend far enough beyond the back wall 680 of the module to contact the electrified indexing rails 636 of the display system, opposite lateral sides of the transverse section 816 of the header assembly 776 are formed with backwardly disposed shoulders 842 having exposed surfaces on which are mounted permanent magnets 844. The magnets 844 contact the front surface of the inwardly bent front edge portion 814 of the top wall 674 of the module 620. This front edge portion 814, or all of the top wall 674, and preferably all of the module 620, is formed from sheet metal. Thus, the magnets 844 on the shoulders 842 of the transverse section 816 of the header assembly 776 come in contact with the front surface of the inwardly bent front edge portion 814 of the top wall 674 of the module so that the header assembly 776 is held in place by magnetic attraction on the module 620, with the coil spring contacts 830 extending outwardly a sufficient distance from the back wall 680 of the module to contact the front wall 640 of the indexing rails 636 and receive power therefrom, which is provided to the light bar (printed circuit board 824) of the header assembly to power the light emitting devices 826 thereof. As stated previously, the light emitting devices 826, when energized, illuminate the merchandise held by the module 620 through the transparent enclosure 820 of the header assembly.

The shoulders 842 of the header assembly 776 provide a space between the transverse section 816 of the header assembly and the release push bar extension piece 796 to allow the owner or employee of the retail establishment to easily grasp the push bar extension piece 796 with his fingers in order to remove a module 620 from the indexing rails 636 of the display system.

Figure 90:
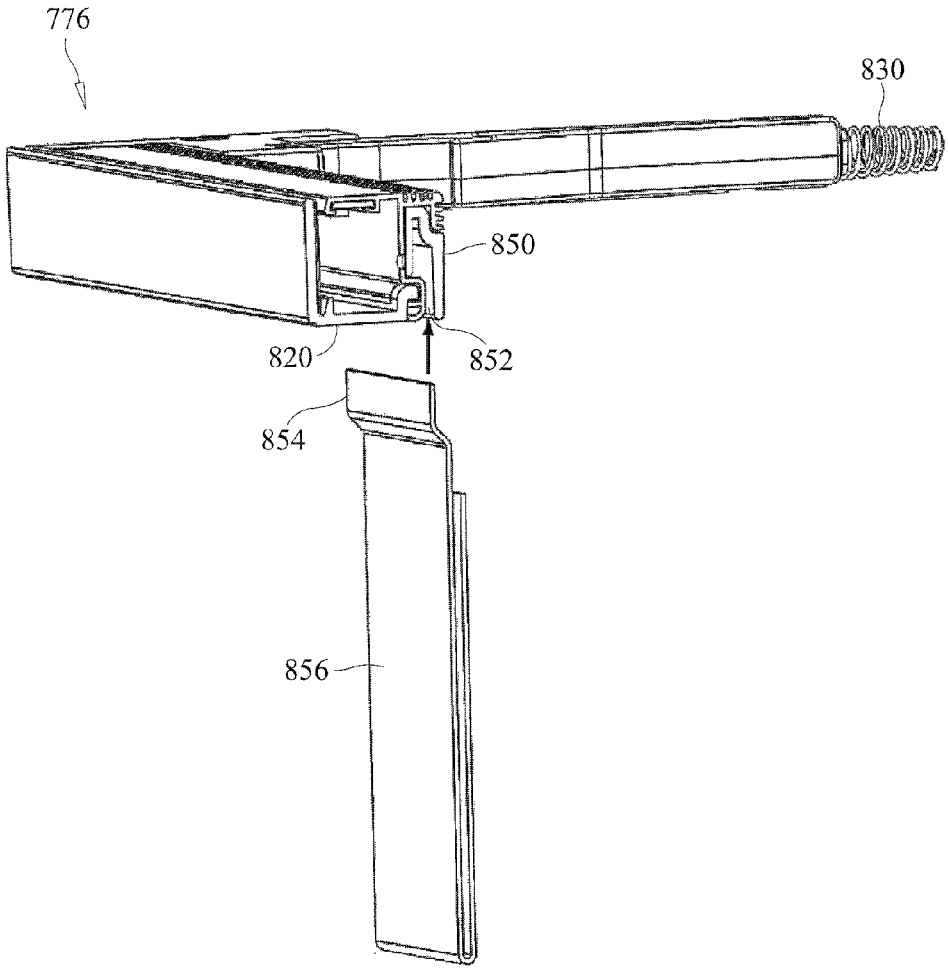
FIG. 90 is an exploded, front perspective, partially cut away view of the header assembly of the merchandise module forming part of the merchandise display system of the present invention shown in FIG. 58.
Figure 91:
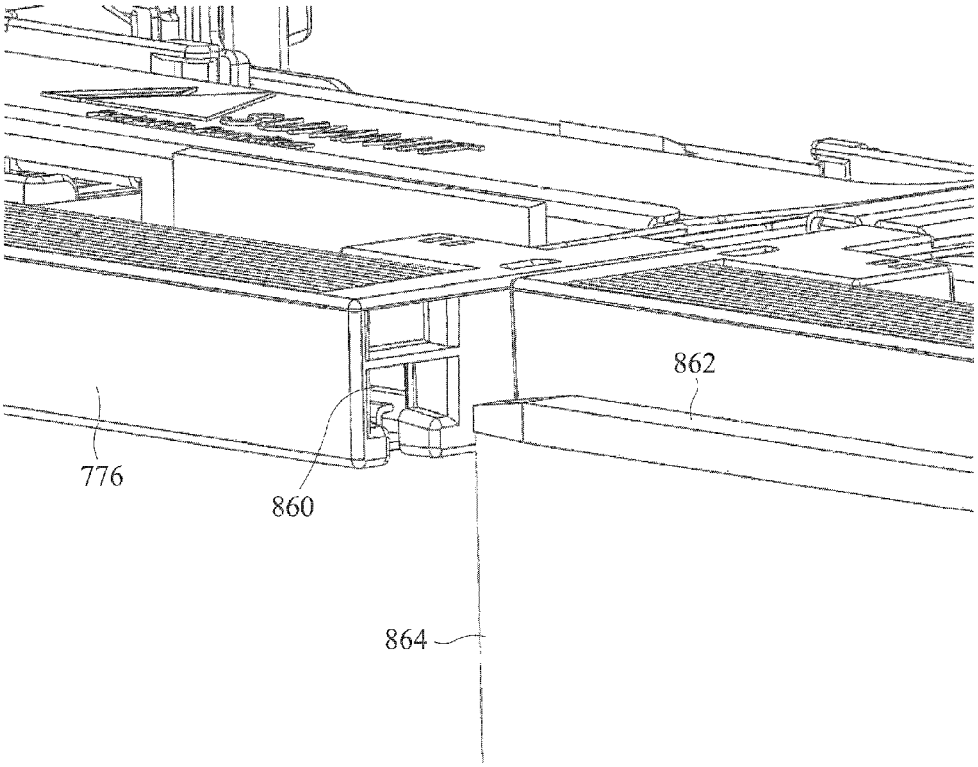
FIG. 91 is an exploded, front perspective, partially cut away view of the header assembly of the merchandise module forming part of the merchandise display system of the present invention shown in FIG. 58.
Figure 92:
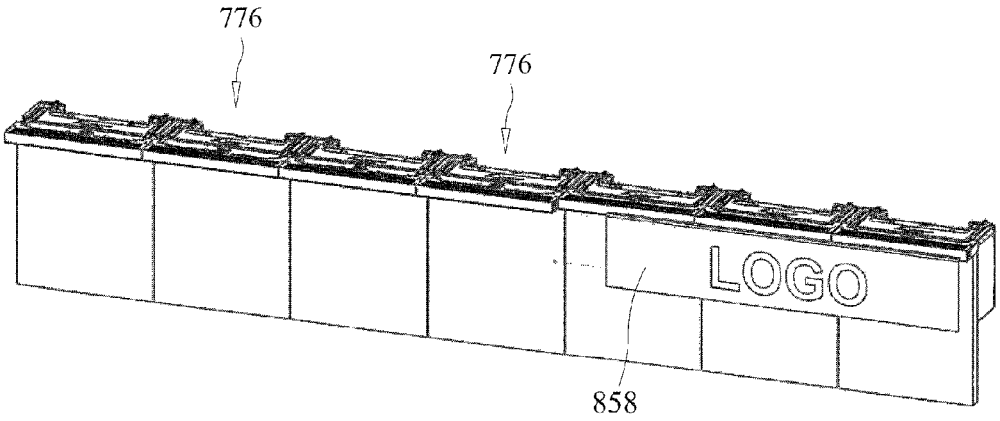
FIG. 92 is a front perspective view of the lighted header assembly and signage connected thereto of the merchandise module forming part of the merchandise display system of the present invention shown in FIG. 58.
Figure 93:
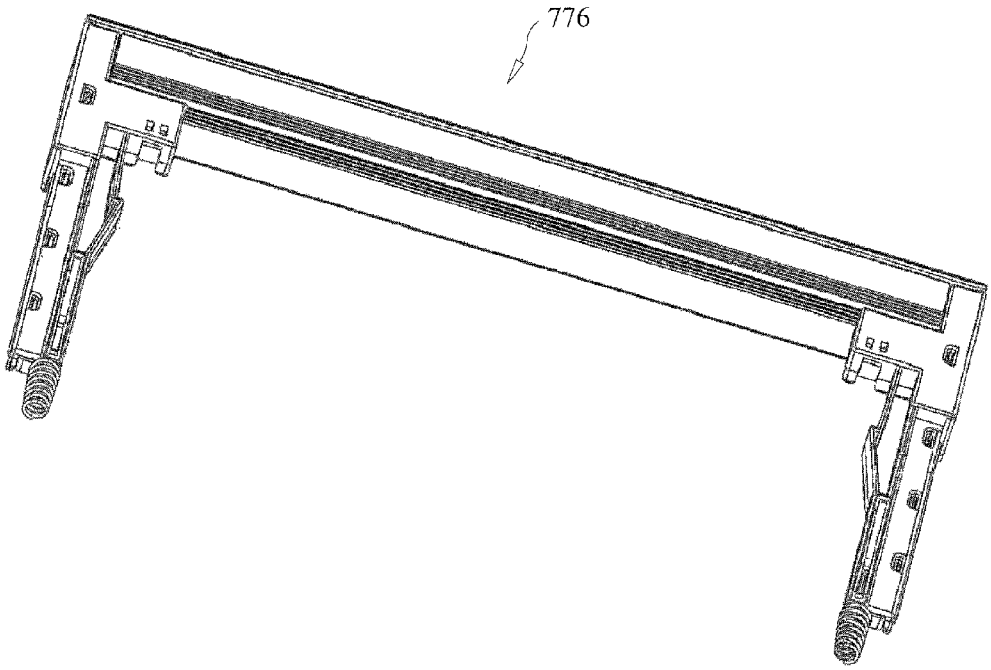
FIG. 93 is a rear perspective view of the header assembly of the merchandise module forming part of the merchandise display system of the present invention shown in FIG. 58.
Figure 95:
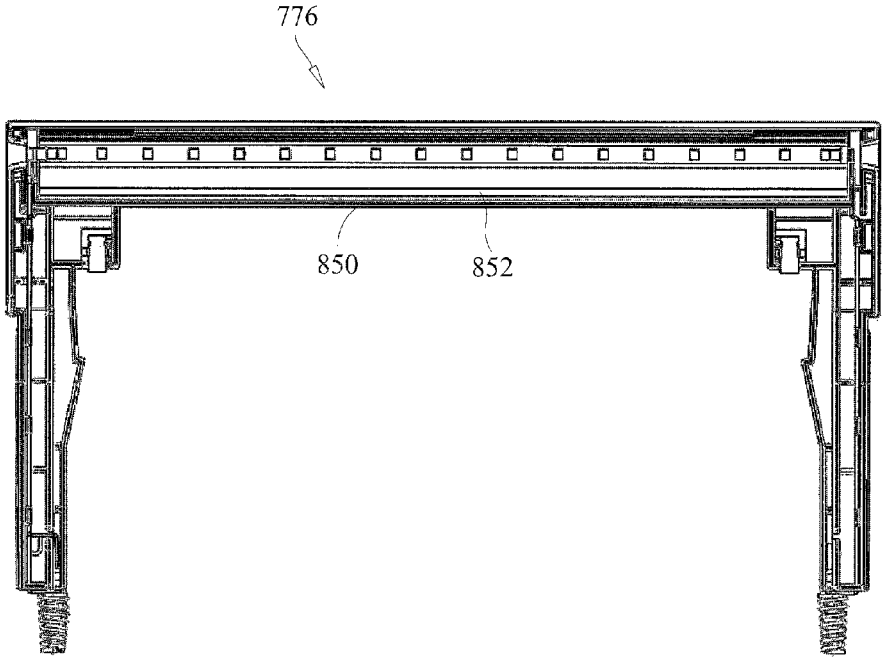
FIG. 95 is a bottom plan view of the lighted header assembly of the merchandise module forming part of the merchandise display system of the present invention shown in FIG. 58.
Figure 100:
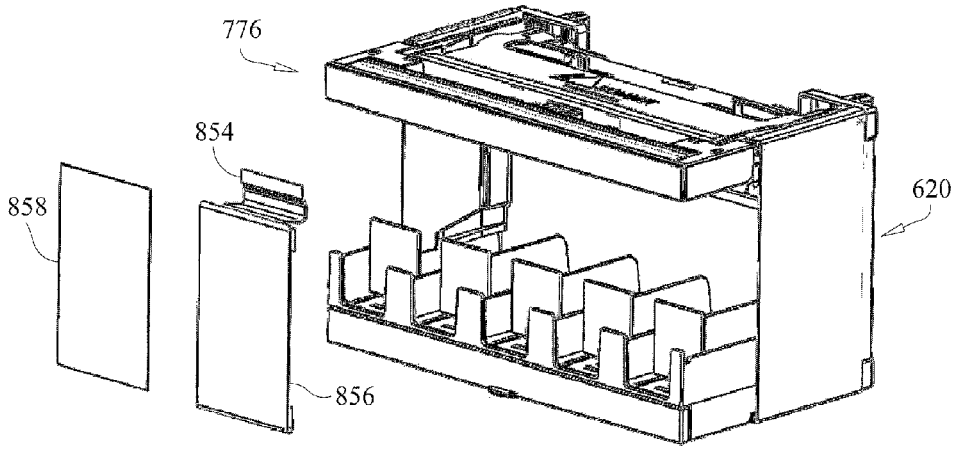
FIG. 100 is a partially exploded, front perspective view of the merchandise module forming part of the merchandise display system of the present invention shown in FIG. 58.

The header assembly 776 may be modified to include a slot for receiving signage. As shown in FIGS. 90, 95 and 100, the transverse section 816 of the header assembly 776 may include an inner wall 850 which defines at its lower end a slot 852 with the glass enclosure 820. The slot may receive an upwardly extending tab 854 of a folded over, transparent plastic plate 856 which can receive and hold captive a placard, advertisement or sign 858. Light from the light emitting devices 826 will shine on the signage 858 to illuminate it.

Alternatively, the header assembly 776 may have its enclosure 820 formed with a T-shaped slot (see FIG. 91) to receive a T-shaped rail 862 mounted on the upper portion of a light transmissive glass or plastic plate 864 in light transmissive communication with the T-shaped rail 862. The rail 862 and plate 864 act as a light bar, and light emitted by the light emitting devices 826 will enter the T-shaped rail 862 and pass therethrough and illuminate the plate 864 and any signage attached thereto or etched in the plate (see FIG. 99).

Figure 94:
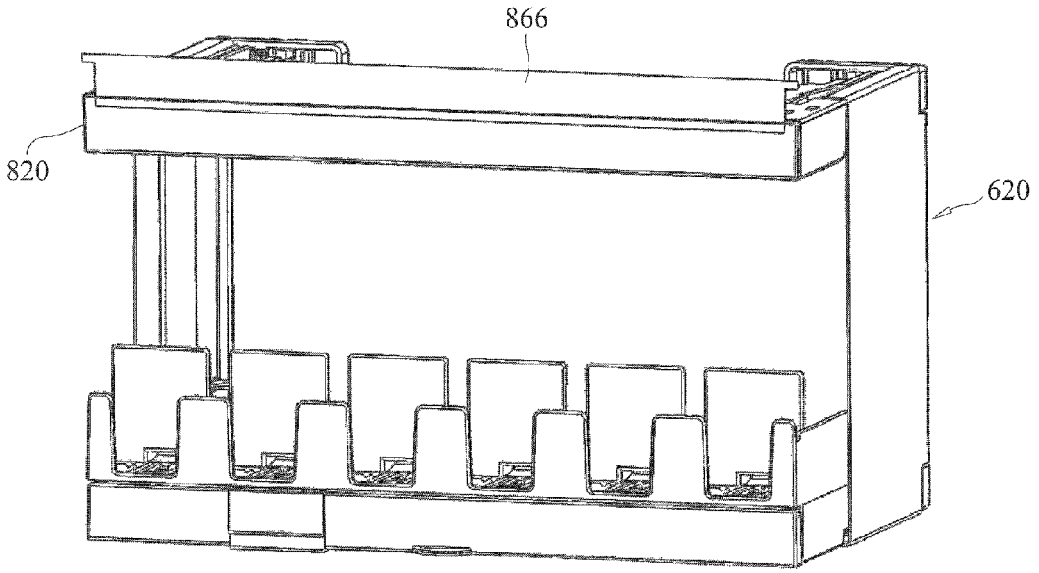
FIG. 94 is a front perspective view of the merchandise module forming part of the merchandise display system of the present invention shown in FIG. 58.

Furthermore, and as shown in FIG. 94 of the drawings, the enclosure 820 of the transverse section 816 of the header assembly 776 may have a channel or slot formed in its transparent front face so as to receive, and back illuminate, by the light emitting devices 826, a placard, advertisement or signage 866.

Figure 96:
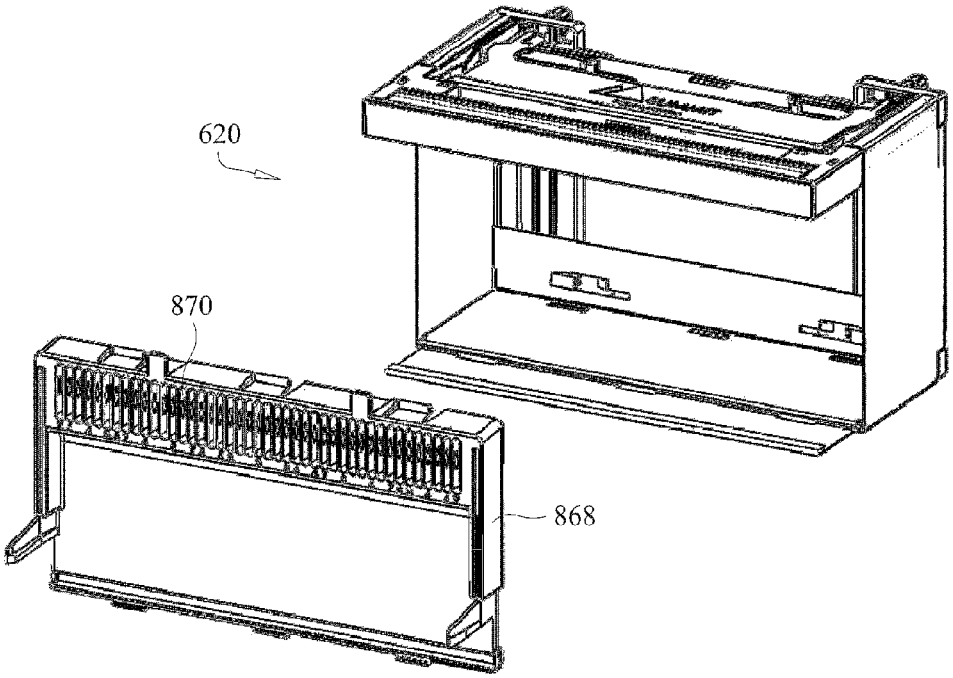
FIG. 96 is a partially exploded, front perspective view of a portion of the merchandise module forming part of the merchandise display system of the present invention shown in FIG. 58.
Figure 97:
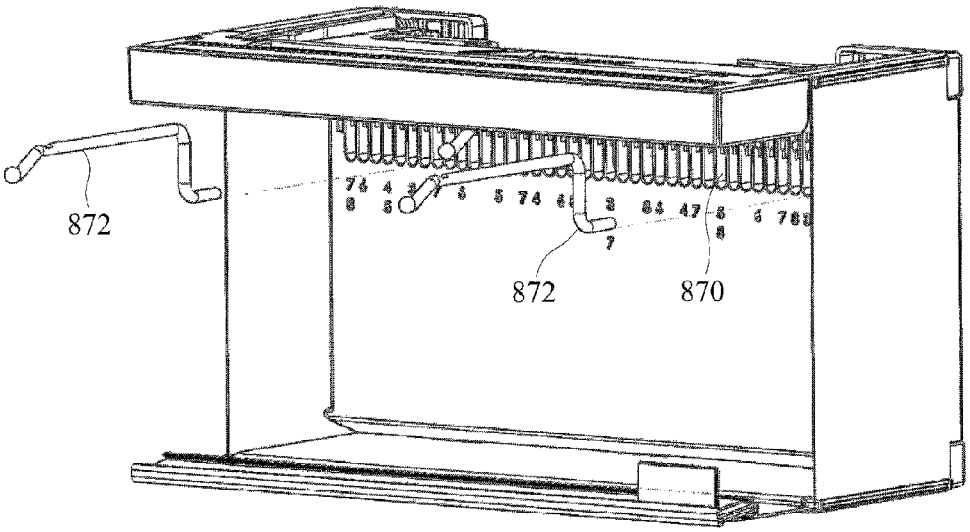
FIG. 97 is a partially exploded, front perspective view of the merchandise module forming part of the merchandise display system of the present invention shown in FIG. 58.
Figure 98:
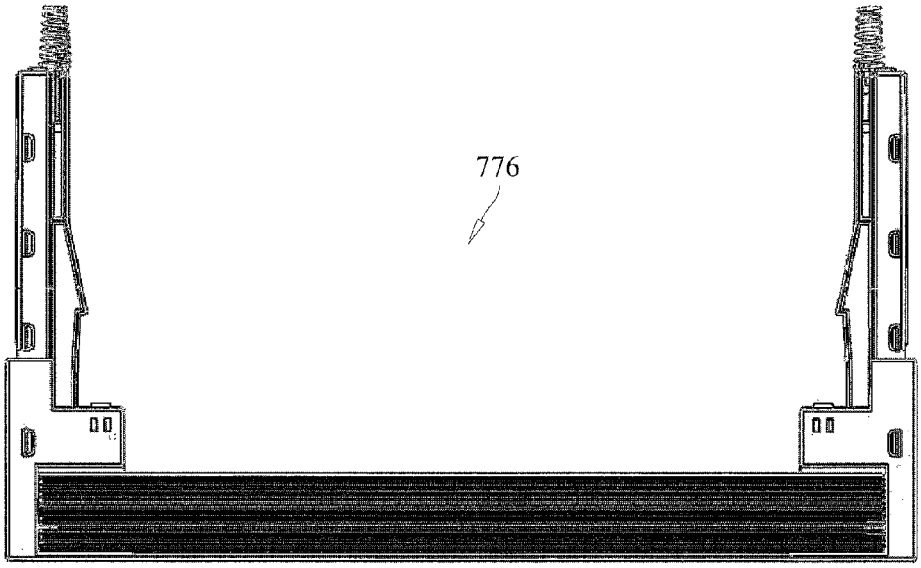
FIG. 98 is a top perspective view of the lighted header assembly of the merchandise module forming part of the merchandise display system of the present invention shown in FIG. 58.
Figure 99:
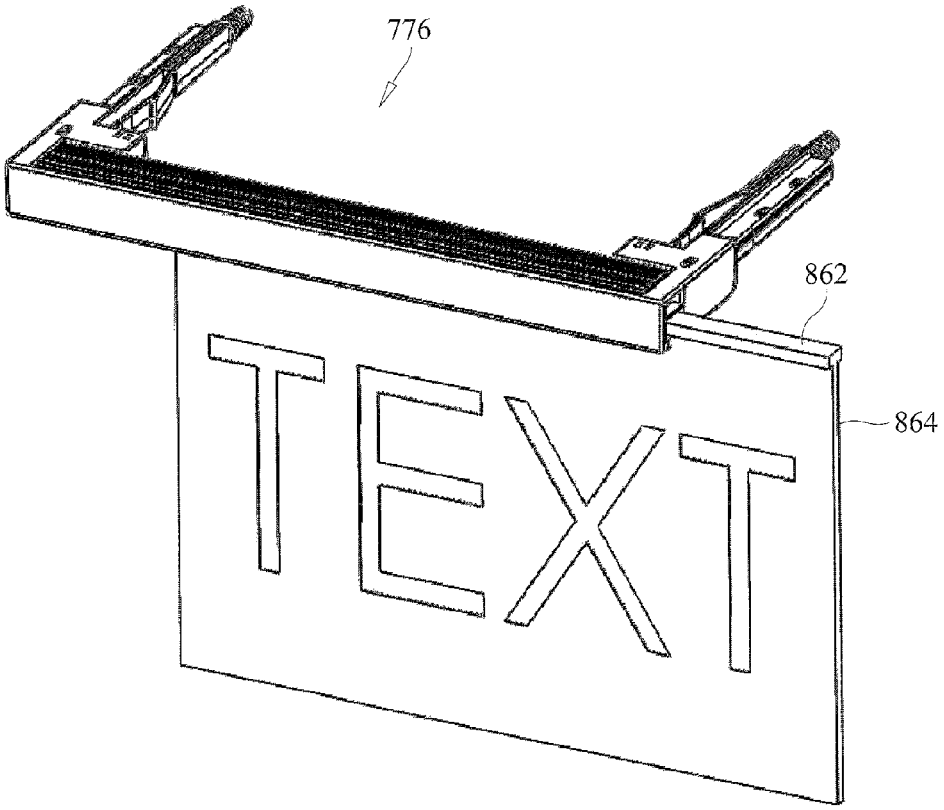
FIG. 99 is a front perspective view of the header assembly shown in FIG. 98 of the merchandise module forming part of the merchandise display system of the present invention shown in FIG. 58.

Additionally, and as shown in FIGS. 96 and 97 of the drawings, the back wall of the module 620 may have mounted on the inside surface thereof a hanger plate 868. The hanger plate 868 includes a plurality of slots 870 which may captively receive hanger rods 872, if so desired by the owner of the retail establishment in which the display system of the present invention is used. The pusher tray assembly 682 may be removed from the module 620 and, instead, the hanger rods 872 may be inserted into the slots 870 in the hanger plate 868 so that merchandize items may be hung from the hanger rods 872 and displayed therefrom within the module 620.

Although illustrative embodiments of the present invention have been described herein with reference to the accompanying drawings, it is to be understood that the invention is not limited to those precise embodiments and that various other changes and modifications may be effected herein by one skilled in the art without departing from the scope or spirit of the invention.

What is claimed is:

1. A modular merchandise display system, which comprises:

a frame, the frame having a pair of spaced apart, parallelly disposed, first and second indexing members, each of the first and second indexing members having an axial length and a thickness, and a plurality of spaced apart openings formed through the thickness thereof and situated at along the axial length thereof; and a plurality of merchandise supporting units, the merchandise supporting units being mountable on and removable from the pair of first and second indexing members, each merchandise supporting unit having a front side, a rear side situated opposite the front side, and opposite first and second lateral sides, at least a first locator protrusion mounted on the rear side and extending outwardly therefrom and being in proximity to the first lateral side, and at least a second locator protrusion mounted on the rear side thereof and extending outwardly therefrom and being in proximity to the second lateral side, the at least first locator protrusion being spaced apart from the at least second locator protrusion a predetermined distance so that the at least first locator protrusion is alignable with and receivable by an opening of the plurality of openings formed in the first indexing member, and so that the at least second locator protrusion is alignable with and receivable by an opening of the plurality of openings formed in the second indexing member;

wherein at least one of the at least first locator protrusion and the at least second locator protrusion has an open side thereon, and a latch barb received thereby and movable within the locator protrusion, the latch barb being positionable in at least a first position wherein the latch barb is engageable with one of the first indexing member and the second indexing member to secure a respective merchandise supporting unit to the one of the first indexing member and the second indexing member, and in a second position wherein the latch barb is disengageable with the one of the first indexing member and the second indexing member to permit a respective merchandise supporting unit to be removed from the one of the first indexing member and the second indexing member; and wherein at least one of the merchandise supporting units is a module generally being in the shape of a parallelepiped or cuboid, the module having a top wall, a bottom wall disposed opposite the top wall, a first lateral side wall, a second lateral side wall disposed opposite the first lateral side wall, a rear wall joined to the top wall, bottom wall and first and second lateral side walls, and at least a partially open front side disposed opposite the rear wall, each of the rear wall and the top wall of the module having an outer surface, and the bottom wall having an inner surface, the at least first locator protrusion and the at least second locator protrusion being mounted on the rear wall of the module and extending outwardly from the outer surface thereof, each of the at least first locator protrusion and the at least second locator protrusion having an open side thereon, and a latch barb received thereby and movable within the at least first locator protrusion and the at least second locator protrusion, the module including a first latch bar and a second latch bar, the latch barb of the at least first locator protrusion being mounted on the first latch bar, and the latch barb of the at least second locator protrusion being mounted on the second latch bar, the first and second latch bars being situated on the rear wall of the module and being reciprocatingly movable relative thereto to position the latch barbs of the at least first locator protrusion and the at least second locator protrusion in one of the first position and the second position.

2. A modular merchandise display system as defined by claim 1, wherein each of the merchandise supporting units includes at least one latch bar, the at least one latch barb being mounted on the at least one latch bar, the at least one latch bar being disposed on the rear side of a corresponding merchandise supporting unit and being reciprocatingly movable relative thereto to position the at least one latch barb mounted thereto in one of the first position and the second position.

3. A modular merchandise display system as defined by claim 2, wherein each of the merchandise supporting units includes a biasing component which is engageable with the at least one latch bar such that the at least one latch barb mounted thereon is biased toward the first position in which the at least one latch barb is engageable with one of the first indexing member and the second indexing member.

4. A modular merchandise display system as defined by claim 3, wherein the biasing component includes a resilient leaf spring mounted on the at least one latch bar.

5. A modular merchandise display system as defined by claim 2, wherein each of the merchandise supporting units includes a release bar, the release bar being engageable with the at least one latch bar to effect reciprocating movement of the at least one latch bar and to position the at least one latch barb in one of the first position and the second position.

6. A modular merchandise display system as defined by claim 5, wherein the release bar includes an actuator ramp having an inclined surface, the inclined surface of the actuator ramp being engageable with the at least one latch bar to effect reciprocating movement thereof.

7. A modular merchandise display system as defined by claim 1, which further comprises:

at least one power supply/converter unit, the at least one power supply/converter unit providing a voltage on the first and second indexing members of the pair of indexing members; and wherein at least one of the merchandise supporting units includes a lighted header assembly, the lighted header assembly being in electrical communication with the first and second indexing members, the lighted header assembly including at least one energizable light emitting device, the lighted header assembly being positioned on the at least one merchandise supporting unit such that, when the at least one light emitting device thereof is energized, the at least one light emitting device emits light which illuminates merchandise supported by the at least one merchandise supporting unit.

8. A modular merchandise display system as defined by claim 1, wherein the module includes a release bar, the release bar being positioned on the outer surface of the top wall of the module and being reciprocatingly movable thereon.

9. A modular merchandise display system as defined by claim 8, wherein the release bar on the module is generally planar in shape and includes a main body portion having a front wall, a rear wall situated opposite the front wall, and opposite first and second lateral side walls, the release bar further including a first side leg and a second side leg extending in an outward direction relative to the rear wall thereof, each of the first side leg and the second side leg including an actuator ramp having an inclined surface, the inclined surface of the actuator ramp of the first side leg of the release bar being engageable with the first latch bar to effect reciprocating movement thereof, and the inclined surface of the actuator ramp of the second side leg of the release bar being engageable with the second latch bar to effect reciprocating movement thereof, whereby reciprocating movement of the first latch bar and the second latch bar effect movement of the latch barbs within the at least first locator protrusion and the at least second locator protrusion to position the latch barbs in one of the first position and the second position.

10. A modular merchandise display system as defined by claim 9, wherein the main body portion of the release bar of the module includes at least a first leaf spring being disposed outwardly from the front wall thereof, and at least a second leaf spring being disposed at least outwardly from the rear wall thereof; and wherein the top wall of the module includes a front extended portion and a rear extended portion situated opposite the front extended portion, each of the front extended portion and the rear extended portion of the top wall extending outwardly from the outer surface of the top wall and being respectively engageable by the at least first leaf spring and the at least second leaf spring of the release bar, the at least first leaf spring and the at least second leaf spring biasing the release bar in a selected position on the top wall of the module.

11. A modular merchandise display system as defined by claim 1, wherein the module includes a first side flange extending above and partially overlying the outer surface of the top wall of the module, and a second side flange extending above and partially overlying the outer surface of the top wall of the module, each of the first side flange and the second side flange defining a receiving channel with the top wall of the module;

wherein the modular merchandise display system further comprises at least one power supply/converter unit, the at least one power supply/converter unit providing a voltage on the first and second indexing members of the pair of indexing members; and wherein the module includes a lighted header assembly, the lighted header assembly being in electrical communication with the first and second indexing members, the lighted header assembly including at least one energizable light emitting device, the lighted header assembly being mountable on the module and having portions thereof which are receivable within the receiving channels defined by the first side flange and the second slide flange, the at least one light emitting device of the lighted header assembly, when energized, emitting light which illuminates merchandise supported by the module.

12. A modular merchandise display system as defined by claim 11, wherein the lighted header assembly includes a transverse section and a pair of spaced apart first and second legs extending perpendicularly outwardly from the transverse section, the first leg of the lighted header assembly being received by the channel defined by the first side flange of the module, and the second leg of the lighted header assembly being received by the channel defined by the second side flange of the module, the transverse section including an upper wall and at least a partially transparent enclosure mounted on the upper wall.

13. A modular merchandise display system as defined by claim 12, wherein the lighted header assembly includes a printed circuit board situated within the at least partially transparent enclosure, the printed circuit board defining a light bar and having a plurality of spaced apart light emitting devices mounted thereto, the plurality of light emitting devices, when energized, emitting light through the at least partially transparent enclosure to illuminate merchandise supported by the module.

14. A modular merchandise display system as defined by claim 13, wherein each of the first side leg and the second side leg of the lighted header assembly includes a free end, and a coiled spring electrical contact mounted on the free end thereof, each coiled spring electrical contact being compressible against and making contact with a respective electrified first and second indexing member, the printed circuit board within the enclosure of the lighted header assembly being in electrical communication with the coiled spring electrical contacts mounted on the free ends of the first and second side legs of the lighted header assembly so as to receive power from the electrified first and second indexing members when the module, with the lighted header assembly mounted thereon, is mounted on the first and second indexing members, and thereby causing the light emitting devices to be energized and to emit light.

15. A modular merchandise display system as defined by claim 14, wherein portions of the transverse section of the lighted header assembly define rearwardly disposed shoulders having exposed surfaces;

wherein the lighted header assembly further include magnets mounted on the exposed surfaces of rearwardly disposed shoulders of the transverse section; and wherein a portion of the module is formed from a magnetically attractable material, the magnetically attractable portions of the module being situated in alignment with the magnets mounted on the shoulders of the transverse section of the lighted header assembly so that, when the lighted header assembly is mounted on the module, the magnets of the transverse section will magnetically couple to the magnetically attractable portions of the module to maintain the lighted header assembly in a desired position on the module.

16. A modular merchandise display system as defined by claim 14, wherein each of the first side leg and the second side leg of the lighted header assembly includes a leg main body and a resilient latch piece extending outwardly from the leg main body, each resilient latch piece of the first side leg and the second side leg including an inclined ramp segment and a shoulder situated adjacent to the inclined ramp segment, the module having first and second portions thereof which are respectively engageable with the resilient latch piece of the first side leg and the second side leg of the lighted header assembly when the first side leg and the second side leg are received in respective channels defined by the first side flange and the second side flange of the module and when the lighted header assembly is being mounted on the module, the shoulders of the resilient latch pieces of the first and second side legs of the lighted header assembly being engageable with the first and second portions of the module to releasably secure the lighted header assembly to the module.

17. A modular merchandise display system as defined by claim 9, wherein the release bar includes a release bar extension piece, the release bar extension piece extending outwardly from the front wall of the main body portion of the release bar, the release bar extension piece being graspable by a user of the display system to effect reciprocating movement of the release bar on the outer surface of the top wall of the module.

18. A modular merchandise display system as defined by claim 1, wherein the module further includes a pusher tray having a lower slide out tray, the module defining an interior shape, the pusher tray, with the lower slide out tray, being removeably mounted within the interior space of the module and resting on the upper surface of the bottom wall thereof, the pusher tray having opposite lateral side walls, the opposite lateral side walls having upper and lower flanges which define therebetween a track, the lower slide out tray being reciprocating slideable within the tracks of the pusher tray and being pivotable thereon, the pusher tray having pairs of upstanding divider walls, and merchandise pusher elements situated between the divider walls of pairs of divider walls.

19. A modular merchandise display system as defined by claim 18, wherein each pusher element is a generally L-shaped member having a first leg and a second leg connected to the first leg, the pusher tray having a bottom wall, and a plurality of elongated slots formed through the thickness of the bottom wall, each elongated slot being situated between respective divider walls of a pair of divider walls, the first leg of the pusher elements having bottom surface and a T-shaped rail extending outwardly from the bottom surface thereof, the T-shaped rail being received within a respective elongated slot formed in the bottom wall of the pusher tray, each pusher element further including a coiled spring mounted thereto and having opposite first and second axial ends, the first axial end of each coiled spring being affixed to the bottom wall of the pusher tray, and the second axial end of each coiled spring being affixed to a respective pusher element, the T-shaped rail extending downwardly from the bottom surface of the first leg of each pusher element being received in a respective elongated slot and being reciprocatingly movable therein so that each pusher element is movable between adjacent divider walls of respective pairs of divider walls, each coiled spring biasing a corresponding pusher element against merchandise situated in contact with the second leg of each pusher element.

20. A modular merchandise display system as defined by claim 18, wherein the lower slide out tray includes a bottom plate and a front wall joined perpendicularly to the bottom plate, the front wall defining a channel having an open side to receive therein a flat sheet of material with indicia thereon, the lower slide out tray being pivotable on the pusher tray so that the front wall and channel thereof may be accessible to a user of the display system in order to remove and replace the material having indicia thereon received by the channel of the front wall.

* * * * *